US011827419B2

(12) United States Patent
Rempe et al.

(10) Patent No.: US 11,827,419 B2
(45) Date of Patent: Nov. 28, 2023

(54) RECLOSABLE BAG AND METHODS OF FORMING AND USING THE SAME

(71) Applicant: Automated Packaging Systems, LLC, Streetsboro, OH (US)

(72) Inventors: Christopher Rempe, Streetsboro, OH (US); Ritchie Joan Leap, Ravenna, OH (US); Arthur Walter Helfeldt, Jr., Stow, OH (US)

(73) Assignee: Sealed Air Corporation (US), Charlotte, NC (US)

( * ) Notice: Subject to any disclaimer, the term of this patent is extended or adjusted under 35 U.S.C. 154(b) by 54 days.

(21) Appl. No.: 17/425,807

(22) PCT Filed: Jan. 8, 2020

(86) PCT No.: PCT/US2020/012670

§ 371 (c)(1),
(2) Date: Jul. 26, 2021

(87) PCT Pub. No.: WO2020/159679

PCT Pub. Date: Aug. 6, 2020

(65) Prior Publication Data

US 2022/0169422 A1 Jun. 2, 2022

Related U.S. Application Data

(60) Provisional application No. 62/799,247, filed on Jan. 31, 2019.

(51) Int. Cl.
*B65D 33/20* (2006.01)
*B65B 5/02* (2006.01)
(Continued)

(52) U.S. Cl.
CPC ..... *B65D 33/20* (2013.01); *B65B 5/022* (2013.01); *B65B 5/045* (2013.01); *B65D 75/5805* (2013.01); *B65D 75/5855* (2013.01)

(58) Field of Classification Search
CPC ..... B65D 33/20; B65D 75/5805; B65D 75/5855; B65B 5/022; B65B 5/045
(Continued)

(56) References Cited

U.S. PATENT DOCUMENTS 3,388,789 A * 6/1968 Simandl ..... B65D 75/527 383/203
3,790,068 A * 2/1974 Stutz ..... B65D 27/10 229/69
(Continued)

FOREIGN PATENT DOCUMENTS

AT 12425 U1 * 3/2012 ..... B65D 33/20
DE 9214187 U1 * 12/1993
(Continued)

OTHER PUBLICATIONS

Machine translation of DE-9214187-U1.*

*Primary Examiner* — Jes F Pascua
(74) *Attorney, Agent, or Firm* — Jon M. Isaacson

(57) ABSTRACT

A reclosable bag includes: first and second plies extending from a first side to a second side and from atop bottom to a top; a seal joining the first and second plies arranged near the bottom of the bag; a reclosing material disposed on an interior surface of one of the first and second plies; a release material disposed between the reclosing material and the other of the first and second plies; and a bag opening zone extending between the top and the bottom.

10 Claims, 82 Drawing Sheets

(51) Int. Cl.
*B65B 5/04* (2006.01)
*B65D 75/58* (2006.01)

(58) Field of Classification Search
USPC ..... 383/203, 204
See application file for complete search history.

(56) References Cited

U.S. PATENT DOCUMENTS 4,762,230 A * 8/1988 Croce ..... B65D 75/327 229/940
4,785,940 A 11/1988 Wilson
5,007,744 A * 4/1991 Scarberry ..... B65D 75/46 493/194
5,743,070 A 4/1998 Lerner et al.
5,954,431 A * 9/1999 Fabel ..... B42D 15/08 229/80
7,654,064 B2 2/2010 Riccardi et al.
8,069,635 B2 12/2011 Riccardi et al.
8,905,638 B2 * 12/2014 Moehlenbrock ..... B65B 9/06 383/203
2003/0118254 A1 * 6/2003 Razeti ..... B65D 75/5816 383/211
2010/0247003 A1 * 9/2010 Huffer ..... B65D 75/5855 383/207
2014/0251849 A1 9/2014 Huffer
2016/0325866 A1 11/2016 Riccardi et al.

FOREIGN PATENT DOCUMENTS

EP 2716566 A1 * 4/2014 ..... B65D 75/5855
EP 3470343 A1 * 4/2019
WO 2014056776 A1 4/2014

* cited by examiner

RECLOSABLE BAG AND METHODS OF FORMING AND USING THE SAME

TECHNICAL FIELD

The present application relates generally to packaging and in particular to a reclosable bag and methods for forming a reclosable bag and reclosing a product in a reclosable bag.

BACKGROUND

Many consumers prefer to purchase products online or by telephone and have the products shipped to them. Some products, including but not limited to, clothing and other goods, are frequently shipped to a consumer in a sealed bag. The sealed bag may be a one-time use bag, which the consumer will tear open to gain access to the product and then dispose of the torn bag. Alternatively, the sealed bag may be configured as a multi-use bag that permits the consumer to access the product and then, if the consumer is dissatisfied with the product, the consumer may place the product back into the bag, reseal the bag, and return the product to the seller by mail or courier service.

Current multi-use bags generally have an opening for loading and retrieving a product and a lip or tab to close the opening. The lip or tab generally includes two spaced apart lines of adhesive that are covered by a separate release strip. A pair of lines of perforations are provided through the lip or tab between the lines of adhesive. The pair of lines of perforations define an opening strip.

In use, a product may be loaded into the opening of the bag and one release strip may be removed to expose a line of adhesive. Next, the lip or tab is folded over the opening and pressed against the bag to adhere the lip or tab to the bag and thereby close the opening. When the bag containing the product is received, the consumer may open the bag and retrieve the product by pulling on the opening strip to break the lines of perforation. After inspecting the product the consumer may decide that they want to return the product to the seller. If the consumer wants to return the product to the seller, the consumer may insert the product into the bag through the opening. Next, the consumer may remove the remaining release strip to expose the remaining line of adhesive. The consumer may then fold a portion of the lip or tab over the opening and press the lip or tab against the bag to adhere the lip or tab to the bag and thereby cover the opening. The consumer may then return the package to the seller by mail or courier service.

SUMMARY

The present application discloses a reclosable bag and methods for forming a reclosable bag and reclosing a product in a reclosable bag. In an exemplary embodiment, the reclosable bag includes: first and second plies extending from a first side to a second side and from a top bottom to a top; a seal joining the first and second plies arranged near the bottom of the bag; a reclosing material disposed on an interior surface of one of the first and second plies; a release material disposed between the reclosing material and the other of the first and second plies; and a bag opening zone extending between the top and the bottom.

In one exemplary embodiment, a method of reclosing a product within a reclosable bag includes steps of: forming a product retrieval opening in a bag opening zone of a reclosable bag; removing a product from the reclosable bag through the product retrieval opening; forming a reclosing flap between the bag opening zone and the first side of the reclosable bag; inserting the product through the product retrieval opening; removing the release material; and folding the reclosing flap to reclose the reclosable bag by adhering the reclosing material to an exterior surface of the first ply. The reclosable bag includes first and second plies extending from a first side to a second side and from a top bottom to a top, a seal joining the first and second plies arranged near the bottom of the bag, a reclosing material disposed on an interior surface of one of the first and second plies, and a release material disposed between the reclosing material and the other of the first and second plies.

A further understanding of the nature and advantages of the present invention are set forth in the following description and claims, particularly when considered in conjunction with the accompanying drawings in which like parts bear like reference numerals.

BRIEF DESCRIPTION OF THE DRAWING

To further clarify various aspects of embodiments of the present disclosure, a more particular description of the certain embodiments will be made by reference to various aspects of the appended drawings. It is appreciated that these drawings depict only typical embodiments of the present disclosure and are therefore not to be considered limiting of the scope of the disclosure. Moreover, while the figures can be drawn to scale for some embodiments, the figures are not necessarily drawn to scale for all embodiments. Embodiments and other features and advantages of the present disclosure will be described and explained with additional specificity and detail through the use of the accompanying drawings in which:

FIG. 28 is a view of the web of reclosable bag taken along line A-A in

FIG. 27;

FIG. 118 is a view of the reclosable bag taken along line A-A in FIG. 117;

FIG. 119 is a schematic illustration of an exemplary web of reclosable bags;

FIG. 120 is a view of the reclosable bag taken along line A-A in FIG. 119;

FIG. 121 is a schematic illustration of an exemplary reclosable bag;

FIG. 122 is a view of the reclosable bag taken along line A-A in FIG. 121;

FIG. 123 is a schematic illustration of an exemplary reclosable bag containing a product;

FIG. 124 is a view of the reclosable bag taken along line A-A in FIG. 123;

FIG. 125 is a schematic illustration of an exemplary web of reclosable bags;

FIG. 126 is a view of the reclosable bag taken along line A-A in FIG. 125;

FIG. 127 is a schematic illustration of an exemplary reclosable bag;

FIG. 128 is a view of the reclosable bag taken along line A-A in FIG. 127;

FIG. 129 is a schematic illustration of an exemplary reclosable bag showing an opening for receiving a product;

Figure 130:
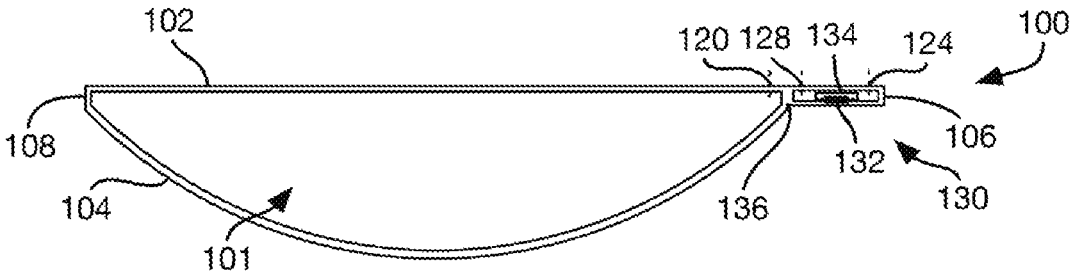
Figure 129:
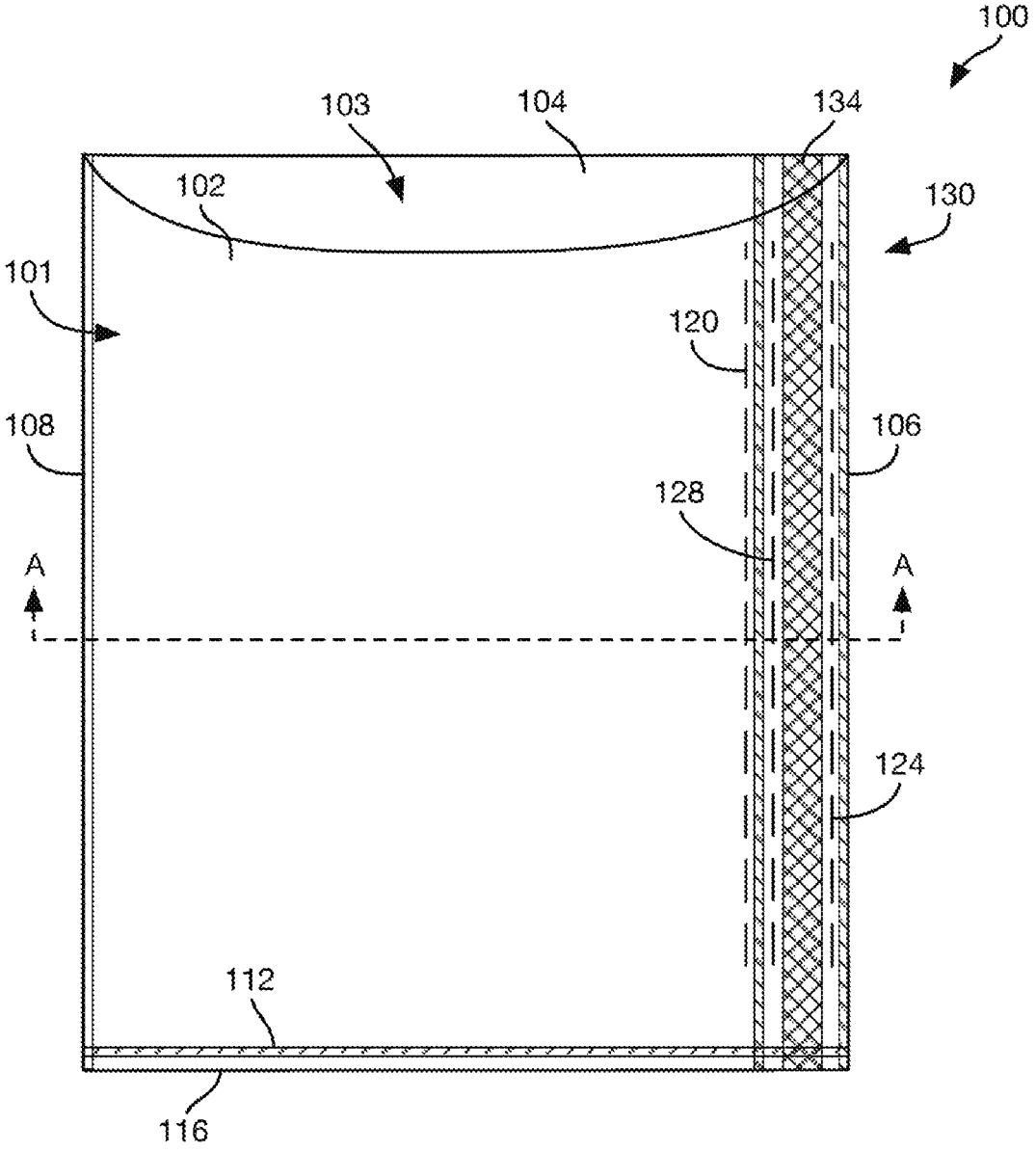
Figure 132:
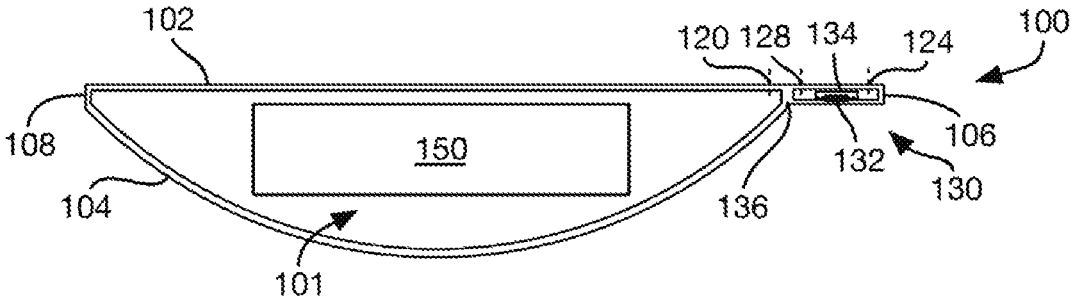
Figure 131:
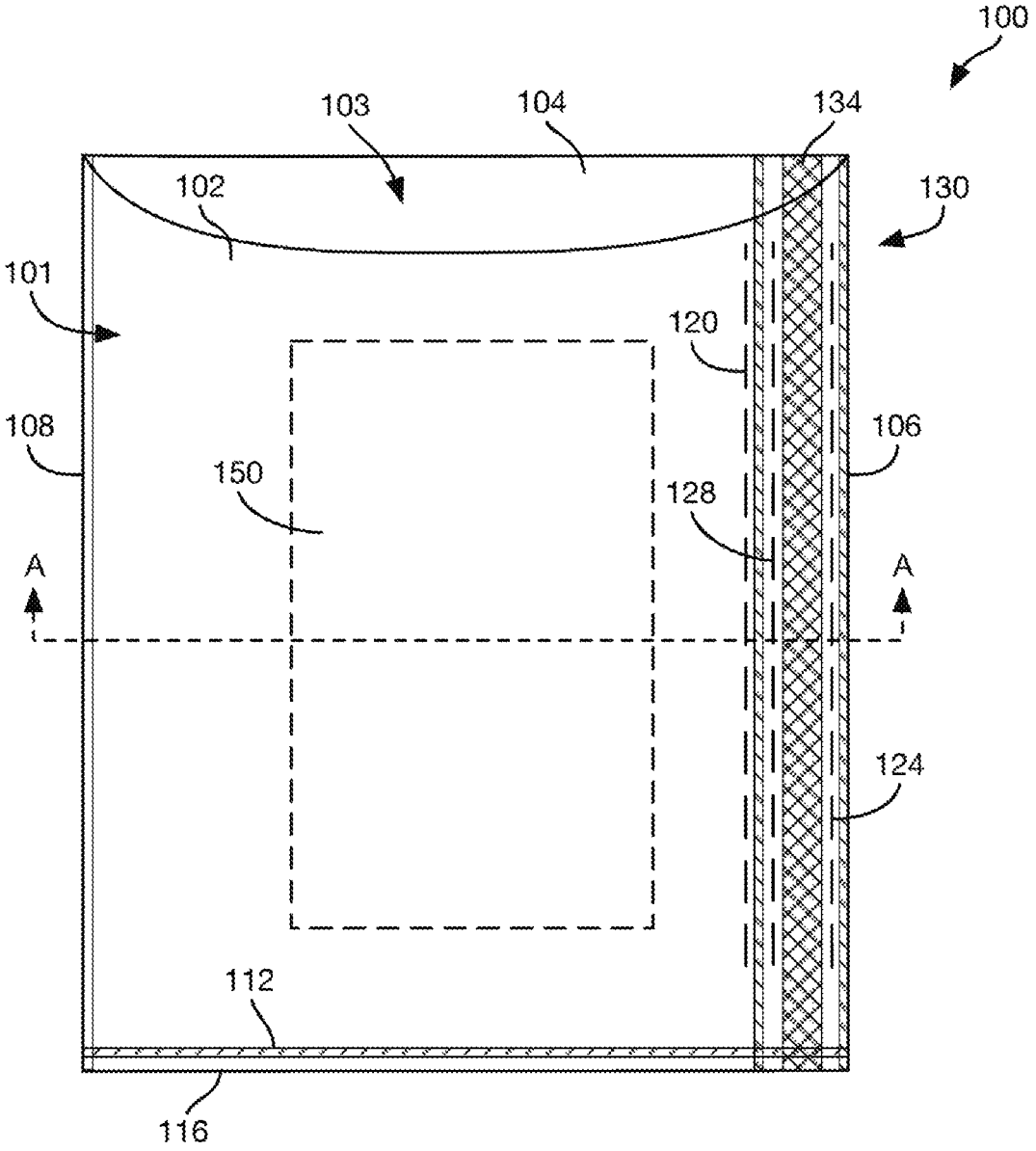
Figure 134:
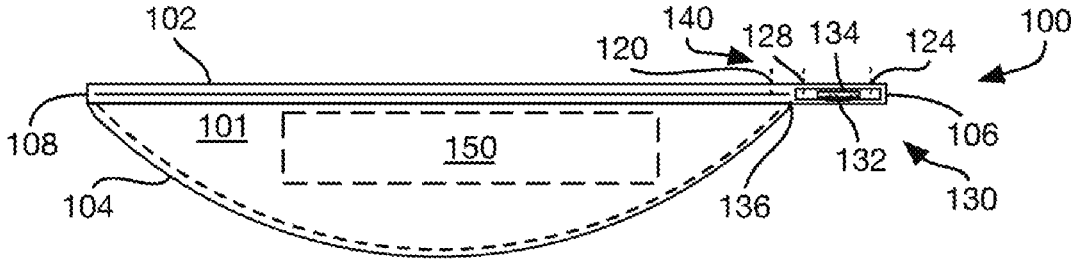
Figure 133:
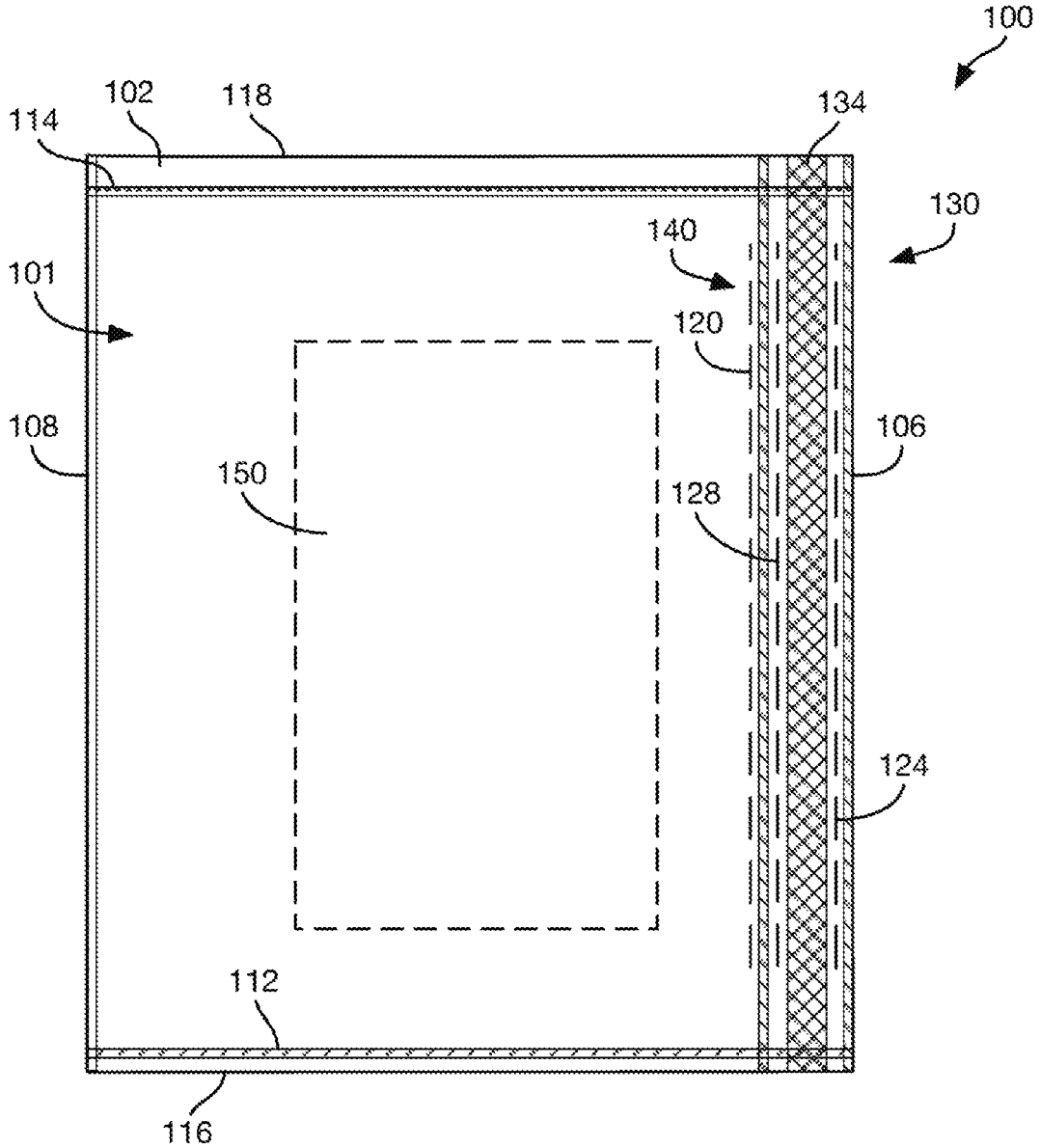
Figure 136:
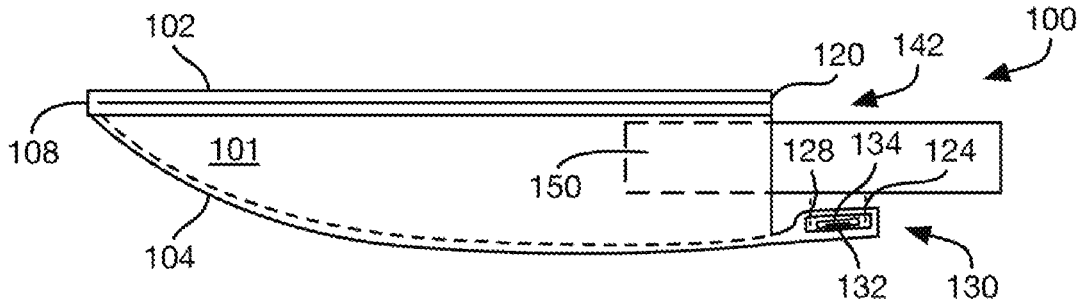
Figure 135:
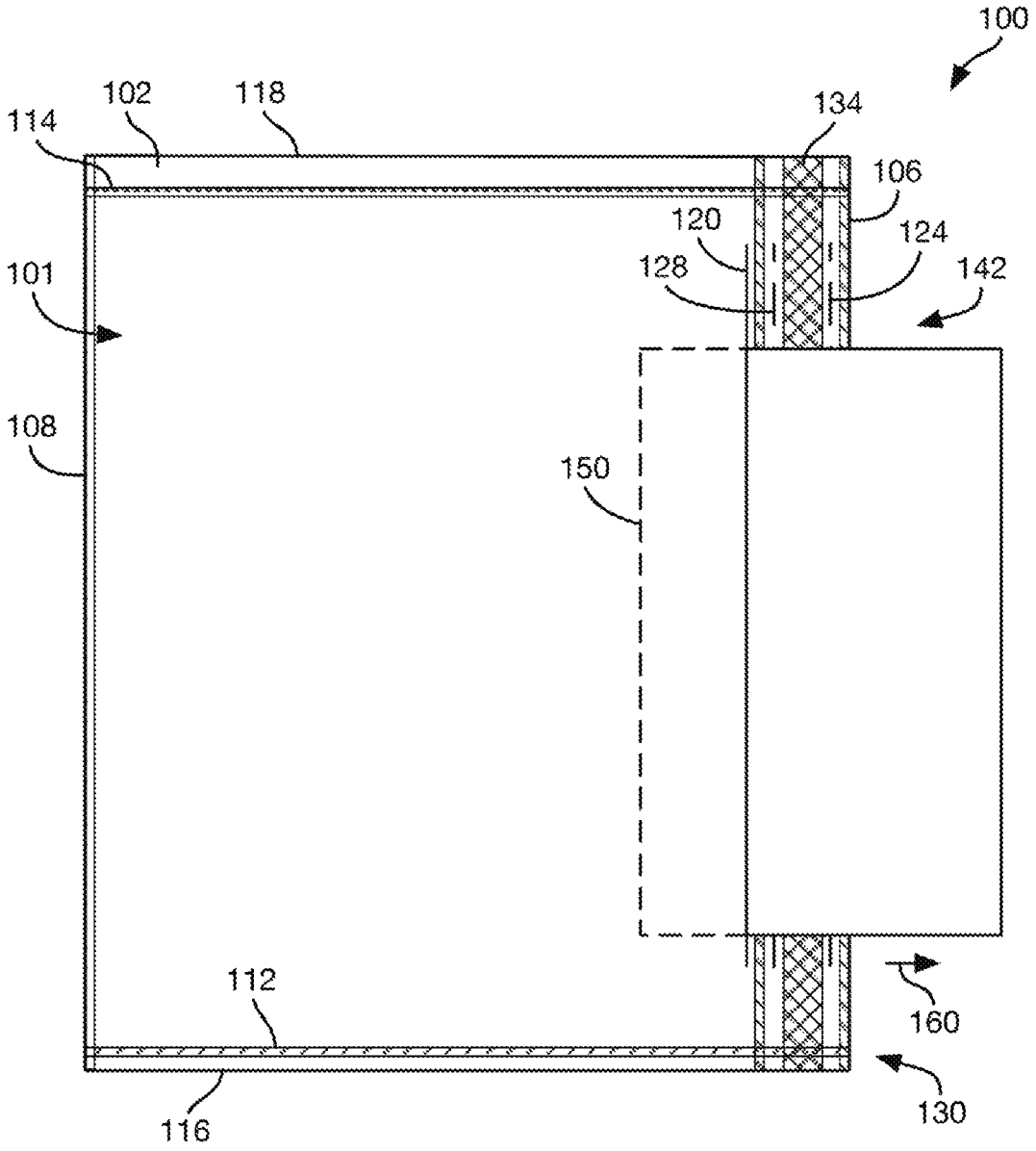
Figure 138:
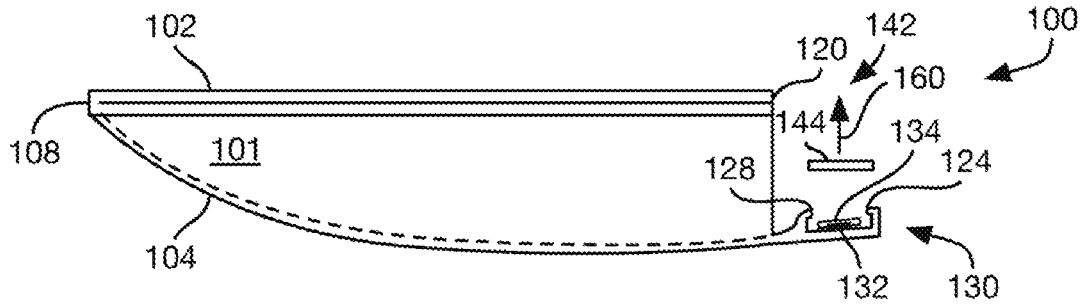
Figure 137:
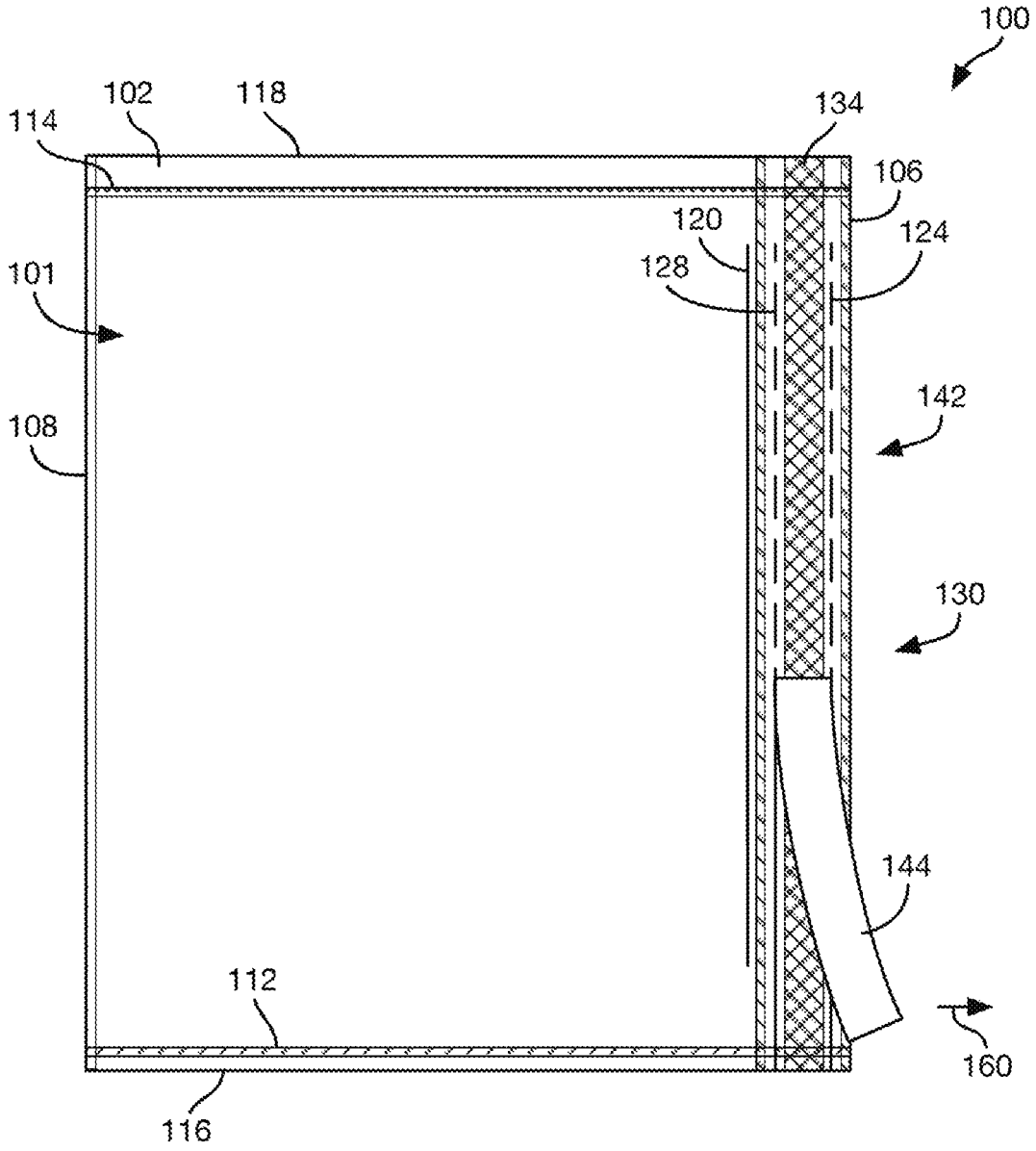
Figure 140:
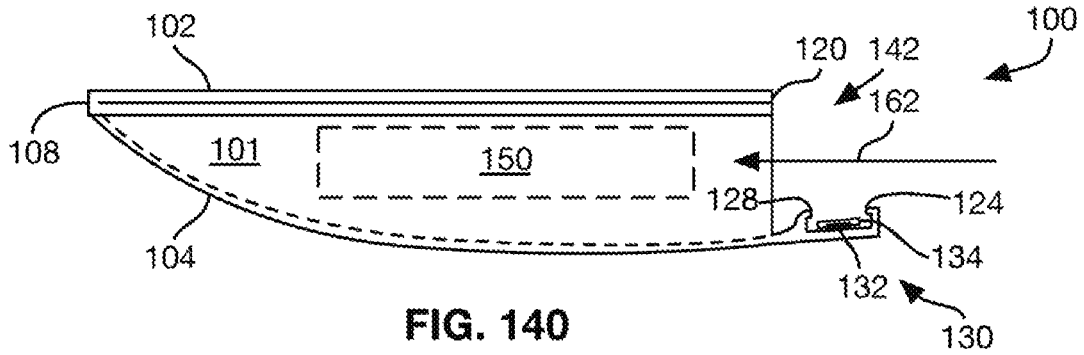
Figure 139:
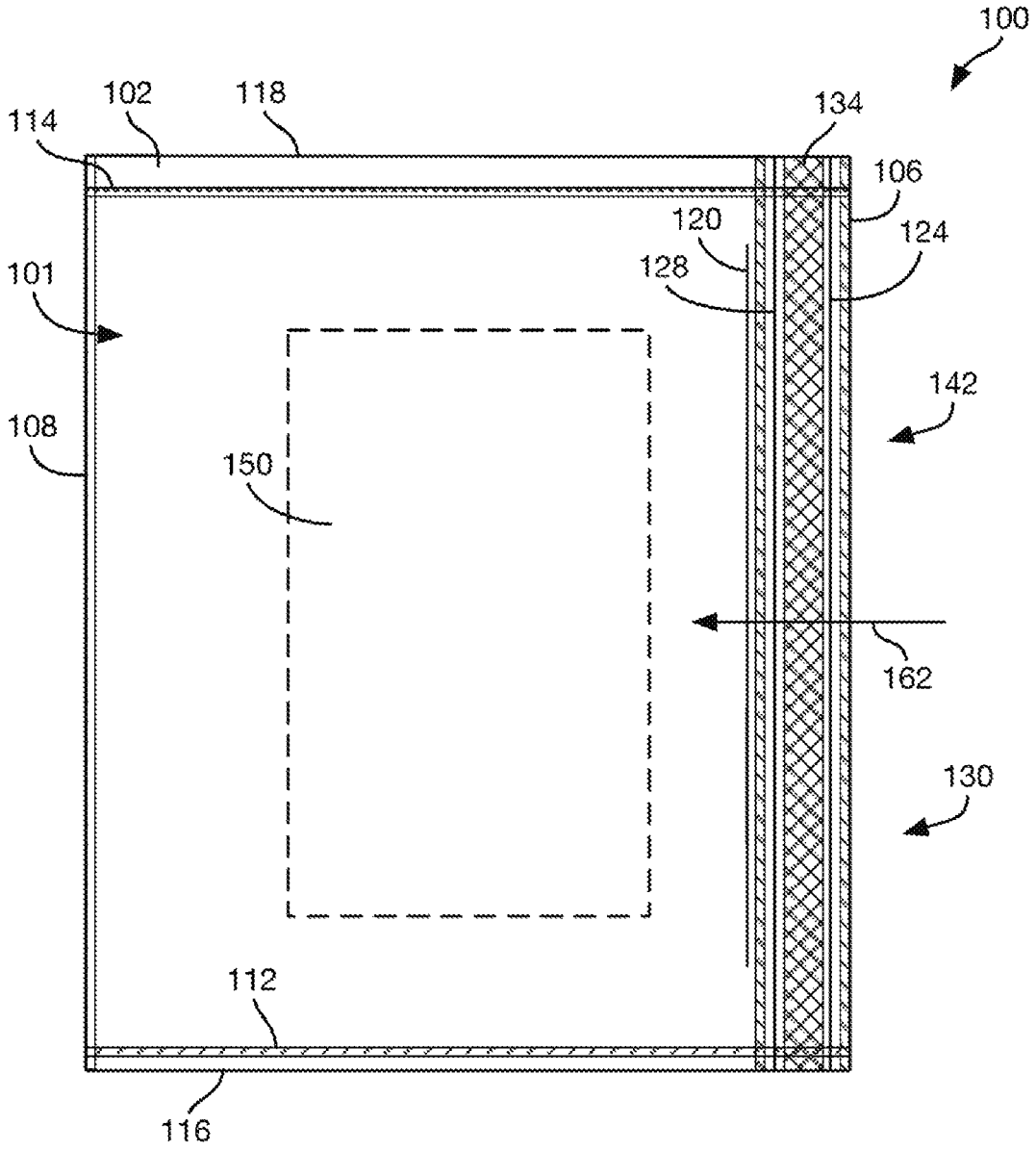
Figure 142:
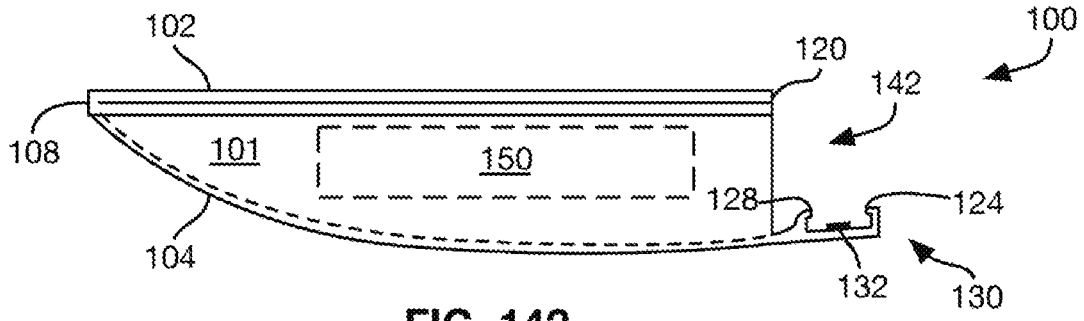
Figure 141:
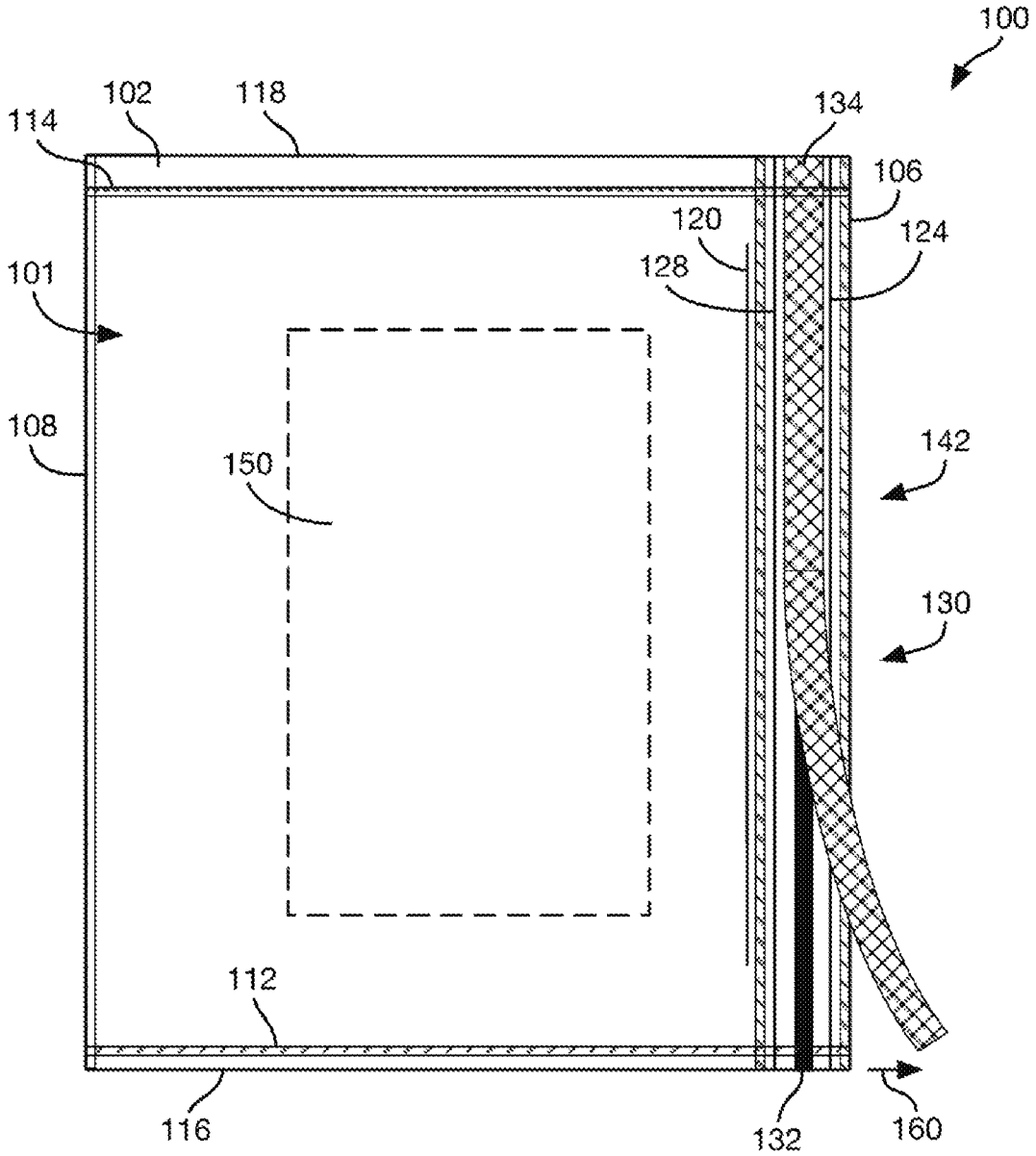
Figure 144:
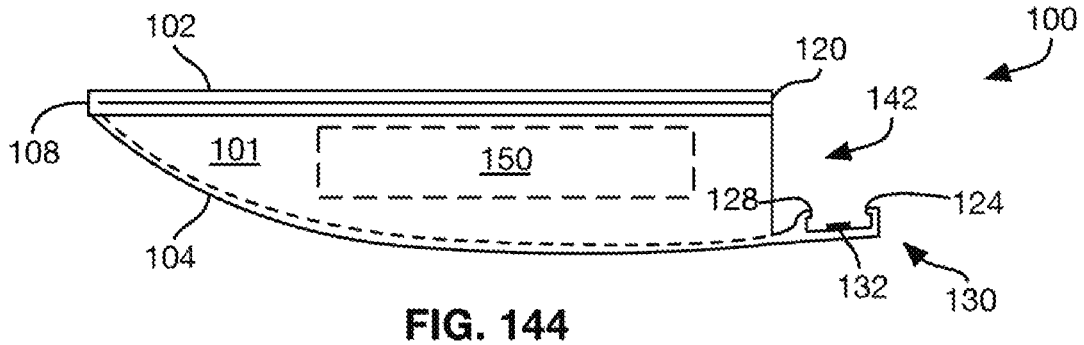
Figure 143:
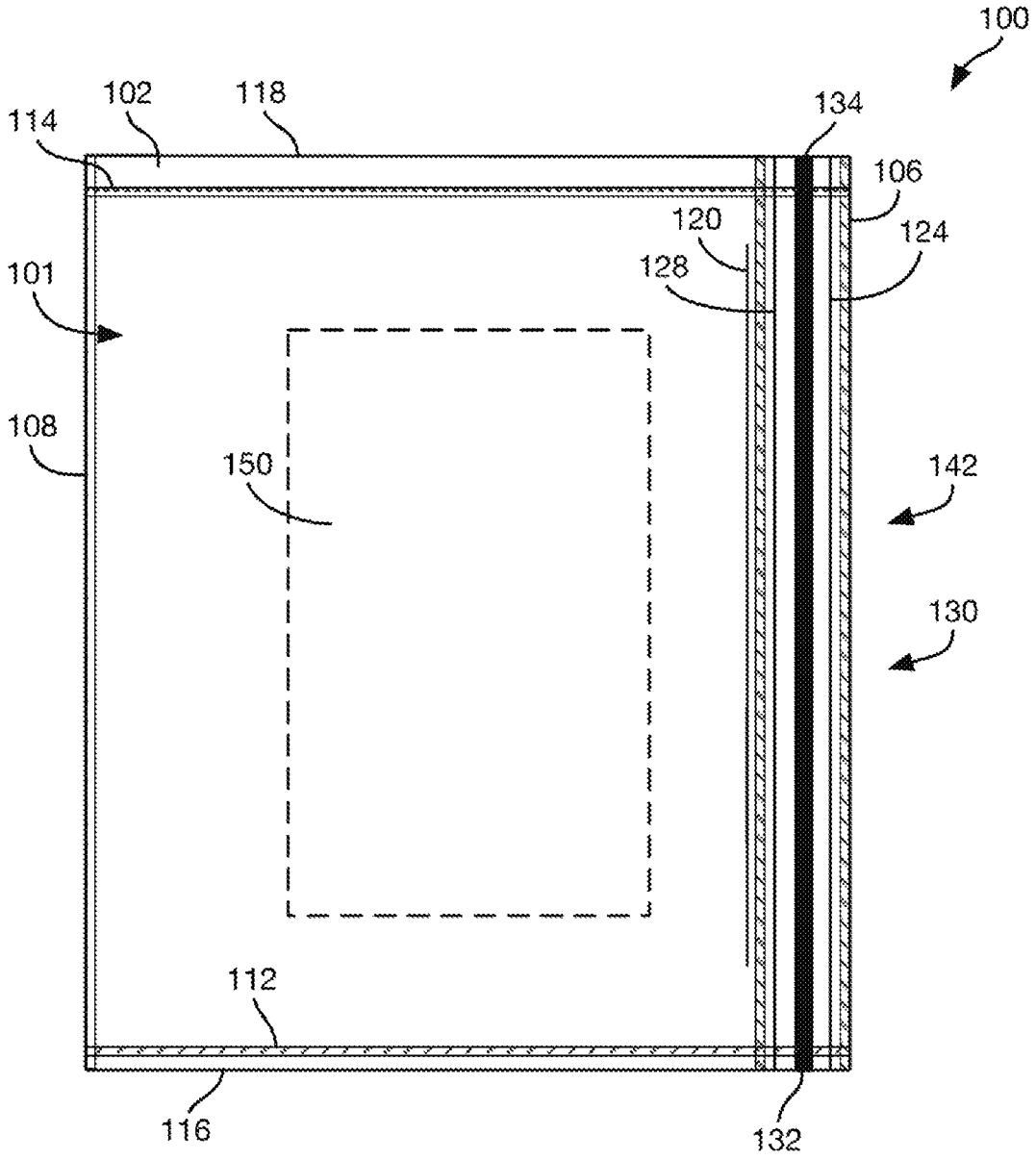
Figure 146:
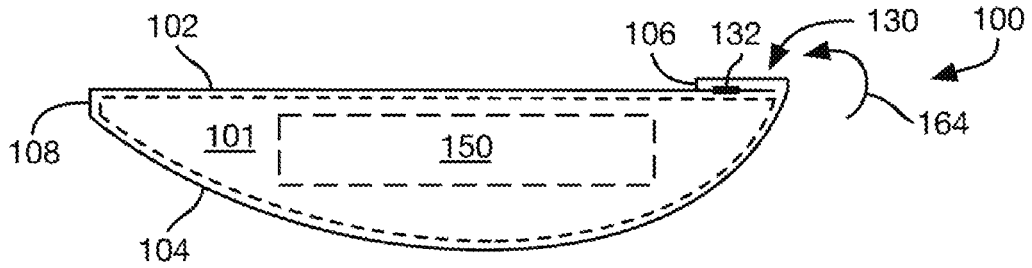
Figure 145:
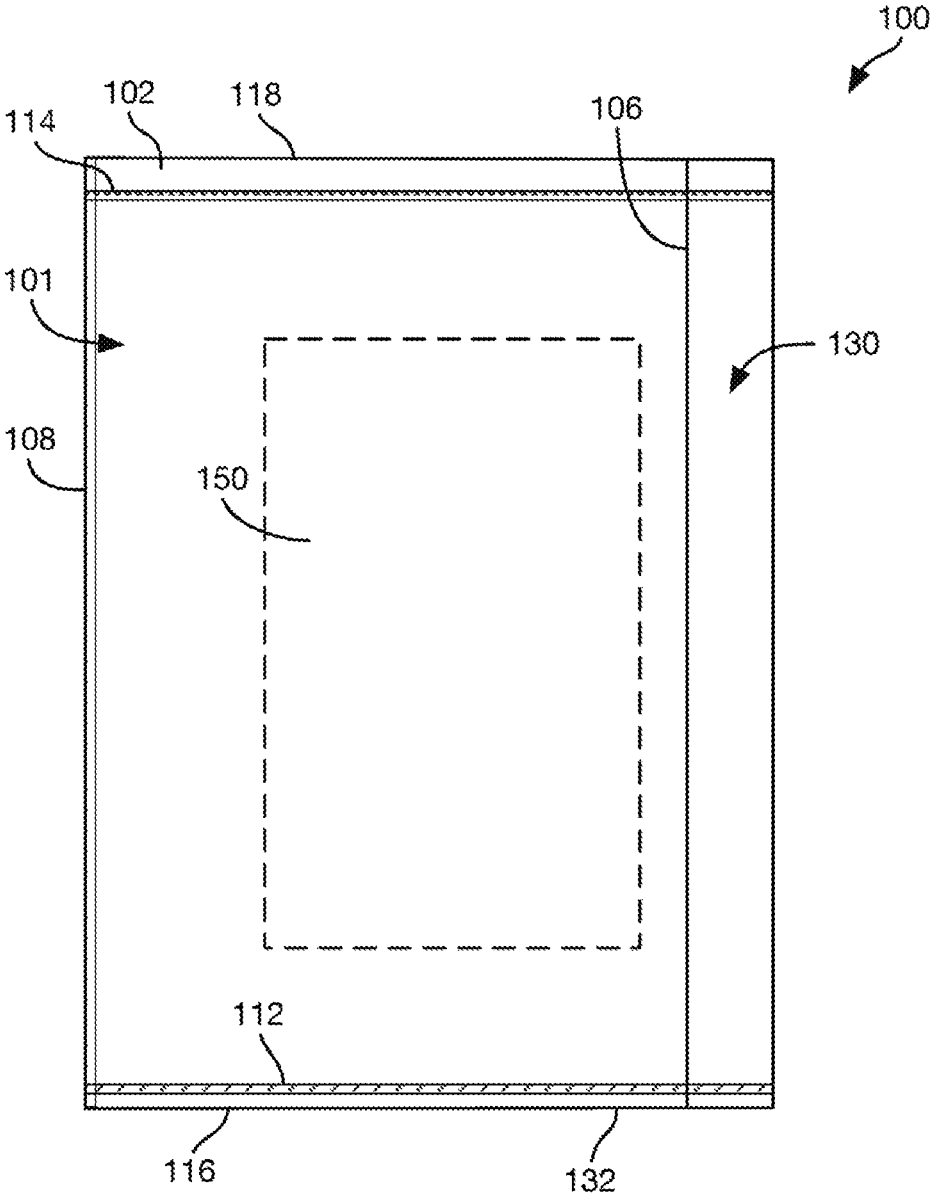
Figure 148:
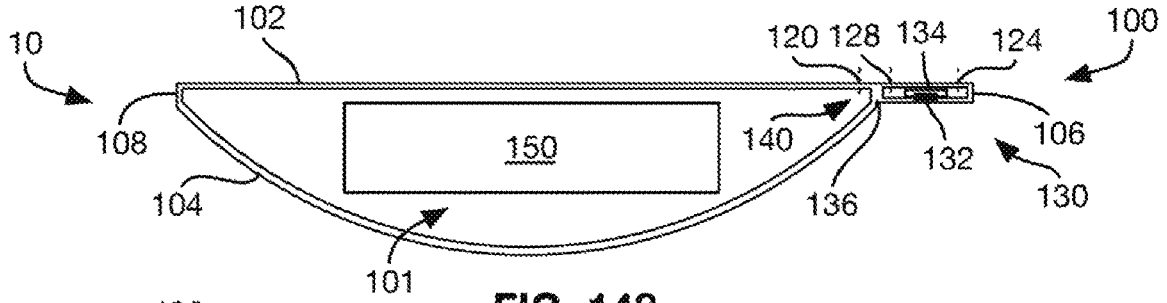
Figure 147:
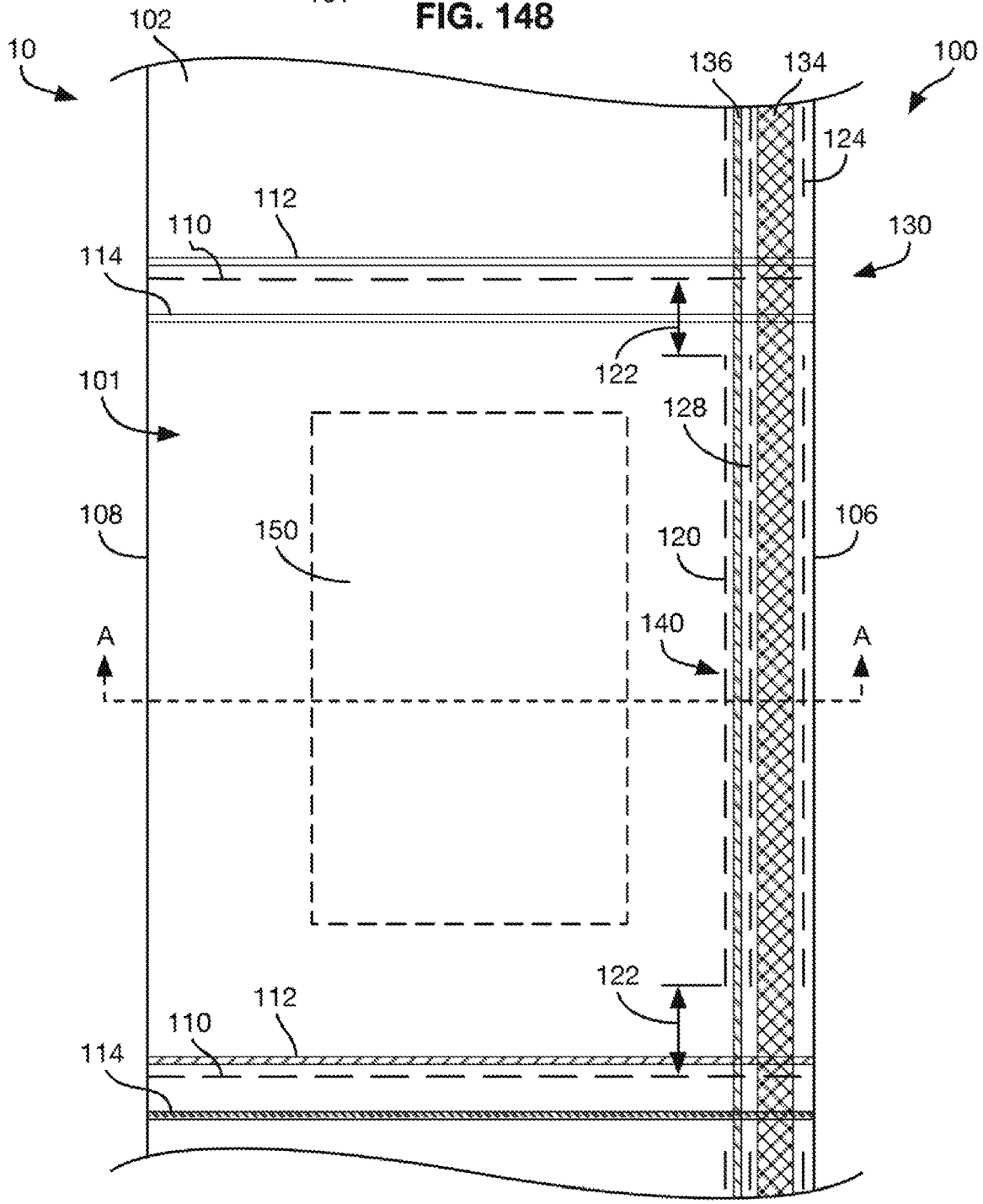
Figure 150:
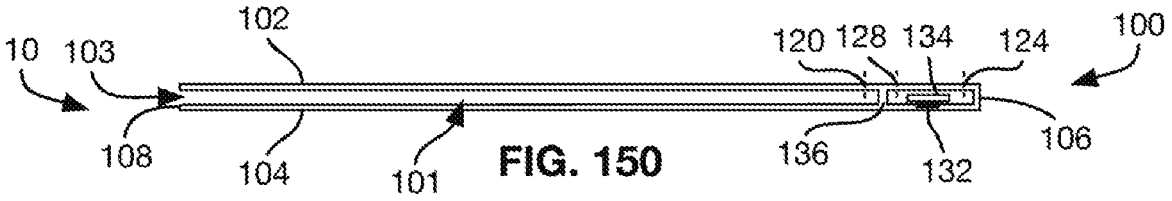
Figure 149:
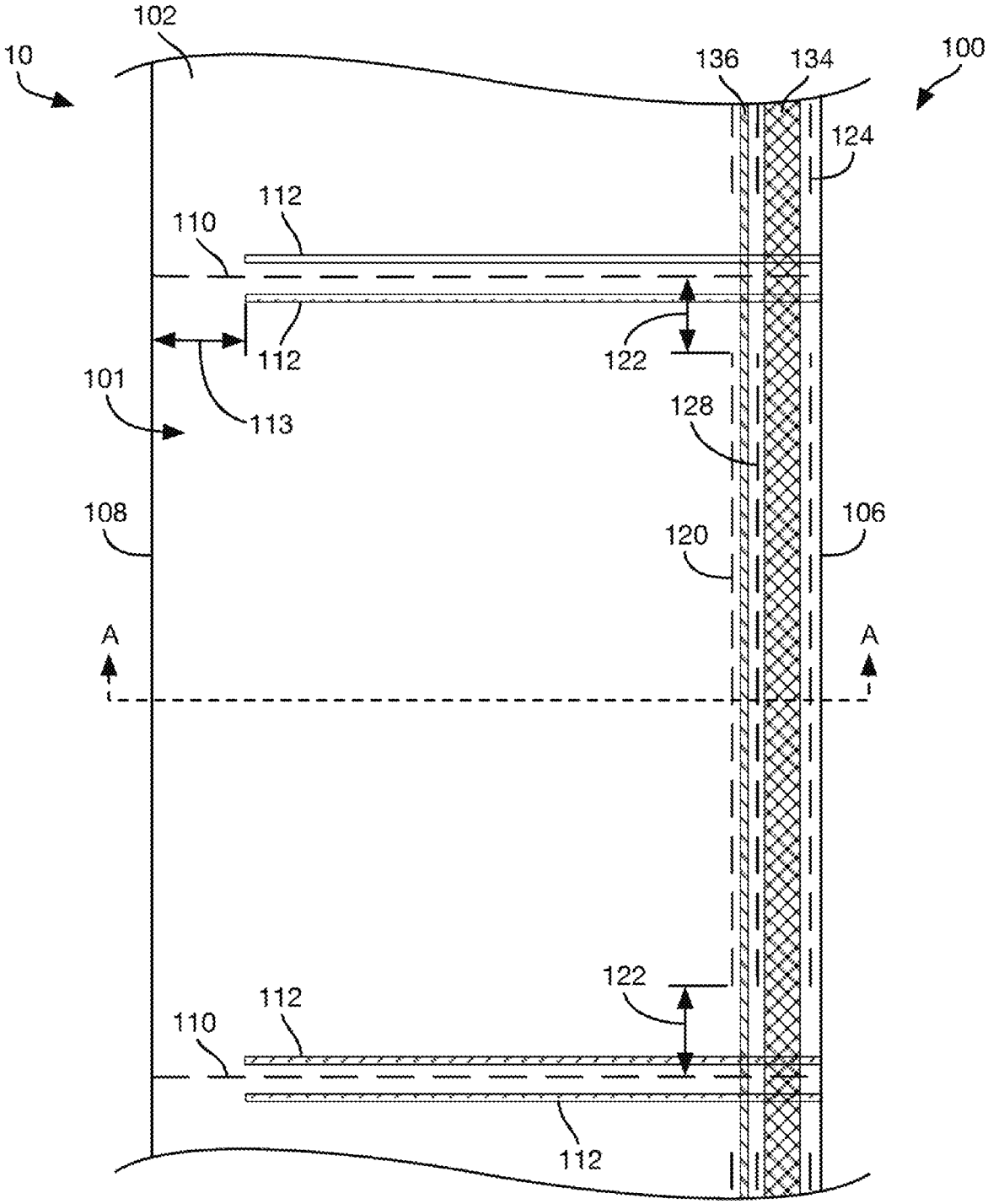
Figure 152:
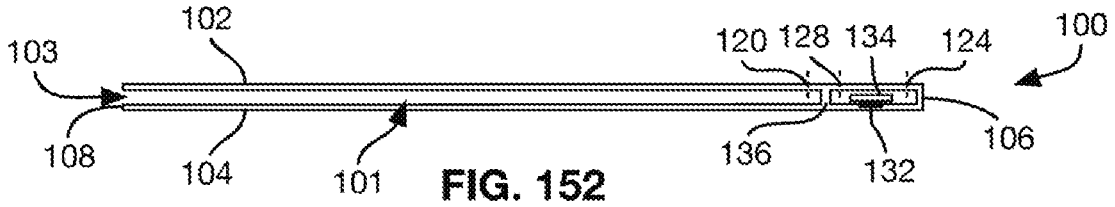
Figure 151:
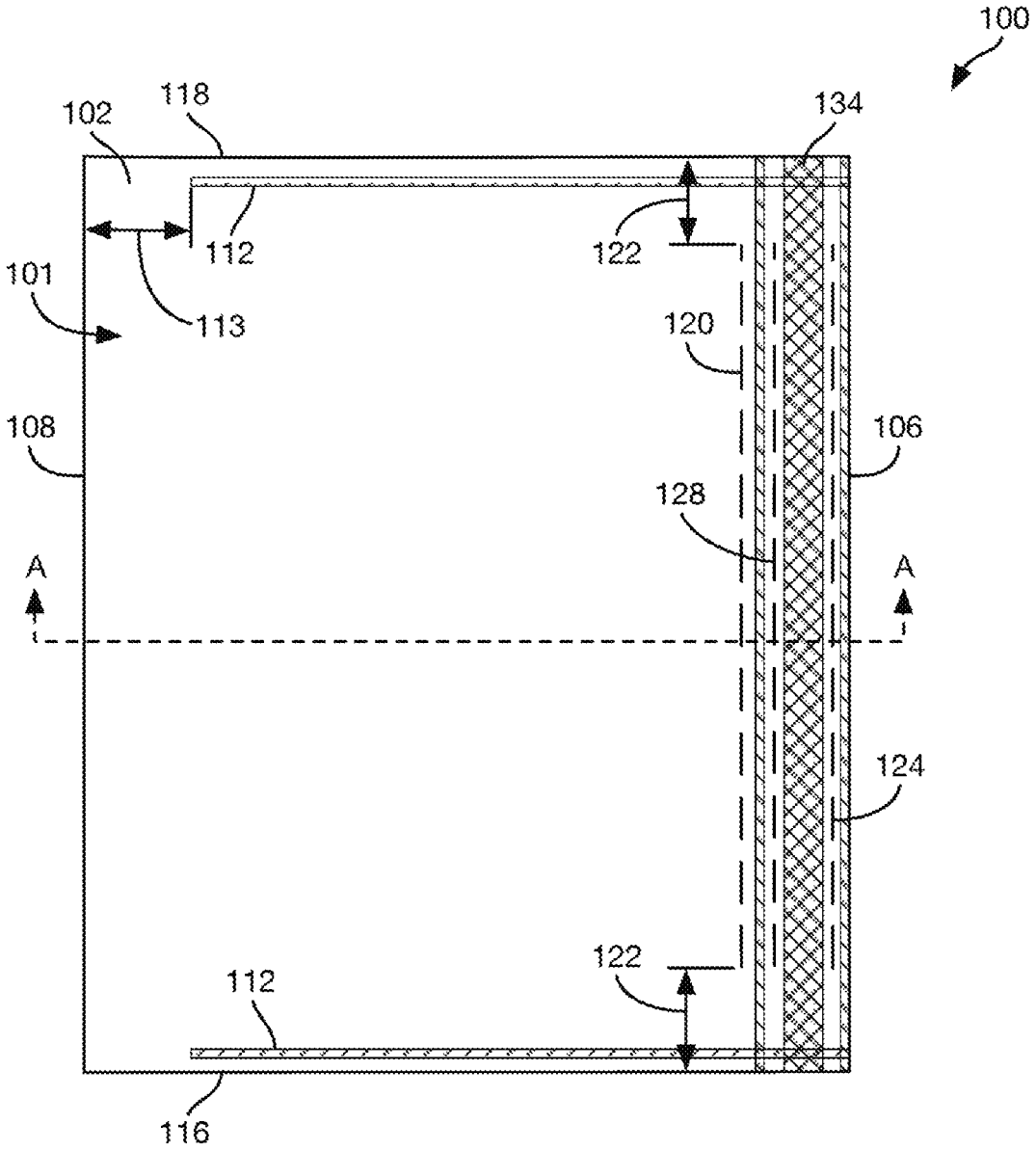
Figure 154:
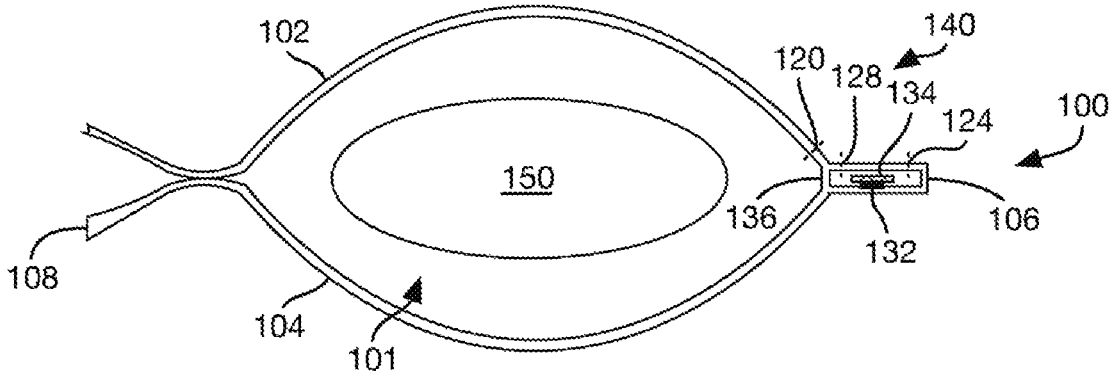
Figure 153:
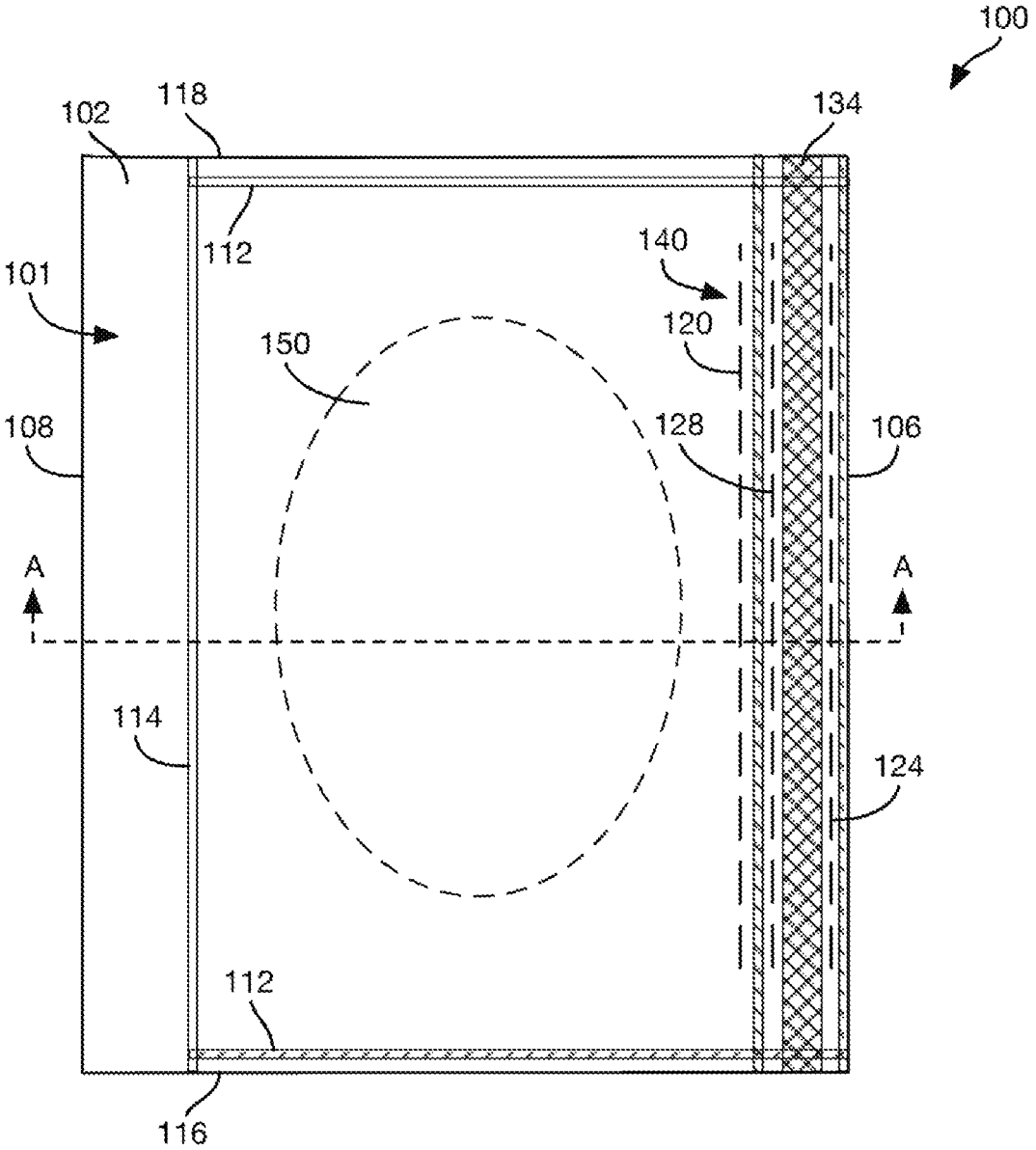
Figure 156:
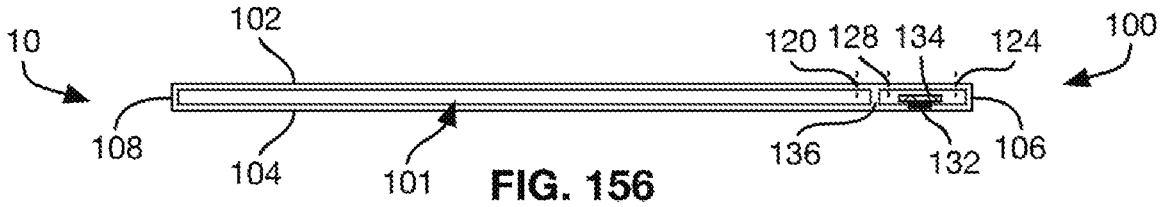
Figure 155:
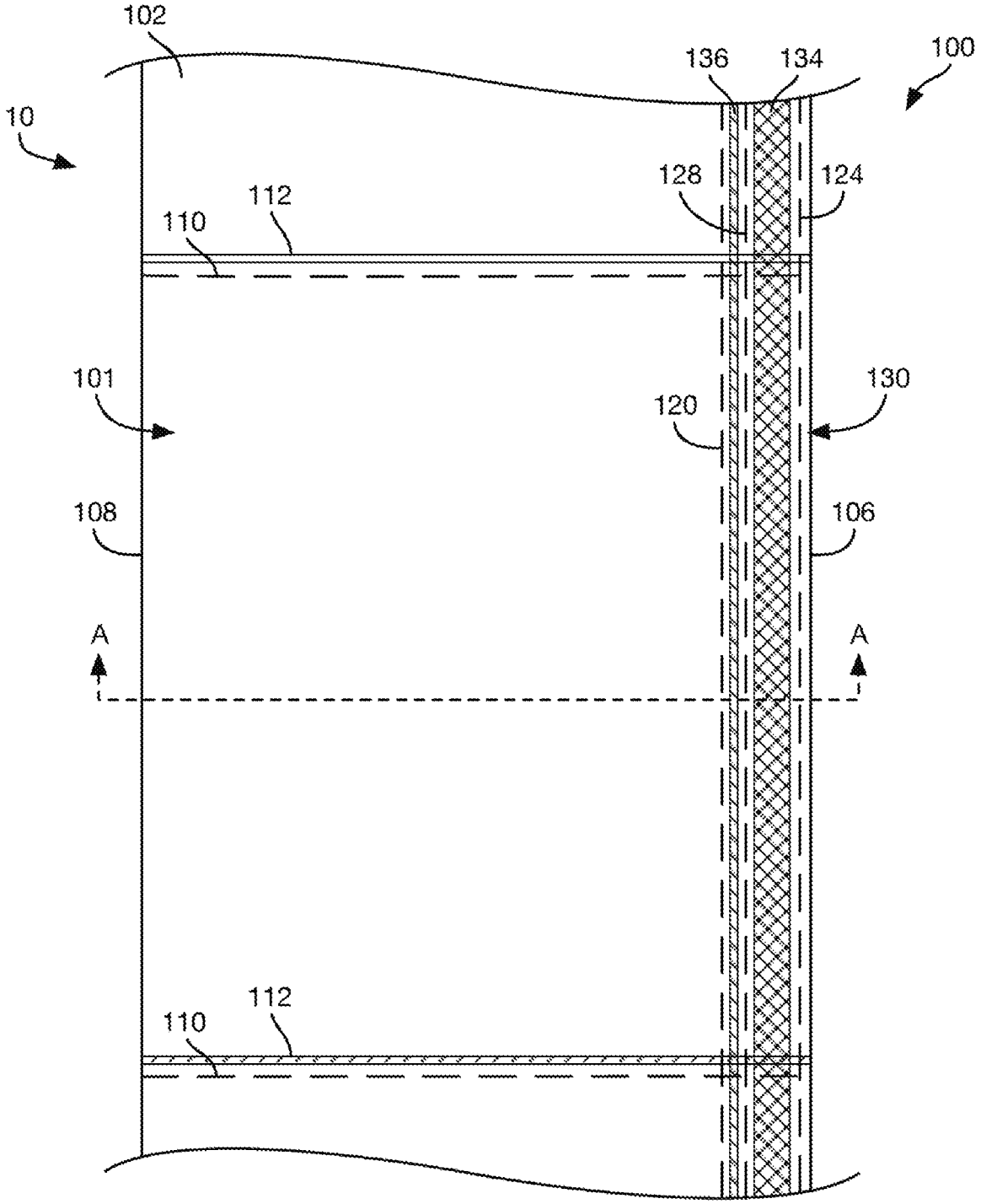
Figure 158:
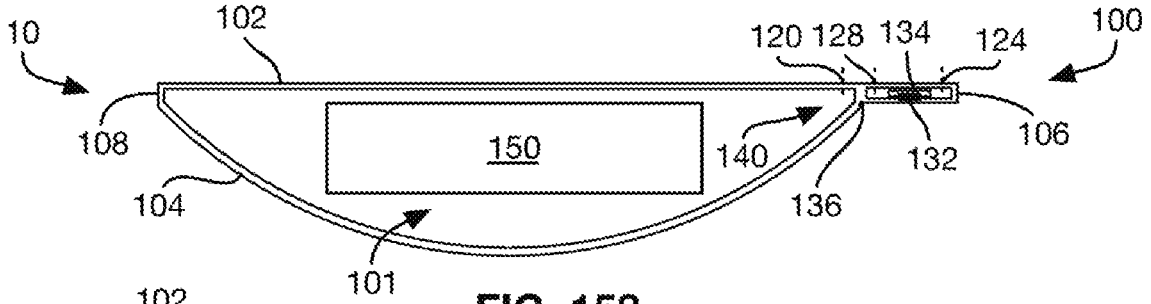
Figure 157:
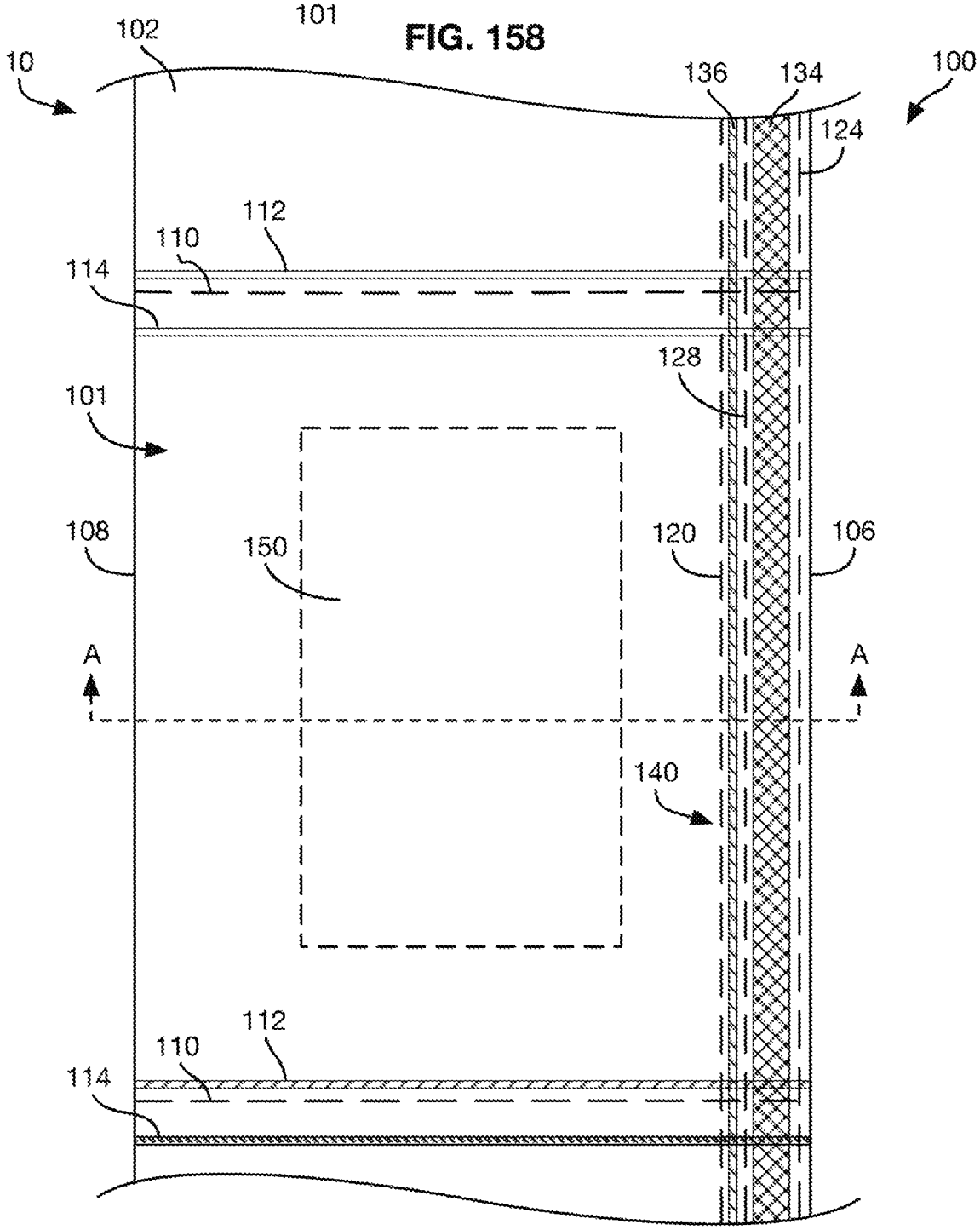
Figure 160:
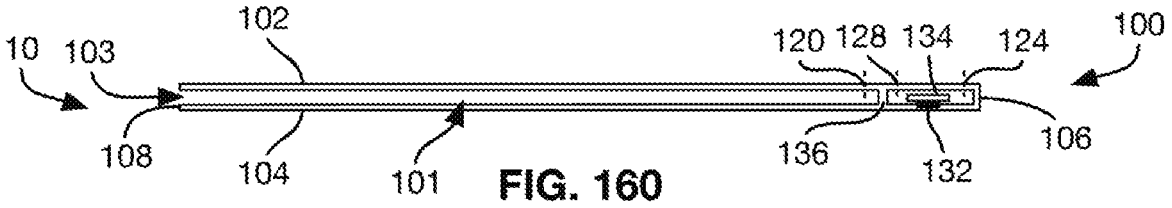
Figure 159:
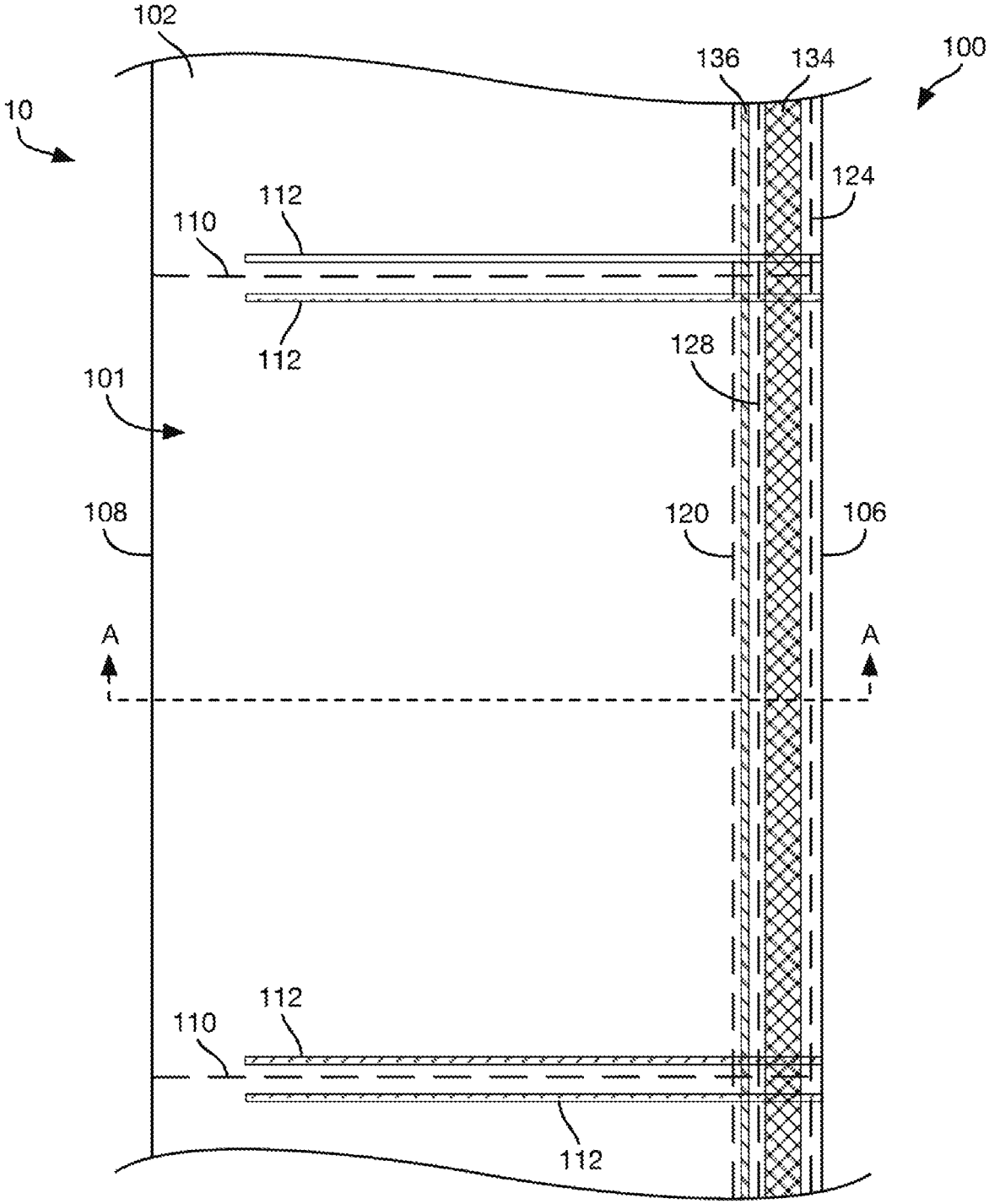
Figure 162:
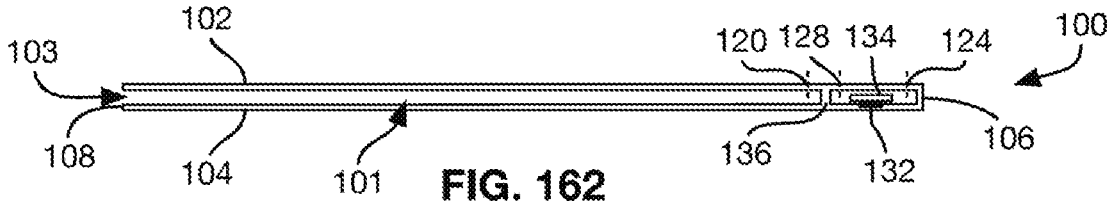
Figure 161:
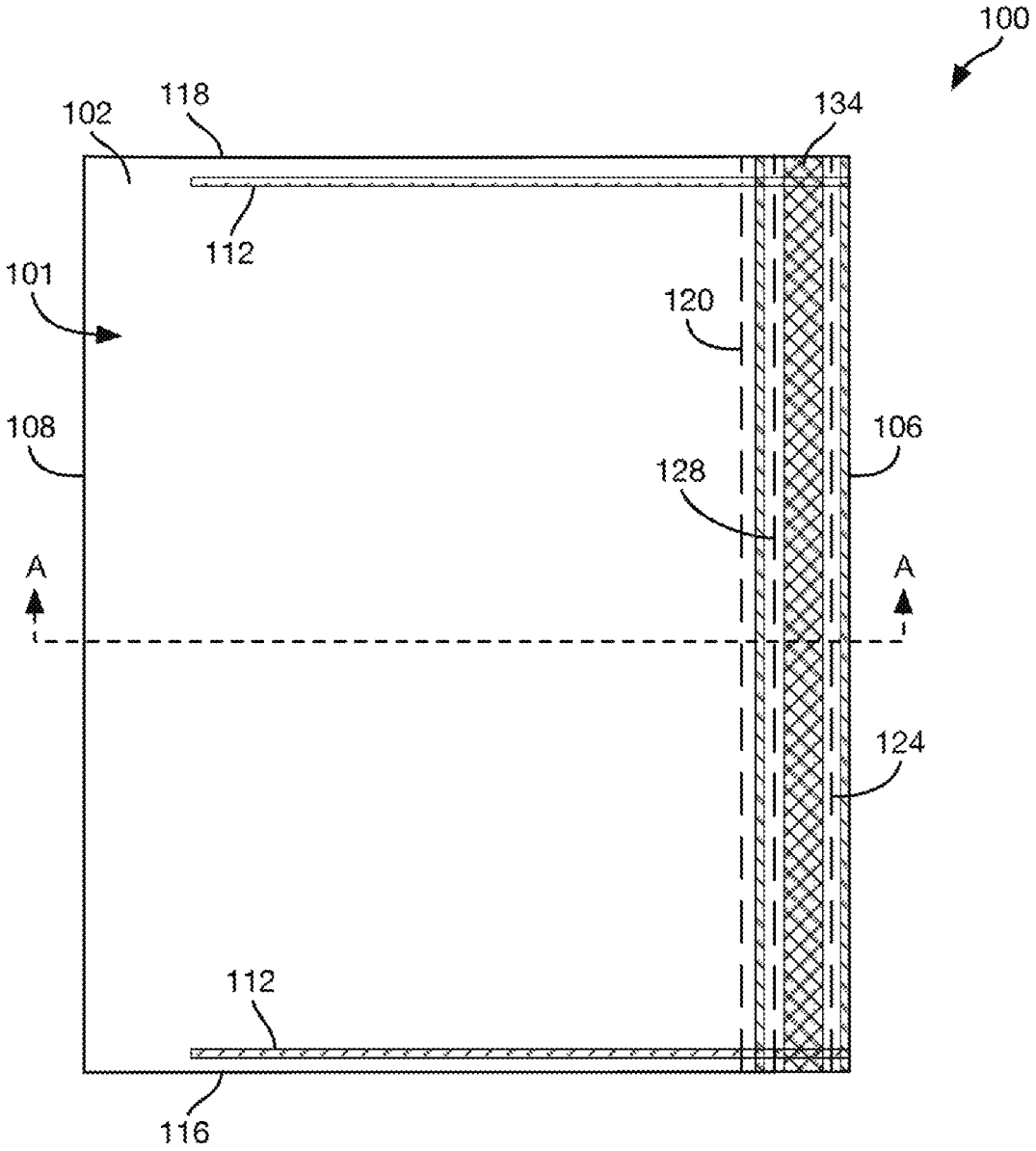
Figure 164:
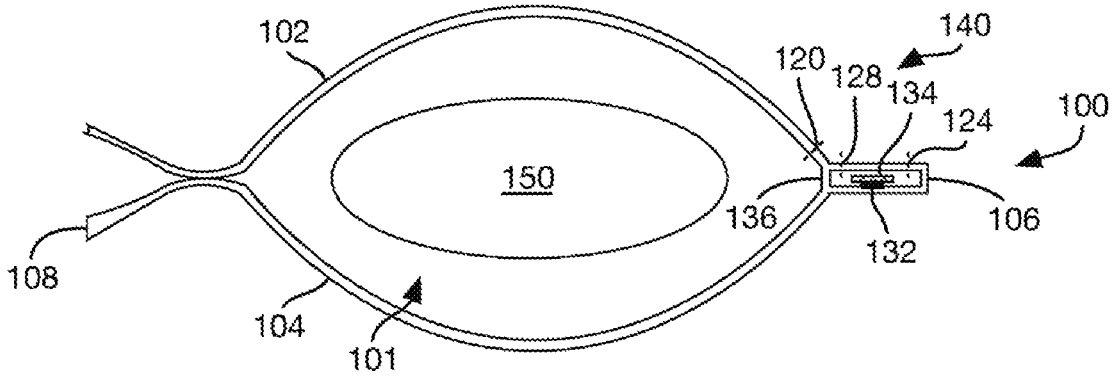
Figure 163:
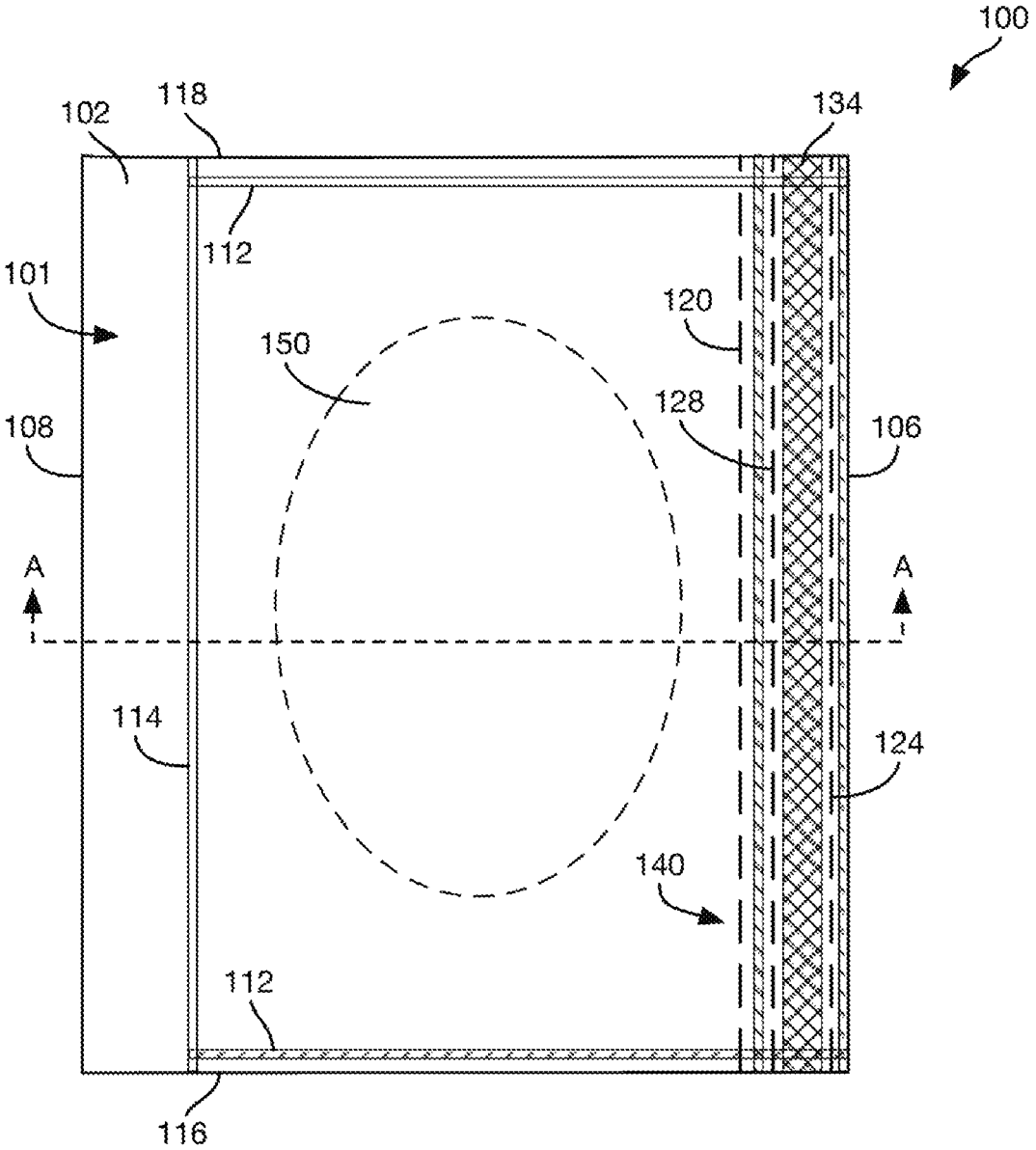

FIG. 130 is a view of the reclosable bag taken along line A-A in FIG. 129;

FIG. 131 is a schematic illustration of an exemplary reclosable bag with a product loaded into the bag;

FIG. 132 is a view of the reclosable bag taken along line A-A in FIG. 131;

FIG. 133 is a schematic illustration of an exemplary reclosable bag containing a product;

FIG. 134 is a bottom view of the reclosable bag of FIG. 133;

FIG. 135 is a schematic illustration of an exemplary reclosable bag showing a product being removed through an opening;

FIG. 136 is a bottom view of the reclosable bag of FIG. 135;

FIG. 137 is a schematic illustration of an exemplary reclosable bag showing a compartment of a reclosing flap being opened;

FIG. 138 is a bottom view of the reclosable bag of FIG. 137;

FIG. 139 is a schematic illustration of an exemplary reclosable bag showing a product being loaded into the bag;

FIG. 140 is a bottom view of the reclosable bag of FIG. 139;

FIG. 141 is a schematic illustration of an exemplary reclosable bag showing a release material being removed;

FIG. 142 is a bottom view of the reclosable bag of FIG. 141;

FIG. 143 is a schematic illustration of an exemplary reclosable bag showing a reclosing flap with reclosing material exposed;

FIG. 144 is a bottom view of the reclosable bag of FIG. 143;

FIG. 145 is a schematic illustration of an exemplary reclosable bag showing the bag reclosed;

FIG. 146 is a bottom view of the reclosable bag of FIG. 145;

FIG. 147 is a schematic illustration of an exemplary web of reclosable bags with a product loaded in a bag;

FIG. 148 is a view of the reclosable bag taken along line A-A in FIG. 147;

FIG. 149 is a schematic illustration of an exemplary web of reclosable bags;

FIG. 150 is a view of the reclosable bag taken along line A-A in FIG. 149;

FIG. 151 is a schematic illustration of an exemplary reclosable bag;

FIG. 152 is a view of the reclosable bag taken along line A-A in FIG. 151;

FIG. 153 is a schematic illustration of an exemplary reclosable bag showing containing a product;

FIG. 154 is a view of the reclosable bag taken along line A-A in FIG. 153;

FIG. 155 is a schematic illustration of an exemplary web of reclosable bags;

FIG. 156 is a view of the reclosable bag taken along line A-A in FIG. 155;

FIG. 157 is a schematic illustration of an exemplary web of reclosable bags with a product loaded in a bag;

FIG. 158 is a view of the reclosable bag taken along line A-A in FIG. 157;

FIG. 159 is a schematic illustration of an exemplary web of reclosable bags;

FIG. 160 is a view of the reclosable bag taken along line A-A in FIG. 159;

FIG. 161 is a schematic illustration of an exemplary reclosable bag;

FIG. 162 is a view of the reclosable bag taken along line A-A in FIG. 161;

FIG. 163 is a schematic illustration of an exemplary reclosable bag containing a product; and FIG. 164 is a view of the reclosable bag taken along line A-A in FIG. 163.

DETAILED DESCRIPTION

The following description refers to the accompanying drawings, which illustrate specific embodiments of the present disclosure. Other embodiments having different structures and operation do not depart from the scope of the present disclosure.

Exemplary embodiments of the present disclosure are directed to reclosable bags and methods of forming and using reclosable bags. It should be noted that various embodiments of reclosable bags are disclosed herein, and any combination of these options can be made unless specifically excluded. In other words, individual components or portions of the disclosed bags can be combined unless mutually exclusive or otherwise physically impossible.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of). Also as described herein, the phrase "line or area of weakness" may be a line or lines of perforations through a portion of a piece of material, a score line or lines that weaken a portion of a piece of material along a line or area, or other processing known in the art that weakens a portion of a piece of material to allow the piece of material to be separated or broken.

The present application relates to reclosable bags and methods for forming reclosable bags and reclosing products in reclosable bags. The reclosable bags are particularly useful as shipping packages for products that are shipped to a consumer. In addition, the reclosable bags function as "multi-use" bags in that the consumer may use the reclosable bags as return shipping packages to return an unwanted or defective product to the seller. Other reclosable bags are described in U.S. Pat. No. 9,302,821, issued on Apr. 5, 2016, titled "RECLOSEABLE BAG AND METHODS OF FORMING AND USING THE SAME" which is incorporated herein by reference in its entirety.

Figure 2:
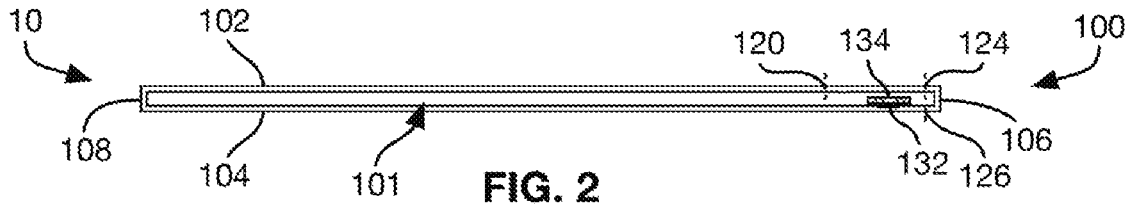
FIG. 2 is a view of the web of reclosable bags taken along line A-A in FIG. 1.
Figure 1:
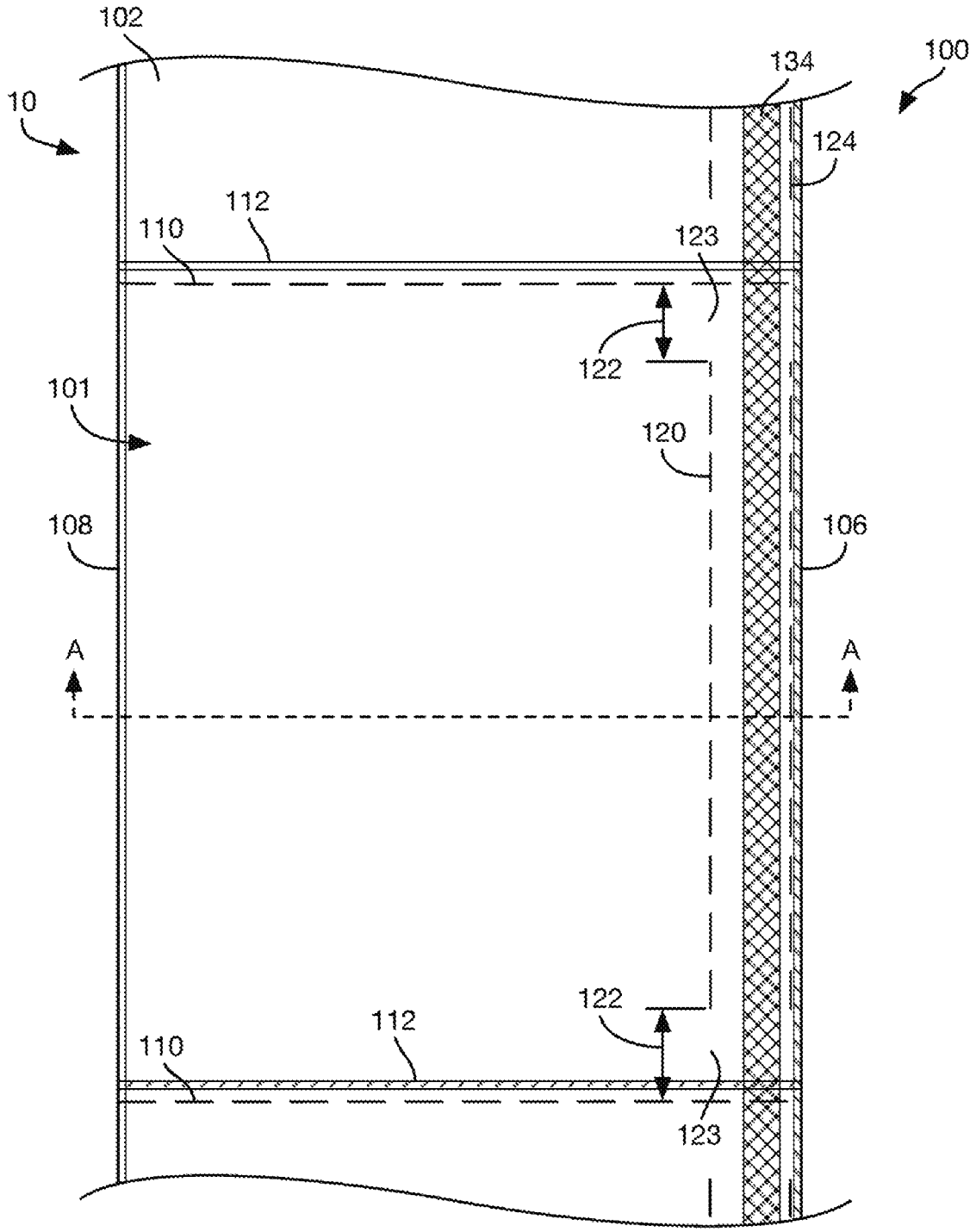
FIG. 1 is a schematic illustration of an exemplary web of reclosable bags.

Referring now to FIGS. 1 and 2, an exemplary web 10 of reclosable bags 100 is shown. The web 10 can be supplied on a roll or from a box. The web 10 includes a first ply 102 and a second ply 104. The first and second plies 102, 104 may be two separate plies, or a single ply that is folded and joined together. In some embodiments, the first ply 102 and second ply 104 are portions of a tube of material that is flattened. In certain embodiments, the first ply 102 may be hermetically joined to the second ply 104 by various techniques including, but not limited to, heat sealing, ultrasonic welding, gluing, etc.

The first ply 102 and the second ply 104 may be formed of any suitable material. Examples of suitable materials include, but are not limited to, plastic materials, polyethylene, cellophane, vinyl films, pliofilms, cellulose acetate film, polystyrene, polypropylene, and virtually any type of heat sealable or ultrasonic weldable material. The first ply 102 and the second ply 104 can also be formed from a padded material, such as, for example, bubble wrap, one or more inflated cushions, or the like. In some embodiments, the first ply 102 and the second ply 104 are formed from multi-layered materials that include a layer of padding material, such as bubble wrap or an inflatable material.

The web 10 extends between a first edge or side 106 and second edge or side 108. One or both of the first and second sides 106, 108 can be formed from folds in a single piece of material, such as a flattened tube of material, or may be formed from seals that hermetically join the first ply 102 to the second ply 104.

Seals joining the first and second plies 102, 104 can have a seal width such that the plies 102, 104 are not separable from each other until a distance equal to the seal width from the edge of the plies 102, 104. The bags 100 in the web 10 are separated by separating lines or areas of weakness 110 formed in both of the first and second plies 102, 104 that can be formed from a line of perforations, a slit, a thinner portion of material, or the like, that allow one of the bags 100 to be torn or otherwise removed from the web 10. A product 150 (e.g., FIG. 7) can be inserted into the bag 100 while the bag 100 is part of the web 10 or can be inserted after the bag 100 is removed from the web 10.

A seal 112 extends across the web 10 from the first side 106 to the second side 108 near each of the separating lines of weakness 110 to form a bottom edge or side 116 (FIG. 3) of the bag 100. The seal 112 may be formed by various techniques including, but not limited to, heat sealing, ultrasonic welding, gluing, etc. The first ply 102, second ply 104, first side 106, second side 108, and seal 112 define a compartment 101 for receiving a product 150 (e.g., FIG. 7). Although FIGS. 1 and 2 illustrate the bag 100 as having a single compartment 101, the bag 100 may have any number of compartments. Before product 150 is inserted into the compartment 101, the compartment 101 remains open along the top of the bag 100.

The web 10 includes a first opening line or area of weakness 120 and a second opening line or area of weakness 124 in the first ply 102. A third opening line or area of weakness 126 is formed in the second ply 104. In some embodiments, the second and third opening lines of weakness 124, 126 are aligned and are formed in a single operation when the web 10 is manufactured. As will be discussed in further detail below, the opening lines of weakness 120, 124, 126 facilitate the creation of openings in the bags 100 to retrieve product from the bag 100 and to insert product to be returned into the bag 100.

The opening lines of weakness 120, 124, 126 also allow for the removal of portions of the bag 100 to reconfigure the bag 100 to create a reclosing flap 130 (e.g., FIGS. 17 and 18) for reclosing the bag 100 after the bag 100 has been opened to retrieve the product 150. The reclosing flap 130 can be formed from portions of one or both of the first and second plies 102, 104. As will be discussed in more detail below, the reclosing flap 130 is configured to move between a passive position where the reclosing material 132 is releasably adhered to the release material 134, and an active position where the reclosing material 132 is adhered to a portion of the bag 100 to reclose the bag 100.

The first, second, and third opening lines of weakness 120, 124, 126 can optionally end in a spaced relationship with the separating lines of weakness 110 to form optional gaps 122 between the first, second, and third opening lines of weakness 120, 124, 126 and the separating lines of weakness 110 separating adjacent bags 100 so that each of the first, second, and third opening lines of weakness 120, 124, 126 extends partially between subsequent separating lines of weakness 110. The gaps 122 can be formed at one or both of the bottom 116 and the top 118 of the bag 100. In some embodiments, the first, second, and third opening lines of weakness 120, 124, 126 are continuous and extend along the entirety of the web 10 so that each of the first, second, and third opening lines of weakness 120, 124, 126 extend fully between subsequent separating lines of weakness 110 in the web 10. In some embodiments, one or more of the first, second, and third opening lines of weakness 120, 124, 126 extend partially between subsequent separating lines of weakness 110 while the remainder of the first, second, and third opening lines of weakness 120, 124, 126 extend fully between subsequent separating lines of weakness.

Figure 18:
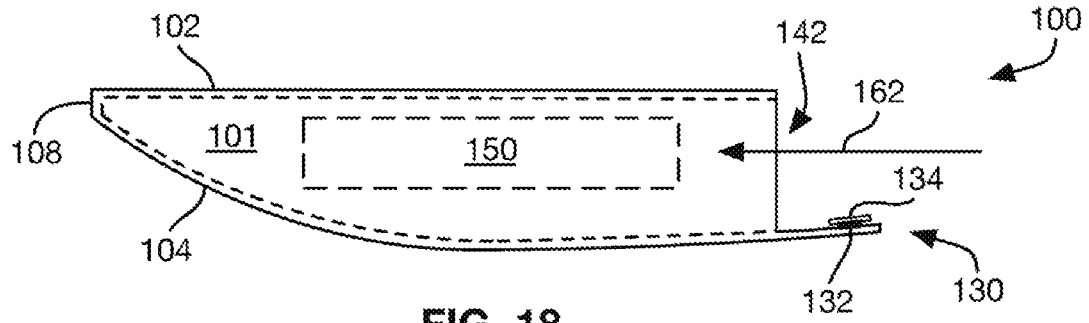
FIG. 18 is a bottom view of the reclosable bag taken of FIG. 17.
Figure 17:
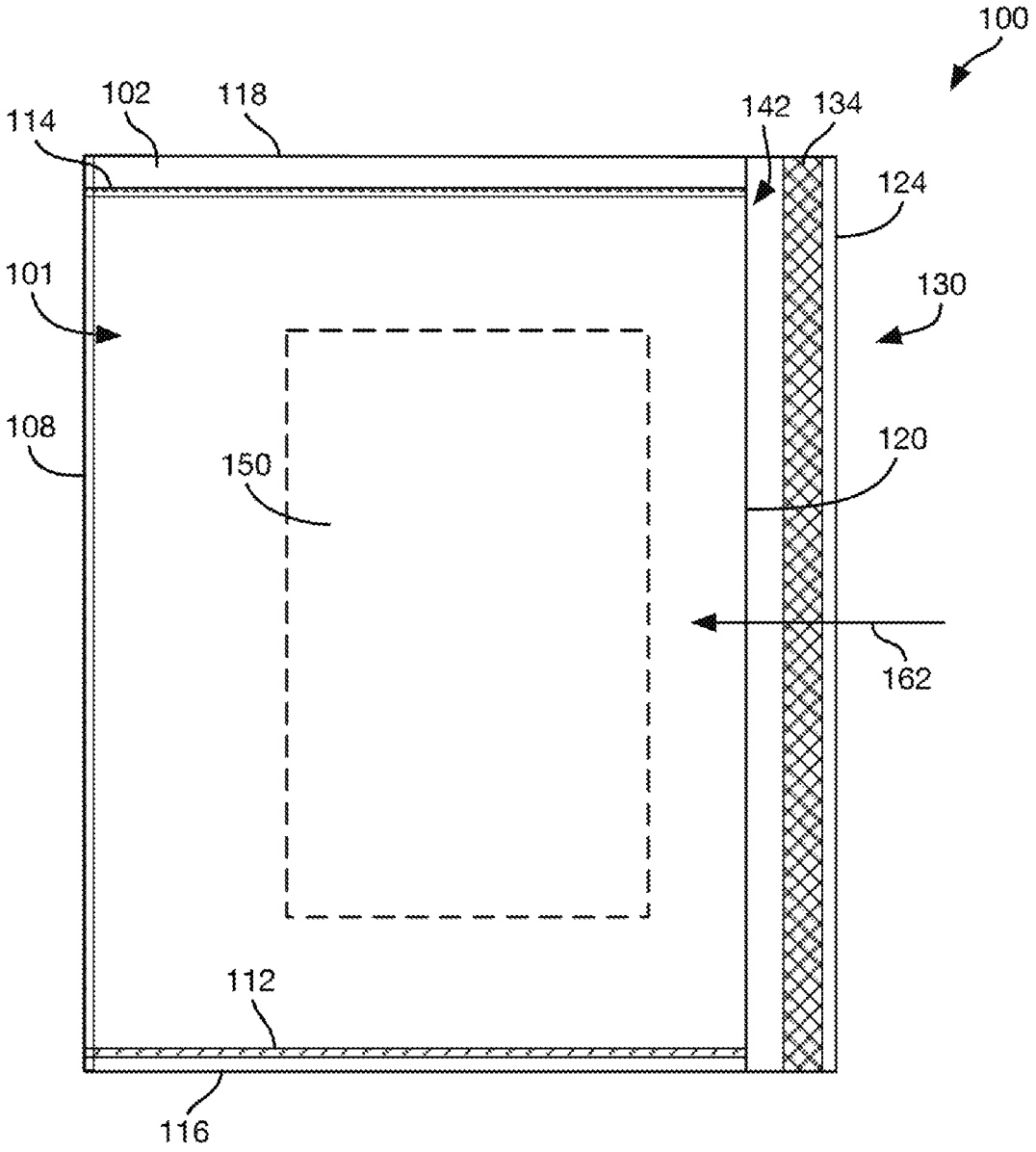
FIG. 17 is a schematic illustration of an exemplary reclosable bag showing a product being loaded into the bag.

The gaps 122 formed between the opening lines of weakness 120, 124, 126 and the top and bottom 116, 118 of the bag 100 form areas of reinforcement 123 to prohibit the openings formed by breaking the opening lines of weakness 120, 124, 126 from extending all the way to the bottom or top 116, 118 of the bag 100 where the seal 112 or closing seal 114 is positioned. These areas of reinforcement 123 make the bag 100 more resistant to damage when the product 150 is being loaded into the compartment 101 via a product retrieval opening 142, as shown in FIGS. 17 and 18. The gaps 122 are not so large, however, so as to prevent a consumer from tearing off the portion of the bag 100 between the opening lines of weakness 120, 124, 126 and the bottom or top 116, 118 of the bag 100 so as to fully open the bag 100, as is described below. In some embodiments, an area of reinforcement is formed only at the bottom 116 or only at the top 118 of the bag 100.

The web 10 includes a reclosing material 132. The reclosing material 132 can be applied to the web 10 in a variety of different ways to facilitate the adherence of a portion of the bag 100 to which the reclosing material 132 is attached to an outer surface of a portion of the bag 100. For example, the reclosing material can be applied in a strip along at least one of the first ply 102 and second ply 104. In the embodiment shown in FIGS. 1 and 2, the reclosing material 132 is applied to a surface of the second ply 104 on the interior of the bag 100. The reclosing material 132 may take a wide variety of different forms. For example, the reclosing material 132 may be an adhesive. In certain embodiments, the reclosing material 132 is a pressure sensitive adhesive. For instance, the reclosing material 132 may be a pressure sensitive adhesive selected from the group consisting of an acrylic based adhesive, a methacrylate based adhesive, a polyurethane based adhesive, a rubber based adhesive, a styrene copolymer based adhesive, a silicone based adhesive, and combinations thereof. However, those with skill in the art will appreciate that various types of adhesives may be utilized so long as the reclosing material 132 permits the portion of the bag 100 to which the reclosing material 132 is attached to adhere to an outer surface of a portion of the bag 100, such as one of the first ply 102 or the second ply 104.

The web 10 includes a release material 134. The release material 134 may be applied to the web 10 in a variety of different ways to cover the reclosing material 132 and thereby prohibit the adhesion of the reclosing material 132 to the web 10 until such adhesion is desirable. For example, as is shown in FIGS. 1 and 2, the release material 134 may be formed in a strip that covers the reclosing material. In some embodiments, the release material may be applied to one of the first and second plies 102, 104 so that the release material 134 is arranged between the reclosing material 132 and the first or second ply 102, 104. That is, in certain embodiments, the reclosing material 132 is applied to the second ply 104 and the release material 134 is applied to the first ply 102. The release material 134 may be printed, laminated, sprayed, or otherwise deposited and/or adhered to one of the first and second plies 102, 104 or onto a strip of material separate from the first and second plies 102, 104. The release material 134 may take a variety of different forms. In certain embodiments, the release material 134 may be a chemical release material selected from the group consisting of polyacrylates, carbamates, polyolefins, fluorocarbons, chromium stearate complexes, silicones, and combinations thereof. In certain embodiments, the selection of the reclosing material 132 and the release material 134 is such that the adhesion between the reclosing material 132 and the release material 134 is strong enough to prevent unintentional separation during transit. For example, when the reclosing material 132 and the release material 134 are in releasable adhesive communication, the adhesion may be characterized as having a peel strength of 1 N/cm to 5 N/cm to separate the reclosing material 132 from the release material 134.

The exemplary web 10 and bags 100 shown in FIGS. 1-32 include first and second opening lines of weakness 120, 124 in the first ply 102 and the third opening line of weakness 126 in the second ply 104, the third opening line of weakness 126 being aligned with the second opening line of weakness 124 in the illustrated example. The reclosing material 132 is applied to the second ply 104 between the first and second opening lines of weakness 120, 124 and the releasing material 134 is provided as a strip of material or tape that covers and releasably adheres to the reclosing material.

Figure 4:
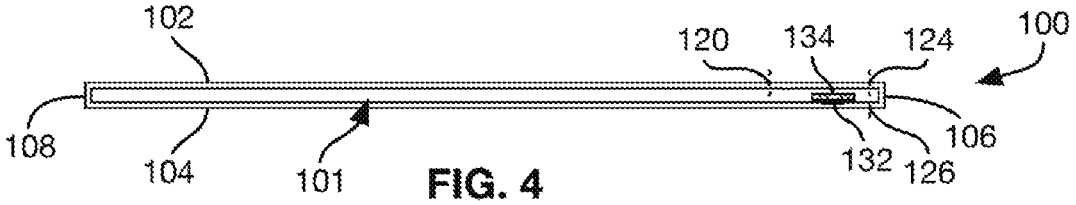
FIG. 4 is a view of the reclosable bag taken along line A-A in FIG. 3.
Figure 3:
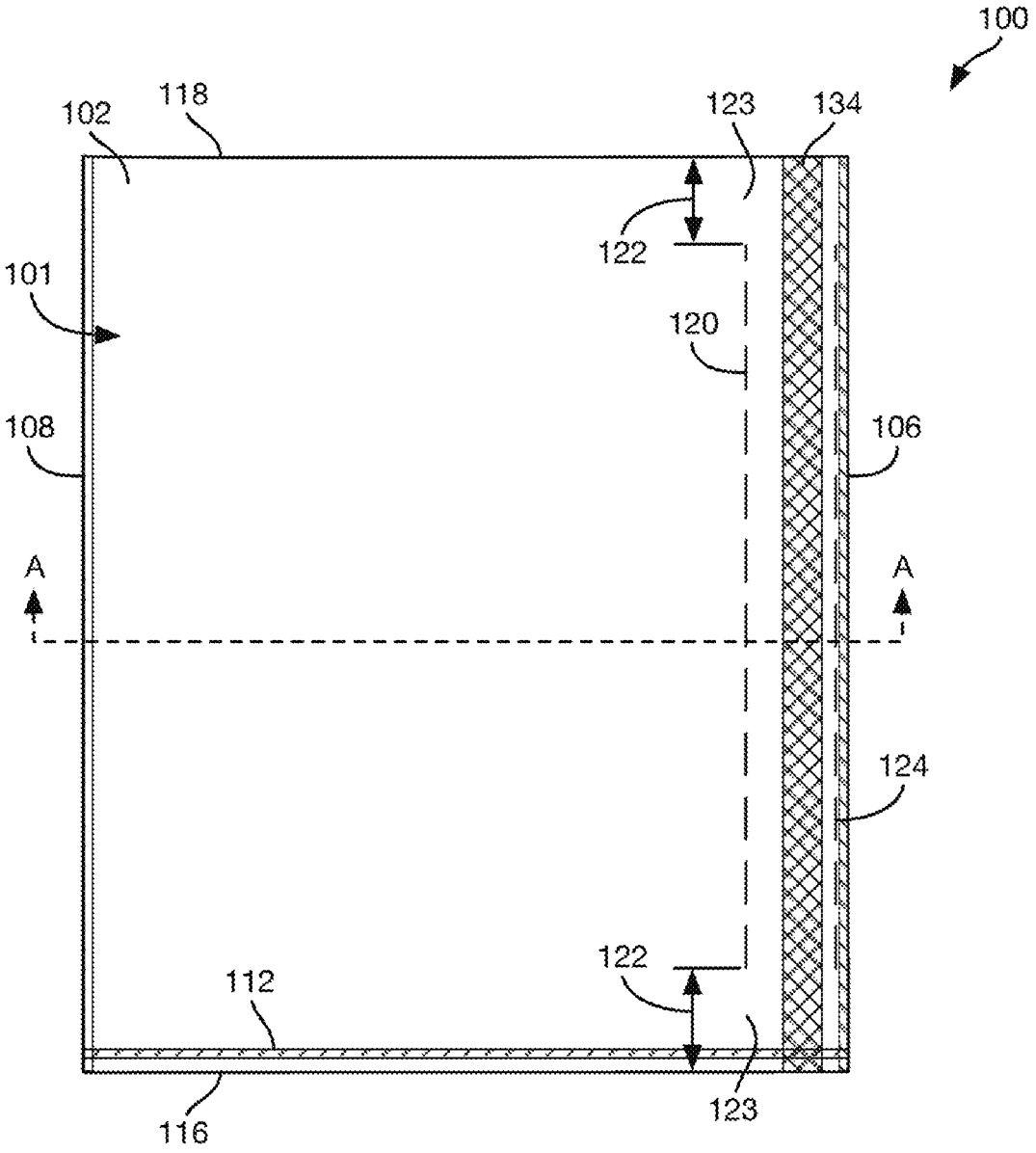
FIG. 3 is a schematic illustration of an exemplary reclosable bag.
Figure 6:
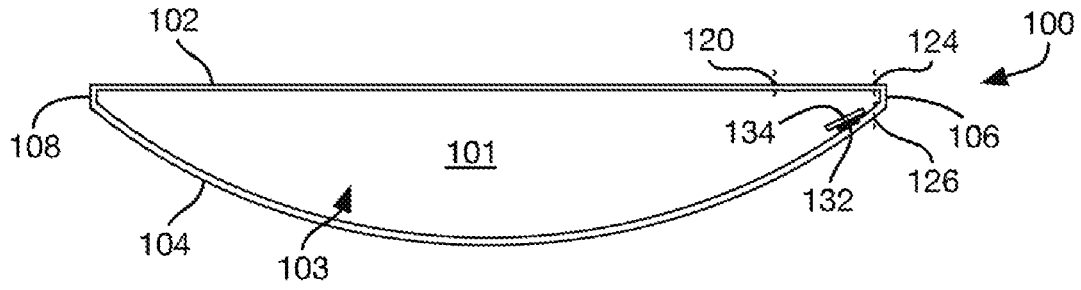
FIG. 6 is a view of the reclosable bag taken along line A-A in FIG. 5.
Figure 5:
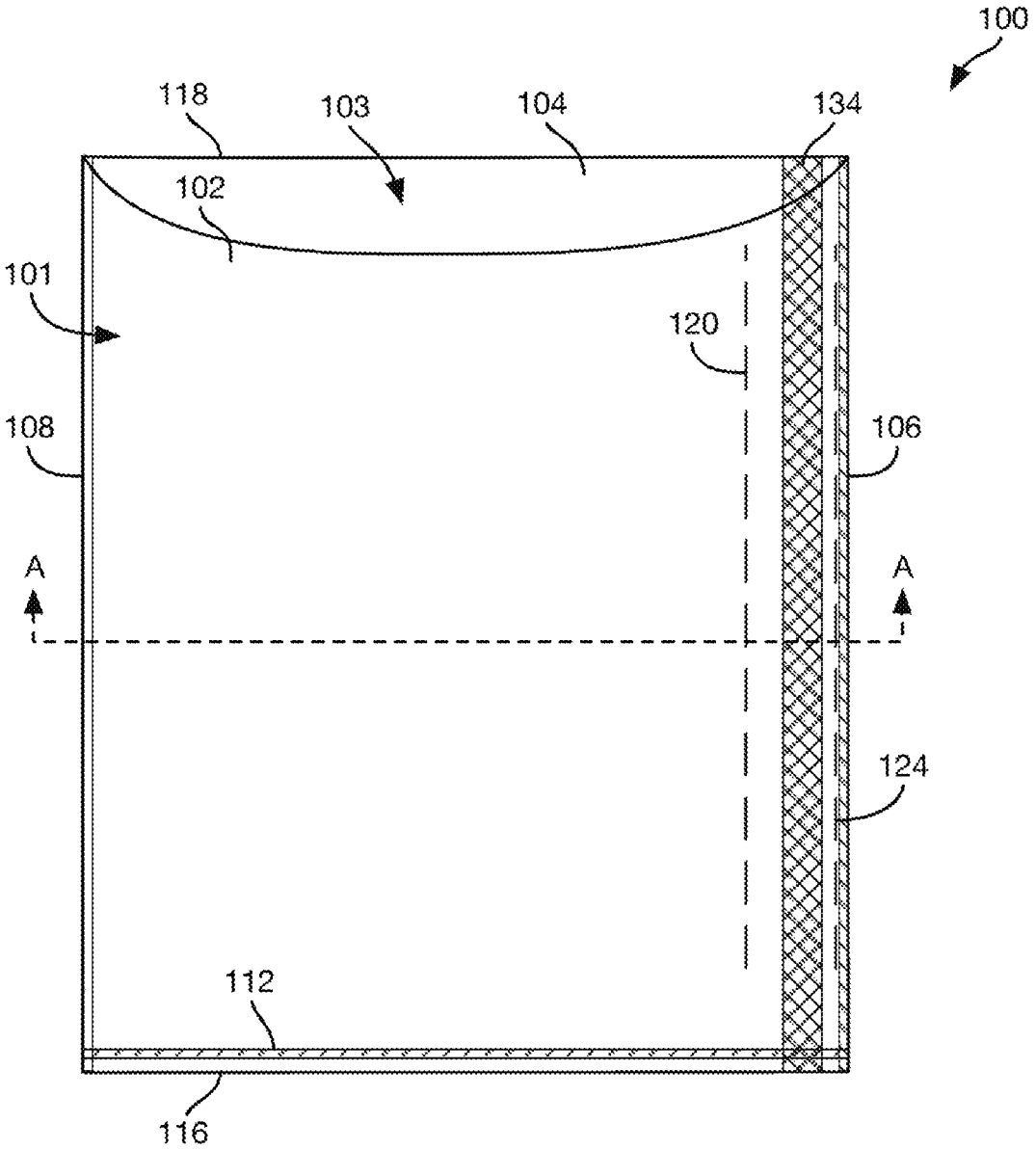
FIG. 5 is a schematic illustration of an exemplary reclosable bag showing an opening for receiving a product.
Figure 8:
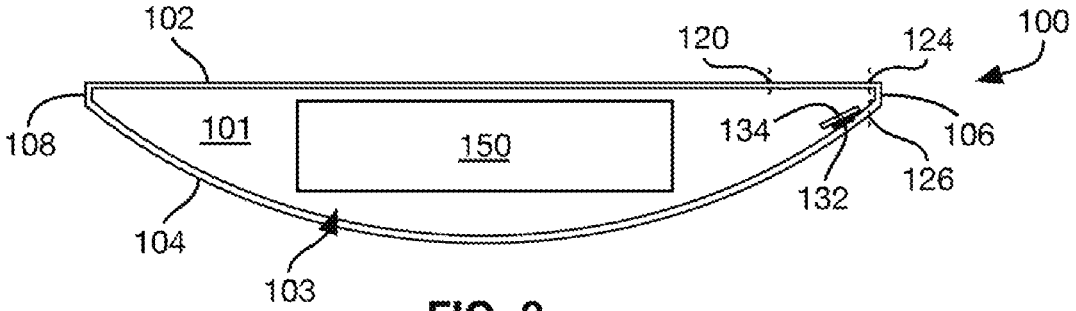
FIG. 8 is a view of the reclosable bag taken along line A-A in FIG. 8.
Figure 7:
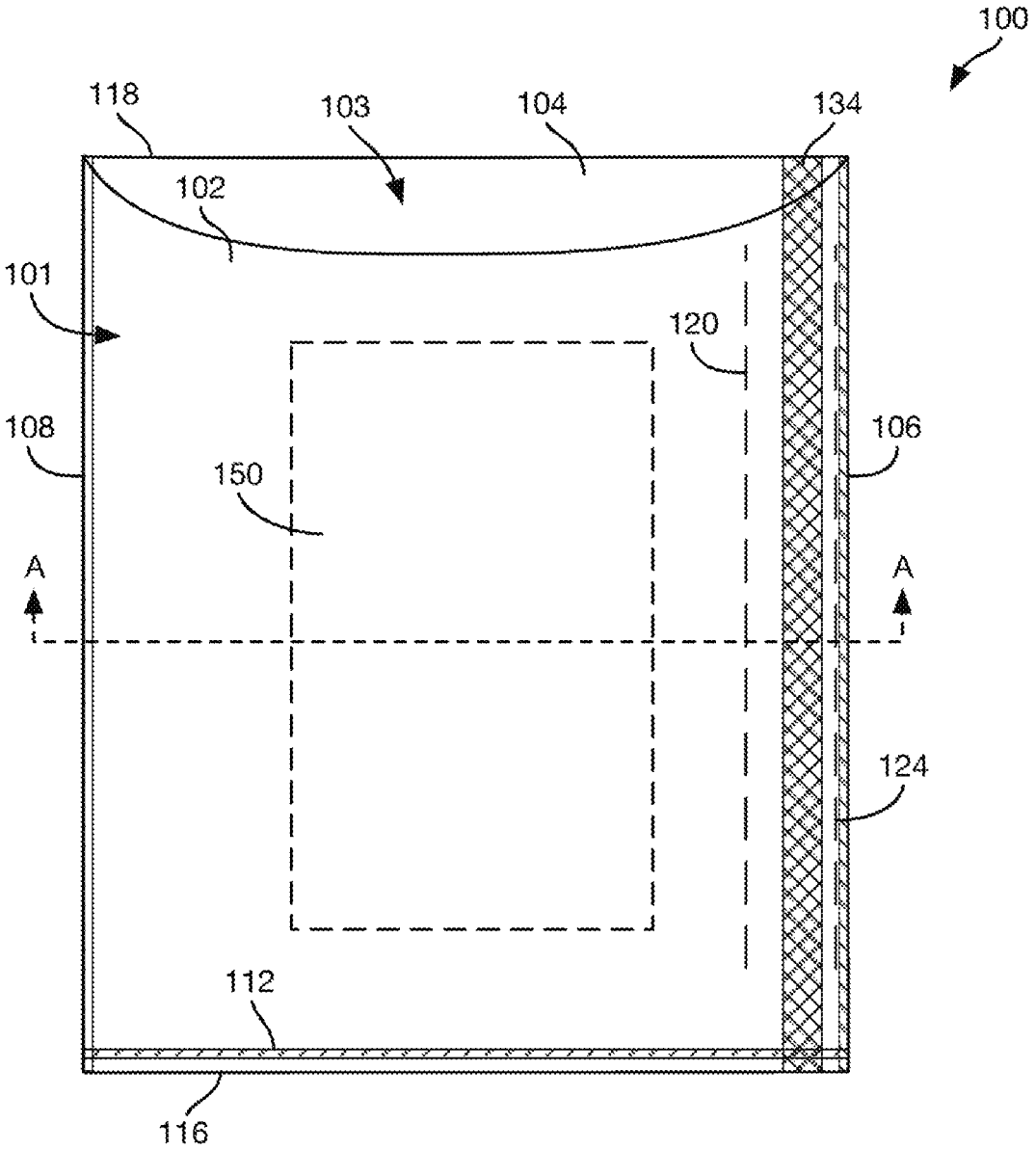
FIG. 7 is a schematic illustration of an exemplary reclosable bag with a product loaded into the bag.

Referring now to FIGS. 3 and 4, one bag 100 is shown removed from the web 10 by breaking two adjacent separating lines of weakness 100 in the web 10. The bag 100 extends from a bottom edge 116 formed by one of the broken separating lines of weakness 110 to a top edge 118 formed by the adjacent line of weakness 110 broken to separate the bag 100. The bag 100 is closed on three sides: the side edges 106, 108 and the bottom edge 116, which is closed by the seal 112. The bag 100 can be opened at the top edge 118 by separating the first and second plies 102, 104, as is shown in FIGS. 5 and 6. Separating the first and second plies 102, 104 to open the bag 100 forms a product receiving opening 103 which allows the product 150 to be loaded into the compartment 101 of the bag 100, as can be seen in FIGS. 7 and 8. In some embodiments, the separating lines of weakness 110 in one or both of the plies 102, 104 do not extend fully to the sides 106, 108 of the web 10 to provide reinforcement during opening of and loading the product 150 through the product receiving opening 103. In certain embodiments, additional reinforcement of the product receiving opening 103 is desirable to prevent tearing of the separating lines of weakness 110 while the product 150 is loaded by a bagging machine, such as the machine taught in US Published Application Pub. No. 2016/0325866, which is incorporated herein by reference in its entirety.

Figure 10:
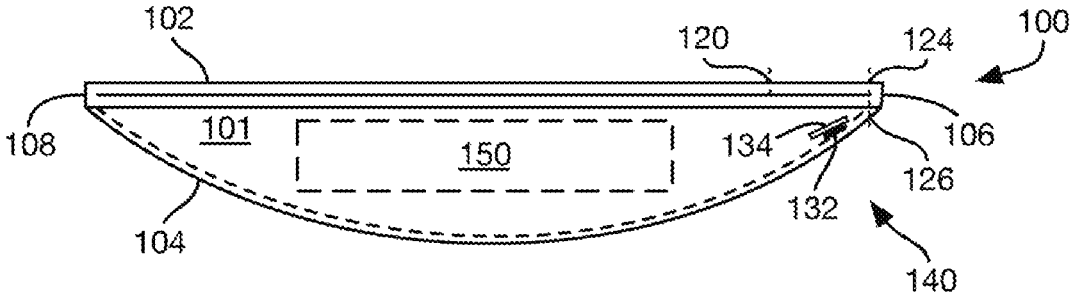
FIG. 10 is a bottom view of the reclosable bag of FIG. 9.
Figure 9:
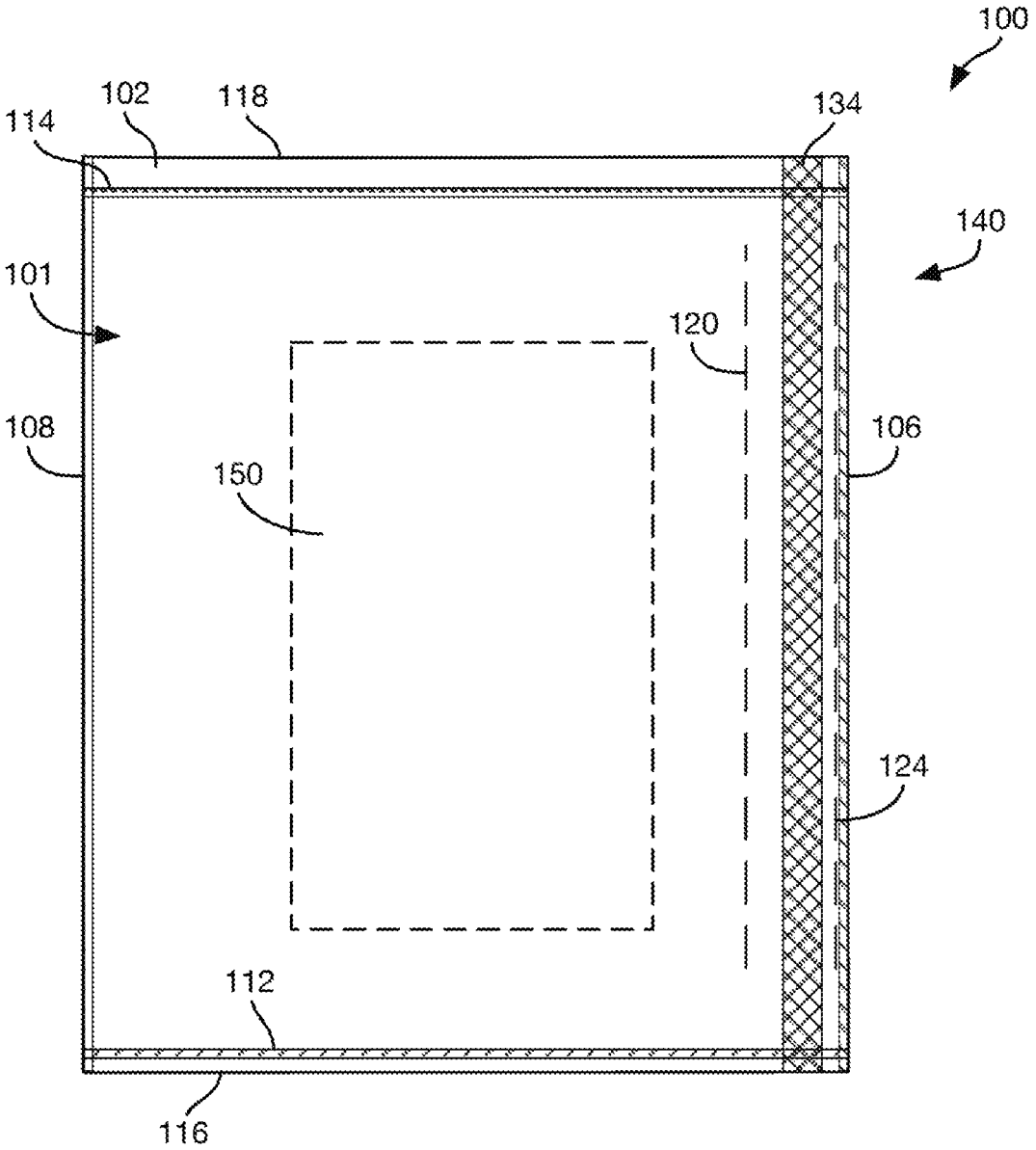
FIG. 9 is a schematic illustration of an exemplary reclosable bag containing a product.

As is shown in FIGS. 9 and 10, once the product 150 is loaded into the bag 100, the bag 100 is sealed near the top 118 with a closing seal 114 that extends from the first side 106 to the second side 108 to seal the compartment 101. In some embodiments, the closing seal 114 may not extend all the way from the first side 106 to the second side 108 or may be intermittent to allow communication between the compartment 101 and external air or the compartment 101 and another optional compartment of the reclosable bag 100. In certain embodiments, the seal 114 may be formed by various techniques including, but not limited to, heat sealing, ultrasonic welding, gluing, etc. Virtually any type of product 150 may be loaded into the reclosable bag 100 for delivery to a consumer. Examples of packaging machines that may be used to form the seal 114 are disclosed by U.S. Pat. Nos. 7,654,064; 8,069,635; and 5,743,070, and in US Published Application Pub. No. 2016/0325866 as is described in more detail below. U.S. Pat. Nos. 7,654,064; 8,069,635; and 5,743,070 are incorporated herein by reference in their entirety.

When the reclosable bag 100 containing a product 150 is received, the consumer may open the reclosable bag 101 to retrieve the product 150. Access to the product 150 is provided by a bag opening zone 140, which is configured to be broken or otherwise opened to create a product retrieval opening 142 to permit retrieval of the product 150 from the compartment 101. The bag opening zone 140 includes one or more of the opening lines of weakness 120, 124, 126 that can be broken to form the product retrieval opening 142.

Figure 12:
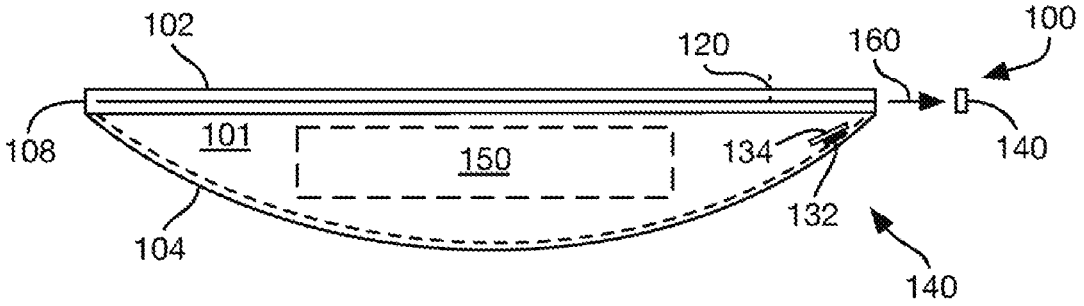
FIG. 12 is a bottom view of the reclosable bag taken of FIG. 11.
Figure 11:
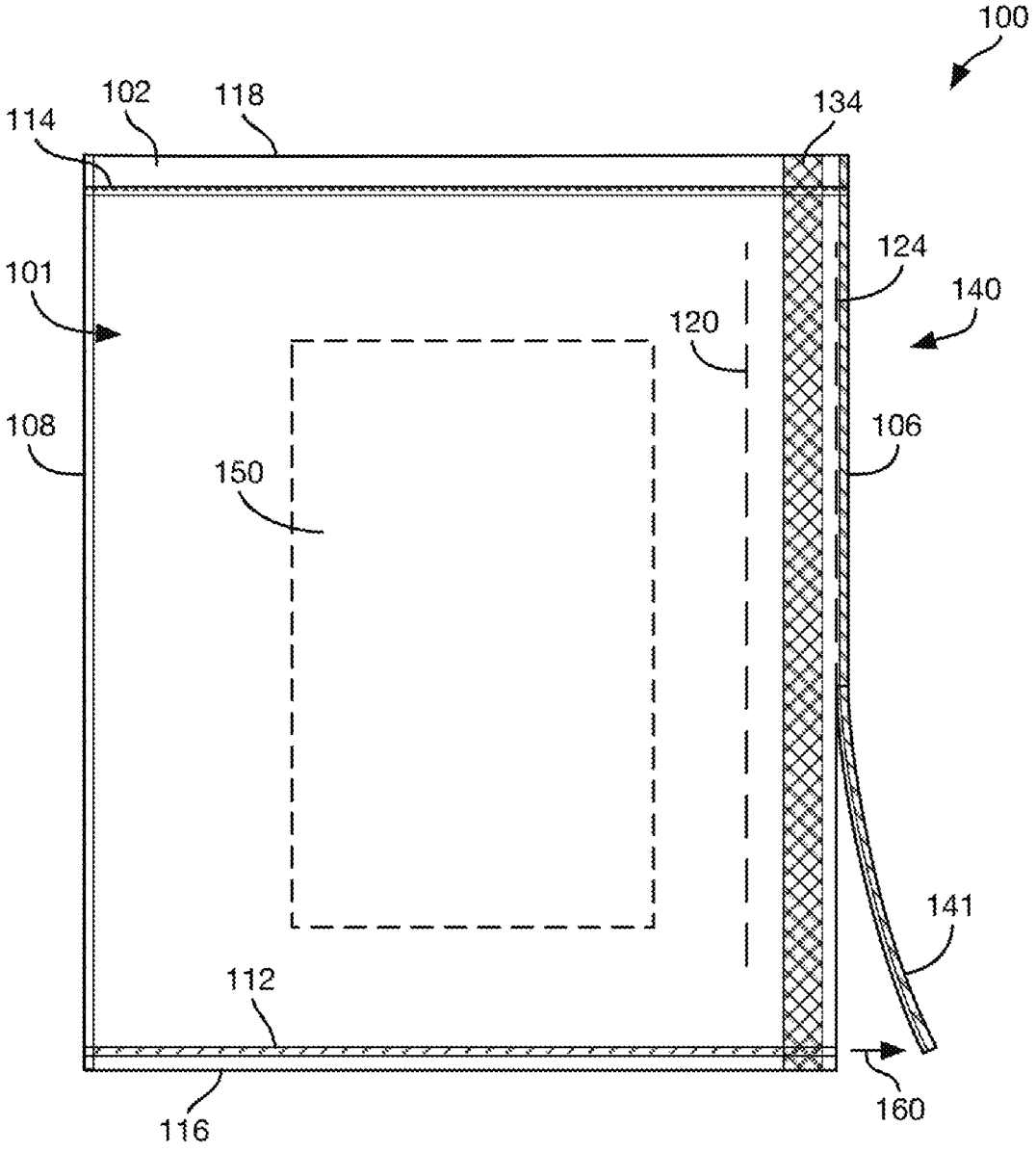
FIG. 11 is a schematic illustration of an exemplary reclosable bag showing an opening for retrieving a product.
Figure 14:
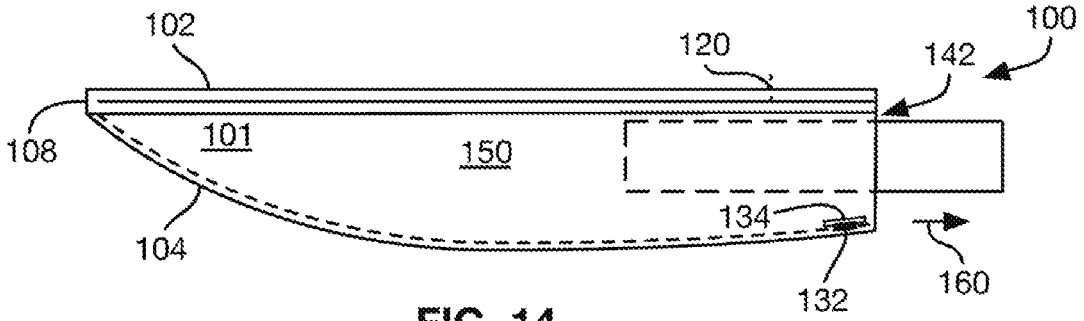
FIG. 14 is a bottom view of the reclosable bag of FIG. 13.
Figure 13:
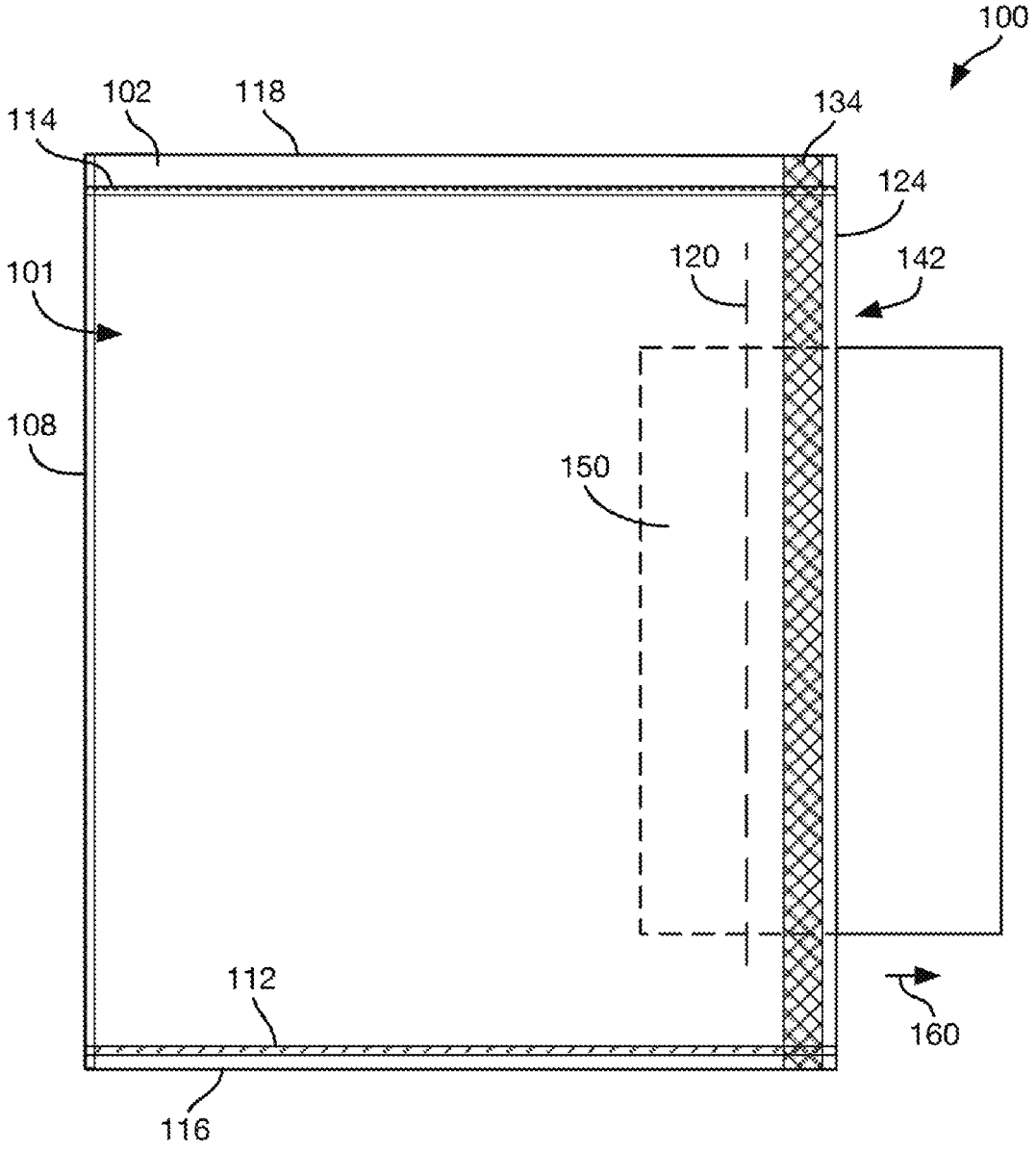
FIG. 13 is a schematic illustration of an exemplary reclosable bag showing a product being removed through an opening.

In the embodiment illustrated in FIGS. 11 and 12, the second and third opening lines of weakness 124, 126 are broken in the bag opening zone 140 to open the bag 100. Breaking the second and third opening lines of weakness 124, 126 creates a strip of material 141 from portions of the first and second plies 102, 104 between the first side 106 of the bag 100 and the second and third opening lines of weakness 124, 126. The strip of material 141 is torn away from the bag 100 in the opening direction 160 by breaking the second and third lines of weakness 124, 126 along the length of the bag 100 from the bottom 116 to the top 118, or vice versa. In some embodiments, only one of the second or third opening lines of weakness 124, 126 are broken in the bag opening zone 140 to form the product retrieval opening 142. Alternatively, the first opening line of weakness 120 can be broken to form the product retrieval opening 142. In certain embodiments, the bag opening zone 140 may extend from the bottom 116 to the top 118 of the bag 100 to provide a larger product retrieval opening 142, while in other embodiments the bag opening zone 140 may be intermittent to provide a plurality of openings that provide access to a plurality of compartments. Once the bag 100 has been opened by the removal of the strip of material 141, the product 150 can be removed by the consumer as seen in FIGS. 13 and 14.

The bag opening zone 140 can take a wide variety of different forms. For example, the bag opening zone 140 may be defined by one or more lines or areas of weakness, an indicia that indicates where the bag 100 should be cut to open the bag 100, an adhesive, an openable connection, etc. Any arrangement that secures the product 150 in the bag 100 during transit, but allows the consumer to easily open the bag 100 can be employed. A line or area of weakness may be a line or lines of perforations through a portion of the bag 100, a score line or lines that weaken a portion of the bag 100 along a line or area, or other processing known in the art that weakens a portion of the bag 100 to allow the bag 100 to be opened.

Referring now to FIGS. 15-24, after the consumer retrieves the product 150 from the compartment 101, the consumer may inspect the product 150. Upon inspection, the consumer may determine that the product 150 is defective, or the consumer may decide that they do not want or do not need the product 150. The reclosable bag 100 allows the consumer to return the product 150 to the seller without having to utilize any additional packaging materials (e.g., packaging tape) and while generating minimal waste. As seen in FIGS. 17 and 18, the product retrieval opening 142 is configured to allow the product 150 to be returned to the compartment 101 through the product retrieval opening 142 in the loading direction 162. In the illustrated embodiment, the product 150 is returned to the compartment 101 at an opening (i.e., the product retrieval opening 142) that is different from the opening (i.e., the product receiving opening 103) through which the product 150 was originally loaded into the compartment 101.

Figure 16:
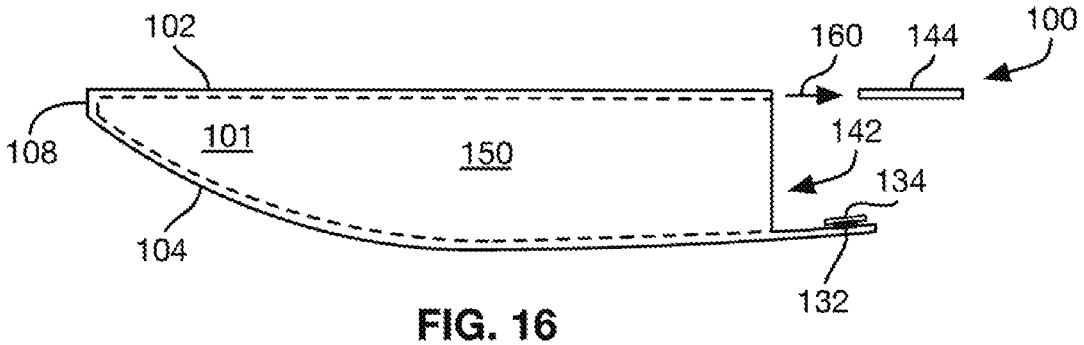
FIG. 16 is a bottom view of the reclosable bag of FIG. 15.
Figure 15:
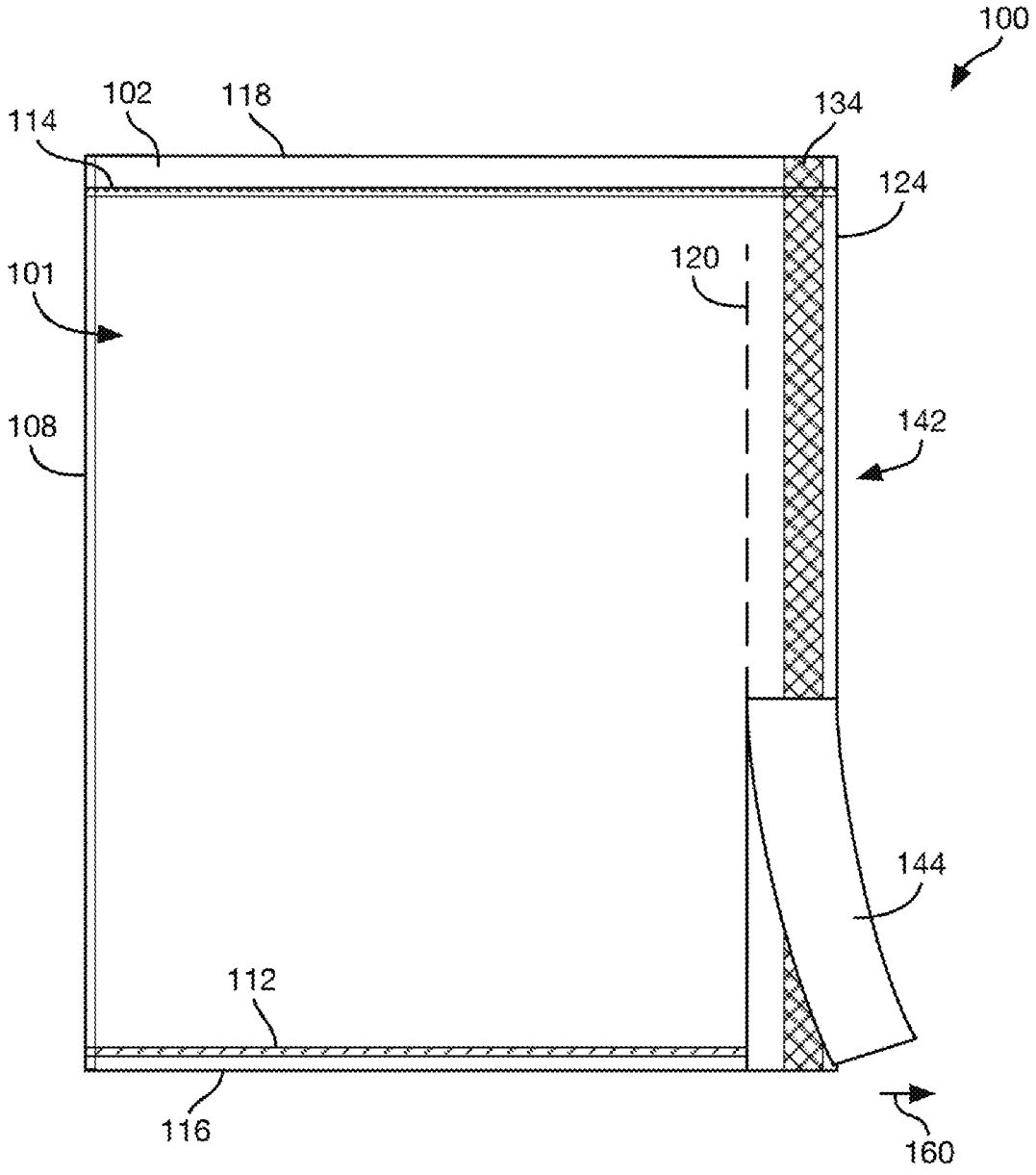
FIG. 15 is a schematic illustration of an exemplary reclosable bag showing a reclosing flap being formed.

Referring to FIGS. 15 and 16, the reclosing flap 130 is exposed by removing a strip of material 144 between the first opening line of weakness 120 and the second opening line of weakness 124. The reclosing flap 130 can be formed before or after the product 150 has been returned to the compartment 101. The reclosing flap 130 can be formed from portions of the first ply 102 and/or the second ply 104. In some embodiments, the reclosing flap 130 is formed from only one of the first and second plies 102, 104. In certain embodiments, the reclosing flap 130 is formed when the bag 100 is opened along the first opening line of weakness 120 to create the product retrieval opening 142.

Figure 20:
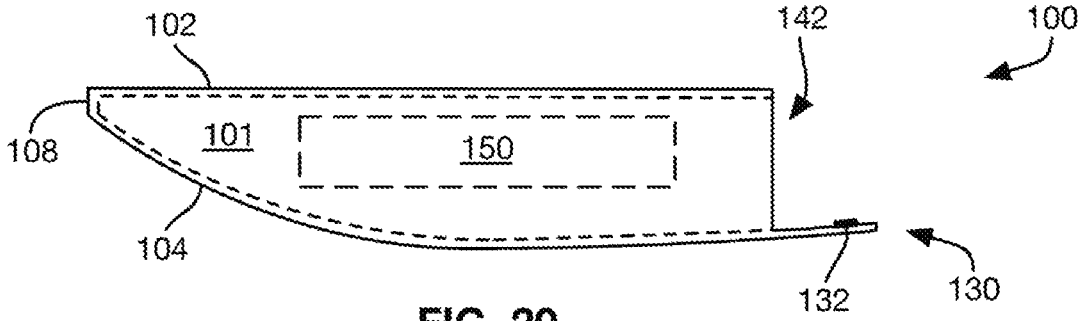
FIG. 20 is a bottom view of the reclosable bag of FIG. 19.
Figure 19:
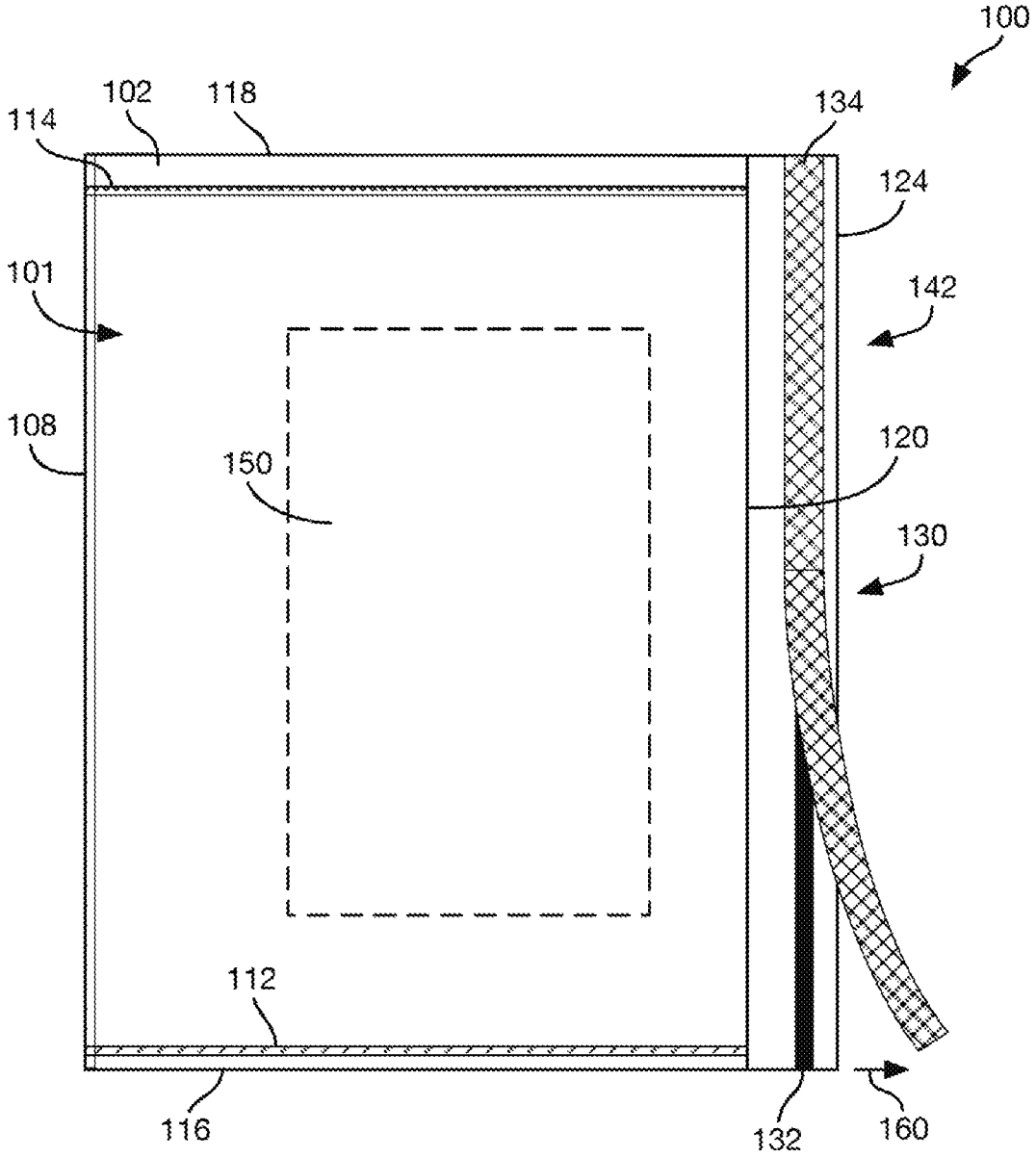
FIG. 19 is a schematic illustration of an exemplary reclosable bag showing a release material being removed.
Figure 22:
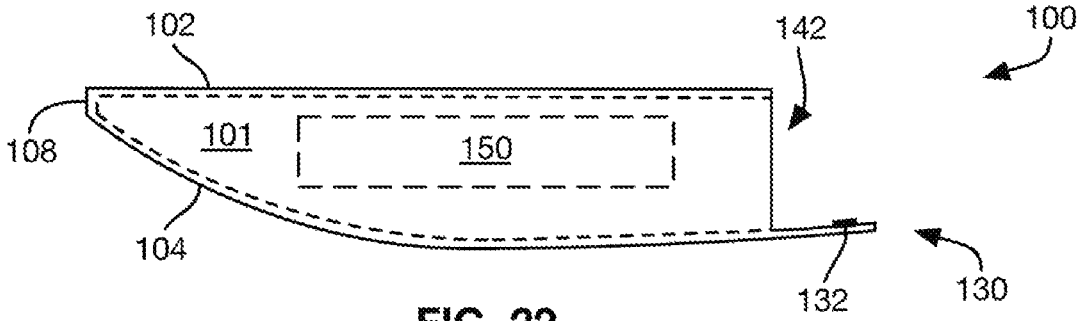
FIG. 22 is a bottom view of the reclosable bag of FIG. 21.
Figure 21:
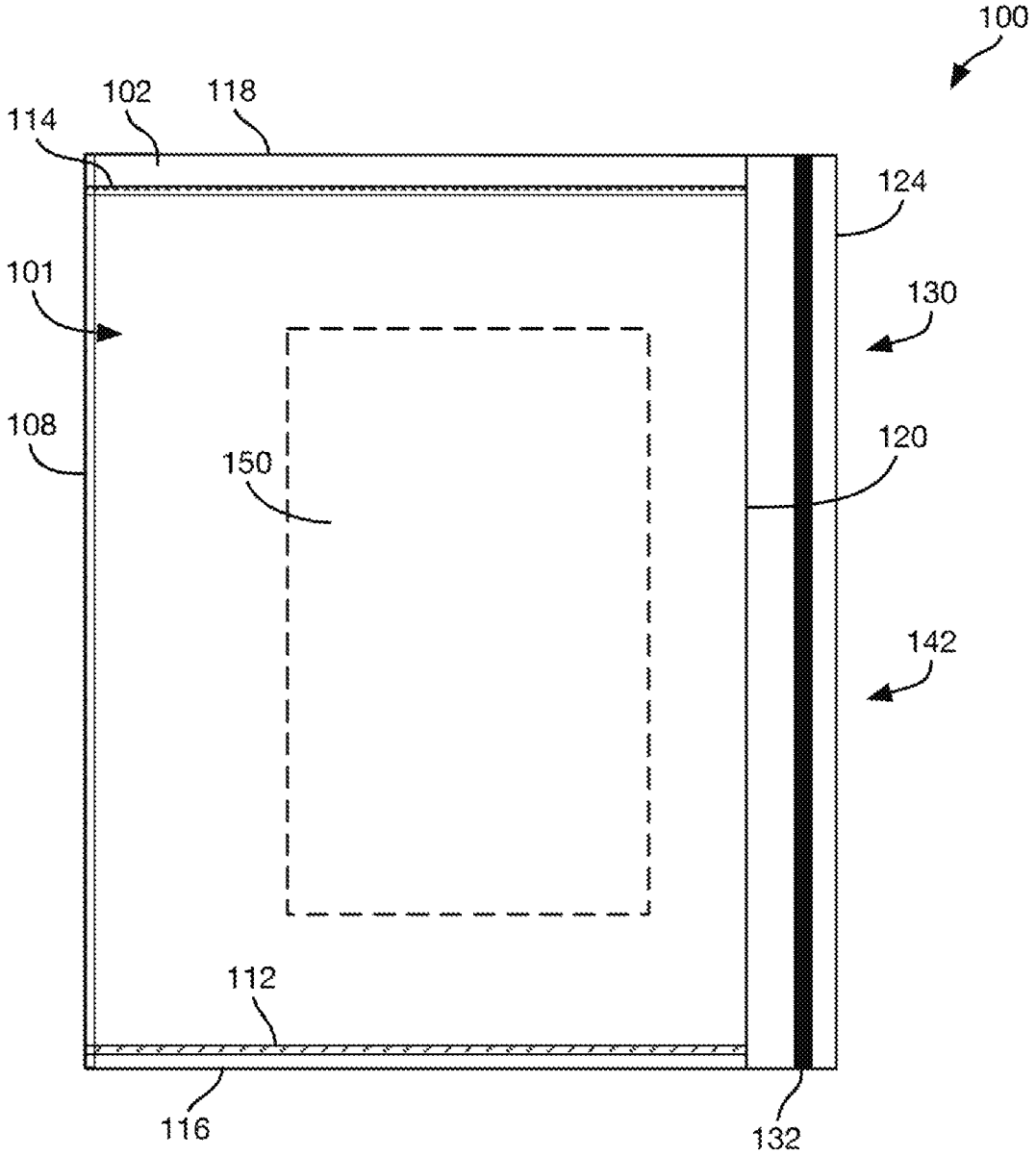
FIG. 21 is a schematic illustration of an exemplary reclosable bag showing a reclosing flap with reclosing material exposed.

As is shown in FIGS. 17 and 18, the reclosing flap 130 is in a passive position where the reclosing material 132 is releasably adhered to the release material 134. The release material 134 is removed from the reclosing material 132 by pulling the strip of release material 134 in the removal direction 160, as shown in FIGS. 19 and 20, so that the reclosing material 132 is exposed, as shown in FIGS. 21 and 22. In some embodiments, the release material 134 is formed on the strip of material 144 so that the reclosing material 132 is exposed when the strip of material 144 is removed to form the reclosing flap 130.

Figure 24:
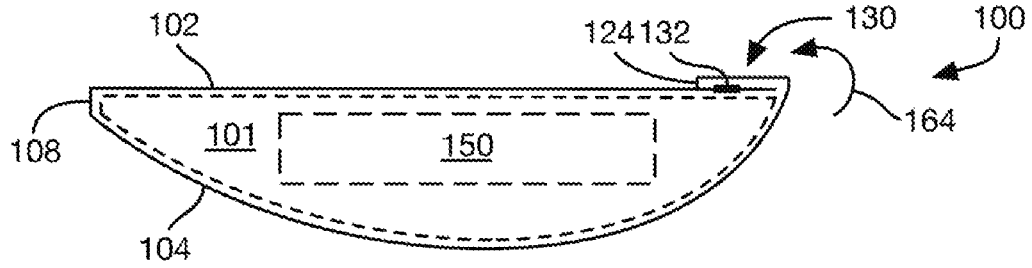
FIG. 24 is a bottom view of the reclosable bag of FIG. 23.
Figure 23:
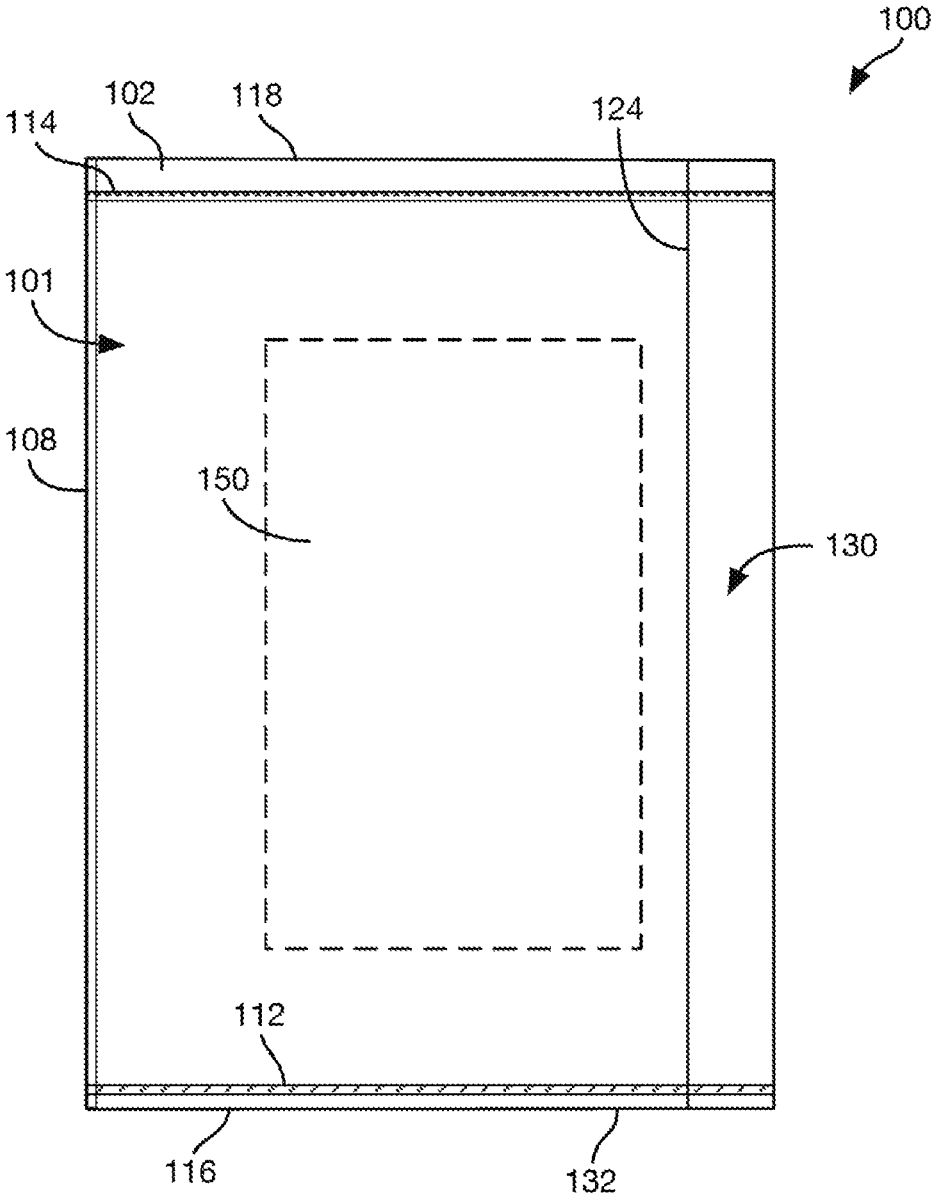
FIG. 23 is a schematic illustration of an exemplary reclosable bag showing the bag reclosed.

With the reclosing material 132 exposed, the reclosing flap 130 can be moved from the passive position to the active or closed position by folding the reclosing flap 130 in a folding direction 164 to bring the reclosing material 132 into contact with and adherence to a portion of the bag 100, such as an outer surface of the bag 100, as shown in FIGS. 23 and 24. After the reclosing flap 130 is moved to the closed position, the product retrieval opening 142 is covered to reclose the compartment 101 with the product 150 retained therein, as seen in FIGS. 23 and 24. Now that the product 150 is within the compartment 101 and the compartment 101 has been reclosed, the consumer may return the product 150 to the seller by mail or courier service.

Figure 26:
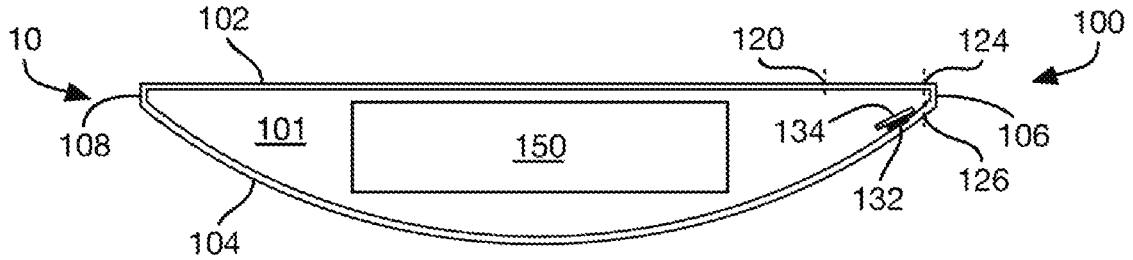
FIG. 26 is a view of the web of reclosable bags taken along line A-A in FIG. 25.
Figure 25:
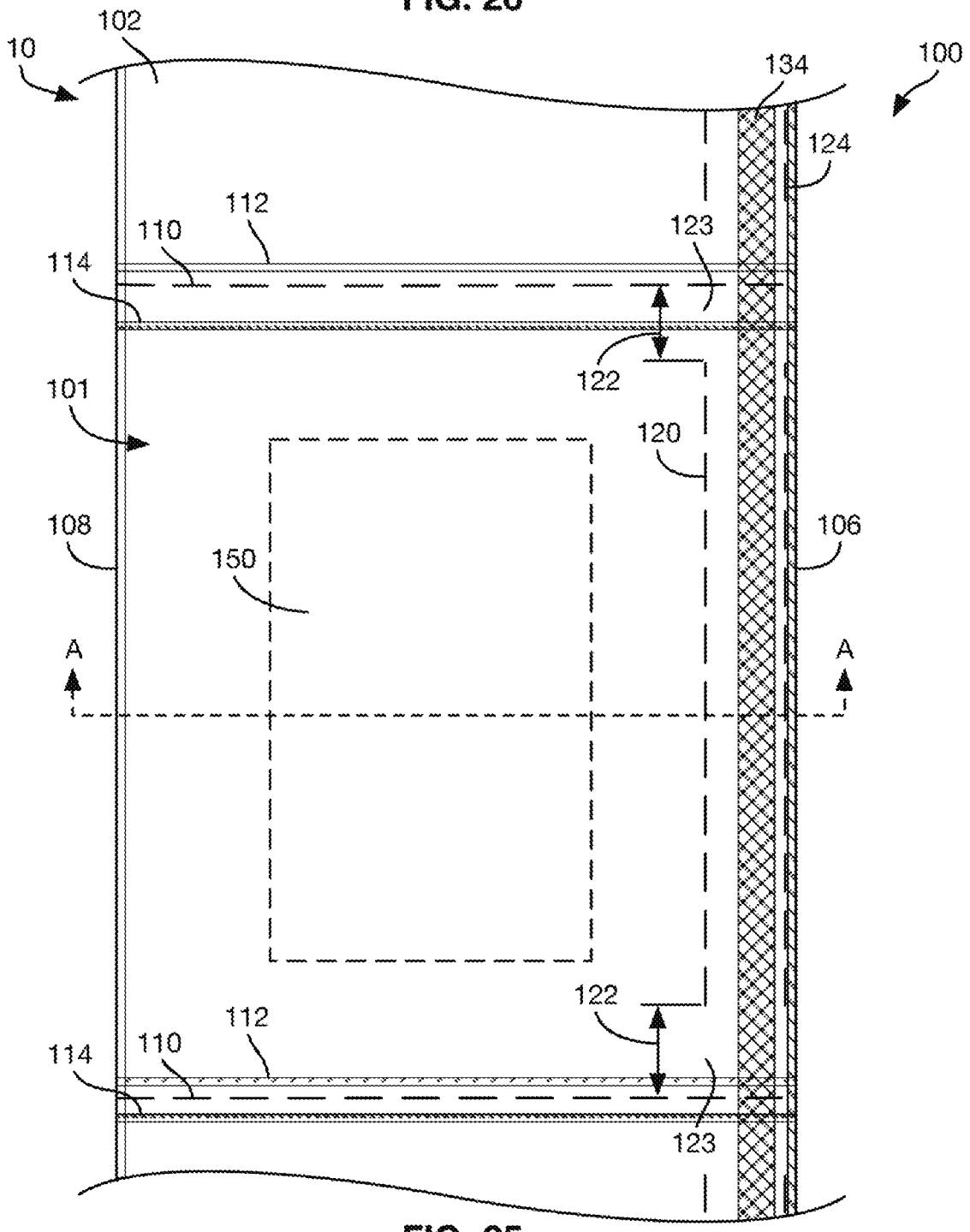
FIG. 25 is a schematic illustration of an exemplary web of reclosable bags with a product loaded in a bag.
Figure 28:
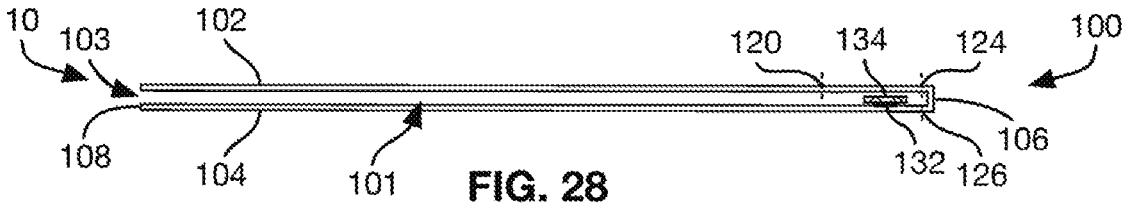
Figure 27:
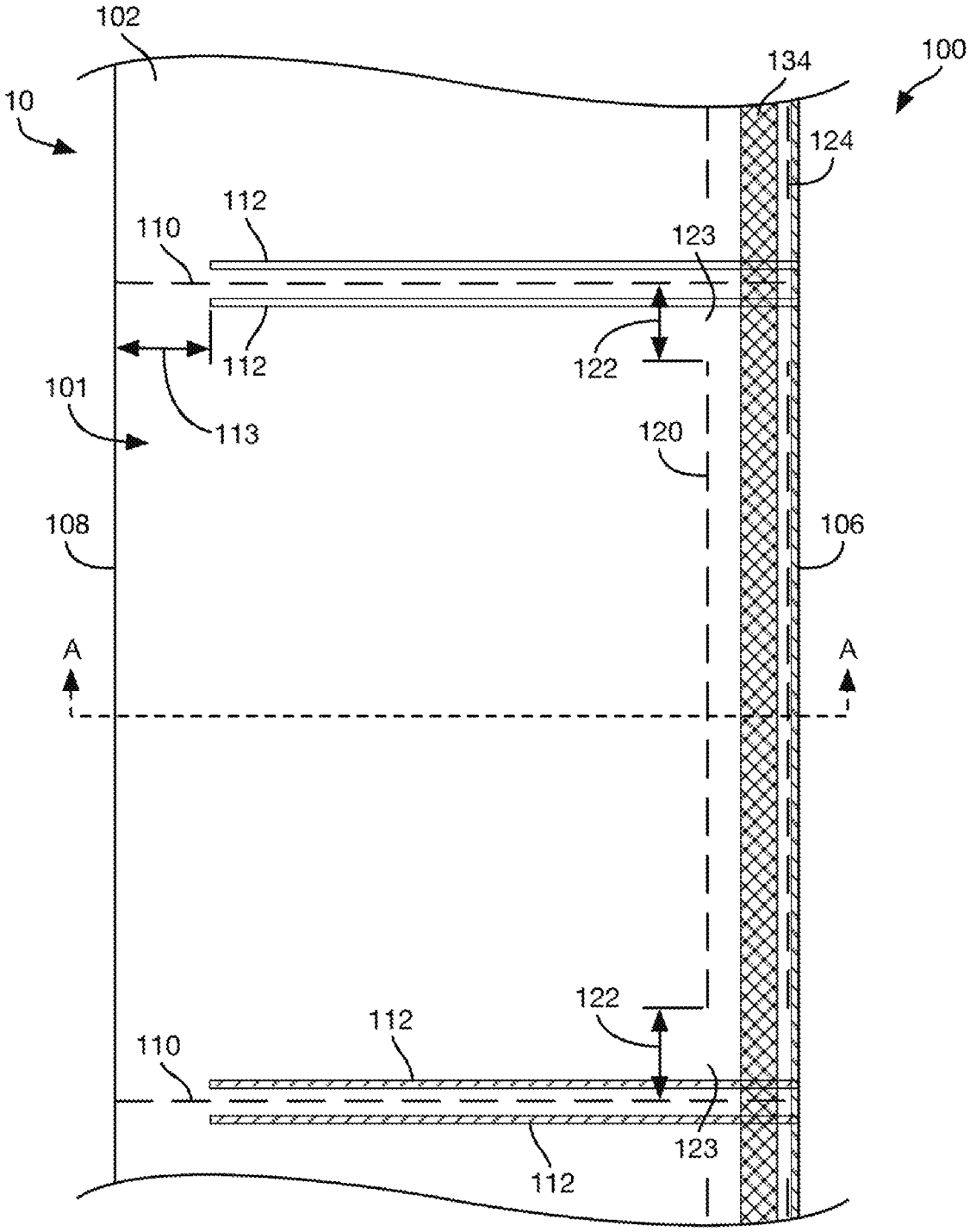
FIG. 27 is a schematic illustration of an exemplary web of reclosable bags.
Figure 30:
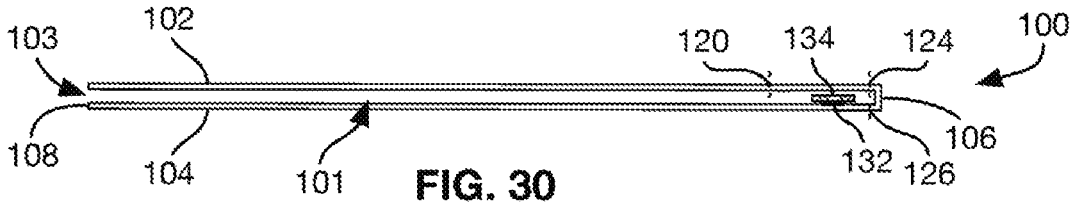
FIG. 30 is a view of the reclosable bag taken along line A-A in FIG. 29.
Figure 29:
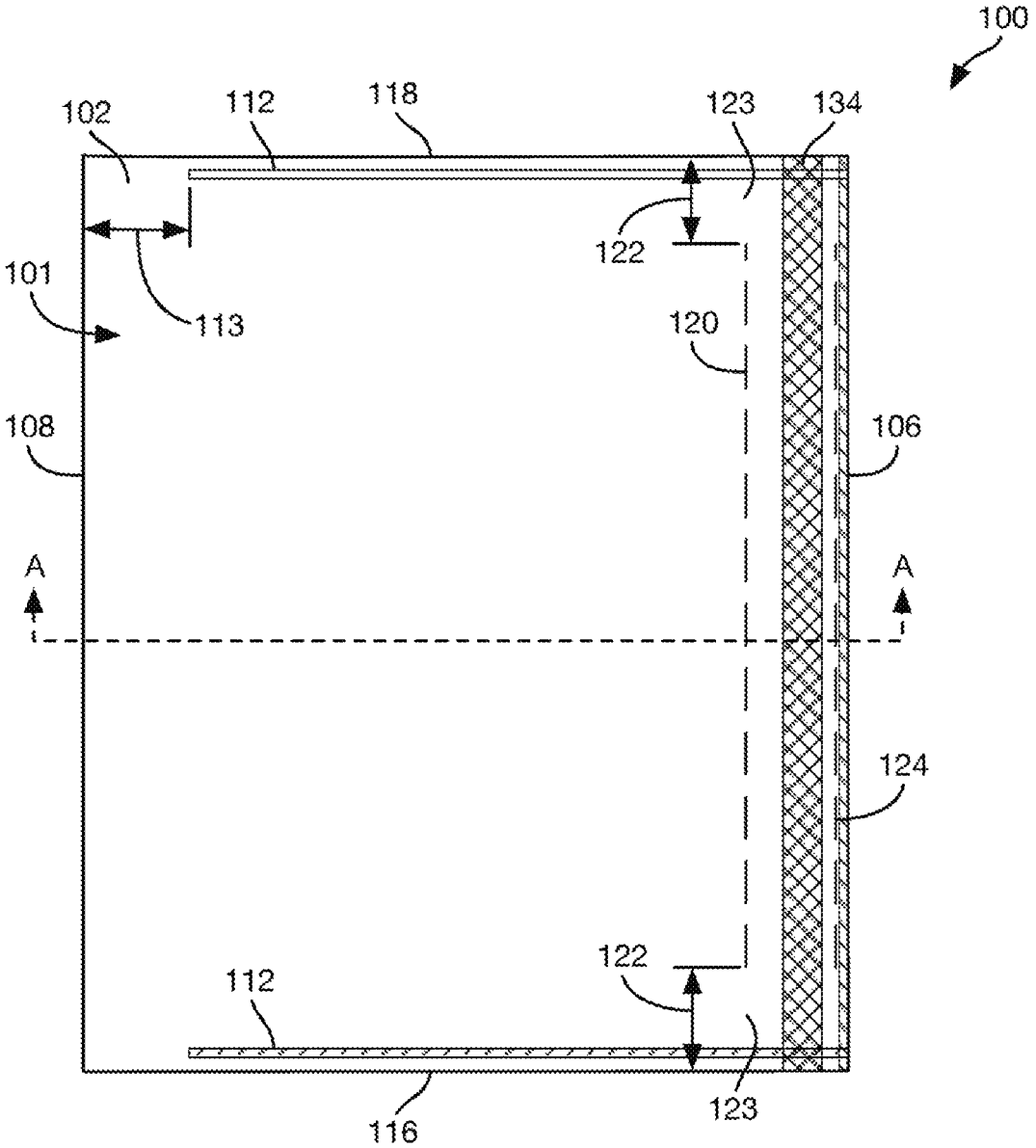
FIG. 29 is a schematic illustration of an exemplary reclosable bag.

FIGS. 25 and 26 illustrate an exemplary embodiment where the bags 100 are configured to be loaded and sealed with the type of machine described in in US Published Application Pub. No. 2016/0325866, U.S. Pat. No. 7,654,064, for example. However, any type of machine may be used to load the bags 100. In FIGS. 25 and 26 an exemplary web 10 of reclosable bags 100 is shown with the product 150 loaded into and sealed within the compartment 101 while one or more of the loaded bags 100 remaining connected in the web 10. This is accomplished by opening the bag 100, such as, for example, by breaking one of the separating lines of weakness 110 in only the first ply 102 so that the plies 102, 104 can be spread apart to form the product receiving opening 103, similar to what is shown in FIGS. 5-8 (or one layer 104 can be pre-cut at the opening while the other layer 102 has a line of weakness at the opening). In some embodiments, an additional cut or line of weakness (not shown) is formed in the first ply 102 to provide for the product receiving opening 103. Once formed, the product receiving opening 103 is held open so that the product 150 can be loaded into the compartment 101. In some embodiments, fingers of a bagging machine are inserted into the product receiving opening 103 and then spread apart. Air may also be blown toward the product receiving opening 103 to inflate the compartment 101 and keep the product receiving opening 103 open to receive the product 150.

Once the product 150 is loaded into the compartment 101, the closing seal 114 is formed across the bag 100 to seal the product within, as is shown in FIG. 25. The bags 100 can then be removed from the web 10 for shipment to the consumer. Once received, the bags 100 of the web 10 shown in FIGS. 25 and 26 are opened and reclosed in the same way as the bags 100 shown in FIGS. 11-24.

FIGS. 27-32 illustrate an exemplary embodiment where the bags 100 are configured to be loaded and sealed with the type of machine described in in U.S. Pat. No. 5,743,070, for example. However, any type of machine may be used to load and seal the bags 100. In the example illustrated by FIGS. 27-32, an exemplary web 10 of reclosable bags 100 is shown that is open on the second side 108 to enable side-loading of the product 150 into the bag 100. That is, the bags 100 are loaded with the product 150 from the second side 108 which is opposite the reclosing flap 130 that can be formed at the first side 106, rather than the top 118 of the bag 100, which is the side of the bag 100 adjacent the second side 108. To accomplish this, as is shown in FIGS. 27-30, the first and second plies 102, 104 are not connected at the second side 108 and seals 112 are formed near the bottom 116 and the top 118 of the bag 100. Thus, the product receiving opening 103 is formed in the second side 108. The first ply 102, second ply 104, first side 106, and seals 112 define the compartment 101 for receiving the product 150 (e.g., FIG. 31). In some embodiments, the seals 112 extend from the first side 106 to a distance 113 from the second side 108, thereby providing portions of the first and second plies 102, 104 that can be engaged and held by a packaging machine (not shown) for loading the product 150 into the bags 100 without removing the bags 100 from the web 10, similar to the web 10 of bags 100 shown in FIGS. 25 and 26. In certain embodiments, the product receiving opening 103 is oriented in an upward direction for easier loading of the bags 100 while on the web 10; that is, the web 10 shown in FIGS. 27-32 may be re-oriented 90 degrees clockwise so that the web 10 extends from left to right.

Figure 32:
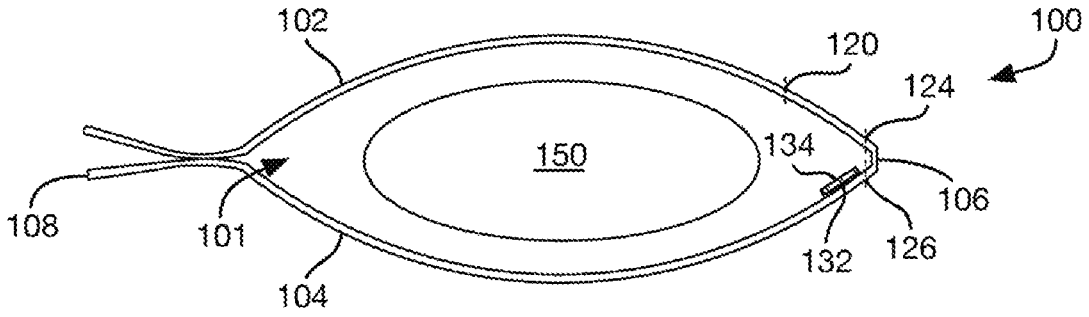
FIG. 32 is a view of the reclosable bag taken along line A-A in FIG. 31.
Figure 31:
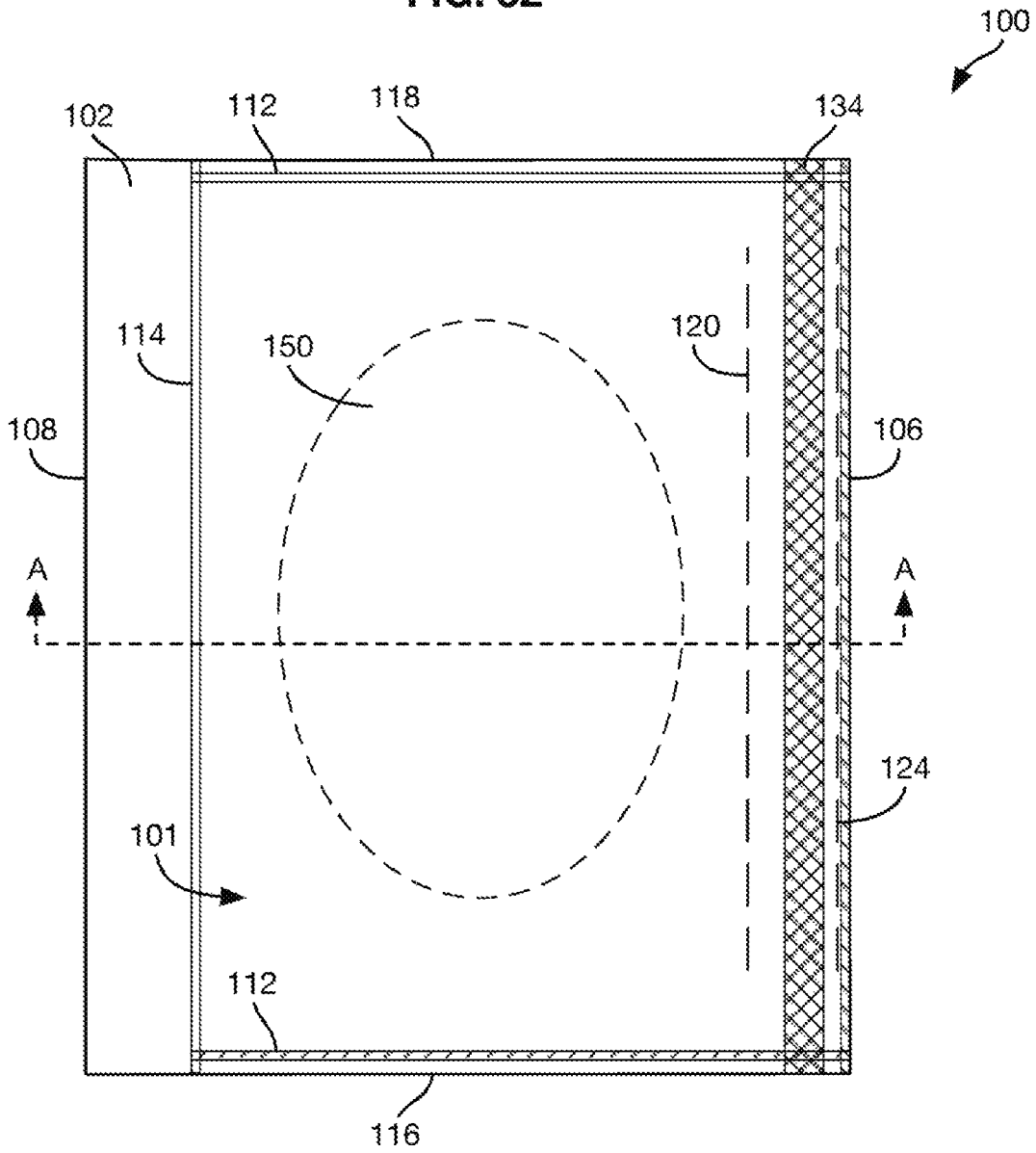
FIG. 31 is a schematic illustration of an exemplary reclosable bag containing a product.
Figure 34:
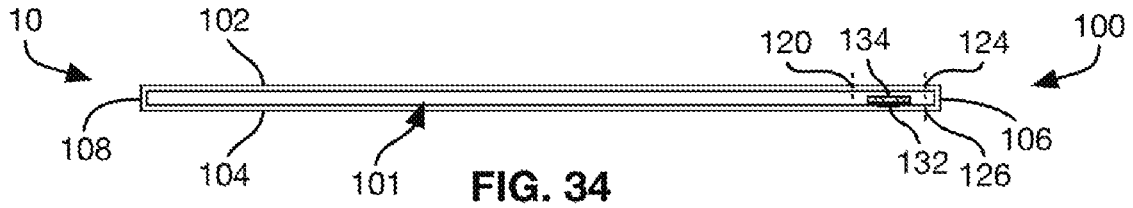
FIG. 34 is a view of the web of reclosable bags taken along line A-A in FIG. 33.
Figure 33:
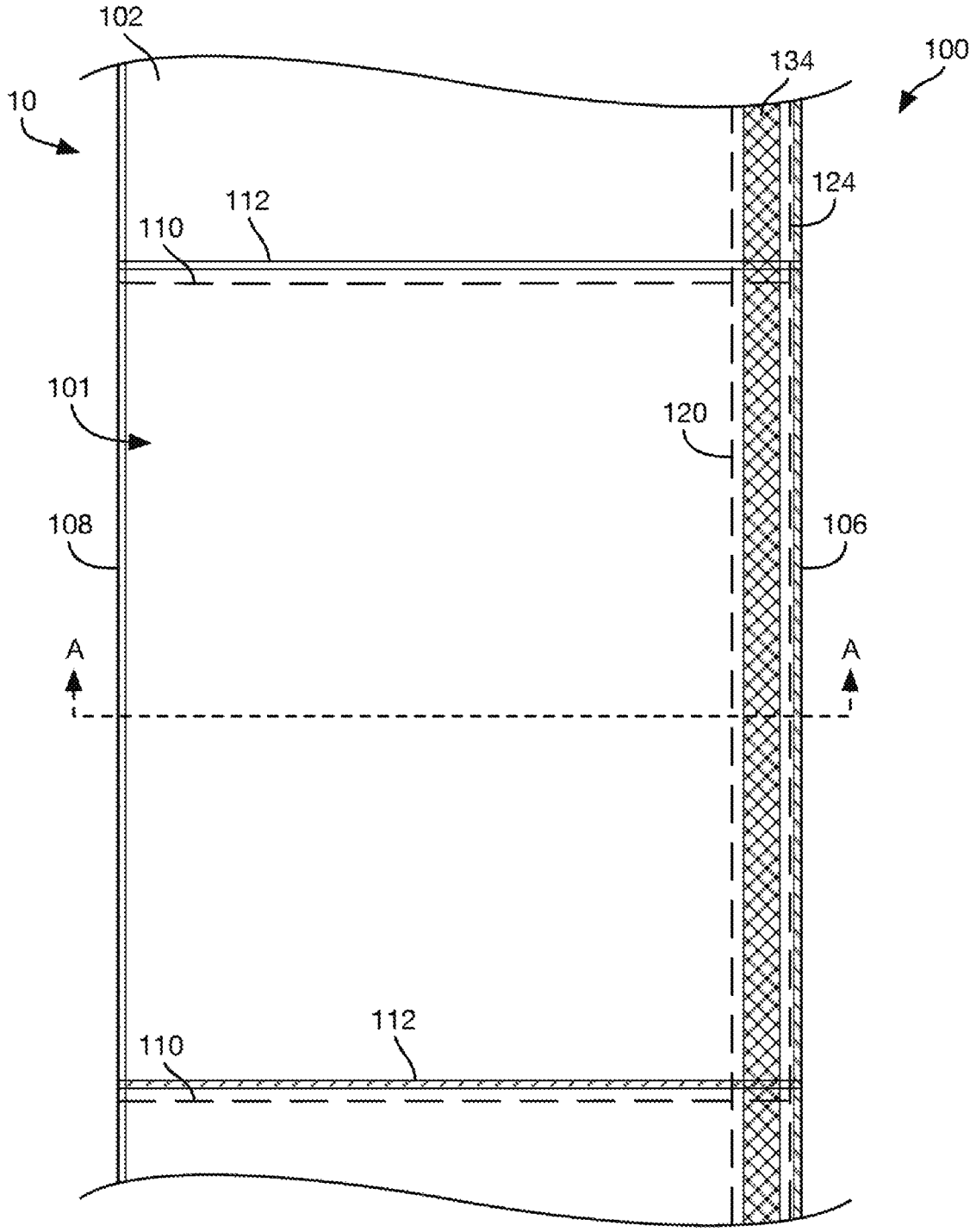
FIG. 33 is a schematic illustration of an exemplary web of reclosable bags.
Figure 36:
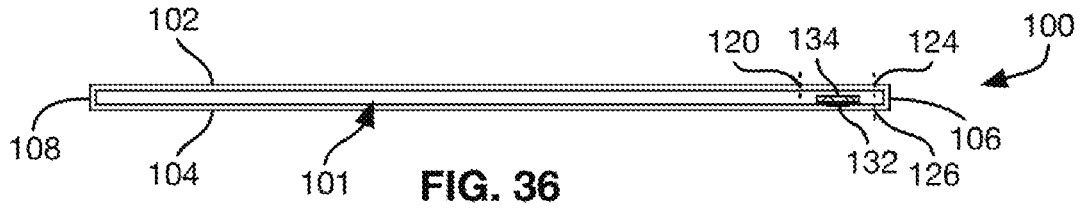
FIG. 36 is a view of the reclosable bag taken along line A-A in FIG. 35.
Figure 35:
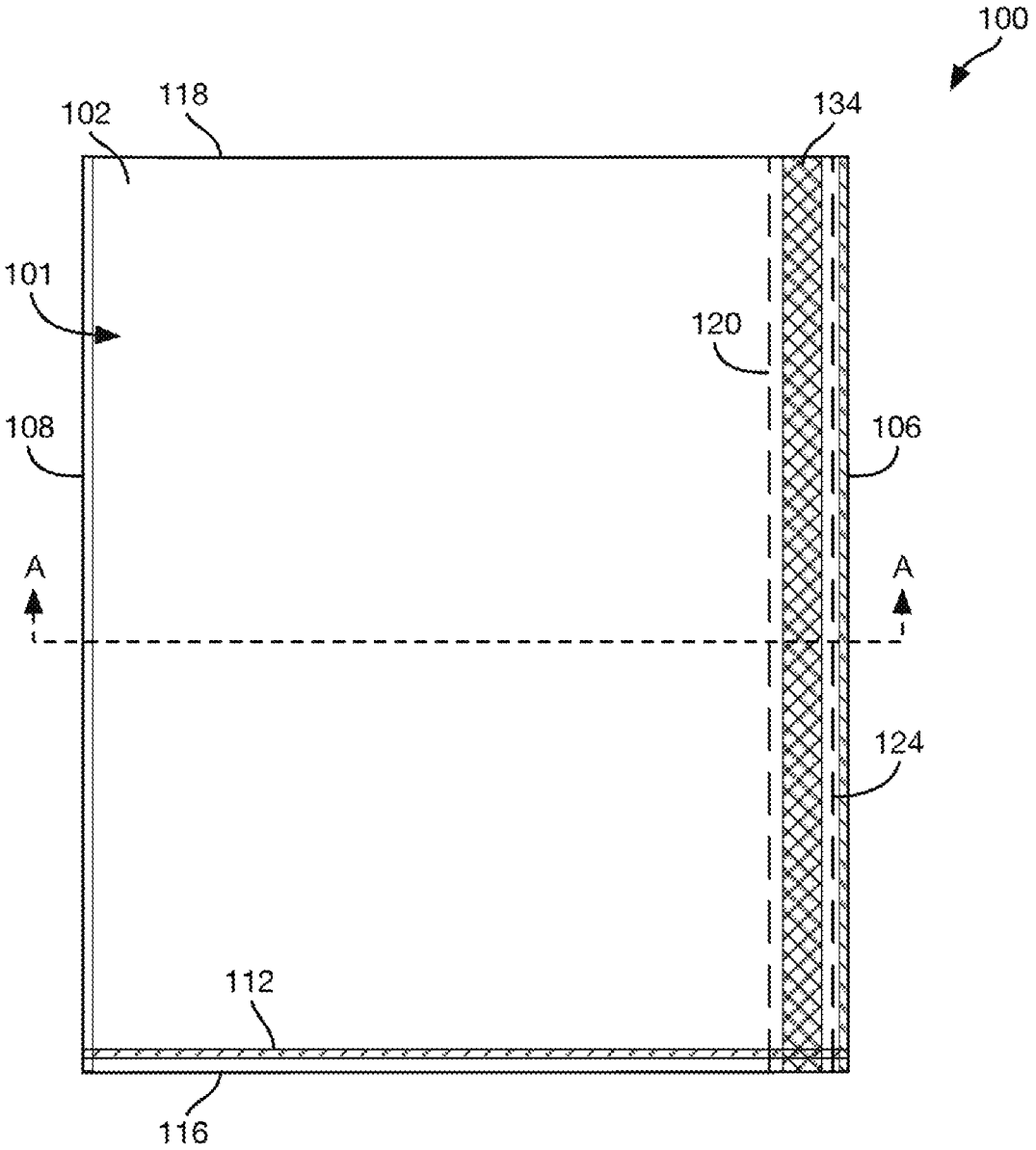
FIG. 35 is a schematic illustration of an exemplary reclosable bag.
Figure 38:
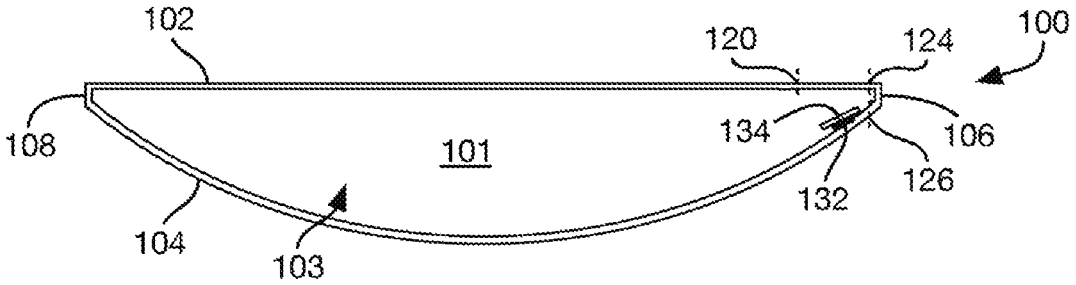
FIG. 38 is a view of the reclosable bag taken along line A-A in FIG. 37.
Figure 37:
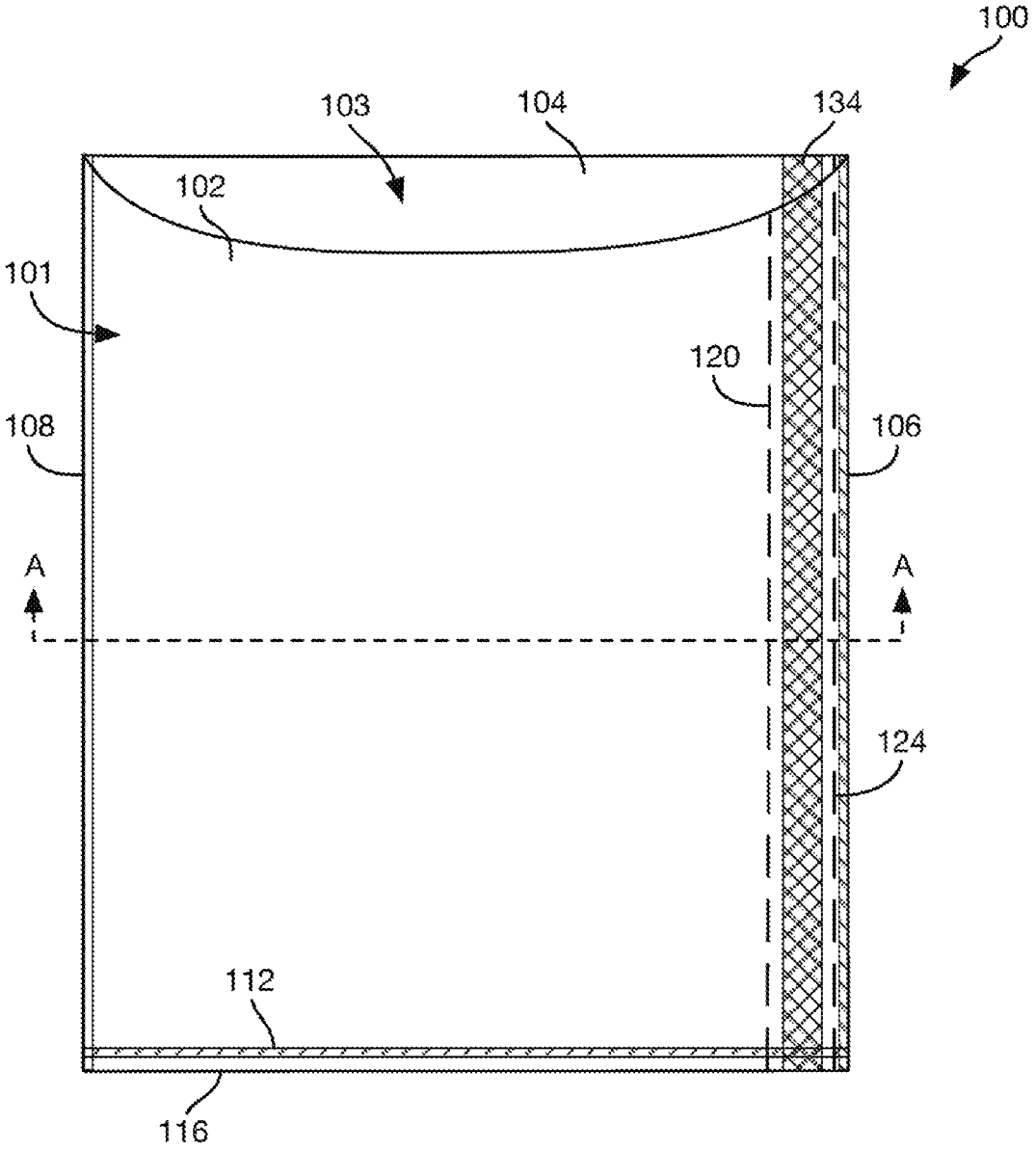
FIG. 37 is a schematic illustration of an exemplary reclosable bag showing an opening for receiving a product.
Figure 40:
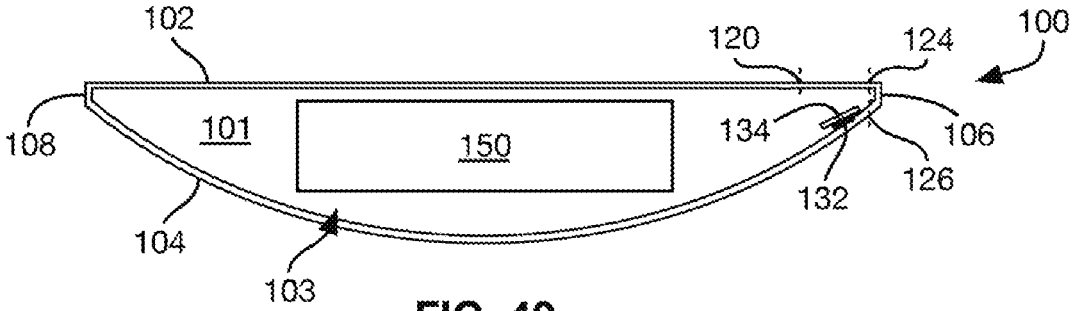
FIG. 40 is a view of the reclosable bag taken along line A-A in FIG. 39.
Figure 39:
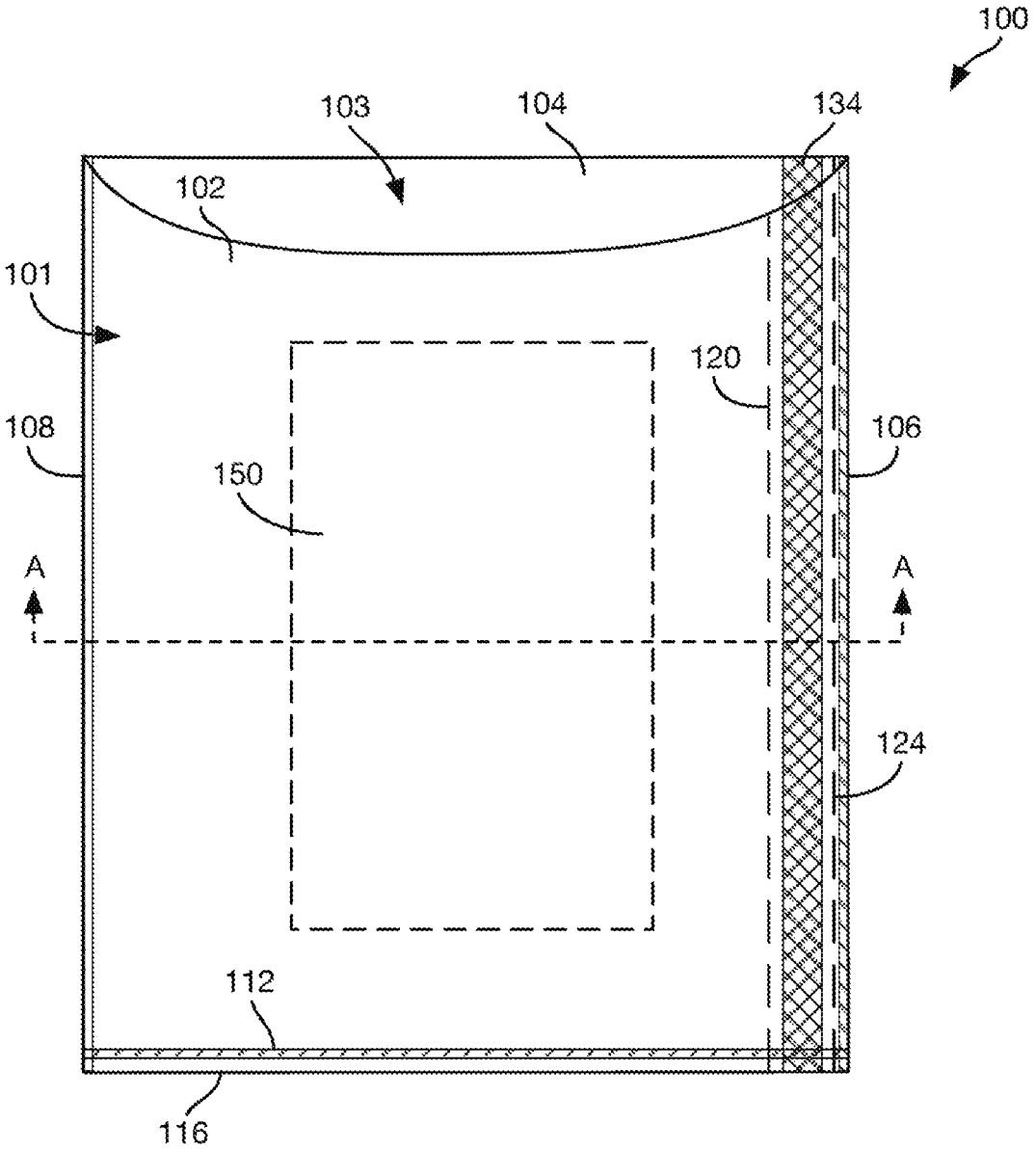
FIG. 39 is a schematic illustration of an exemplary reclosable bag with a product loaded into the bag.
Figure 42:
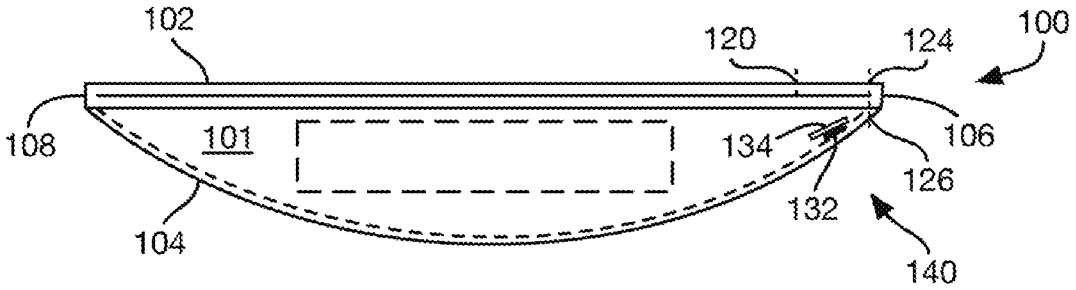
FIG. 42 is a bottom view of the reclosable bag of FIG. 41.
Figure 41:
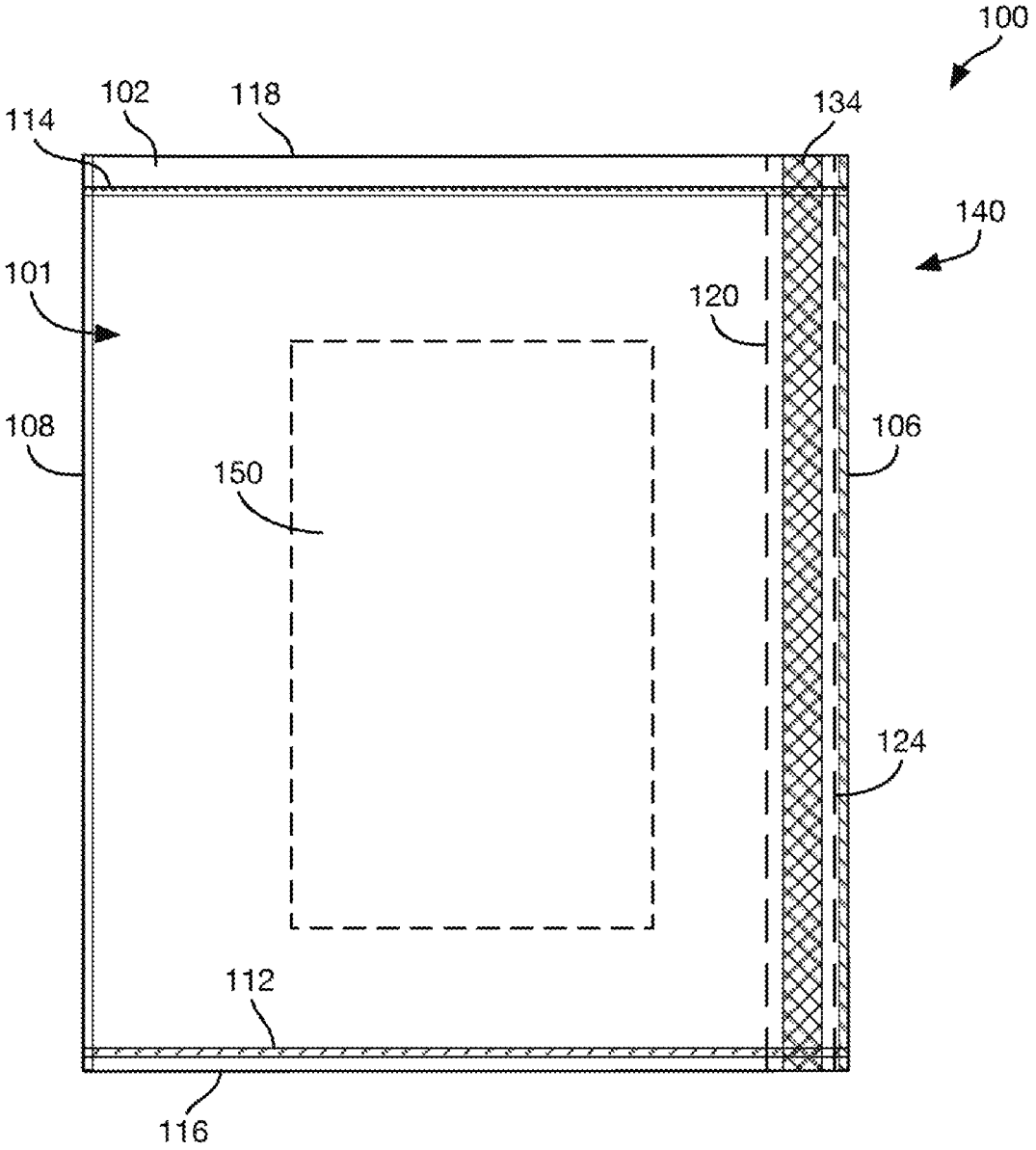
FIG. 41 is a schematic illustration of an exemplary reclosable bag containing a product.
Figure 44:
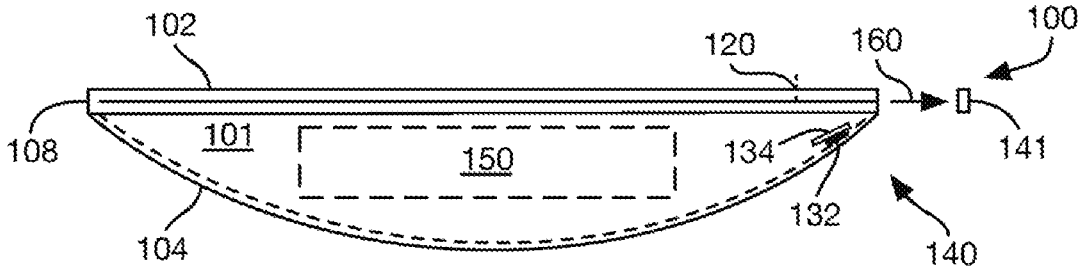
FIG. 44 is a bottom view of the reclosable bag of FIG. 43.
Figure 43:
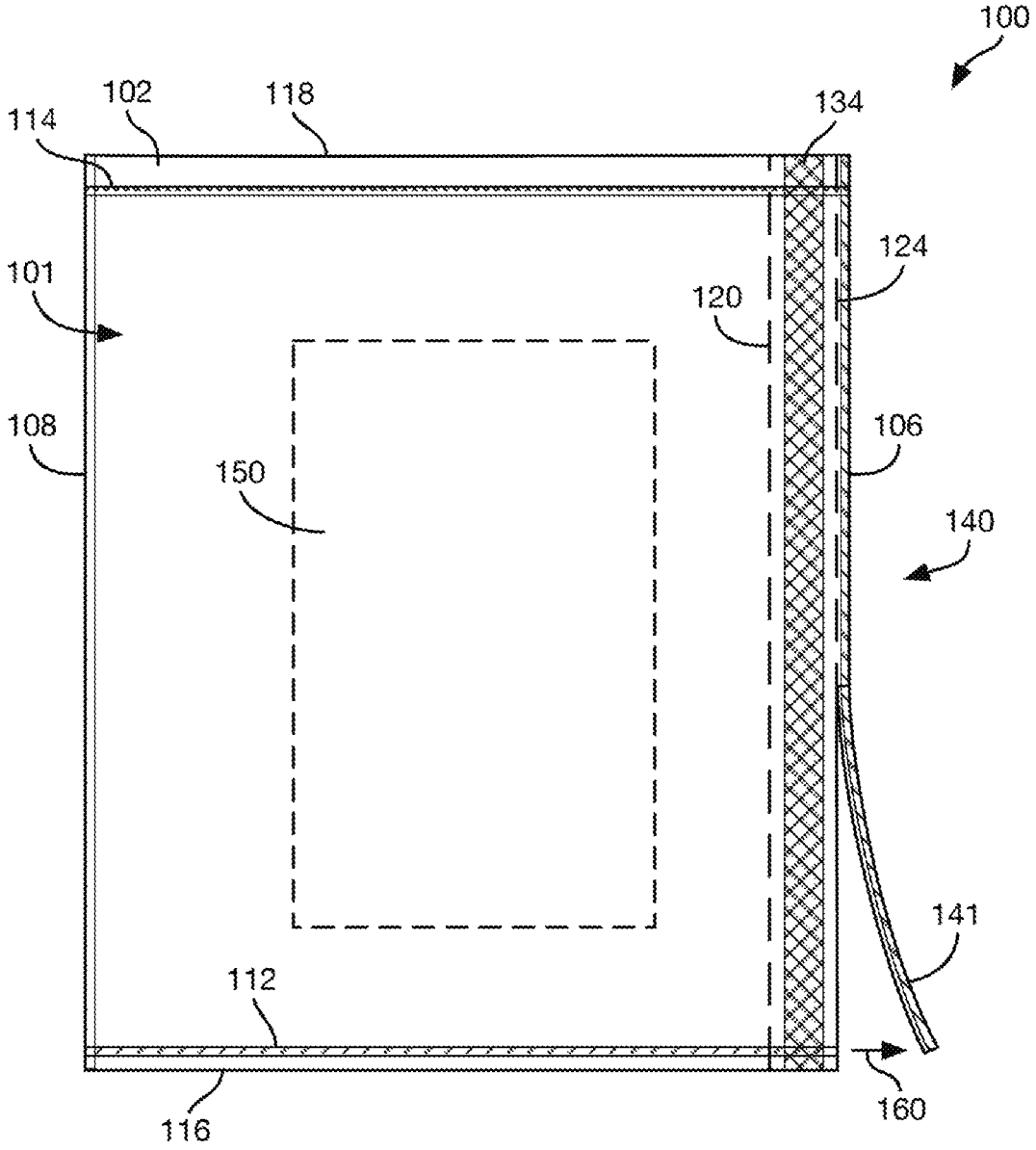
FIG. 43 is a schematic illustration of an exemplary reclosable bag showing an opening for retrieving a product.
Figure 46:
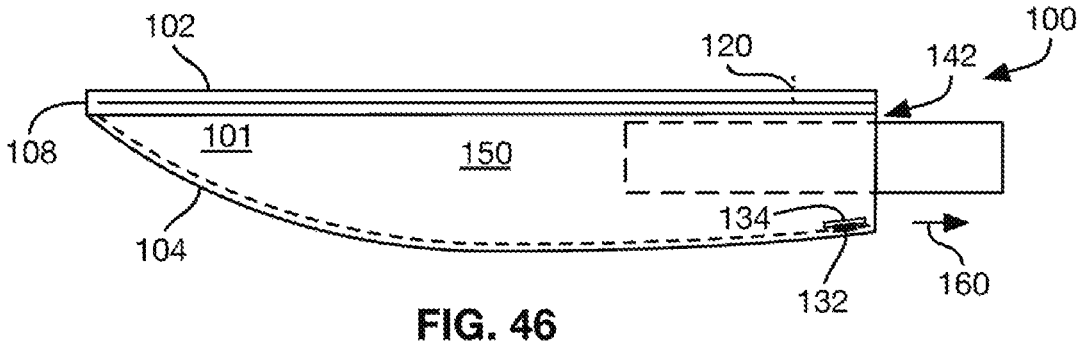
FIG. 46 is a bottom view of the reclosable bag of FIG. 45.
Figure 45:
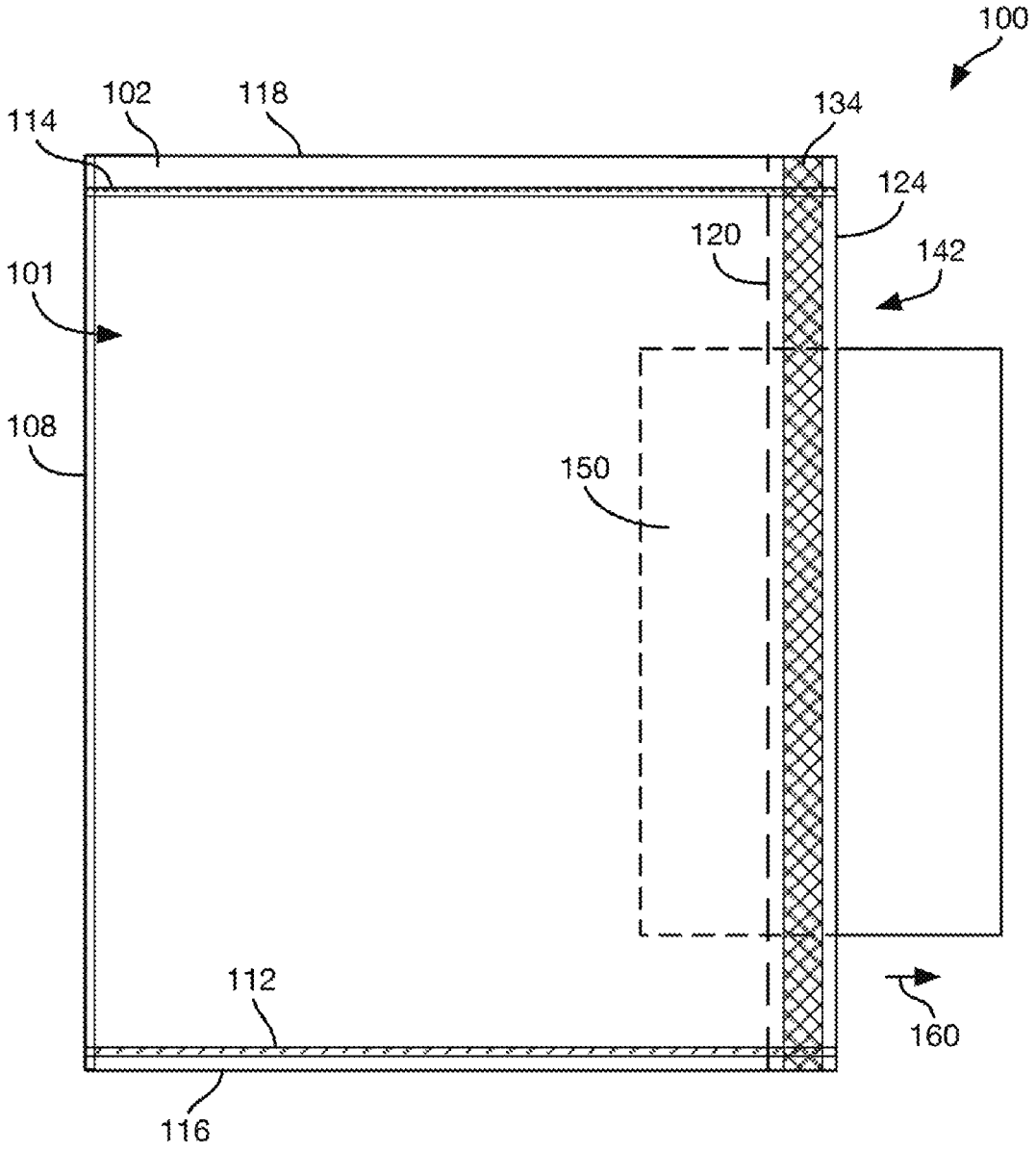
FIG. 45 is a schematic illustration of an exemplary reclosable bag showing a product being removed through an opening.
Figure 48:
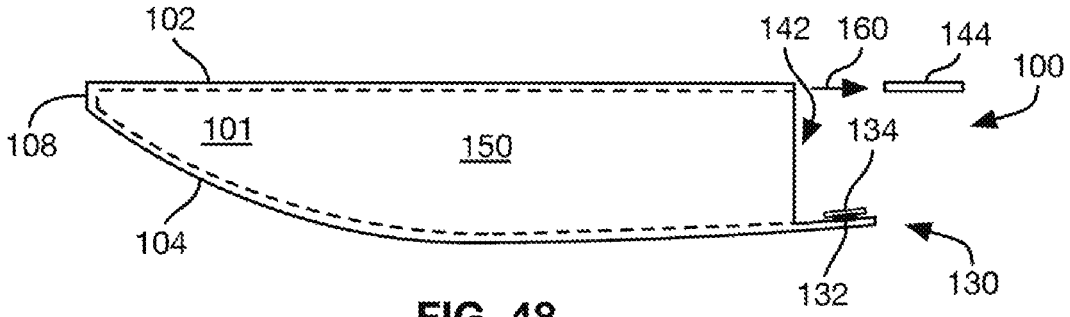
FIG. 48 is a bottom view of the reclosable bag of FIG. 47.
Figure 47:
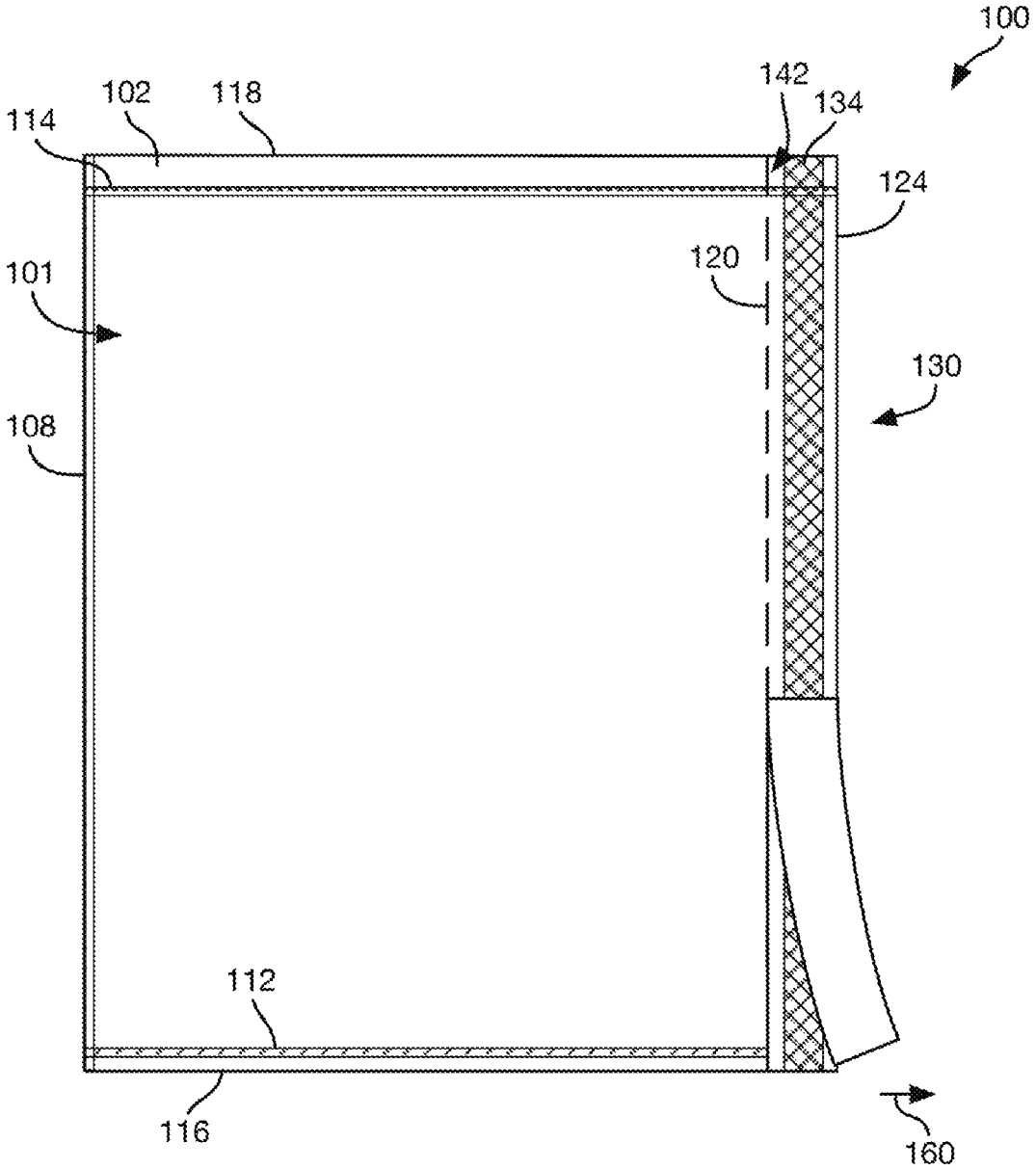
FIG. 47 is a schematic illustration of an exemplary reclosable bag showing a reclosing flap being formed.
Figure 50:
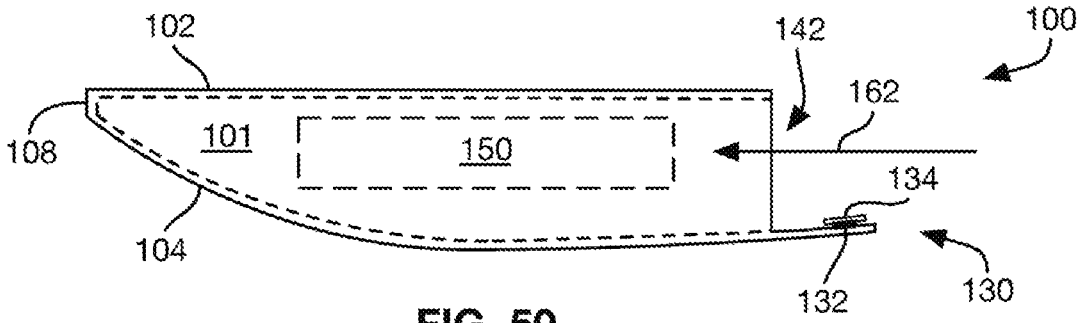
FIG. 50 is a bottom view of the reclosable bag of FIG. 49.
Figure 49:
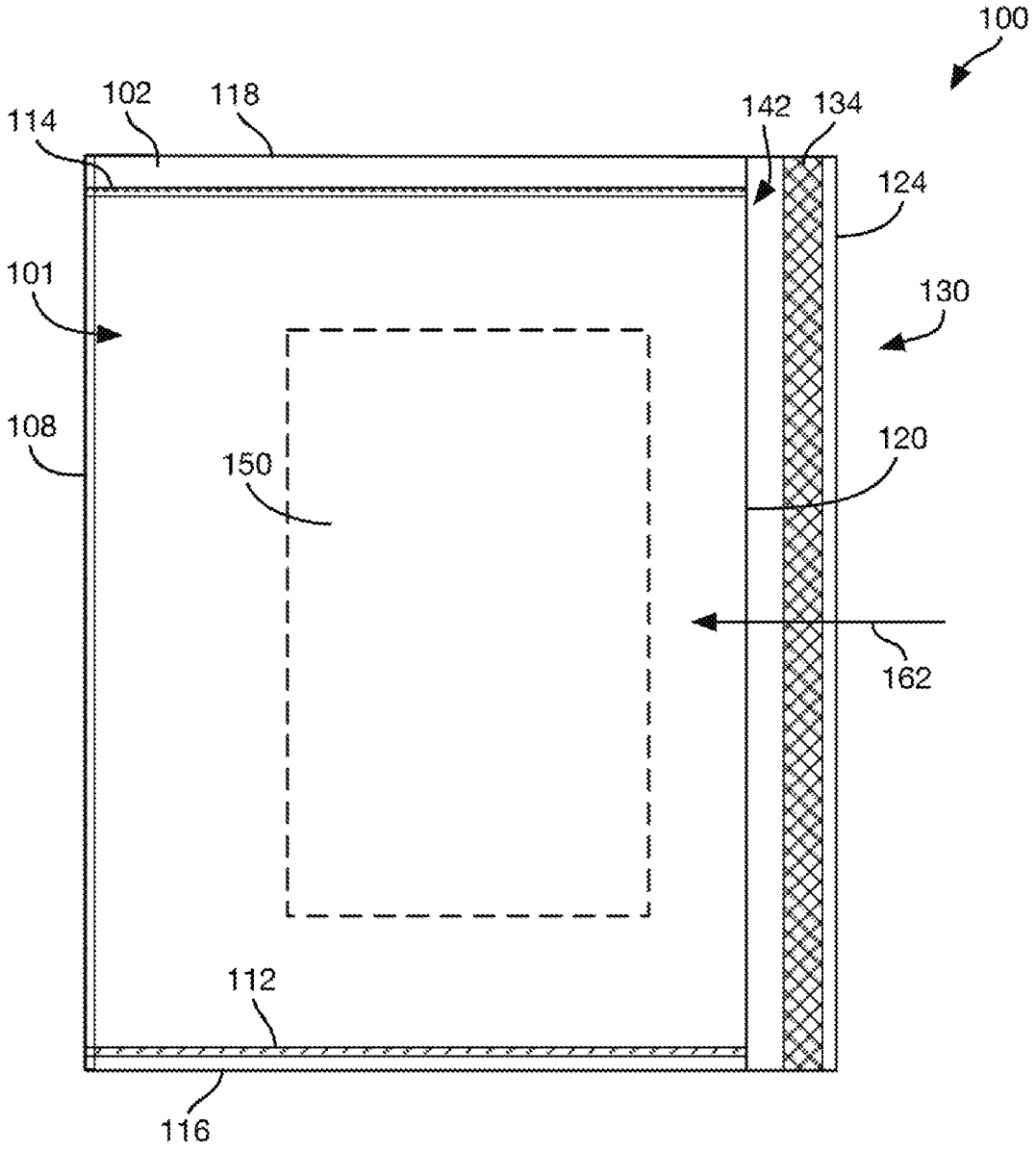
FIG. 49 is a schematic illustration of an exemplary reclosable bag showing a product being loaded into the bag.
Figure 52:
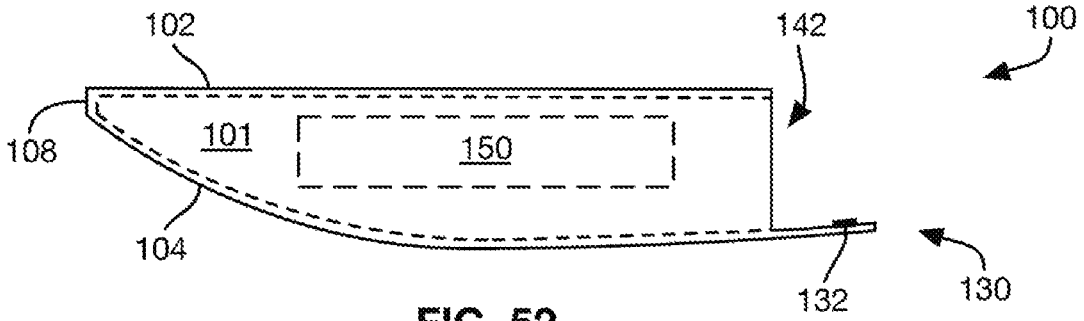
FIG. 52 is a bottom view of the reclosable bag of FIG. 51.
Figure 51:
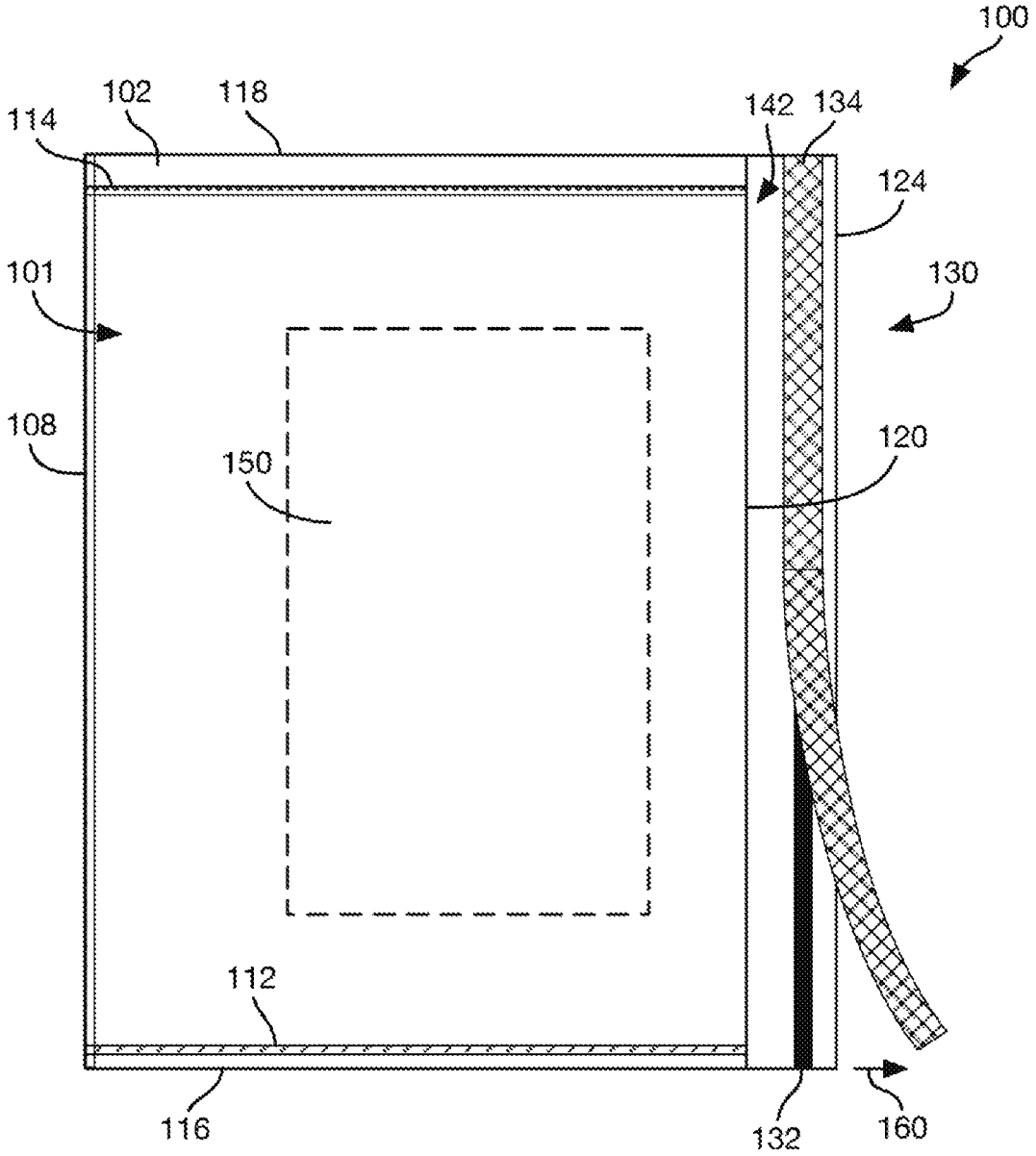
FIG. 51 is a schematic illustration of an exemplary reclosable bag showing a release material being removed.
Figure 54:
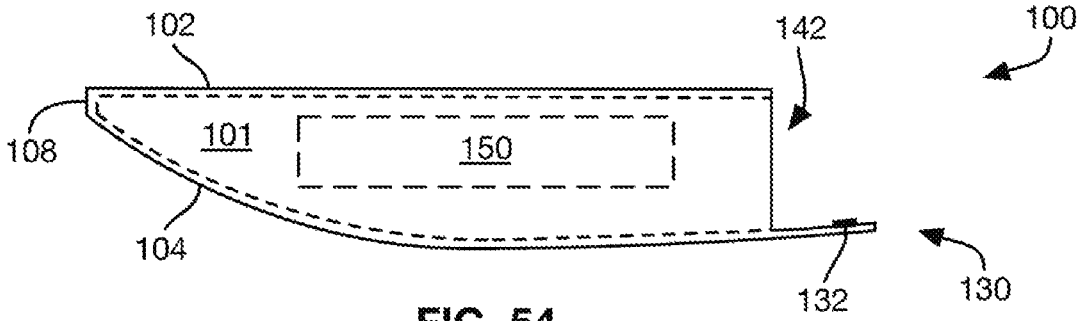
FIG. 54 is a bottom view of the reclosable bag of FIG. 53.
Figure 53:
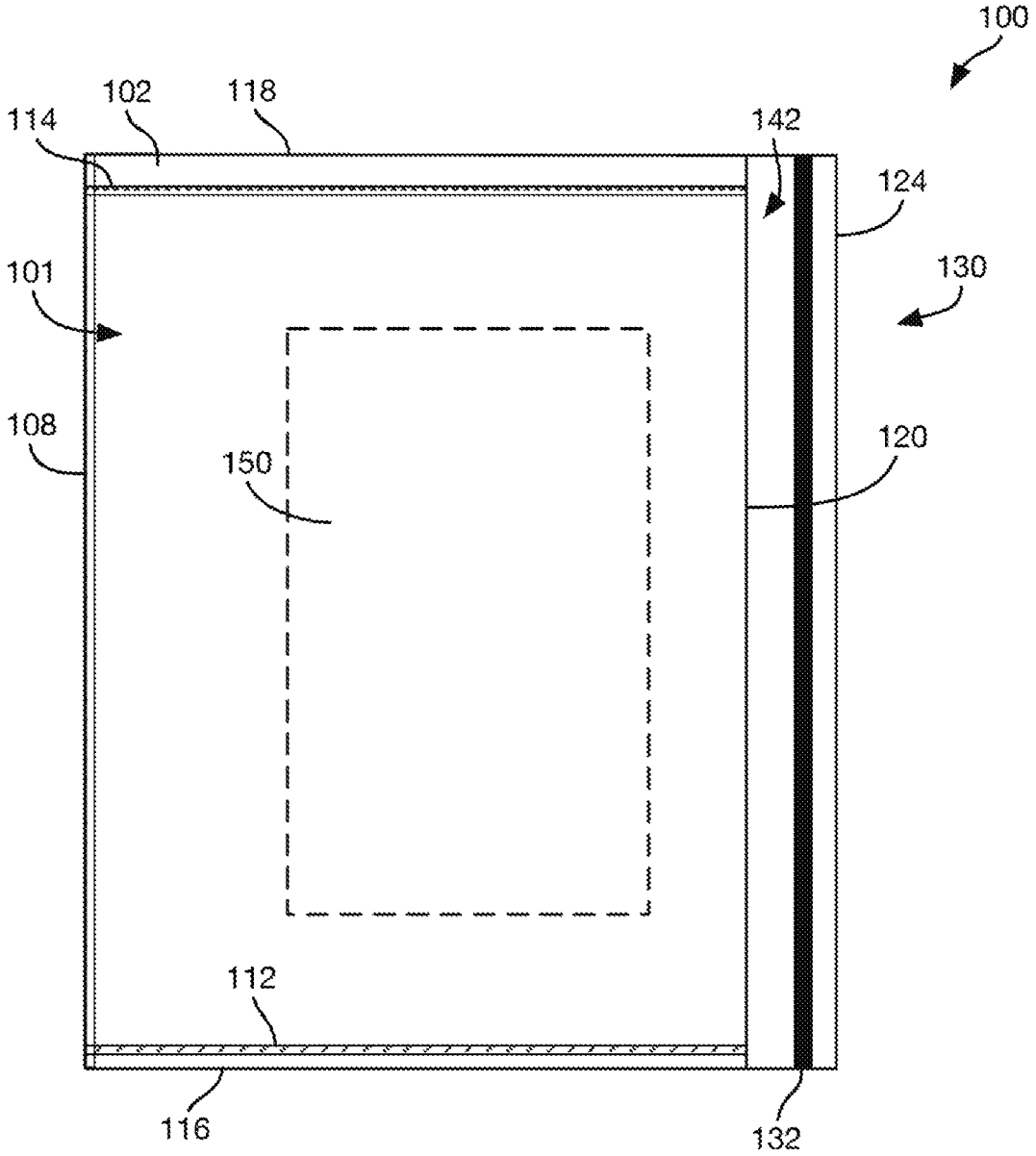
FIG. 53 is a schematic illustration of an exemplary reclosable bag showing a reclosing flap with reclosing material exposed.

As is shown in FIGS. 31 and 32, once the product 150 is loaded into the bag 100, the bag 100 is sealed near the second side 108 with a closing seal 114 that extends from the bottom 116 to the top 118 to seal the compartment 101. As with the bags 100 described above, the closing seal 114 may not extend all the way from the bottom 116 to the top 118 or may be intermittent to allow communication between the compartment 101 and external air or the compartment 101 and another optional compartment of the reclosable bag 100. In certain embodiments, the closing seal 114 may be formed by various techniques including, but not limited to, heat sealing, ultrasonic welding, gluing, etc. Virtually any type of product 150 may be loaded into the reclosable bag 100 for delivery to a consumer. Upon receipt, the bag 100 shown in FIG. 31 can be opened and reclosed in the same manner as the bag 100 shown in FIGS. 11-24.

An additional exemplary web 10 of reclosable bags 100 and bags 100 separated from the web 10 are shown in FIGS. 33-58. The web 10 and bags 100 illustrated in FIGS. 33-58 are similar to those of FIGS. 1-32, except that the first, second, and third opening lines of weakness 120, 124, 126 extend fully between separating lines of weakness 110 of the web 10 and, therefore, from the bottom 116 to the top 118 of the bags 100. Consequently, gaps 122 and areas of reinforcement 123 are not formed in the web 10 or bags 100. Similar to the web 10 shown in FIGS. 25-26, FIGS. 57-58 show that the product 150 can be loaded into and sealed within the compartment 101 while the bags 100 remain connected in the web 10. The web 10 can also be configured for loading from the side 106, like the web 10 shown in FIGS. 27-32. Like the bags 100 previously discussed, the bags 100 illustrated in FIGS. 33-58 are opened in the same manner whether the product 150 is loaded from the side or top.

Figure 56:
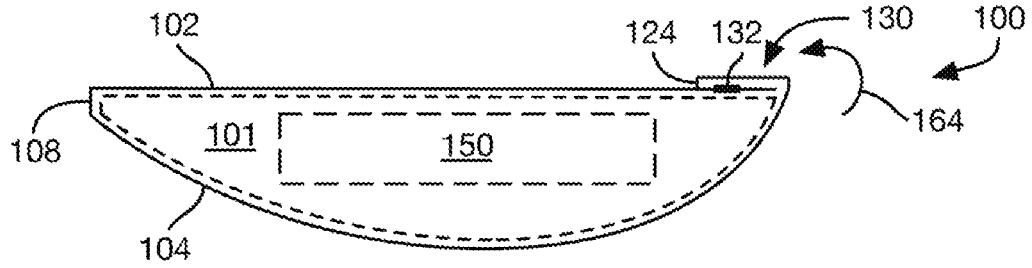
FIG. 56 is a bottom view of the reclosable bag of FIG. 55.
Figure 55:
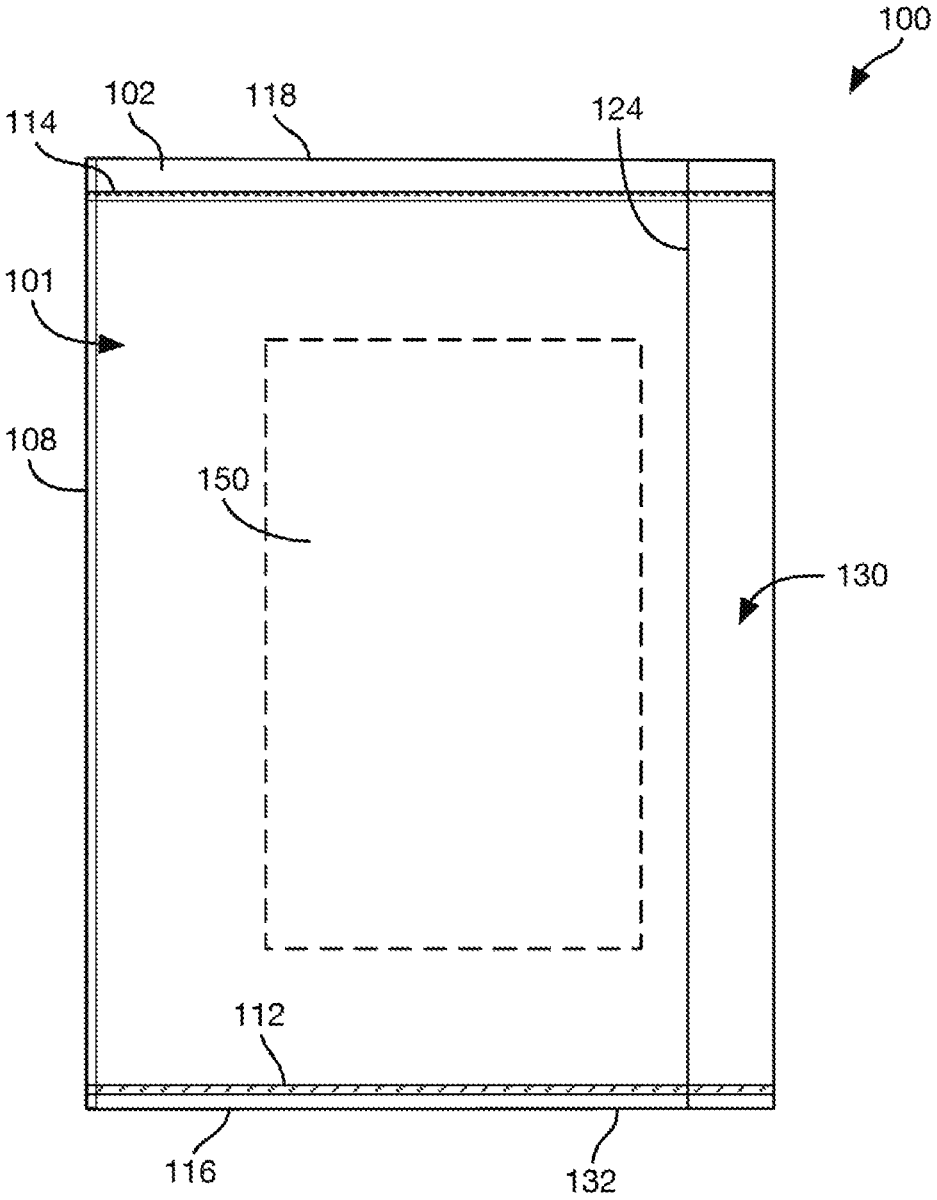
FIG. 55 is a schematic illustration of an exemplary reclosable bag showing the bag reclosed.
Figure 58:
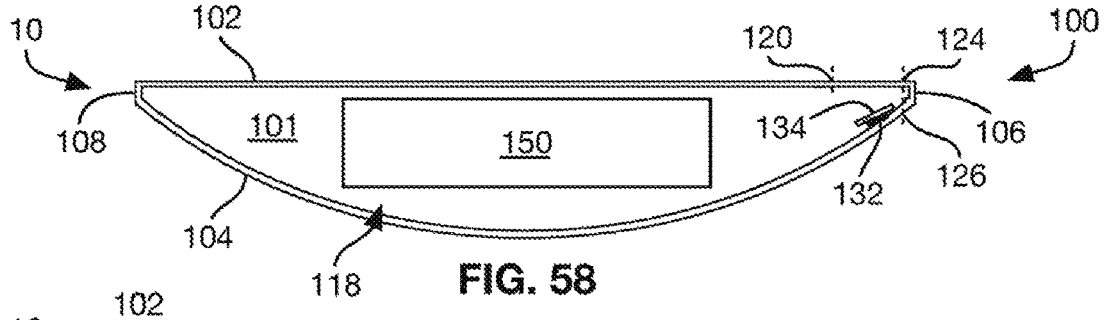
FIG. 58 is a view of the reclosable bag taken along line A-A in FIG. 57.
Figure 57:
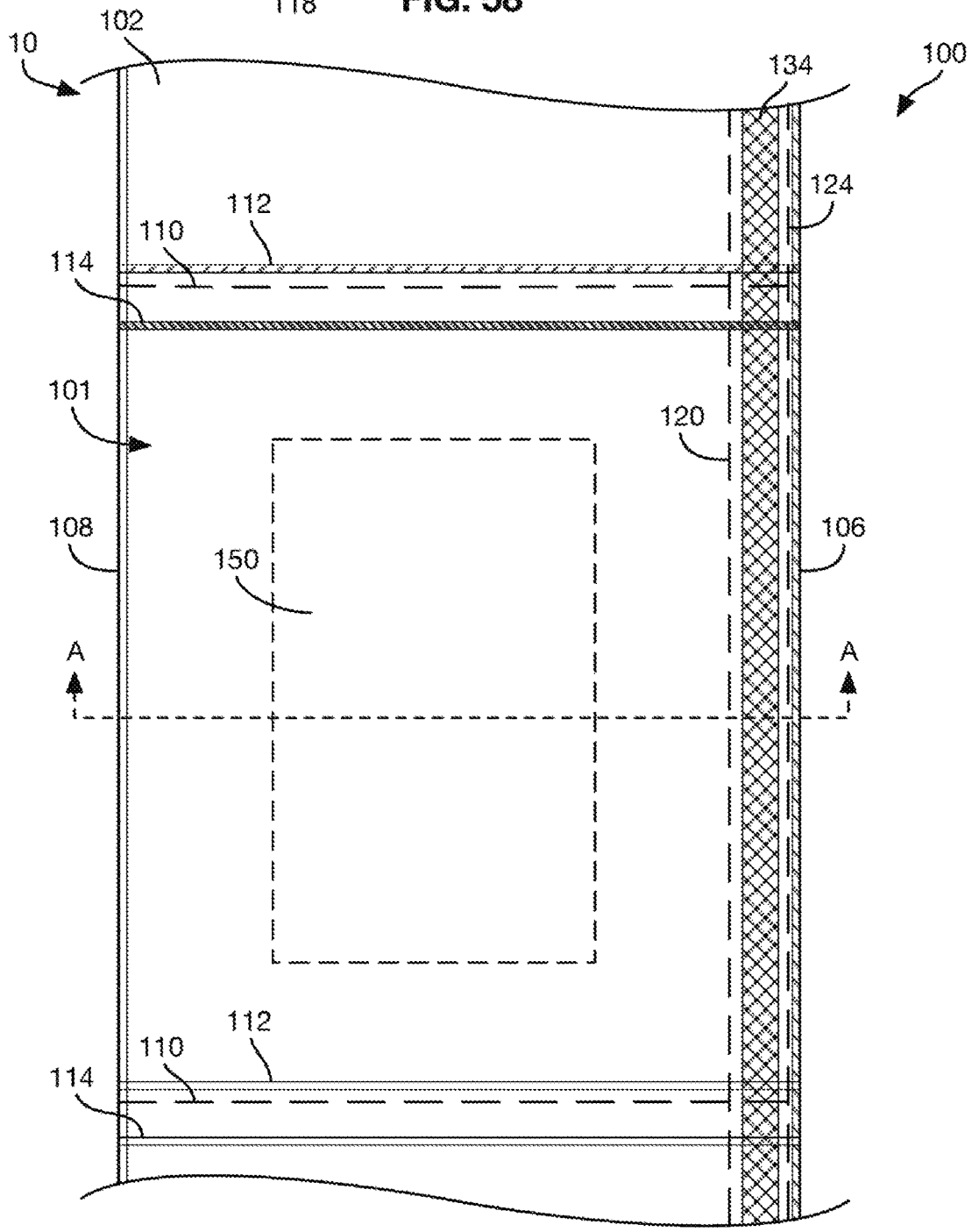
FIG. 57 is a schematic illustration of an exemplary web of reclosable bags with a product loaded in a bag.
Figure 60:
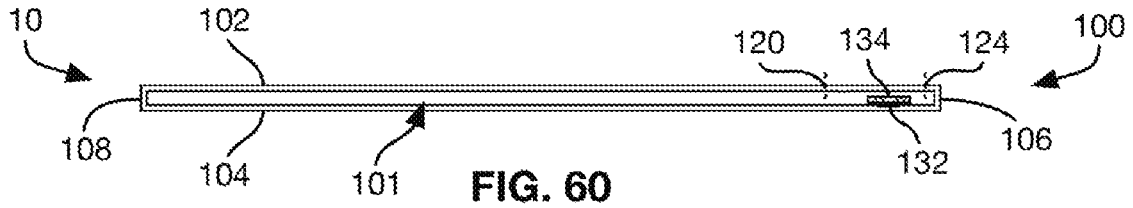
FIG. 60 is a view of the reclosable bag taken along line A-A in FIG. 59.
Figure 59:
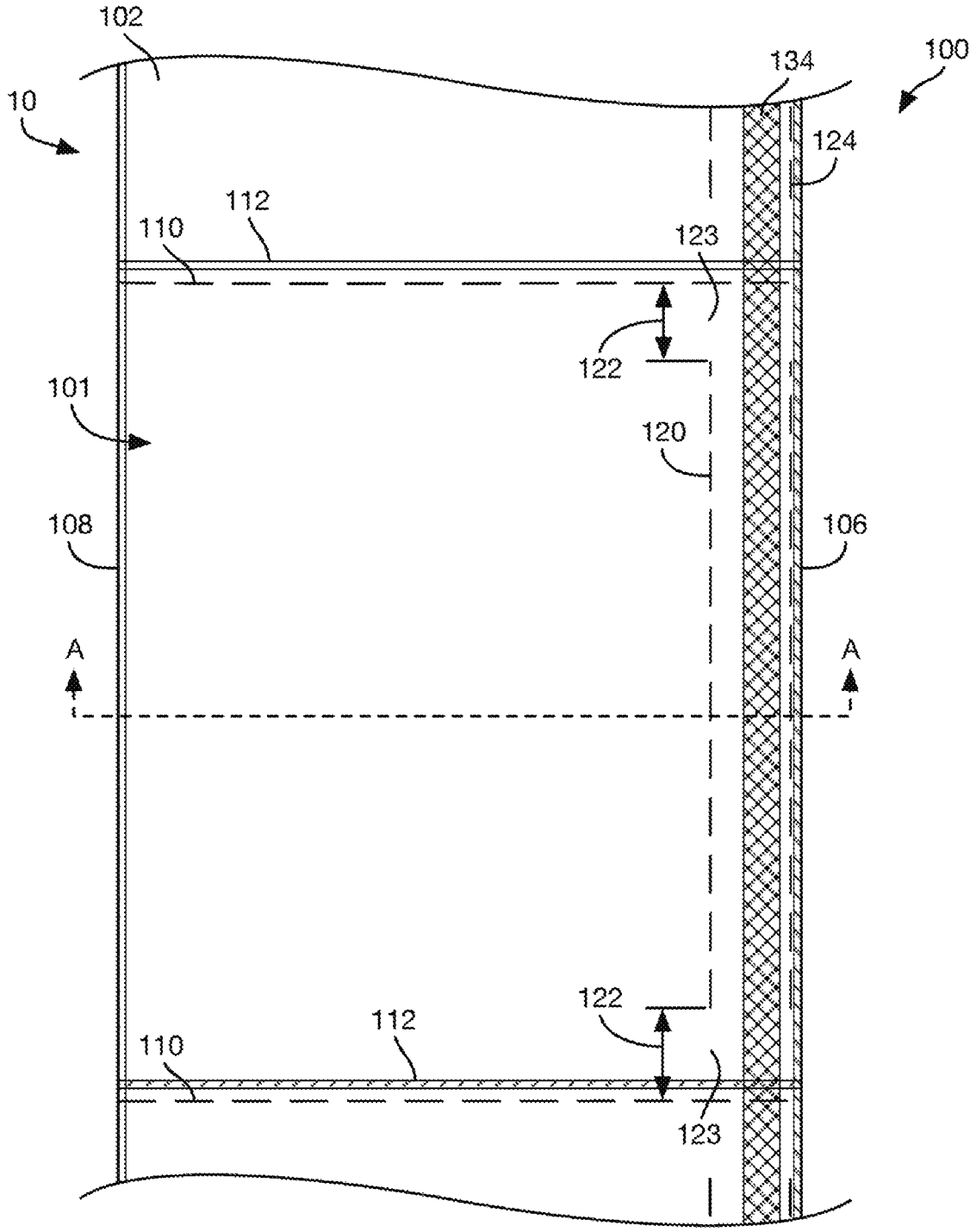
FIG. 59 is a schematic illustration of an exemplary web of reclosable bags.
Figure 62:
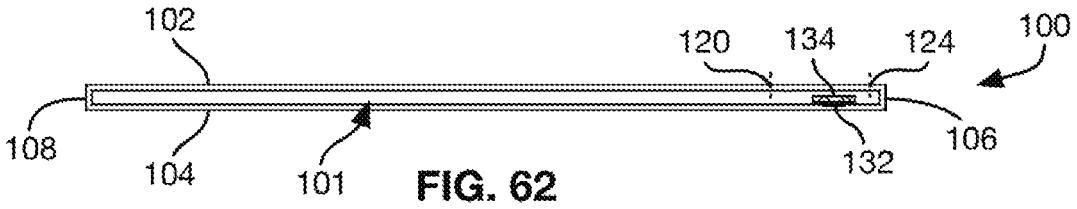
FIG. 62 is a view of the reclosable bag taken along line A-A in FIG. 61.
Figure 61:
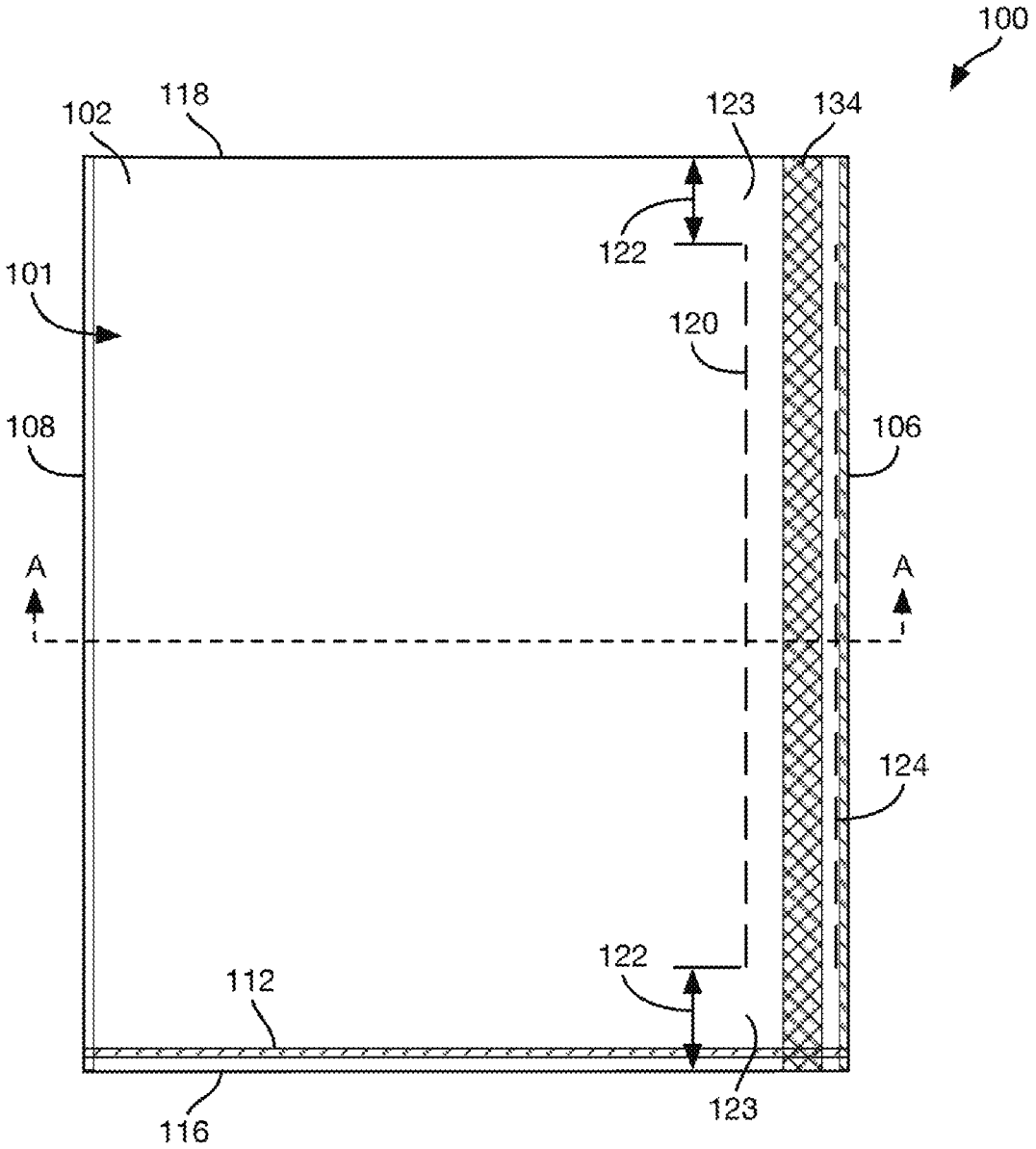
FIG. 61 is a schematic illustration of an exemplary reclosable bag.
Figure 64:
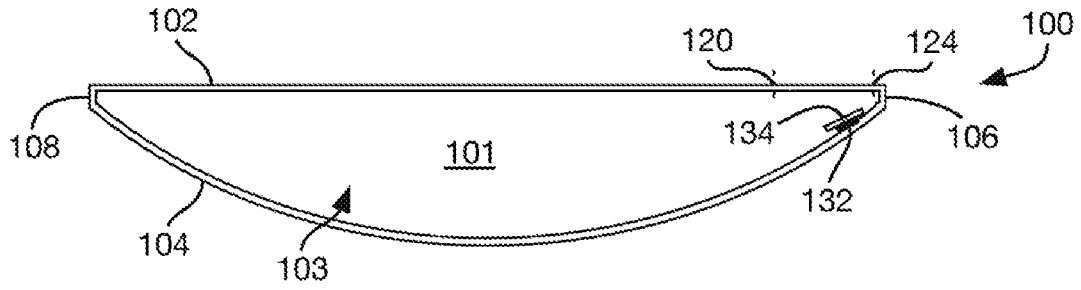
FIG. 64 is a view of the reclosable bag taken along line A-A in FIG. 63.
Figure 63:
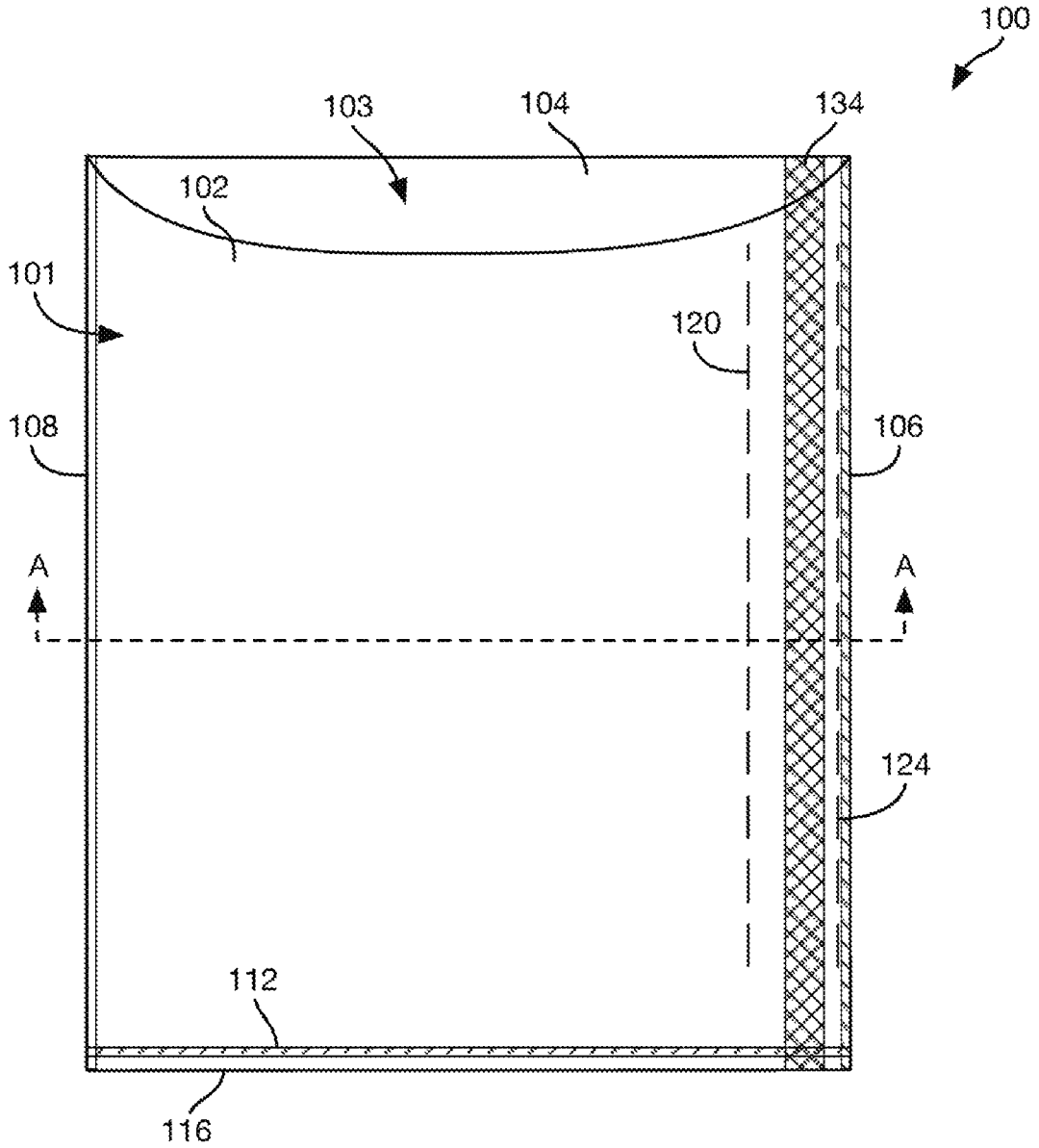
FIG. 63 is a schematic illustration of an exemplary reclosable bag showing an opening for receiving a product.
Figure 66:
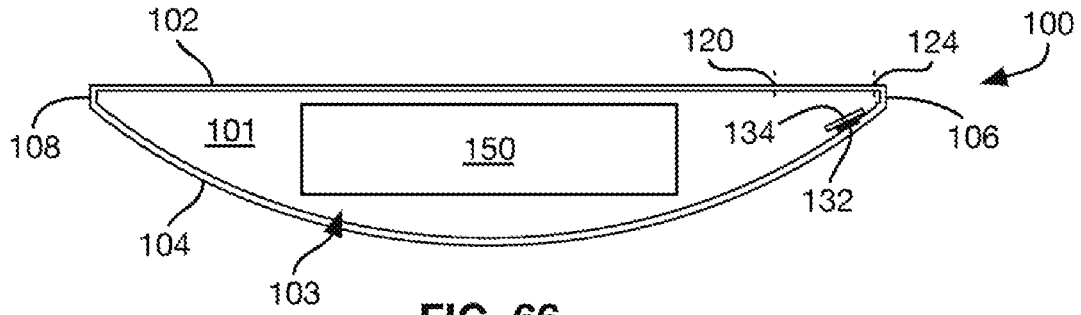
FIG. 66 is a view of the reclosable bag taken along line A-A in FIG. 65.
Figure 65:
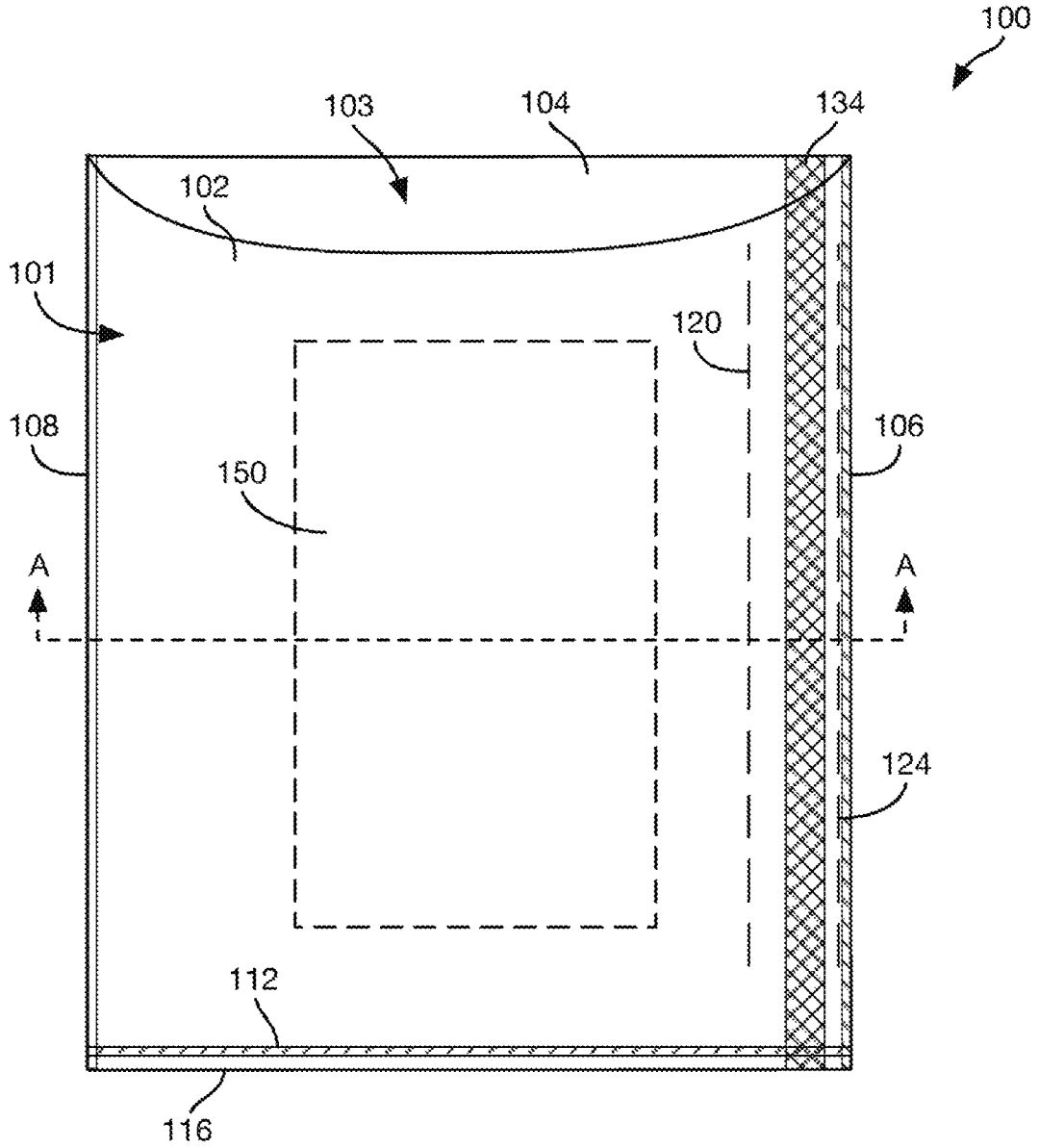
FIG. 65 is a schematic illustration of an exemplary reclosable bag with a product loaded into the bag.
Figure 68:
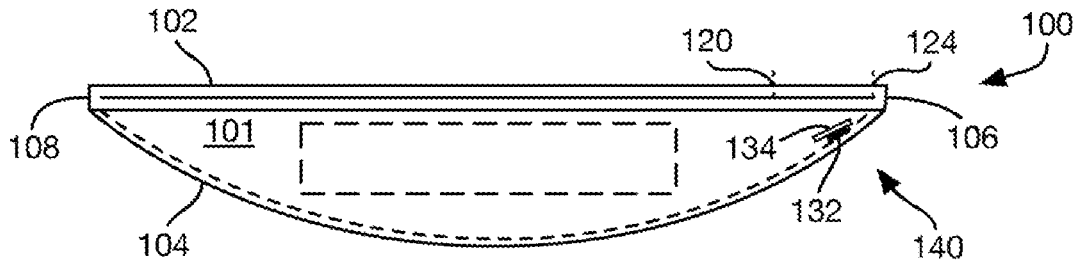
FIG. 68 is a bottom view of the reclosable bag of FIG. 67.
Figure 67:
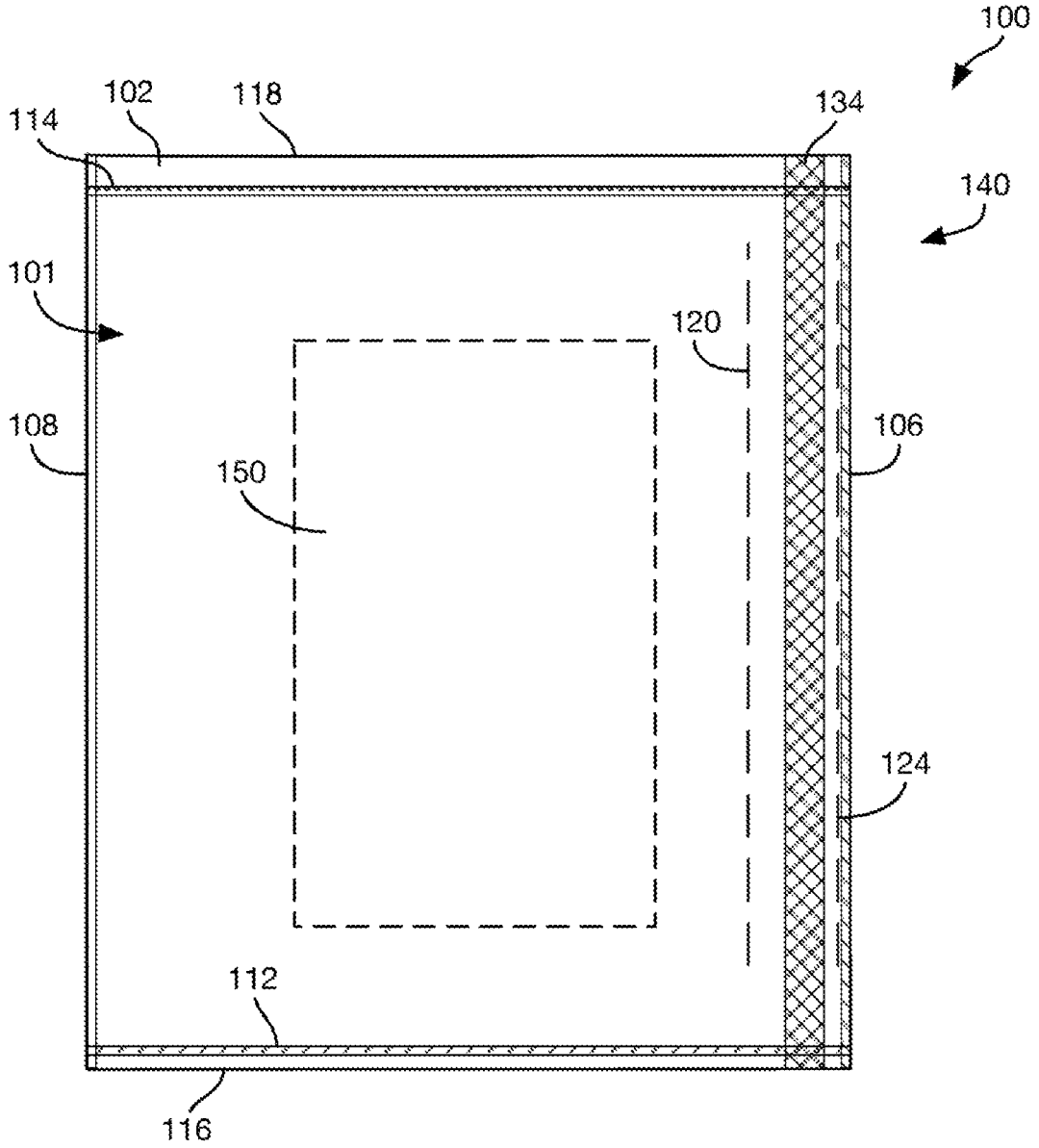
FIG. 67 is a schematic illustration of an exemplary reclosable bag containing a product.
Figure 70:
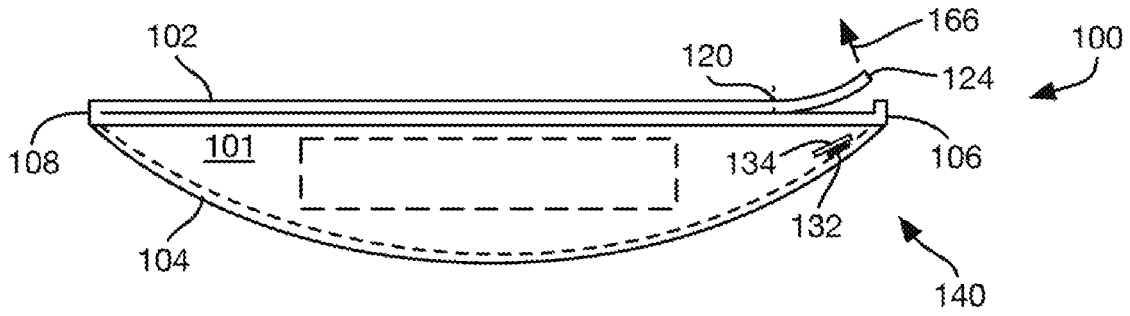
FIG. 70 is a bottom view of the reclosable bag of FIG. 69.
Figure 69:
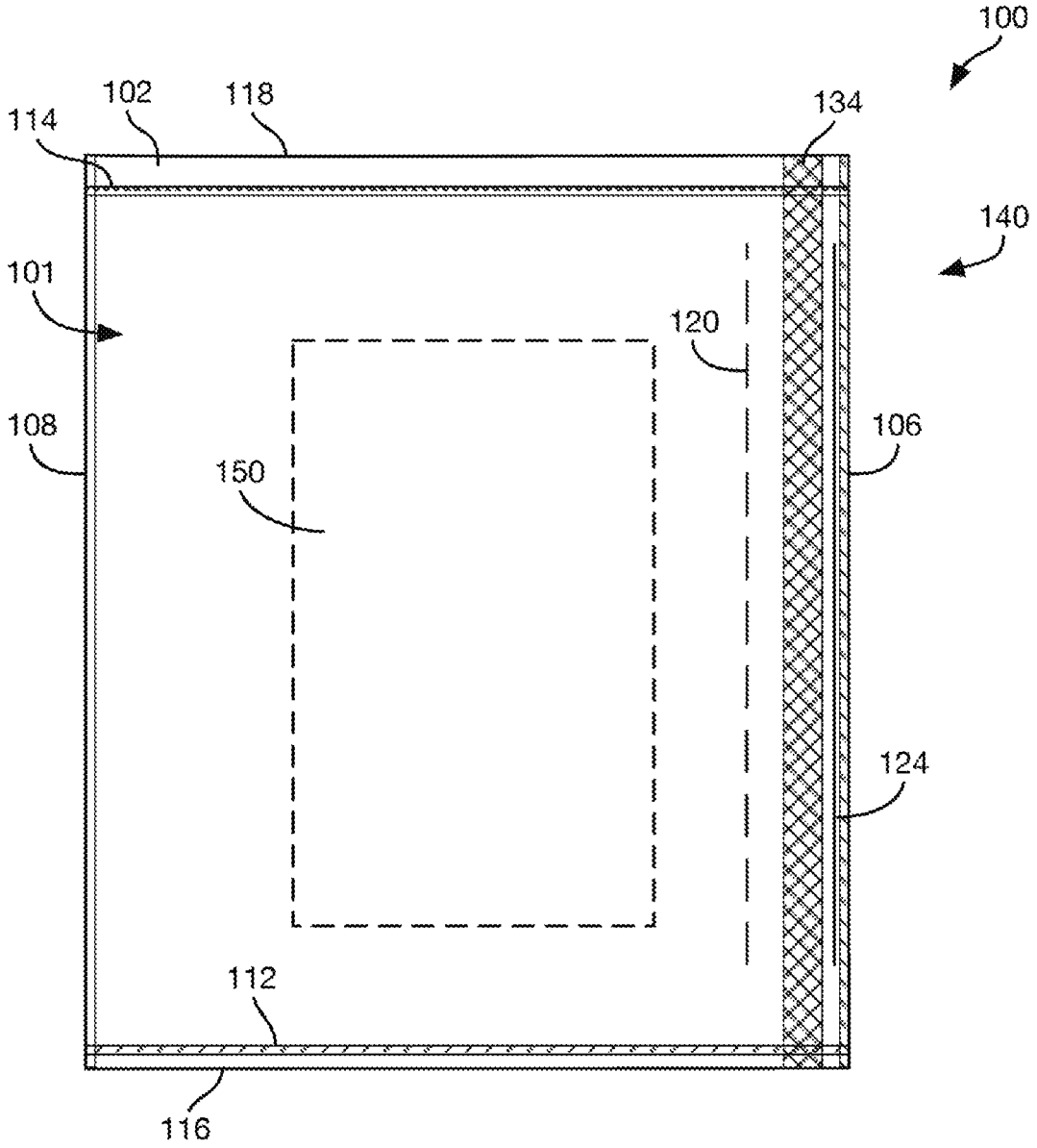
FIG. 69 is a schematic illustration of an exemplary reclosable bag showing an opening for retrieving a product.
Figure 72:
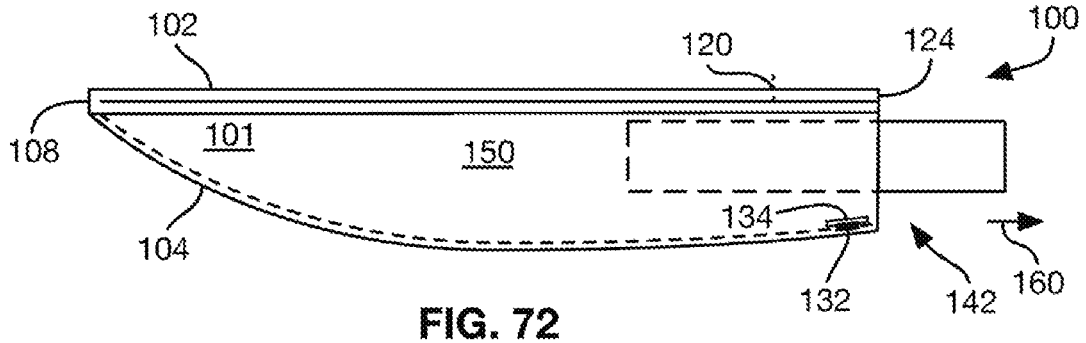
FIG. 72 is a bottom view of the reclosable bag of FIG. 71.
Figure 71:
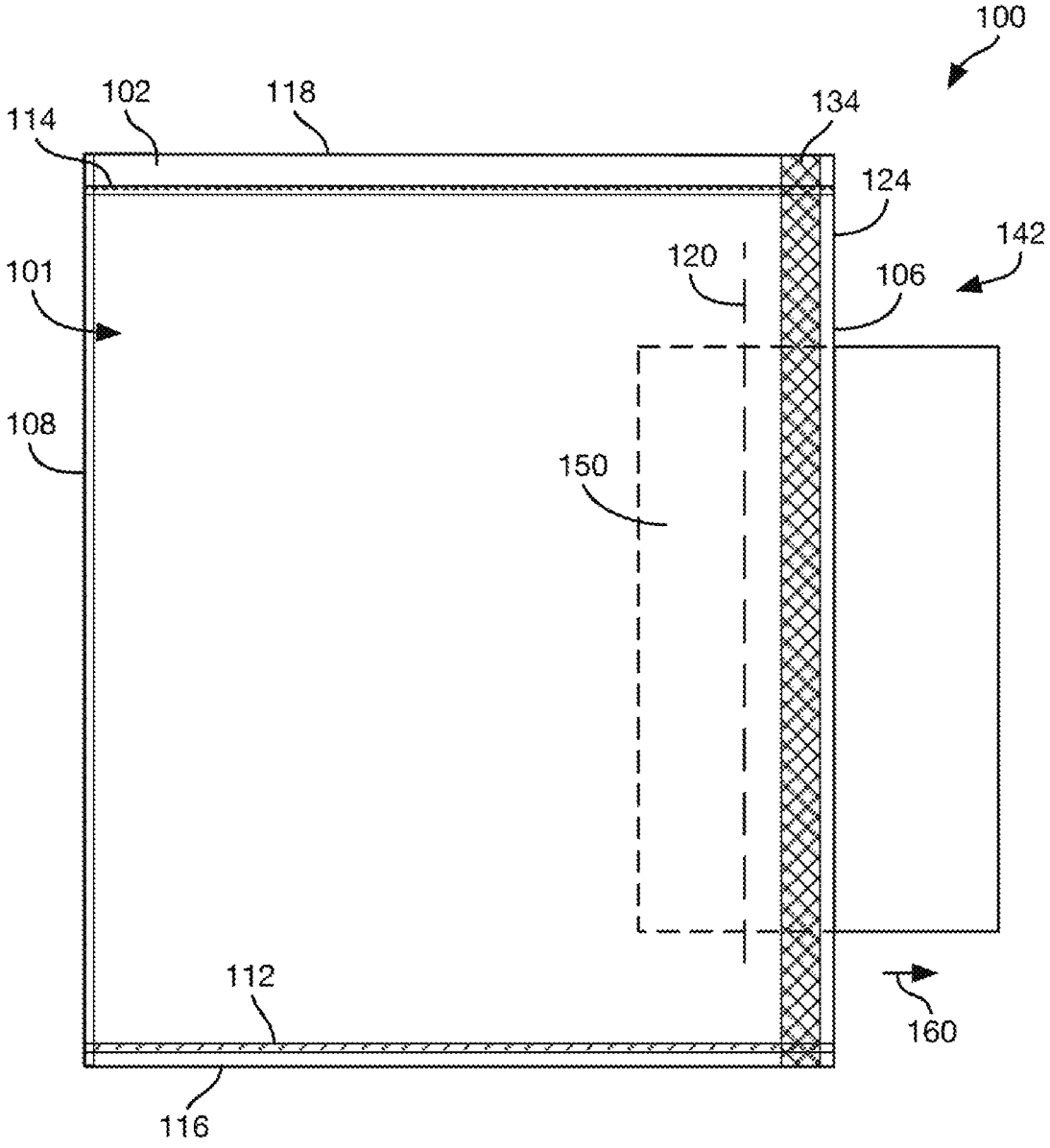
FIG. 71 is a schematic illustration of an exemplary reclosable bag showing a product being removed through an opening.
Figure 74:
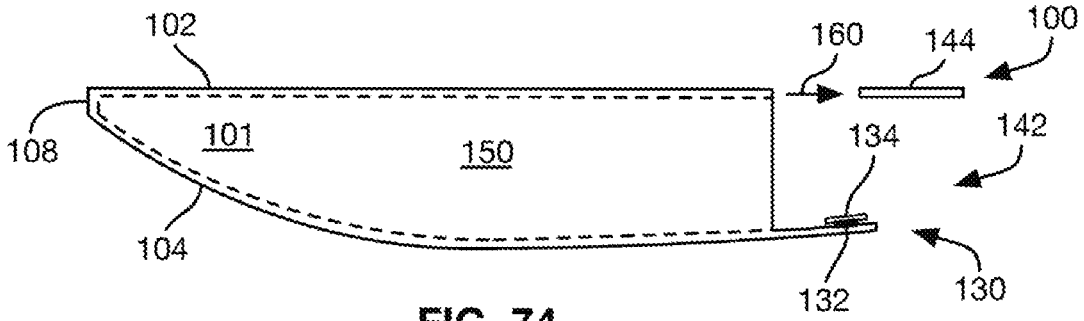
FIG. 74 is a bottom view of the reclosable bag of FIG. 73.
Figure 73:
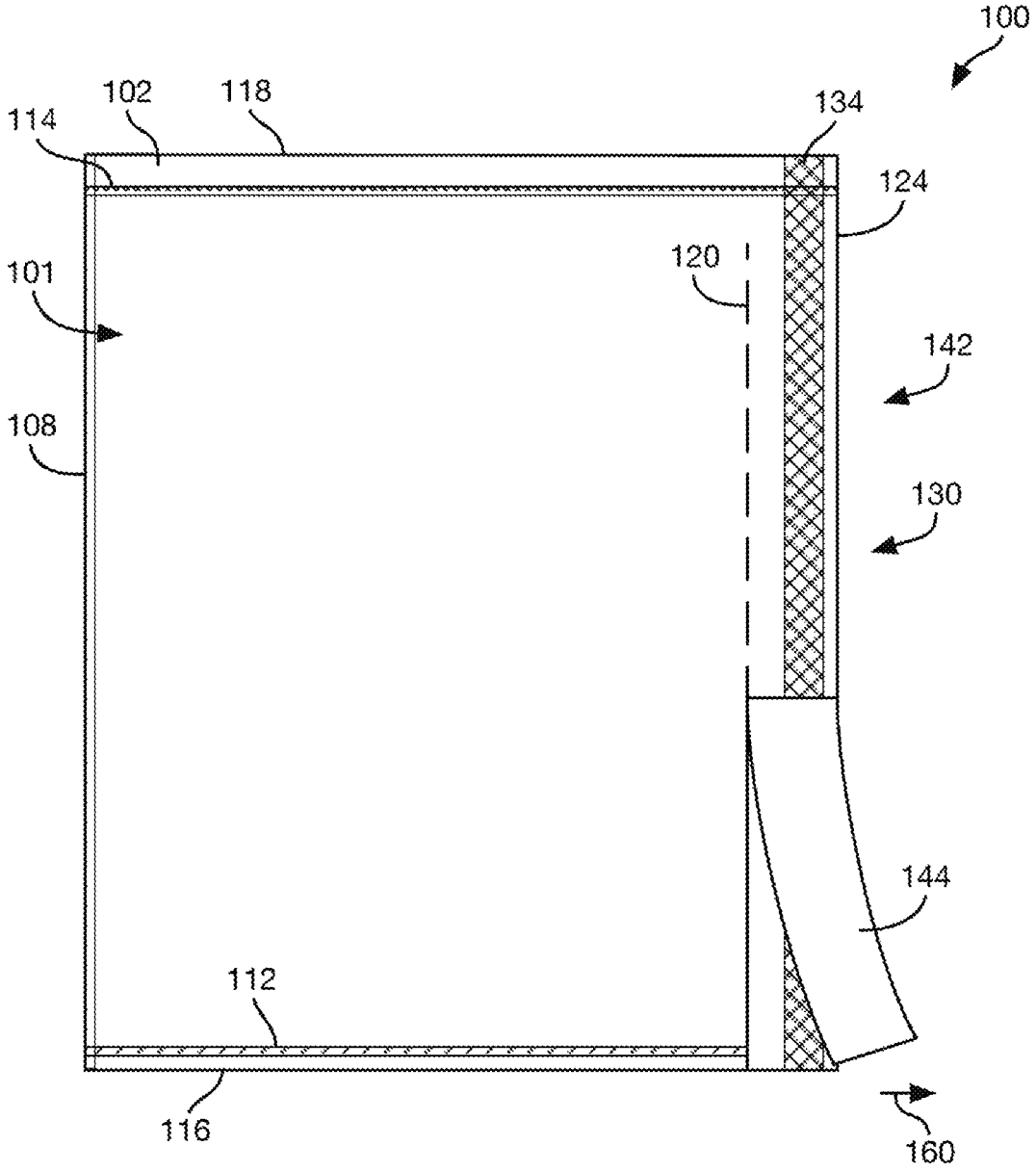
FIG. 73 is a schematic illustration of an exemplary reclosable bag showing a reclosing flap being formed.
Figure 76:
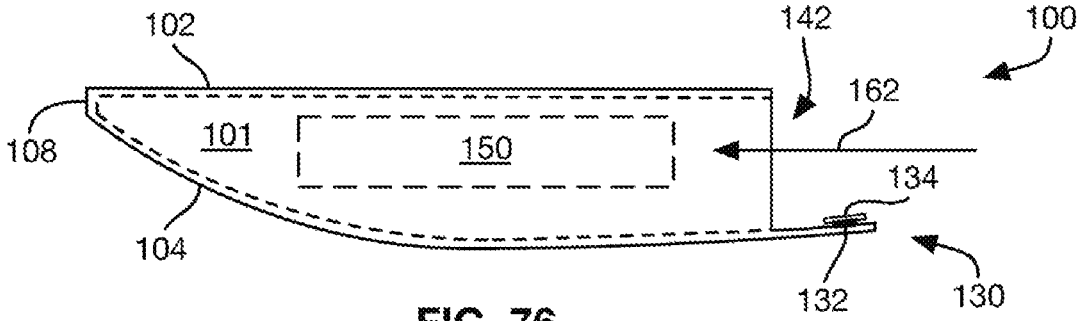
FIG. 76 is a bottom view of the reclosable bag of FIG. 75.
Figure 75:
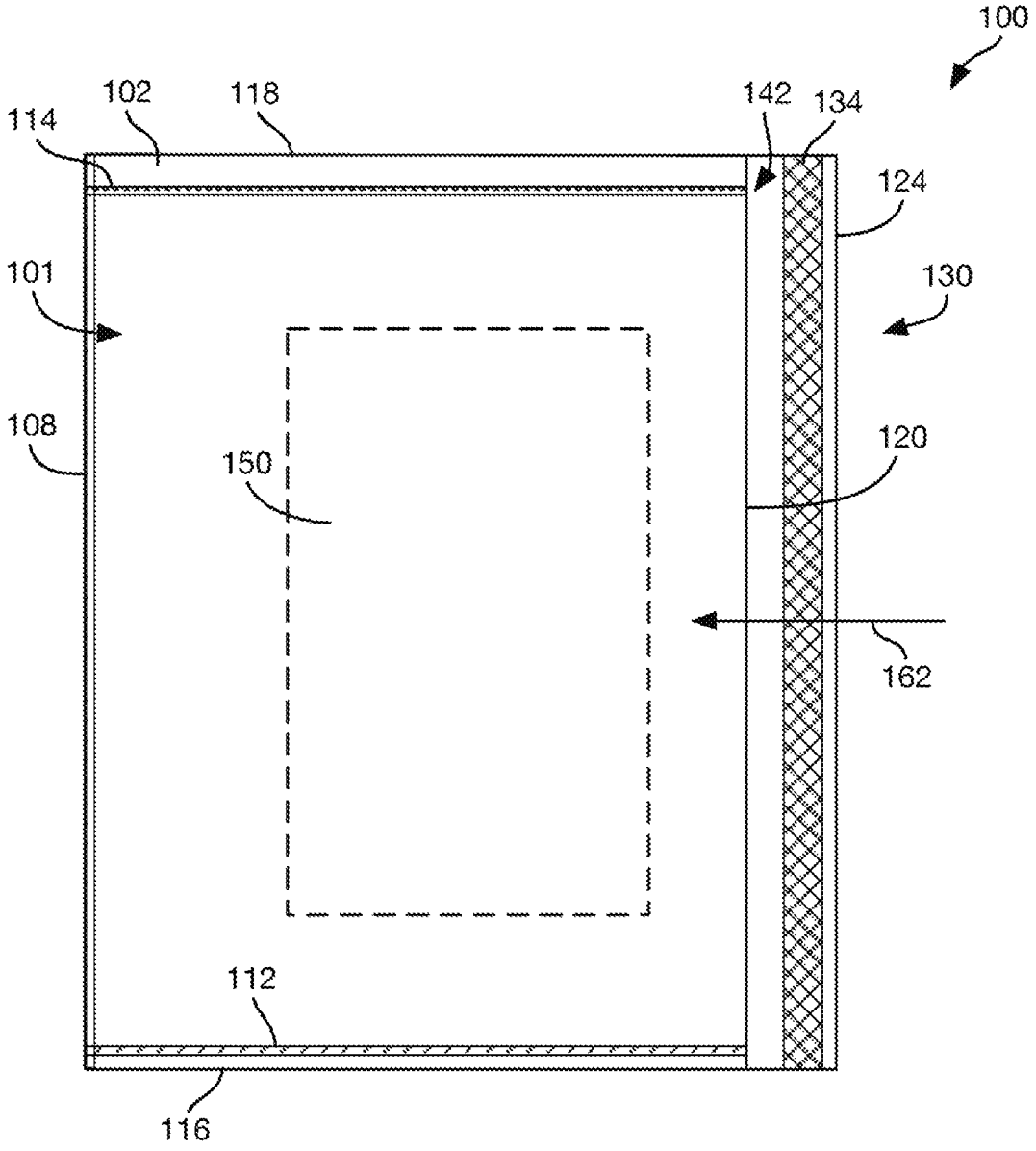
FIG. 75 is a schematic illustration of an exemplary reclosable bag showing a product being loaded into the bag.
Figure 78:
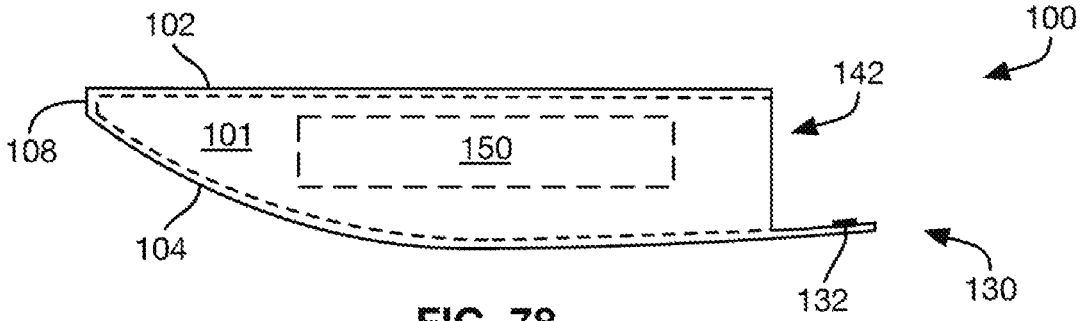
FIG. 78 is a bottom view of the reclosable bag of FIG. 77.
Figure 77:
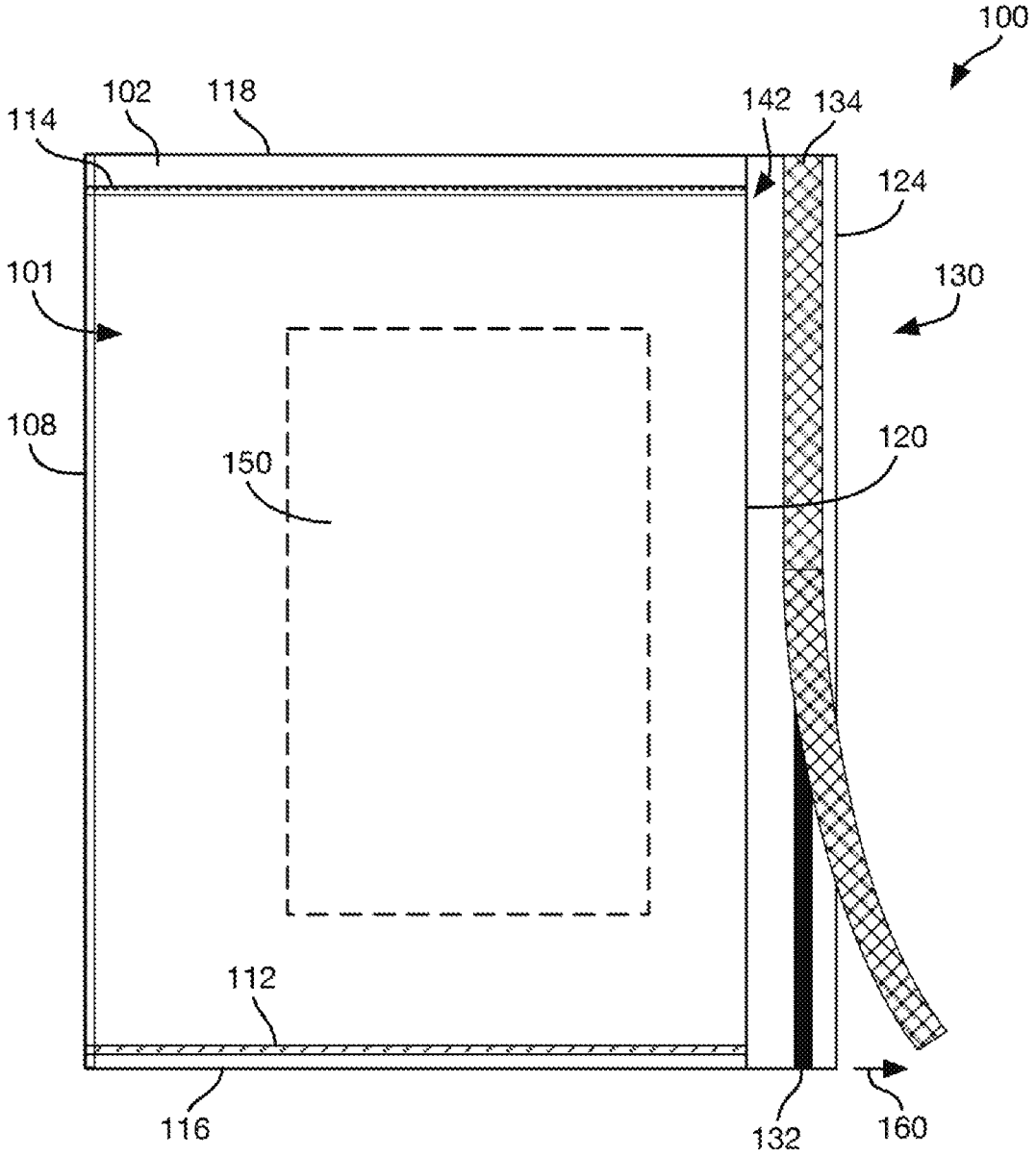
FIG. 77 is a schematic illustration of an exemplary reclosable bag showing a release material being removed.
Figure 80:
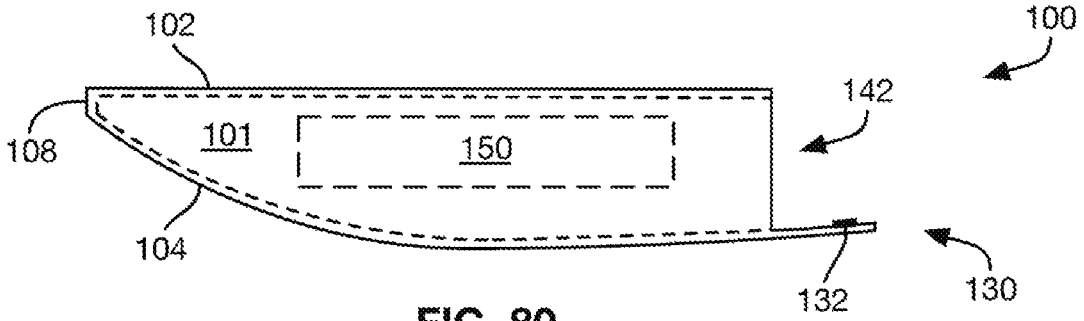
FIG. 80 is a bottom view of the reclosable bag of FIG. 79.
Figure 79:
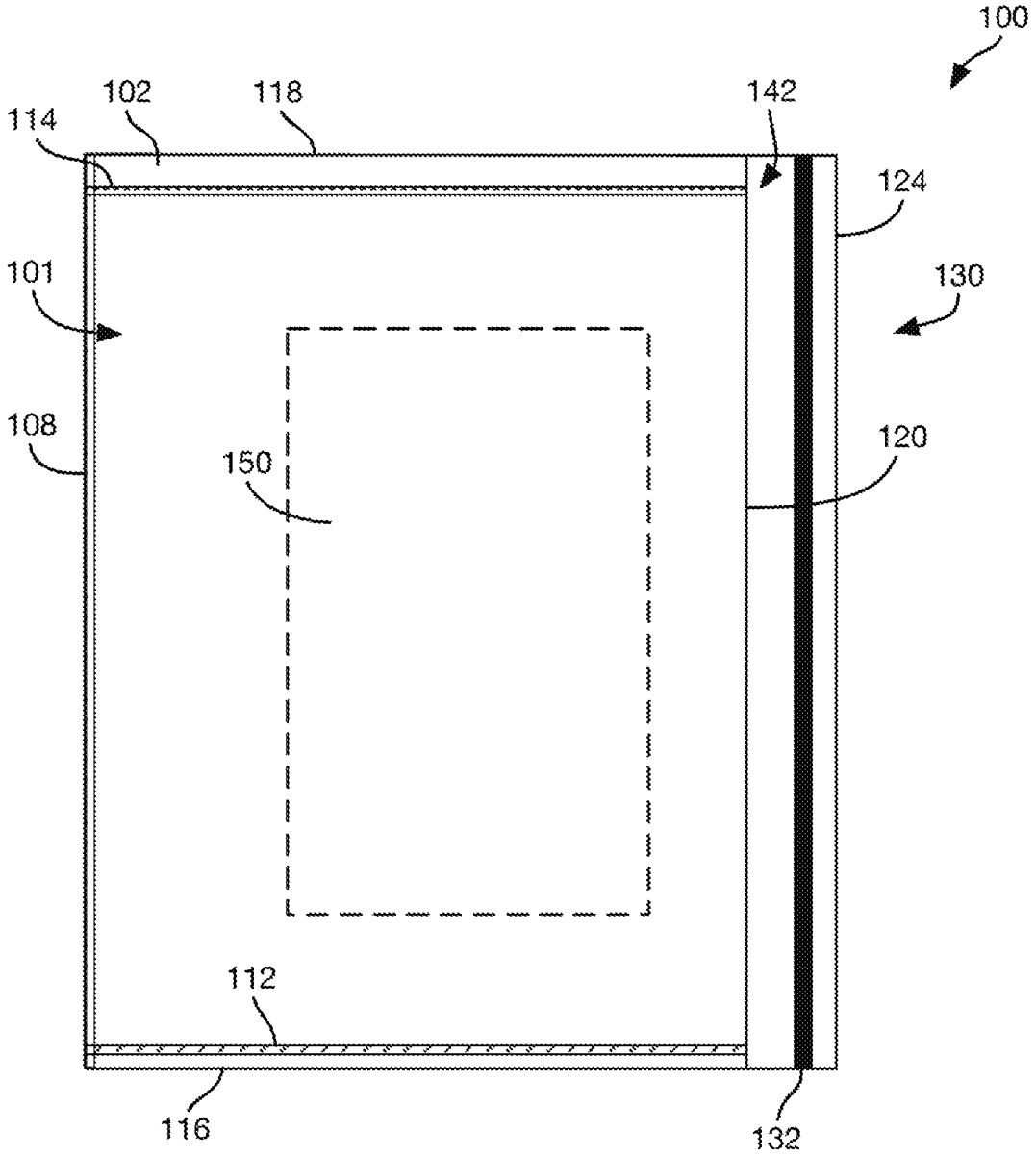
FIG. 79 is a schematic illustration of an exemplary reclosable bag showing a reclosing flap with reclosing material exposed.

The exemplary reclosable bags 100 illustrated in FIGS. 33-58 are used and function in a manner similar to the previously described exemplary reclosable bags 100. For example, the product 150 can be loaded into the bags 100 after separation from the web 10 (FIGS. 37-42) or while part of the web 10 (FIGS. 57-58). The product 150 is removed from the bags 100 by breaking open the bag opening zone 140 (FIGS. 43-46), the reclosing flap 130 is formed by removing the strip of material 144 (FIGS. 47-48), the product 150 is reloaded into the bag 100 (FIGS. 49-50), the releasing material 134 is removed to expose the reclosing material (FIGS. 51-54), and the product 150 is closed within the bag 100 with the reclosing flap 130 by sealing the reclosing material 132 to the bag 100 (FIGS. 55-56). When the product 150 is within the compartment 101 and the compartment 101 has been reclosed, the consumer may return the product to the seller by mail or courier service.

An additional exemplary web 10 of reclosable bags 100 and bags 100 separated from the web 10 are shown in FIGS. 59-90. The web 10 and bags 100 illustrated in FIGS. 59-90 are similar to those of FIGS. 1-32, though the web 10 and bags 100 do not have third opening lines of weakness 126 in the second ply 104. Similar to the web 10 shown in FIGS. 25-26, FIGS. 83-84 show that the product 150 can be loaded into and sealed within the compartment 101 while the bags 100 remain connected in the web 10. Like the webs 10 described above, FIGS. 85-90 show that the web 10 can be configured for loading from the side 106, like the web 10 shown in FIGS. 27-32. Like the bags 10 previously discussed, the bags 100 illustrated in FIGS. 59-90 are opened in the same manner whether the product 150 is loaded from the side or top.

Figure 82:
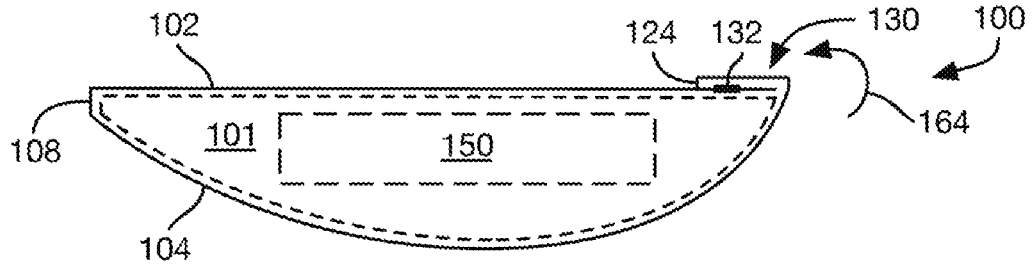
FIG. 82 is a bottom view of the reclosable bag of FIG. 81.
Figure 81:
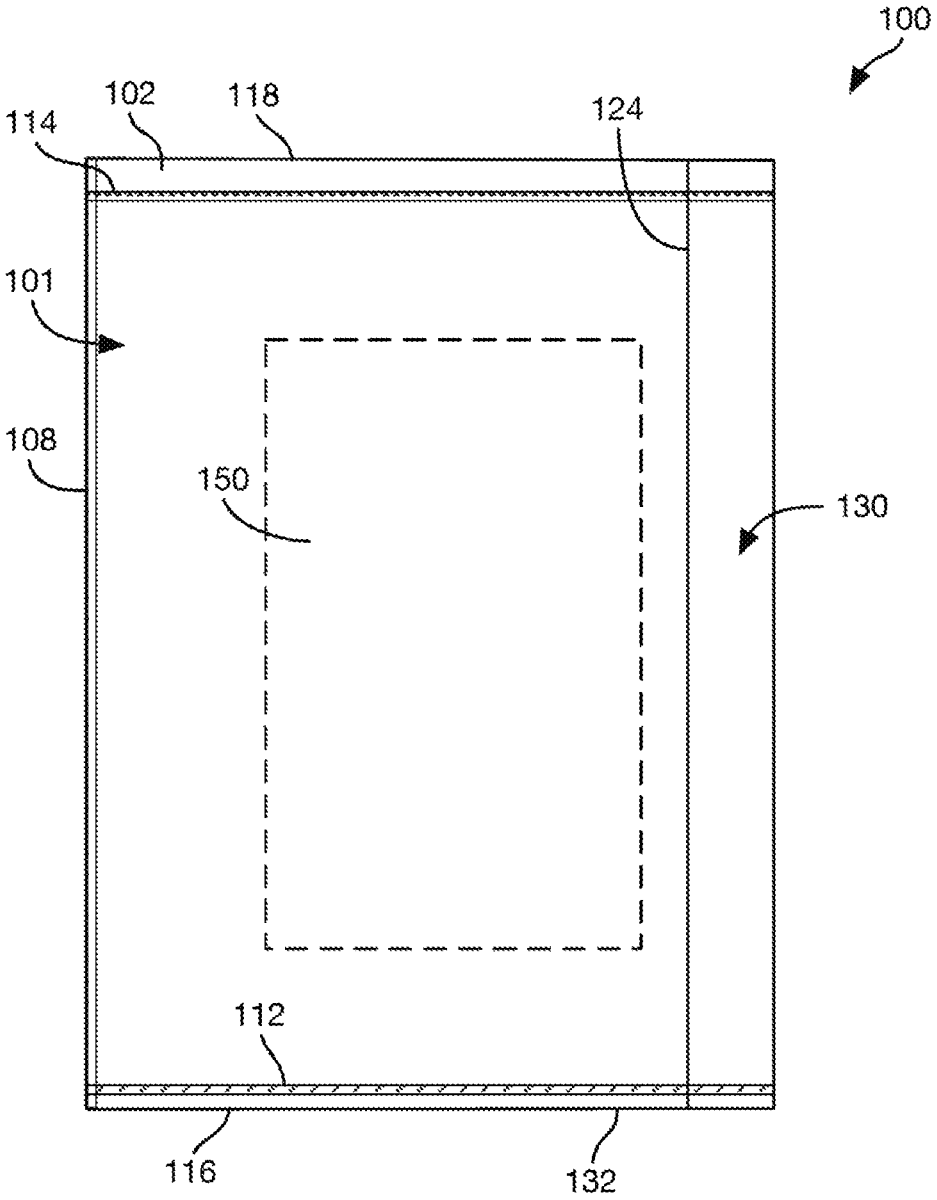
FIG. 81 is a schematic illustration of an exemplary reclosable bag showing the bag reclosed.
Figure 84:
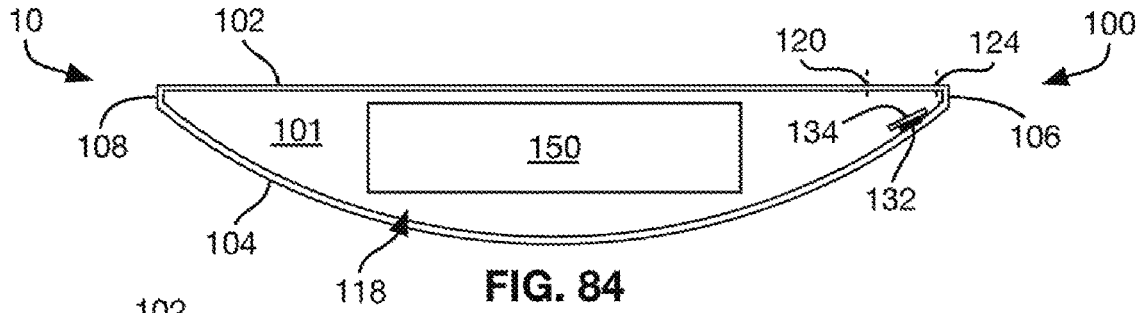
FIG. 84 is a view of the reclosable bag taken along line A-A in FIG. 83.
Figure 83:
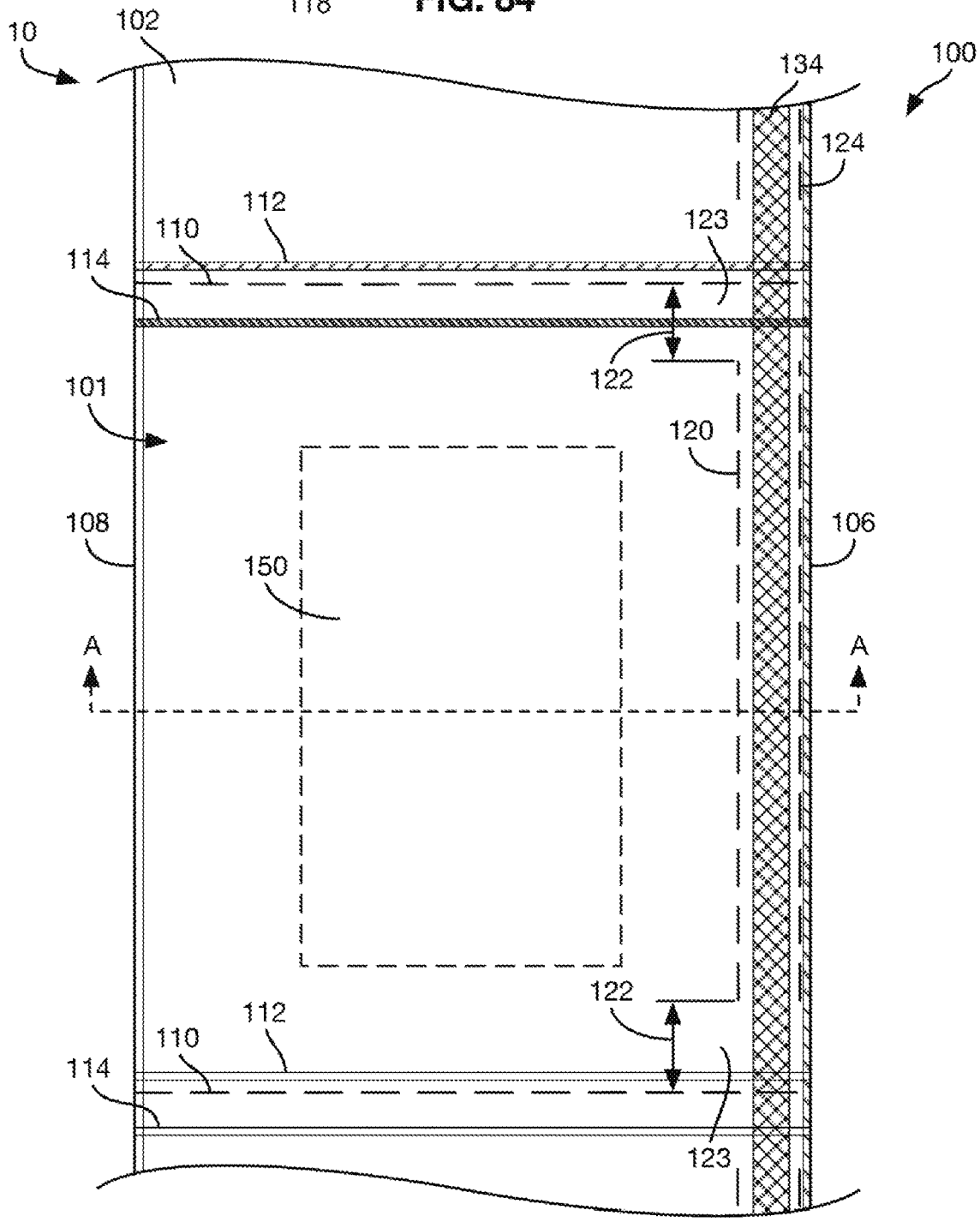
FIG. 83 is a schematic illustration of an exemplary web of reclosable bags with a product loaded in a bag.
Figure 86:
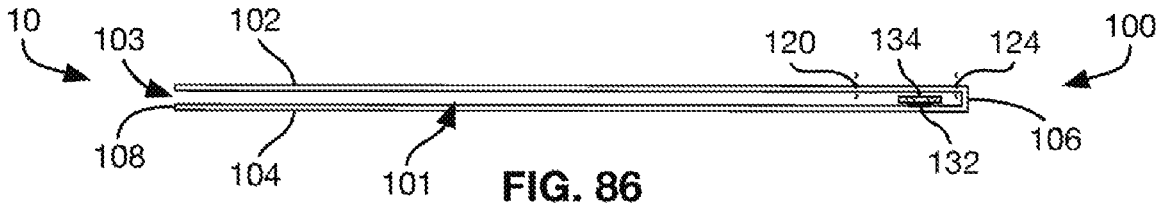
FIG. 86 is a view of the reclosable bag taken along line A-A in FIG. 85.
Figure 85:
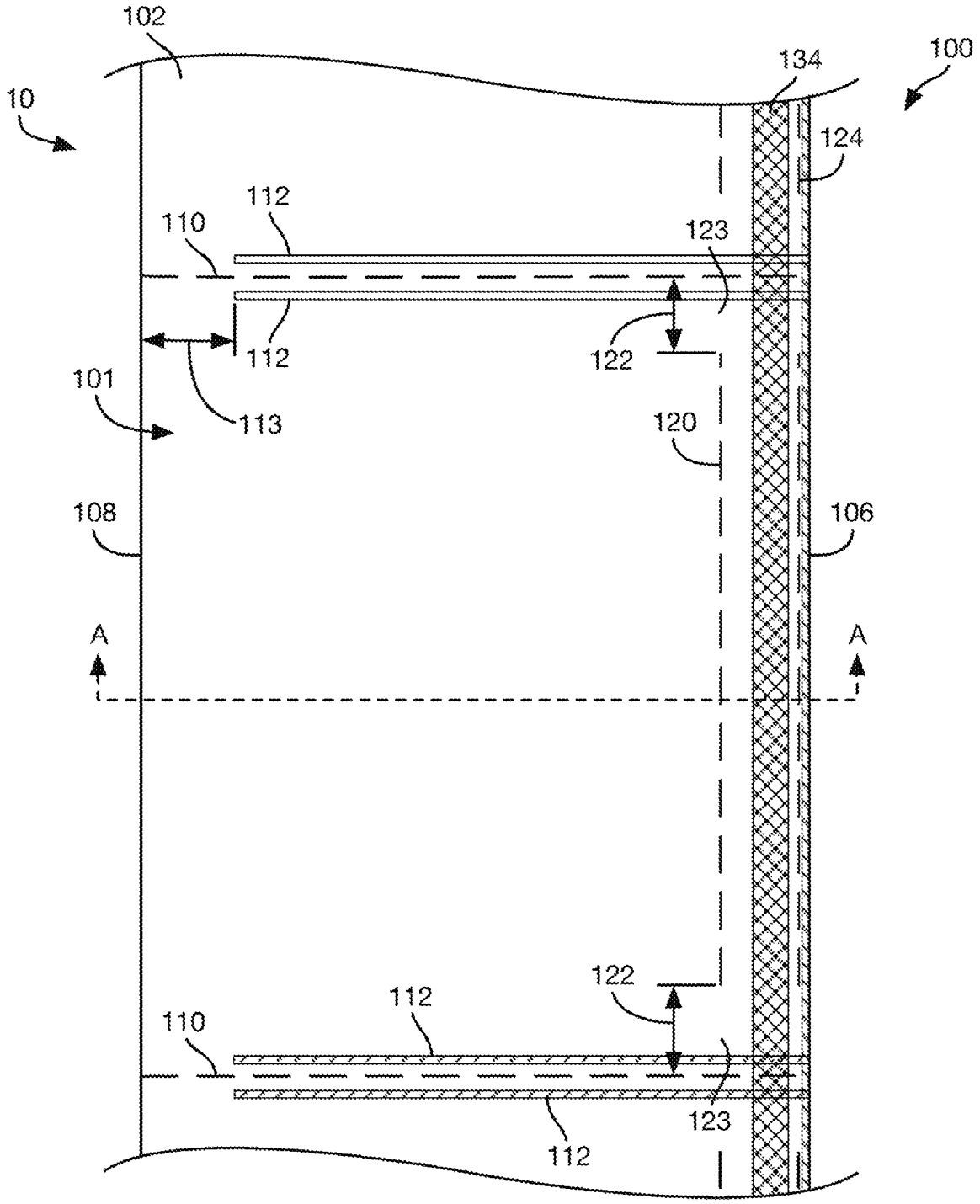
FIG. 85 is a schematic illustration of an exemplary reclosable bag showing web of reclosable bags.
Figure 88:
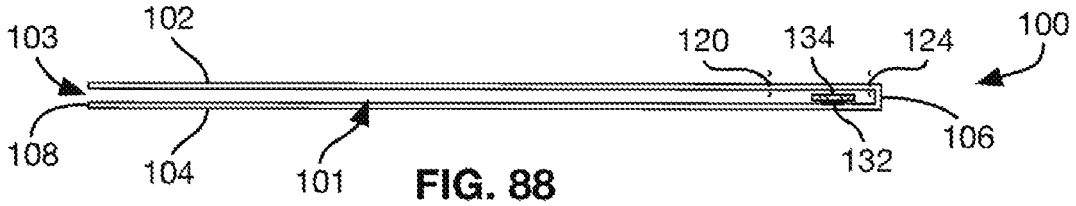
FIG. 88 is a view of the reclosable bag taken along line A-A in FIG. 87.
Figure 87:
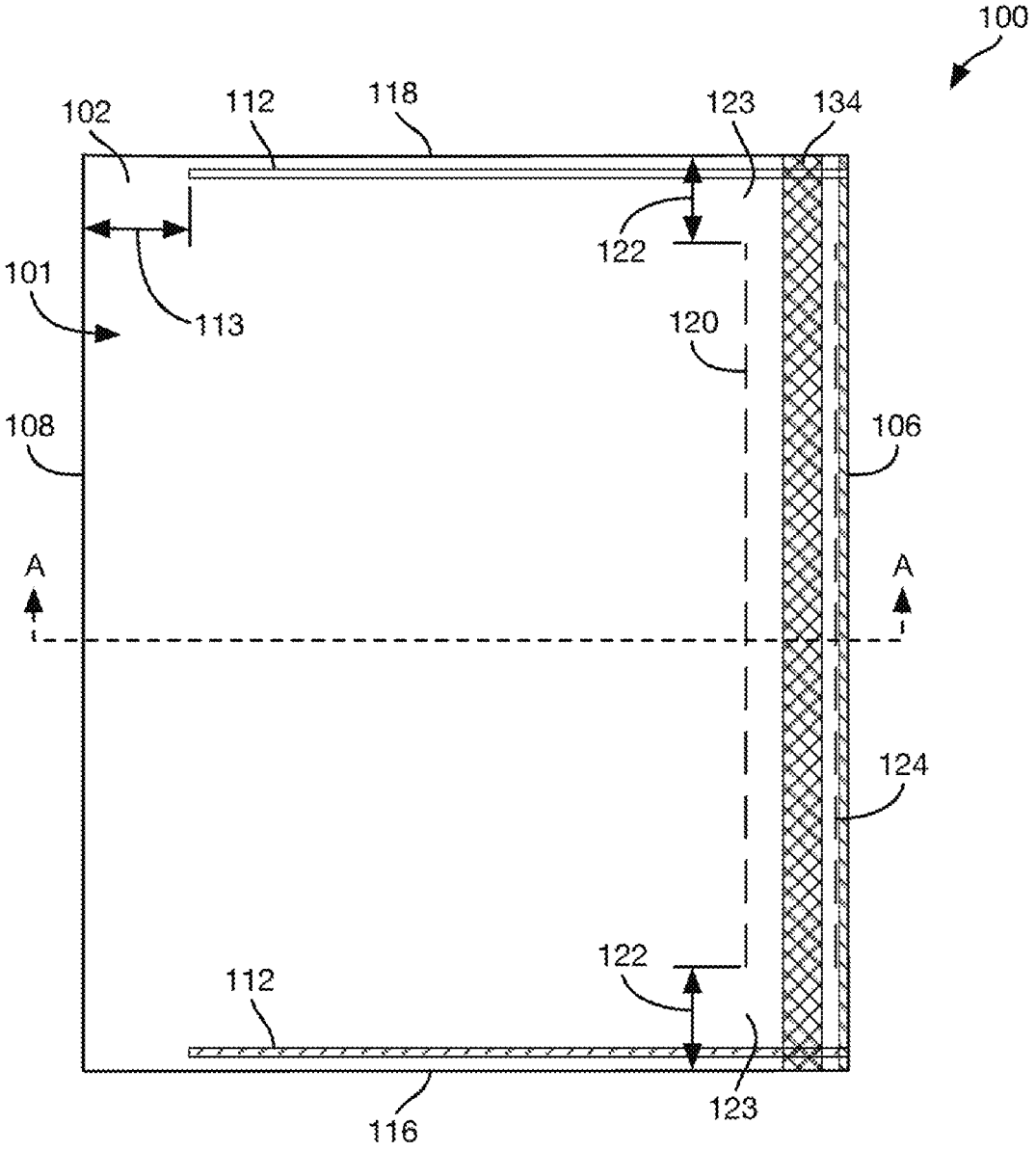
FIG. 87 is a schematic illustration of an exemplary reclosable bag showing an exemplary reclosable bag.
Figure 90:
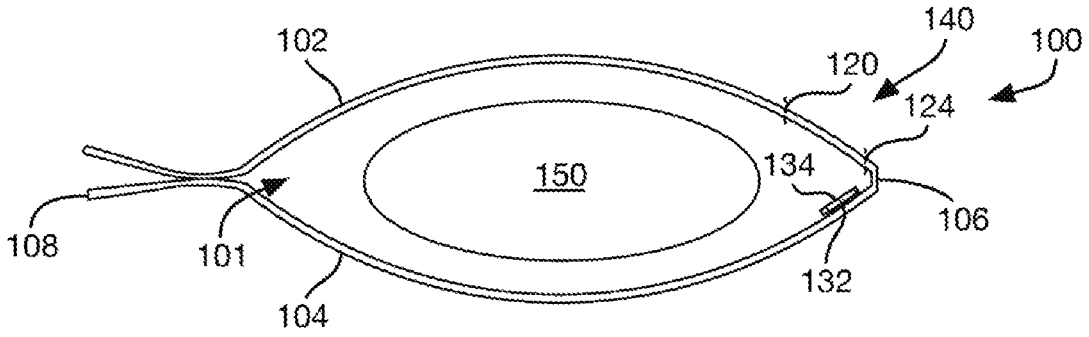
FIG. 90 is a view of the reclosable bag taken along line A-A in FIG. 89.
Figure 89:
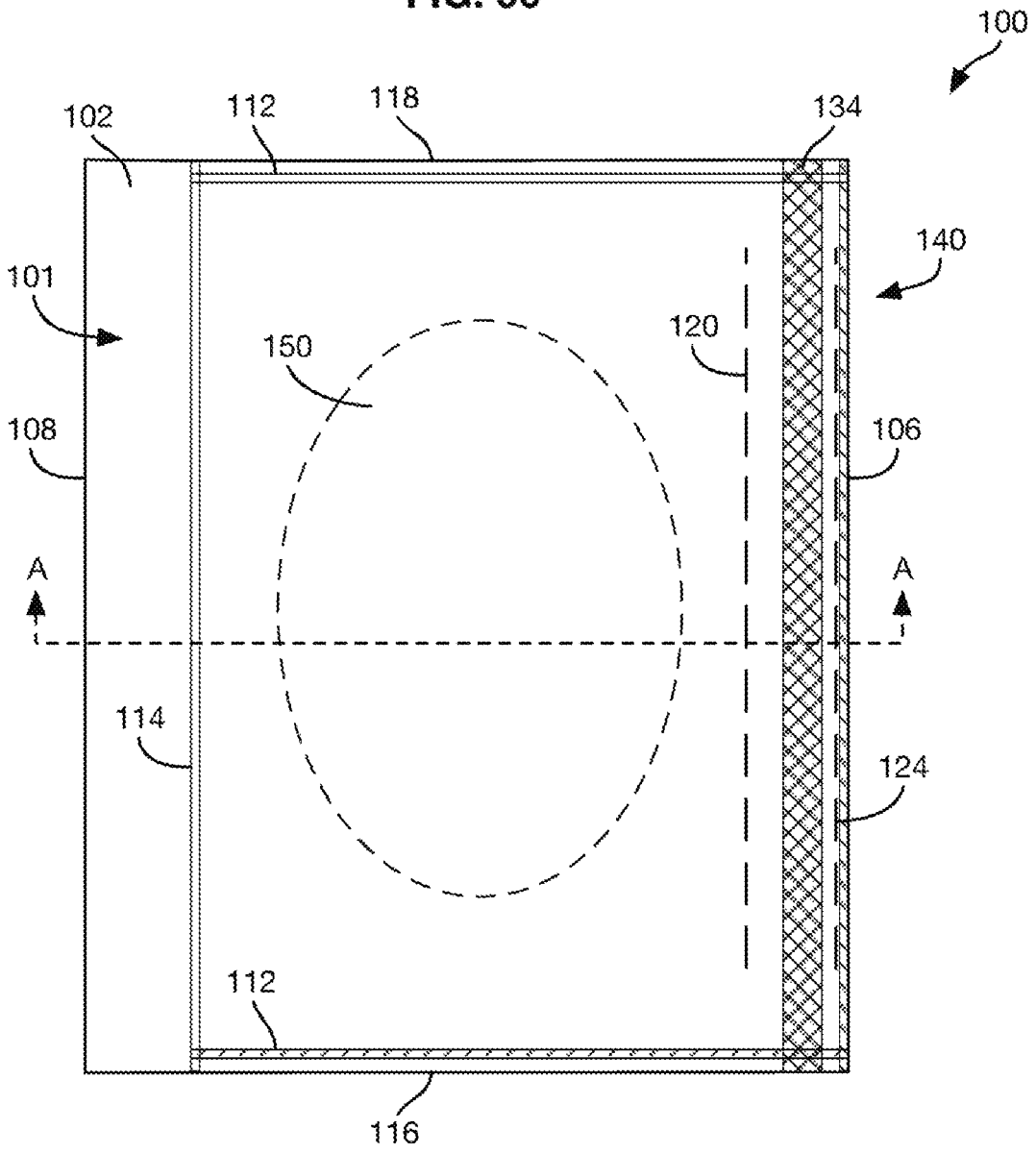
FIG. 89 is a schematic illustration of an exemplary reclosable bag showing an exemplary reclosable bag containing a product.

The exemplary reclosable bags 100 illustrated in FIGS. 59-90 are used and function in a manner similar to the previously described exemplary reclosable bags 100. For example, the product 150 can be loaded into the bags 100 after separation from the web 10 (FIGS. 63-70) or while part of the web 10 (FIGS. 83-84). The product 150 is removed from the bags 100 by breaking open the bag opening zone 140 (FIGS. 69-72), the reclosing flap 130 is formed by removing the strip of material 144 (FIGS. 73-74), the product 150 is reloaded into the bag 100 (FIGS. 75-76), the releasing material 134 is removed to expose the reclosing material (FIGS. 77-80), and the product 150 is closed within the bag 100 with the reclosing flap 130 by sealing the reclosing material 132 to the bag 100 (FIGS. 81-82). When the product 150 is within the compartment 101 and the compartment 101 has been reclosed, the consumer may return the product to the seller by mail or courier service.

In the example illustrated by FIGS. 59-90, the bag opening zone 140 differs from the previously discussed bags, however, in that the opening lines of weakness 120, 124 are formed only in the first ply 102 so that forming the product retrieval opening 142 in the bag opening zone 140 does not involve tearing off the strip of material 141 described above and shown in FIGS. 11 and 43. Instead, the bag 100 can be opened by breaking one of the first or second opening lines of weakness 120, 124 to form the product retrieval opening 142. Alternatively, the strip of material 144 formed between the first and second opening lines of weakness 120, 124 can be torn off to both open the bag 100 and to simultaneously expose the reclosing flap 130. As discussed previously, the release material 134 can be disposed on the first ply 102 opposite the reclosing material 132 so that removal of the strip of material 144 would not only open the bag 100 and form the reclosing flap 130, but would also expose the reclosing material so that the bag 100 was prepared for reclosing.

Figure 92:
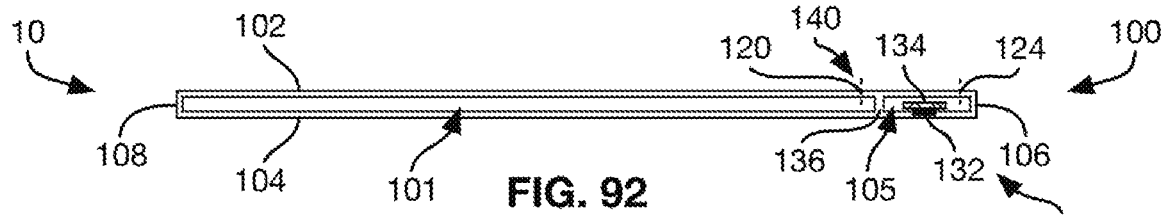
FIG. 92 is a view of the reclosable bag taken along line A-A in FIG. 91.
Figure 91:
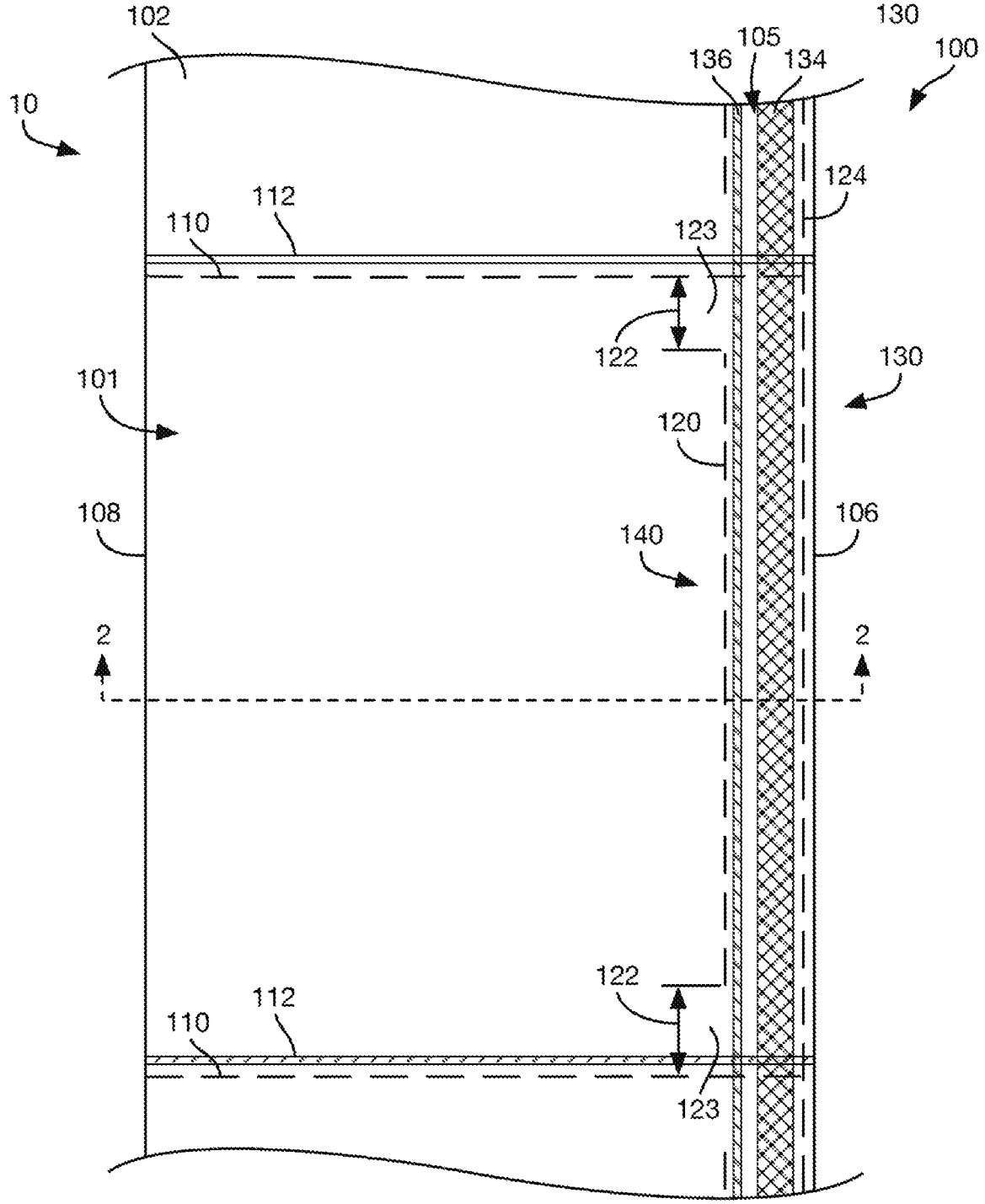
FIG. 91 is a schematic illustration of an exemplary reclosable bag showing an exemplary web of reclosable bags.
Figure 94:
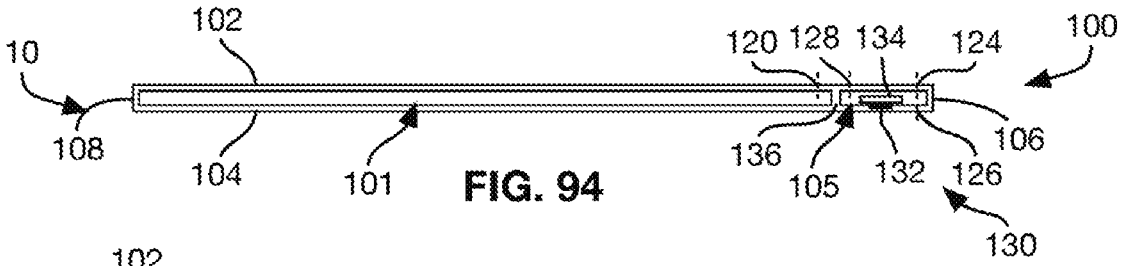
FIG. 94 is a view of the reclosable bag taken along line A-A in FIG. 93.
Figure 93:
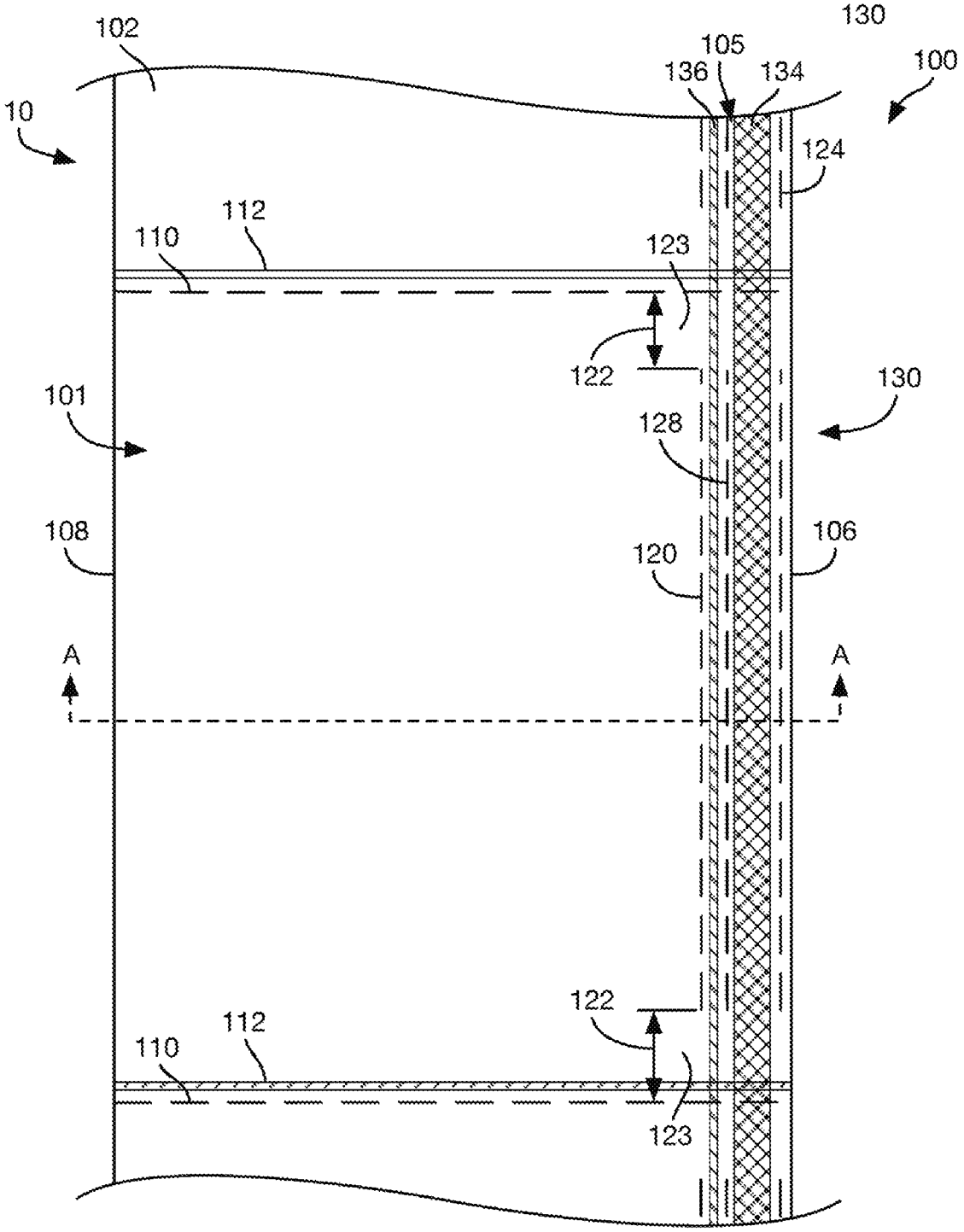
FIG. 93 is a schematic illustration of an exemplary reclosable bag showing an exemplary web of reclosable bags.
Figure 96:
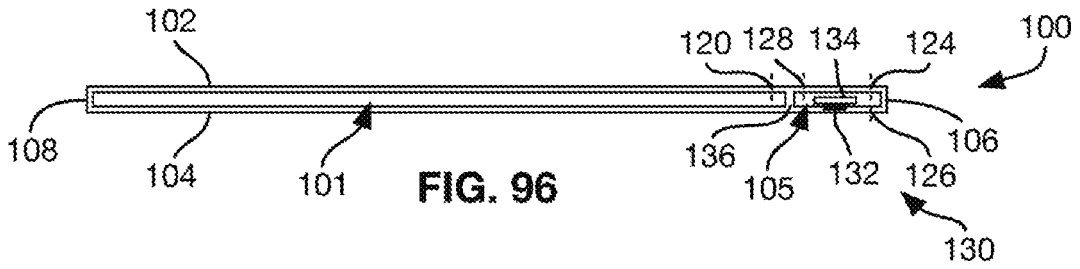
FIG. 96 is a view of the reclosable bag taken along line A-A in FIG. 95.
Figure 95:
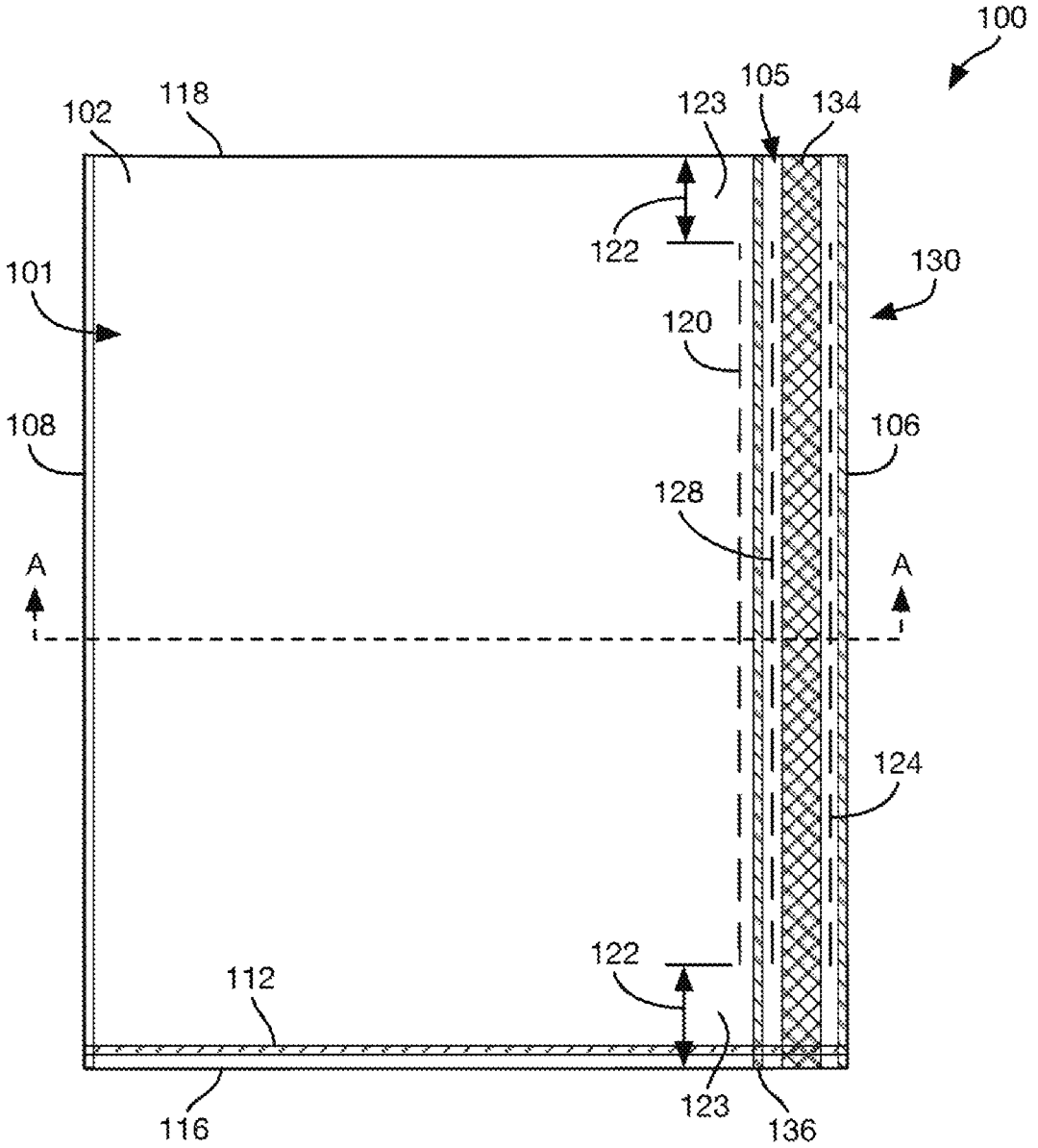
FIG. 95 is a schematic illustration of an exemplary reclosable bag showing an exemplary reclosable bag.
Figure 98:
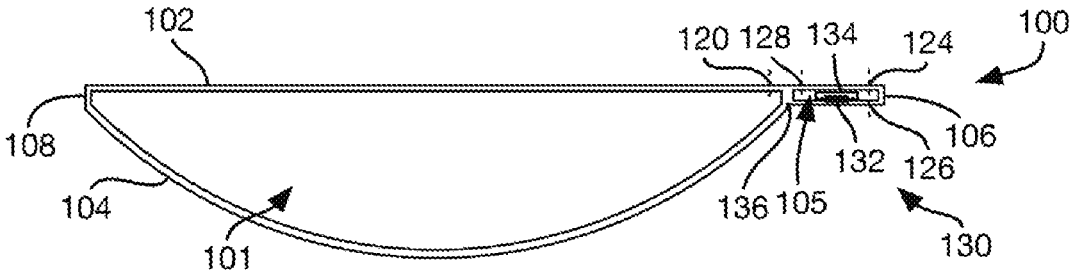
FIG. 98 is a view of the reclosable bag taken along line A-A in FIG. 97.
Figure 97:
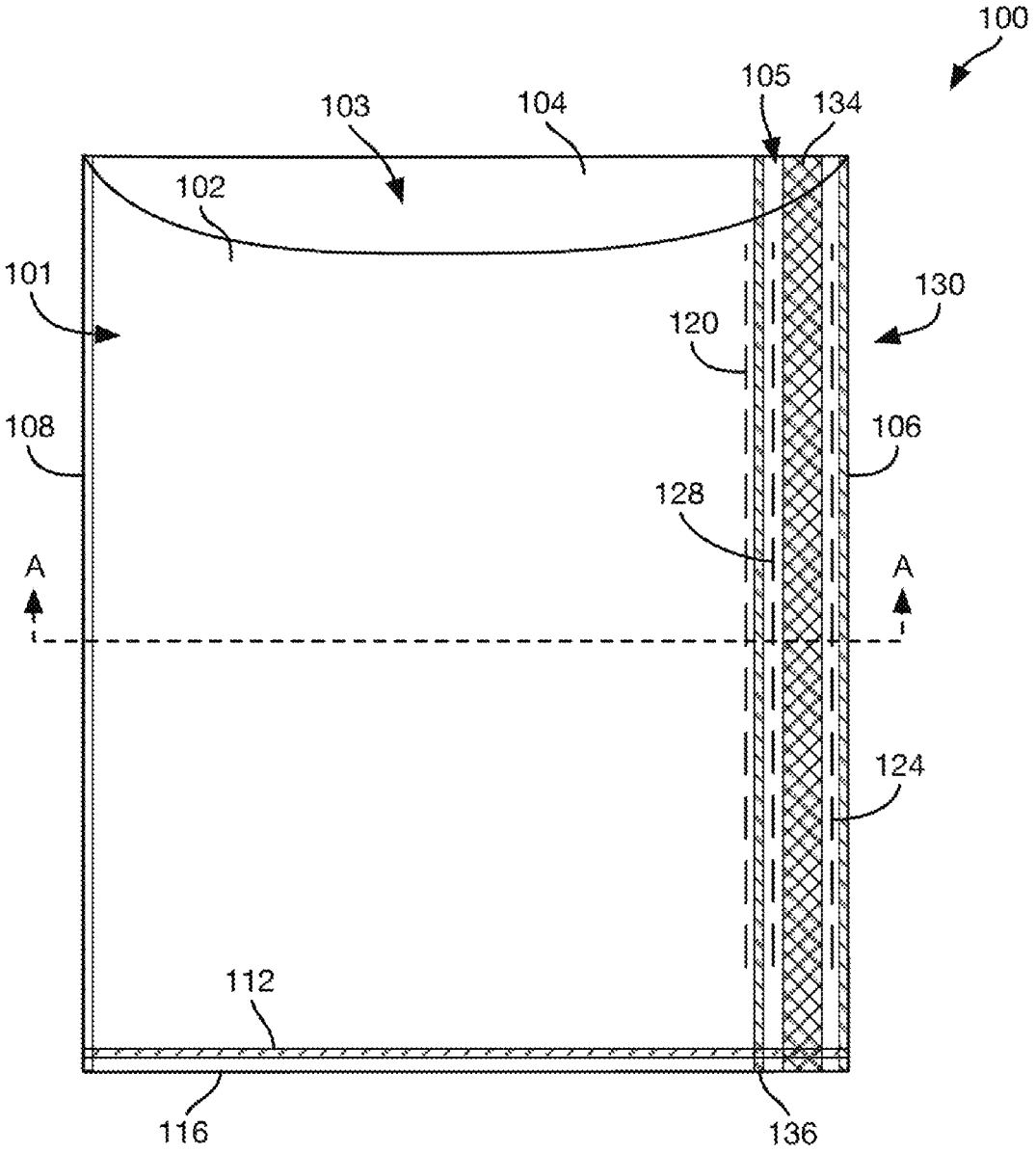
FIG. 97 is a schematic illustration of an exemplary reclosable bag showing an opening for receiving a product.
Figure 100:
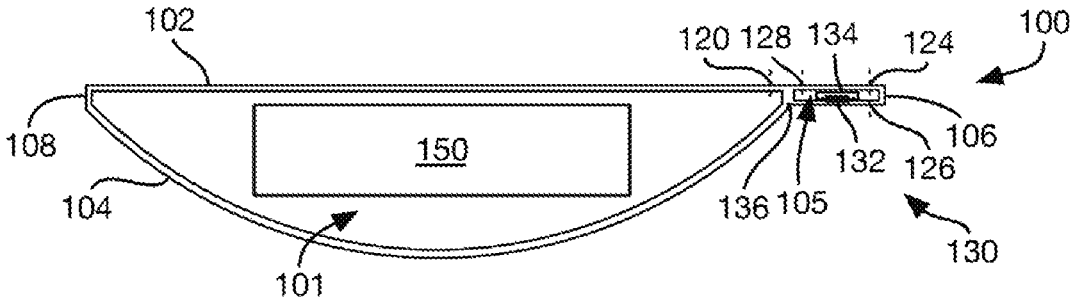
FIG. 100 is a view of the reclosable bag taken along line A-A in FIG. 99.
Figure 99:
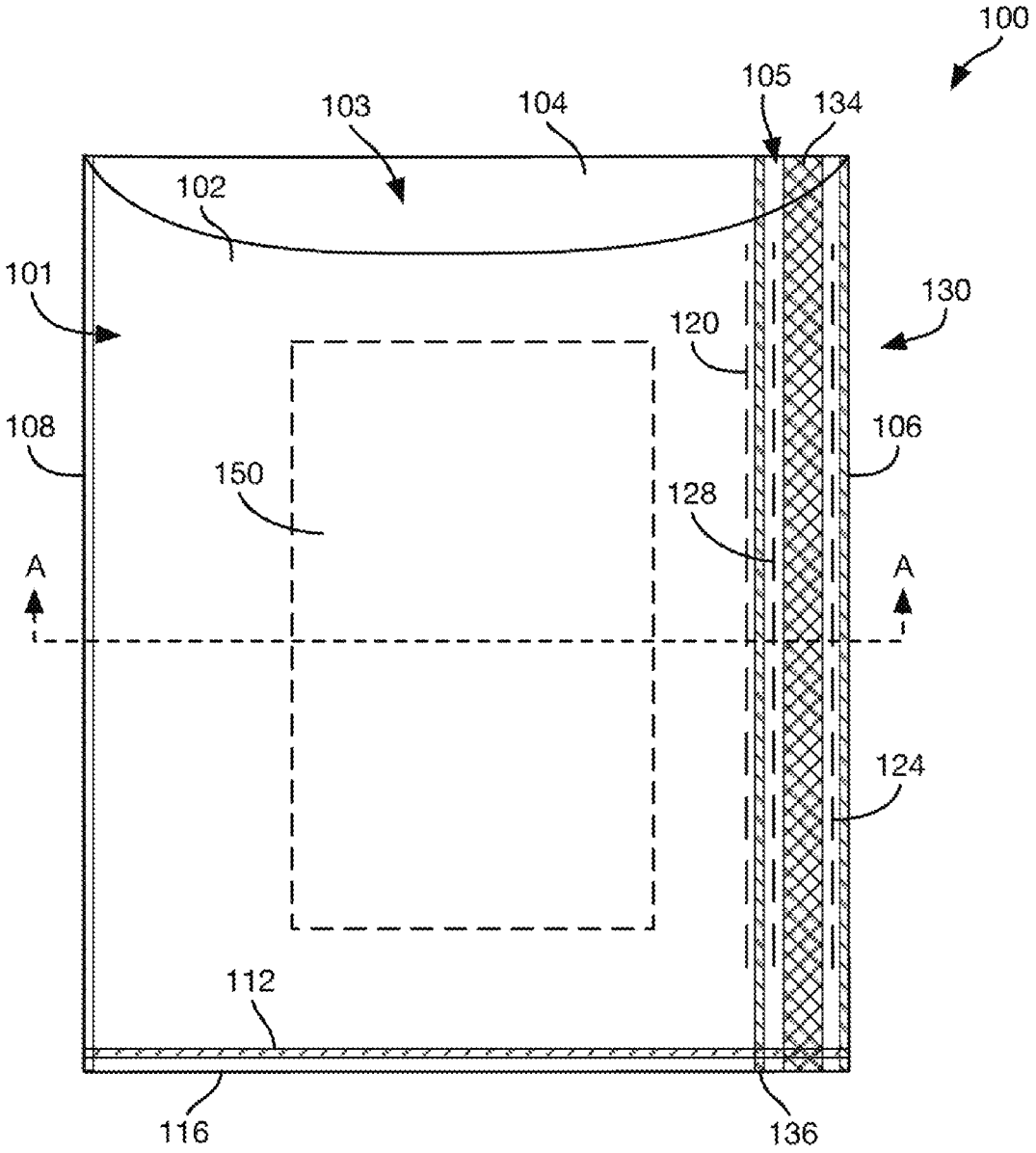
FIG. 99 is a schematic illustration of an exemplary reclosable bag with a product loaded into the bag.
Figure 102:
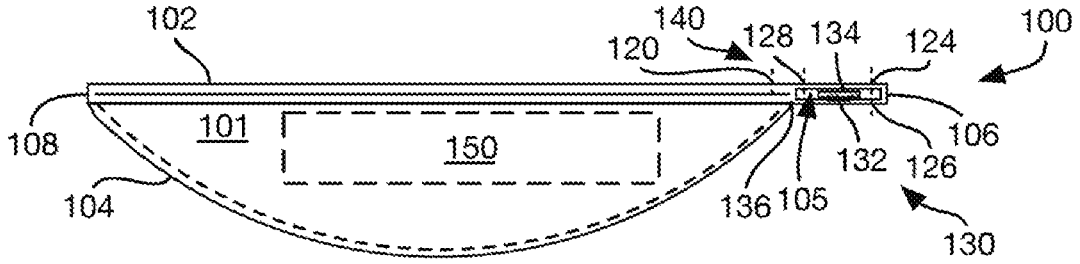
FIG. 102 is a bottom view of the reclosable bag of FIG. 101.
Figure 101:
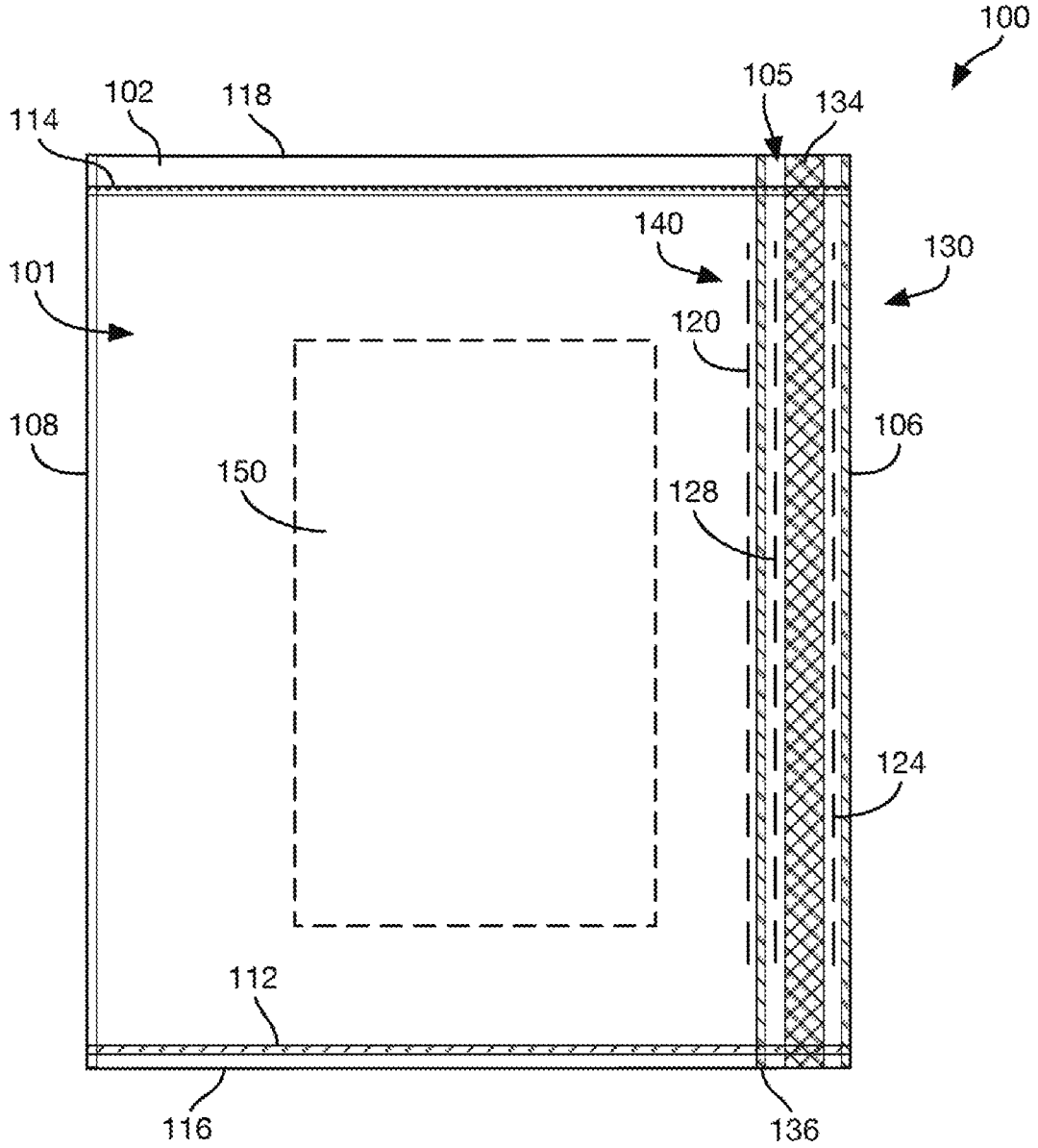
FIG. 101 is a schematic illustration of an exemplary reclosable bag containing a product.

An additional exemplary web 10 of reclosable bags 100 is shown in FIGS. 91-92 that is similar to the web 10 and bags 100 of FIGS. 59-90 in that the web 10 of reclosable bags 100 shown in FIGS. 91-92 has first and second opening lines of weakness 120, 124 in the first ply 102 and no opening lines of weakness in the second ply 104. The web 10 shown in FIGS. 91-92 differs from previously discussed webs, however, in that the web 10 includes an isolating or dividing seal 136 between the first opening line of weakness 120 and the reclosing and releasing materials 132, 134 that forms a separate reclosing flap compartment 105 that is isolated from the compartment 101 of the bag 100. The dividing seal 136 separates the product 150 loaded into the compartment 101 from the reclosing and releasing materials 132, 134 so that the product 150 does not inadvertently remove the releasing material 134 from the reclosing material 132 during shipment. Similar to the web 10 shown in FIGS. 25-26, the product 150 can be loaded into and sealed within the compartment 101 while the bags 100 remain connected in the web 10. Like the webs 10 described above, the web 10 shown in FIGS. 91-92 can be configured for loading from the side 106, as shown in FIGS. 27-32. Like the bags 100 previously discussed, the bags 100 illustrated in FIGS. 91-92 are opened in the same manner whether the product 150 is loaded from the side or top.

The exemplary reclosable bags 100 illustrated in FIGS. 91-92 are used and function in a manner similar to the previously described exemplary reclosable bags 100. For example, the product 150 can be loaded into the bags 100 after separation from the web 10 or while part of the web 10. The product 150 is removed from the bags 100 by breaking open the bag opening zone 140 formed by the first opening line of weakness 120. The product 150 can be reloaded into the bag 100 through the product retrieval opening (not shown) formed by the broken first opening line of weakness 120. The reclosing flap compartment 105 is then opened by breaking the second opening line of weakness 124 and the releasing material 134 is removed to expose the reclosing material 132. The product 150 is then closed within the bag 100 with the reclosing flap 130 by sealing the reclosing material 132 to the bag 100. In some embodiments, the releasing material 134 is attached to the first ply 102 of the reclosing flap compartment 105 so that breaking the second opening line of weakness 124 and pulling back the first ply 102 simultaneously exposes the reclosing material 132. Breaking the second opening line of weakness 124 forms a flap of material between the dividing seal 136 and the second opening line of weakness 124 that can be torn away along the dividing seal 136 or tucked inside the compartment 101 through the product retrieval opening to avoid obstructing the reclosing material 132 when the reclosing flap 130 is folded over to reclose the bag 100. When the product 150 is within the compartment 101 and the compartment 101 has been reclosed, the consumer may return the product to the seller by mail or courier service.

An additional exemplary web 10 of reclosable bags 100 and bags 100 separated from the web 10 are shown in FIGS. 93-124 that combine features of the webs 10 and bags 100 described above. The web 10 of reclosable bags 100 of FIGS. 93-124 includes first, second, and third opening lines of weakness 120, 124, 126 like the web 10 of reclosable bags 100 shown in FIGS. 1-32 and also includes the dividing seal 136 separating the compartment 101 from the reclosing flap compartment 105 like the web 10 of reclosable bags 100 shown in FIGS. 91-92. The web 10 of reclosable bags 100 of FIGS. 93-124 differs from the previously discussed webs 10 in that the web 10 of reclosable bags 100 of FIGS. 93-124 includes a fourth opening line of weakness 128 arranged between the dividing seal 136 and the reclosing and releasing materials 132, 134. Similar to the web 10 shown in FIGS. 25-26, FIGS. 117-118 show that the product 150 can be loaded into and sealed within the compartment 101 while the bags 100 remain connected in the web 10. Like the webs 10 and reclosable bags 100 described above, the web 10 and reclosable bags 100 shown in FIGS. 93-124 can be configured for loading from the side 106, as shown in FIGS. 119-124. Like the bags 100 previously discussed, the bags 100 illustrated in FIGS. 93-124 are opened in the same manner whether the product 150 is loaded from the side or top.

Figure 104:
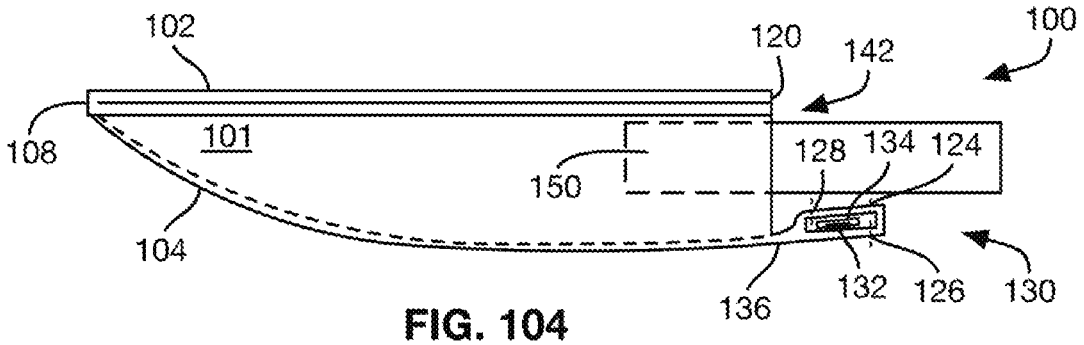
FIG. 104 is a bottom view of the reclosable bag of FIG. 103.
Figure 103:
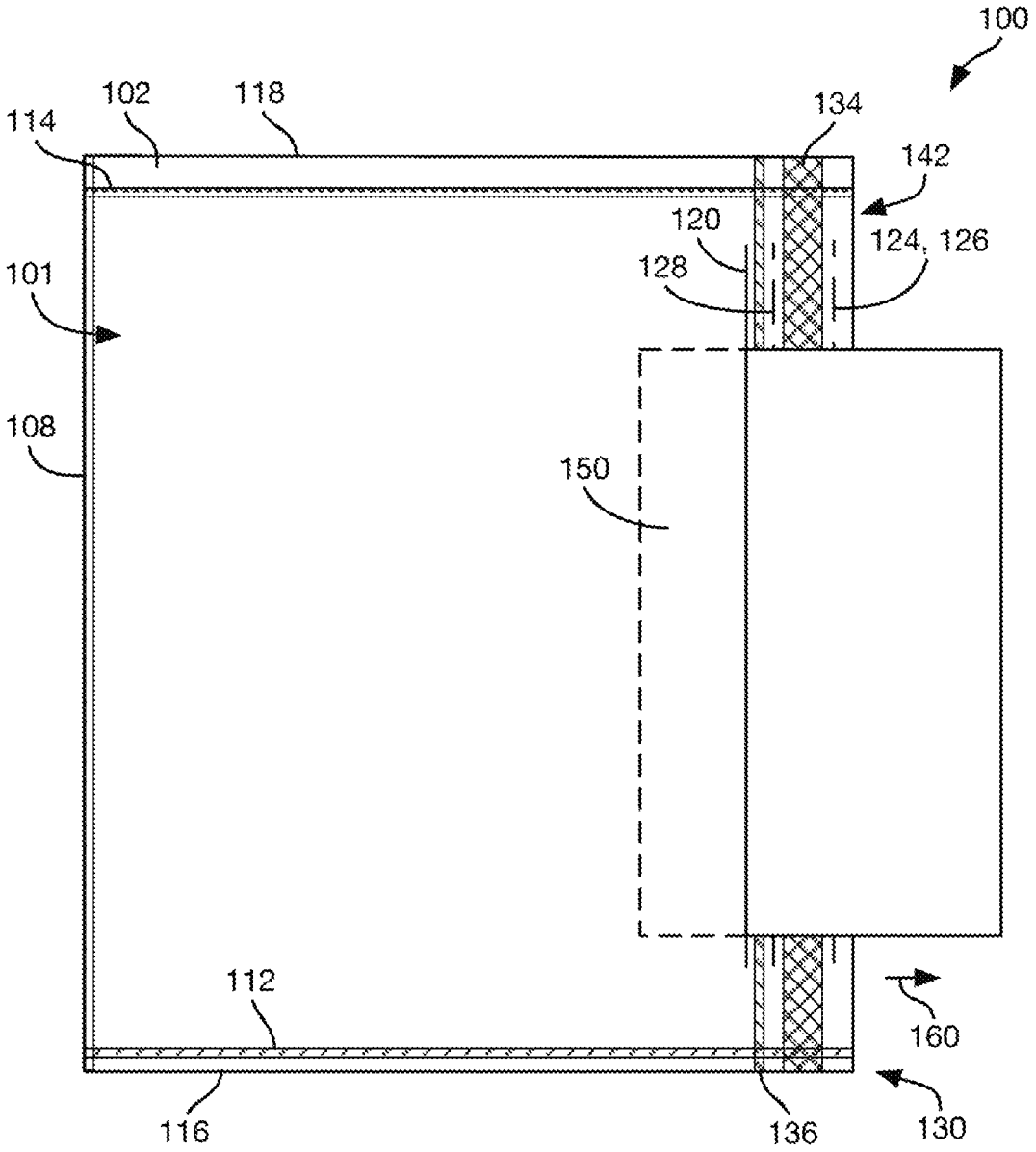
FIG. 103 is a schematic illustration of an exemplary reclosable bag showing a product being removed through an opening.
Figure 106:
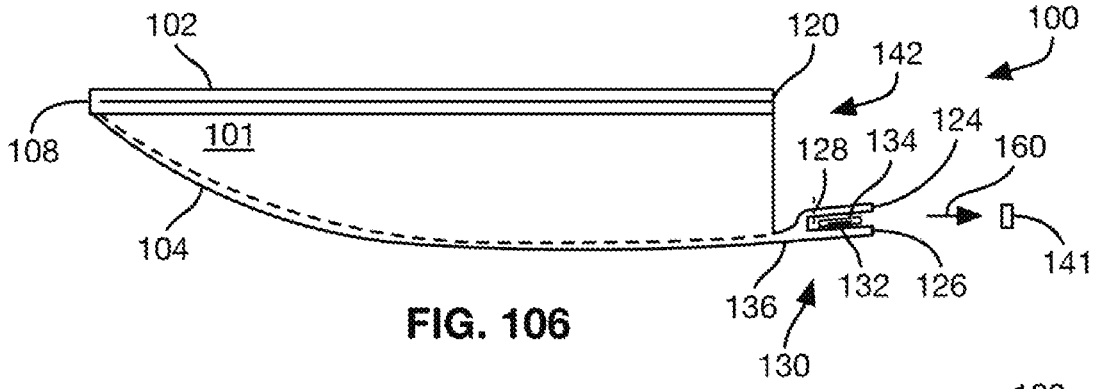
FIG. 106 is a bottom view of the reclosable bag of FIG. 105.
Figure 105:
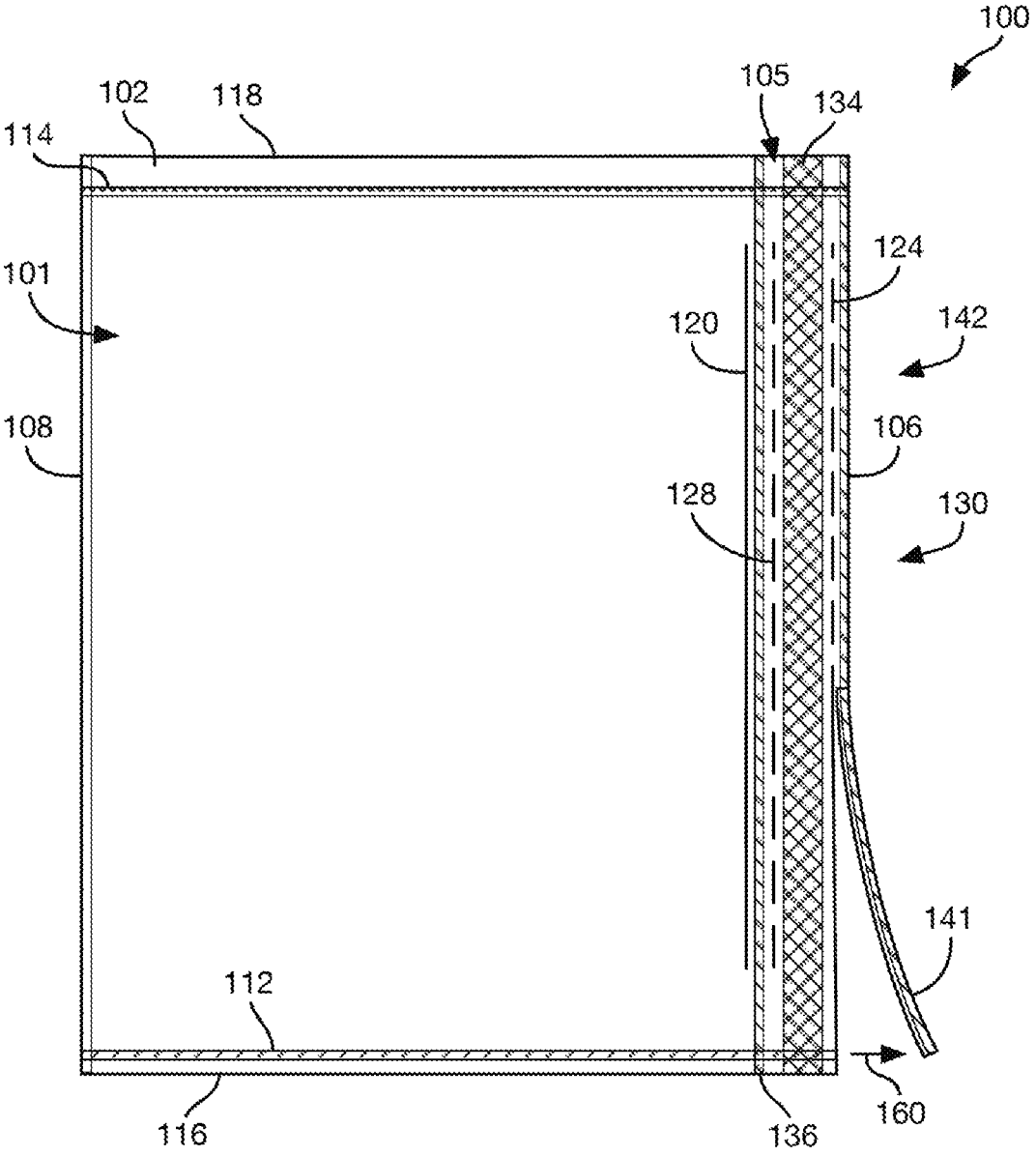
FIG. 105 is a schematic illustration of an exemplary reclosable bag showing a compartment of a reclosing flap being opened.
Figure 108:
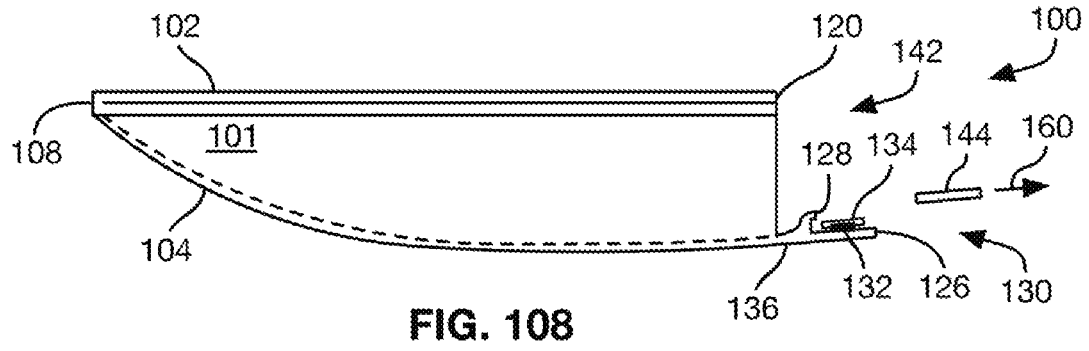
FIG. 108 is a bottom view of the reclosable bag of FIG. 107.
Figure 107:
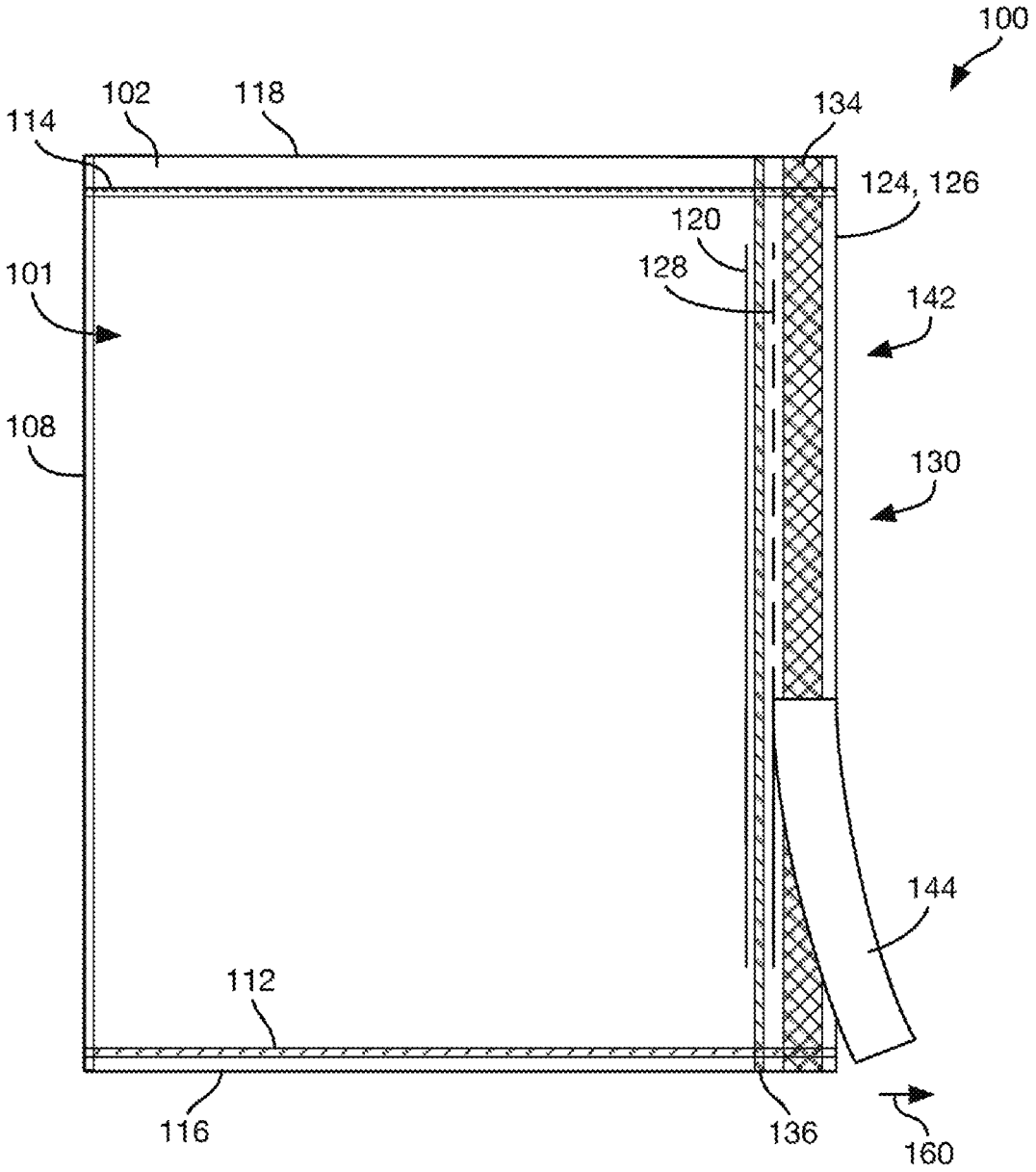
FIG. 107 is a schematic illustration of an exemplary reclosable bag showing reclosing and release material of a reclosing flap being exposed.
Figure 110:
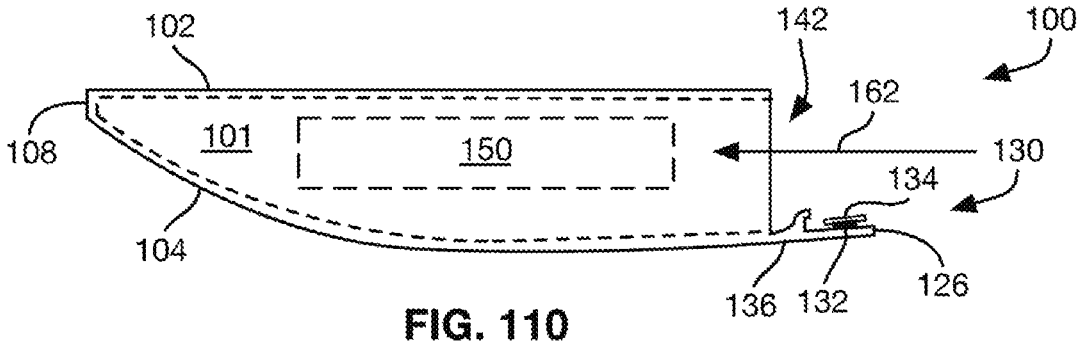
FIG. 110 is a bottom view of the reclosable bag of FIG. 109.
Figure 109:
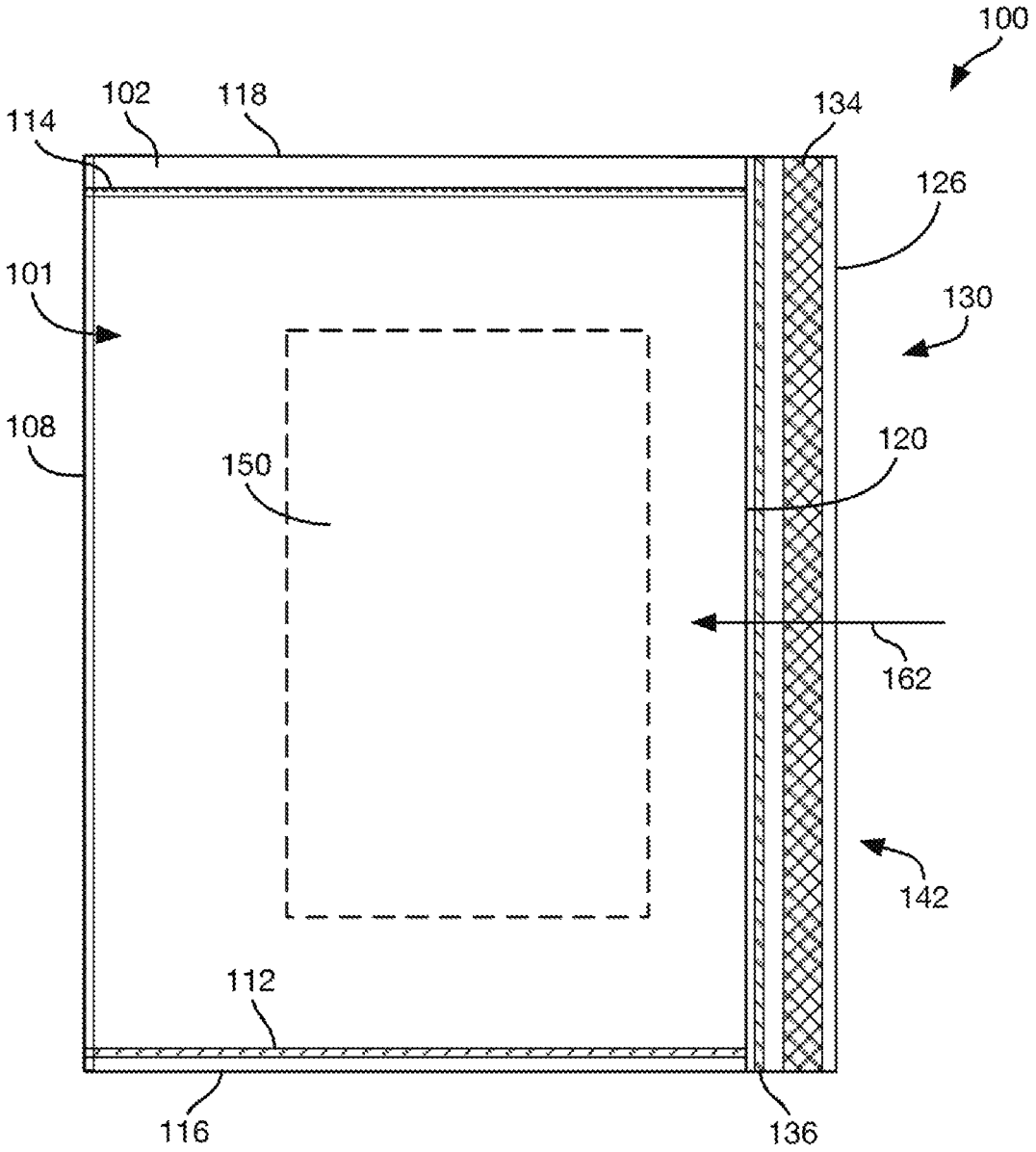
FIG. 109 is a schematic illustration of an exemplary reclosable bag showing a product being loaded into the bag.
Figure 112:
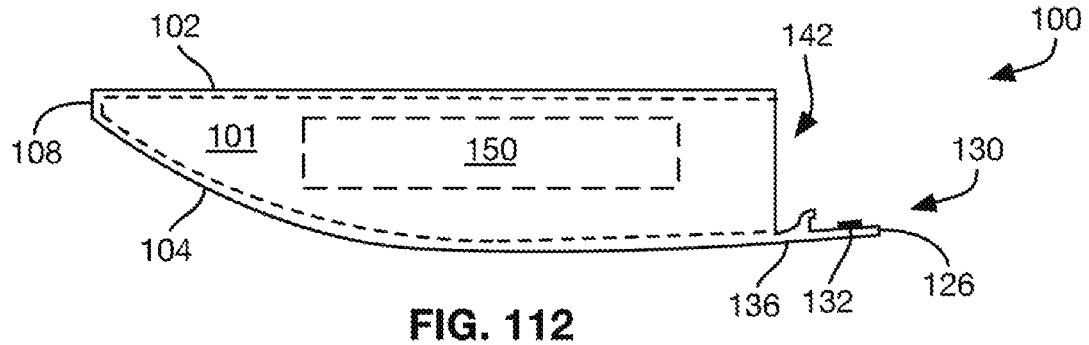
FIG. 112 is a bottom view of the reclosable bag of FIG. 111.
Figure 111:
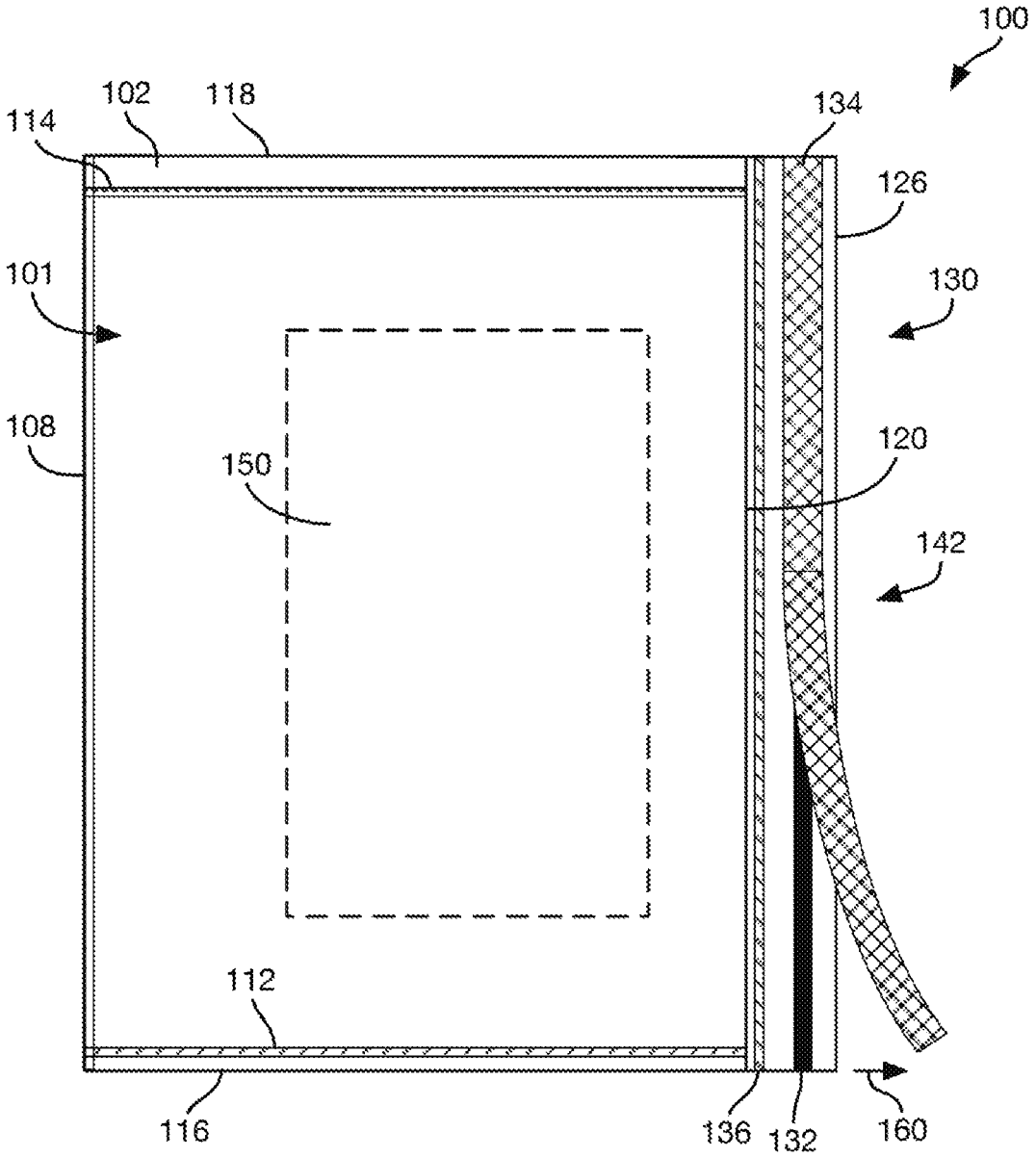
FIG. 111 is a schematic illustration of an exemplary reclosable bag showing a release material being removed.
Figure 114:
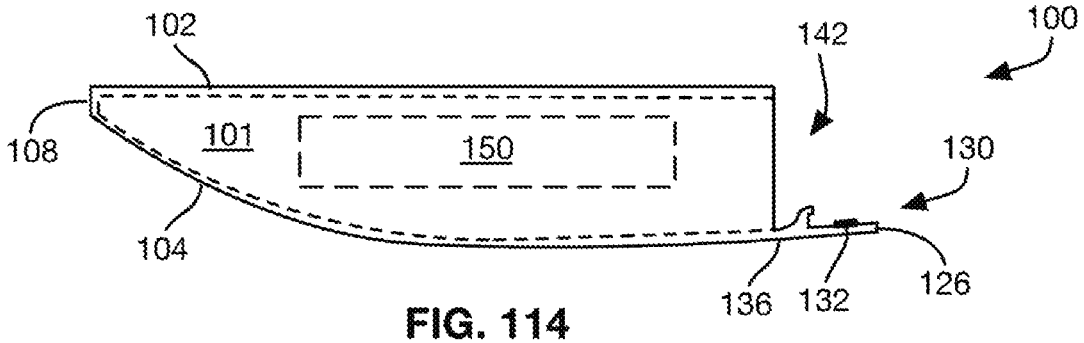
FIG. 114 is a bottom view of the reclosable bag of FIG. 113.
Figure 113:
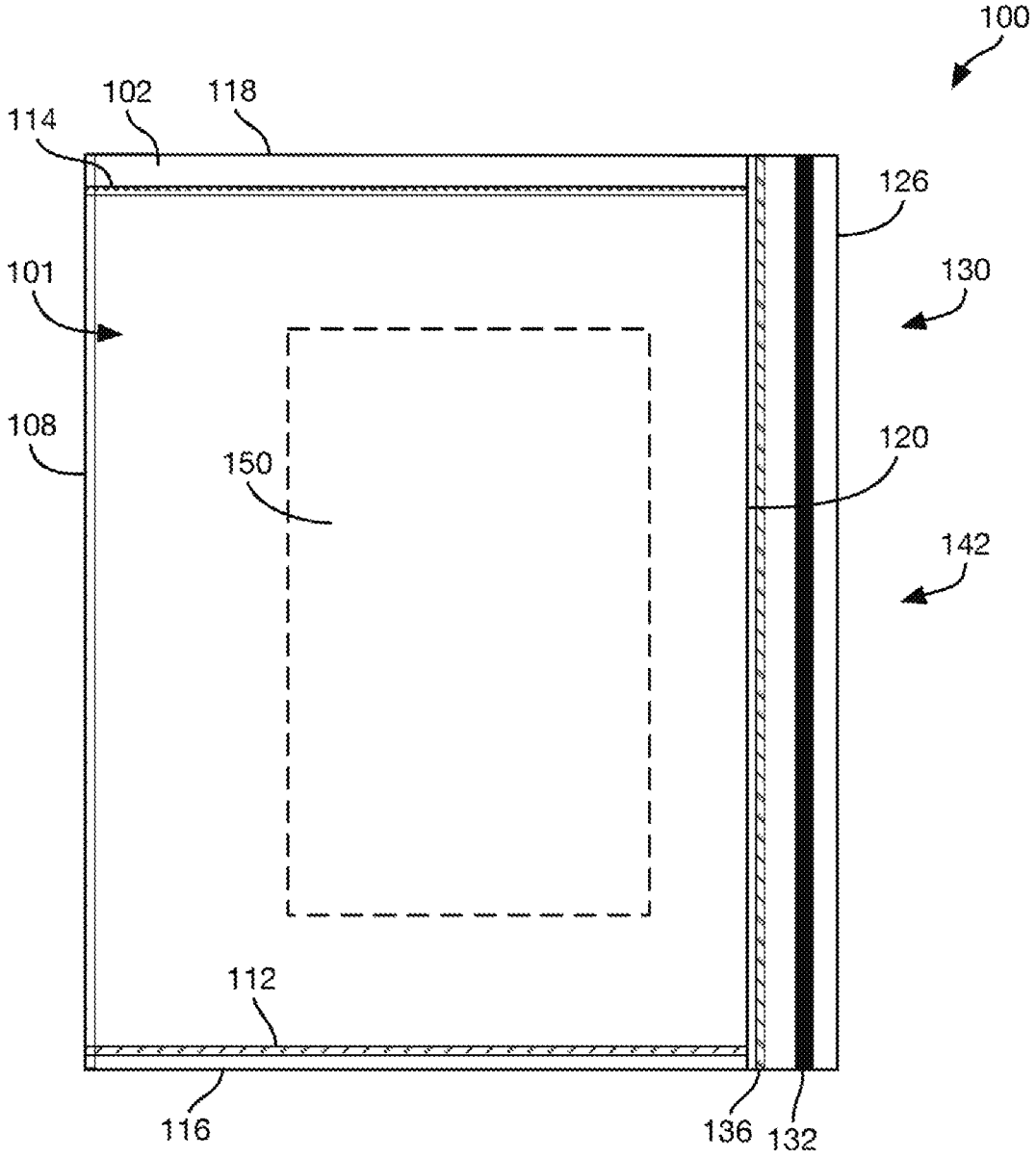
FIG. 113 is a schematic illustration of an exemplary reclosable bag showing a reclosing flap with reclosing material exposed.
Figure 116:
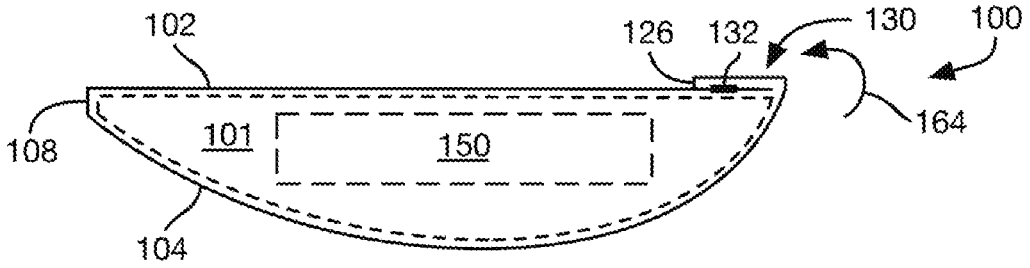
FIG. 116 is a bottom view of the reclosable bag of FIG. 115.
Figure 115:
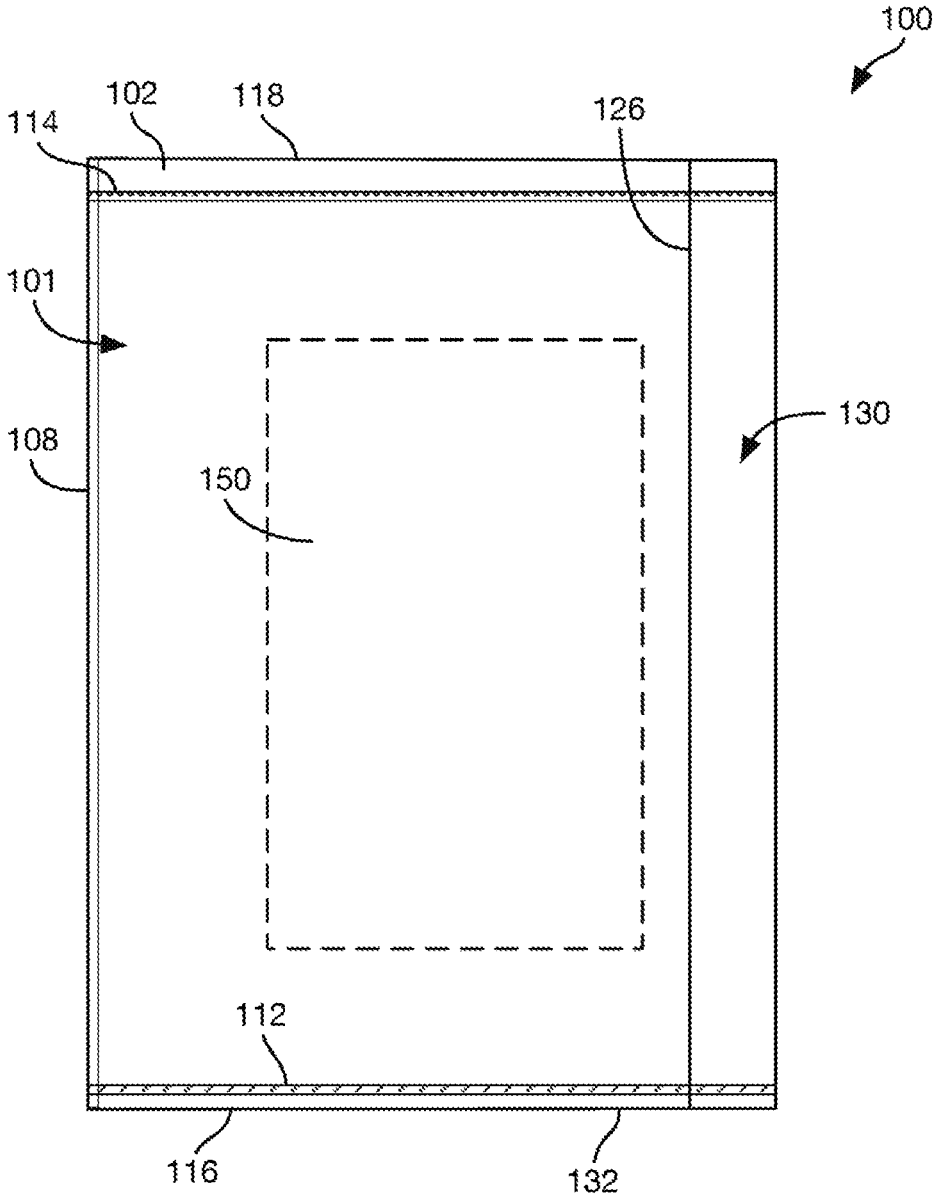
FIG. 115 is a schematic illustration of an exemplary reclosable bag showing the bag reclosed.
Figure 118:
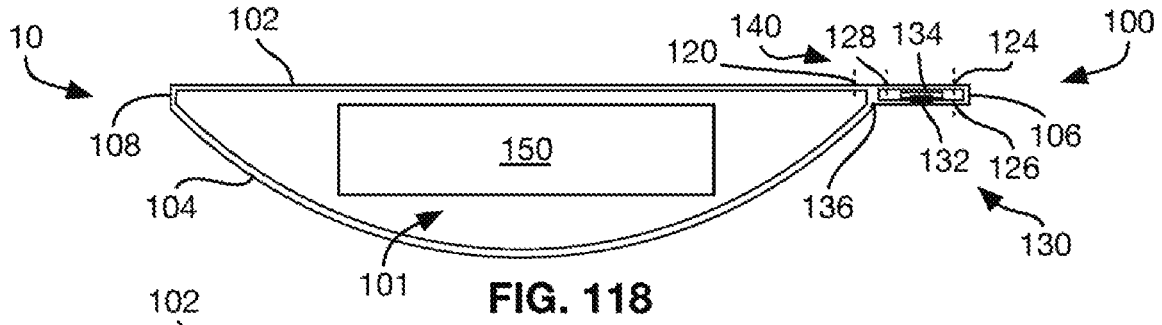
Figure 117:
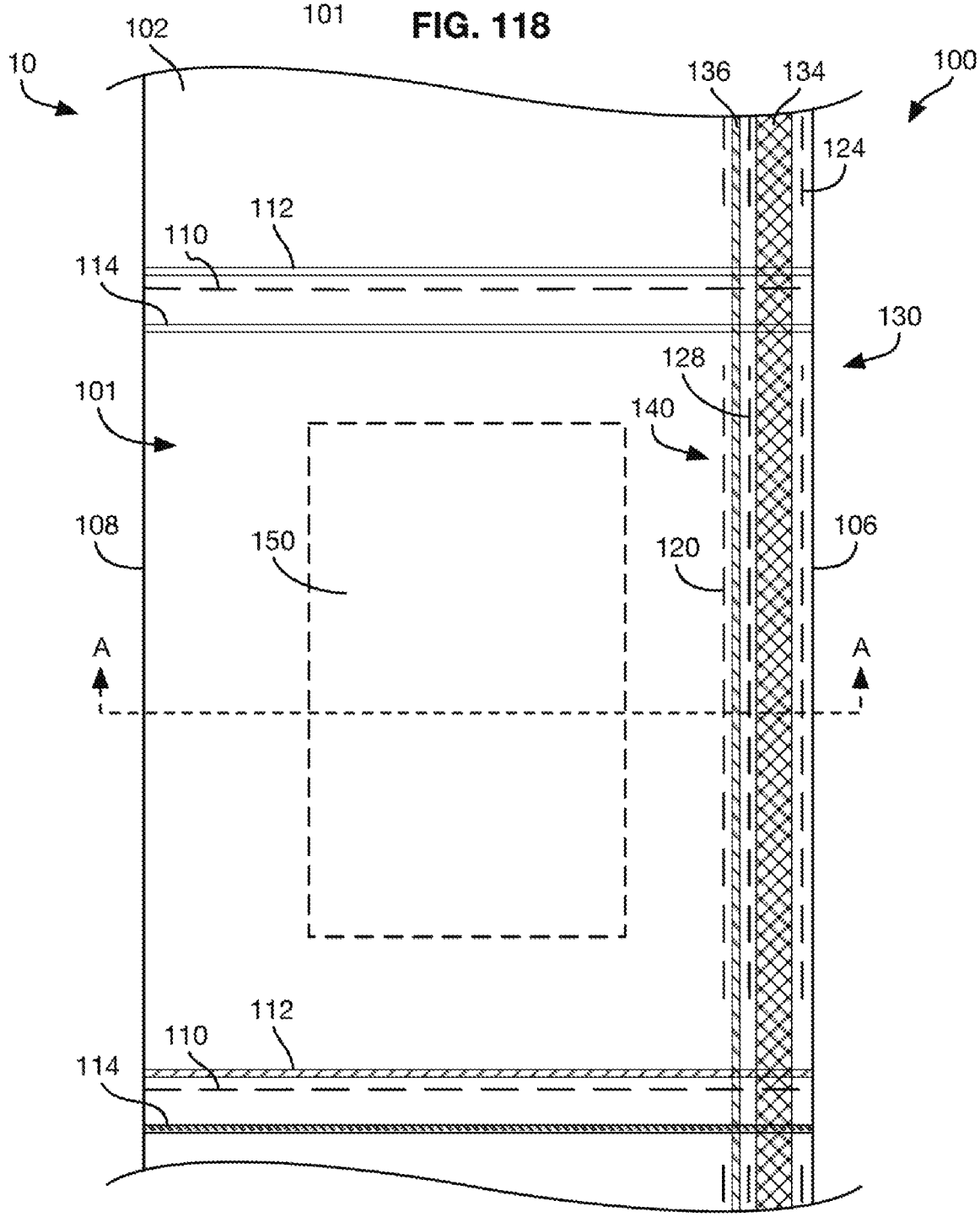
FIG. 117 is a schematic illustration of an exemplary web of reclosable bags with a product loaded in a bag.
Figure 120:
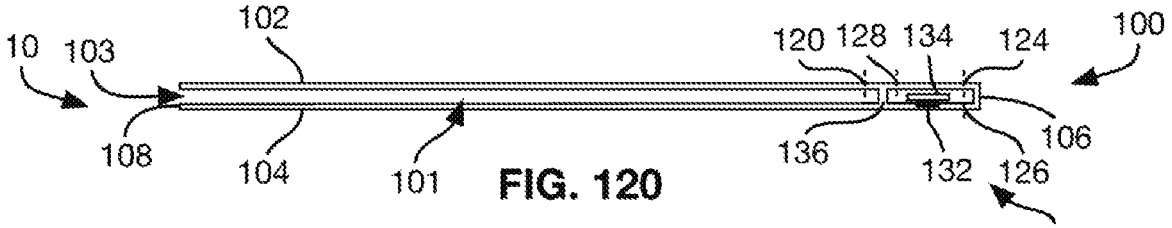
Figure 119:
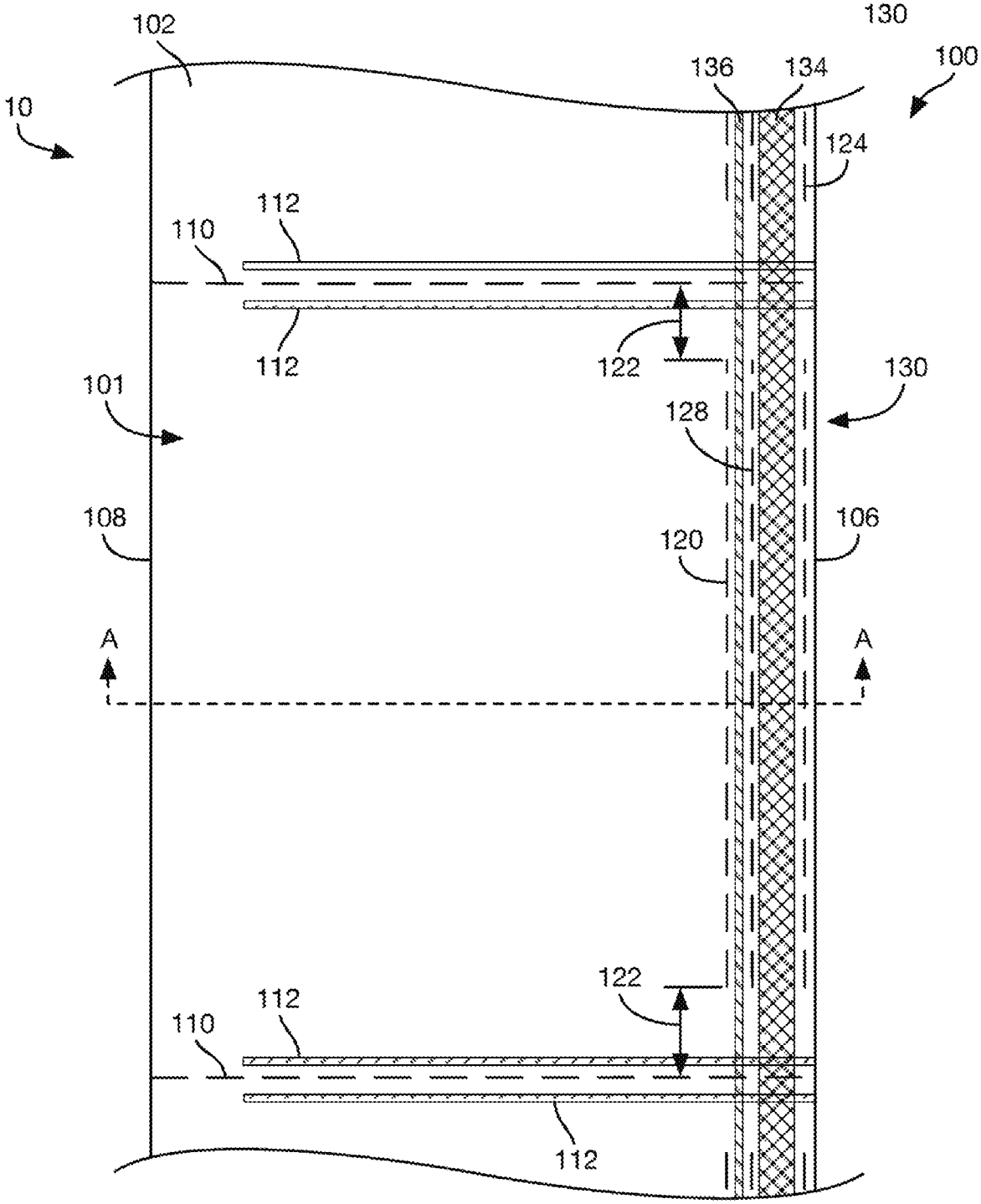
Figure 122:
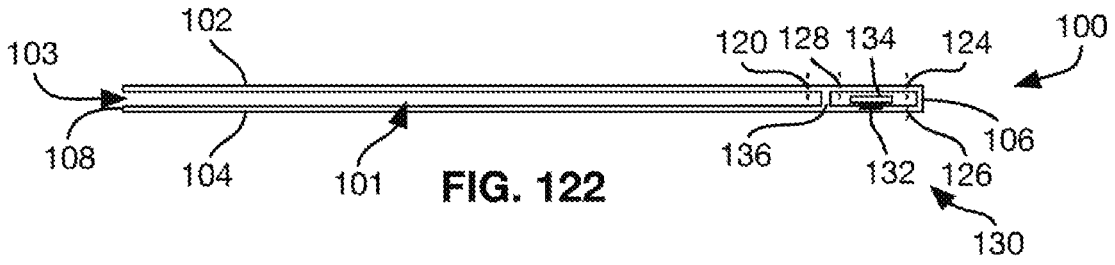
Figure 121:
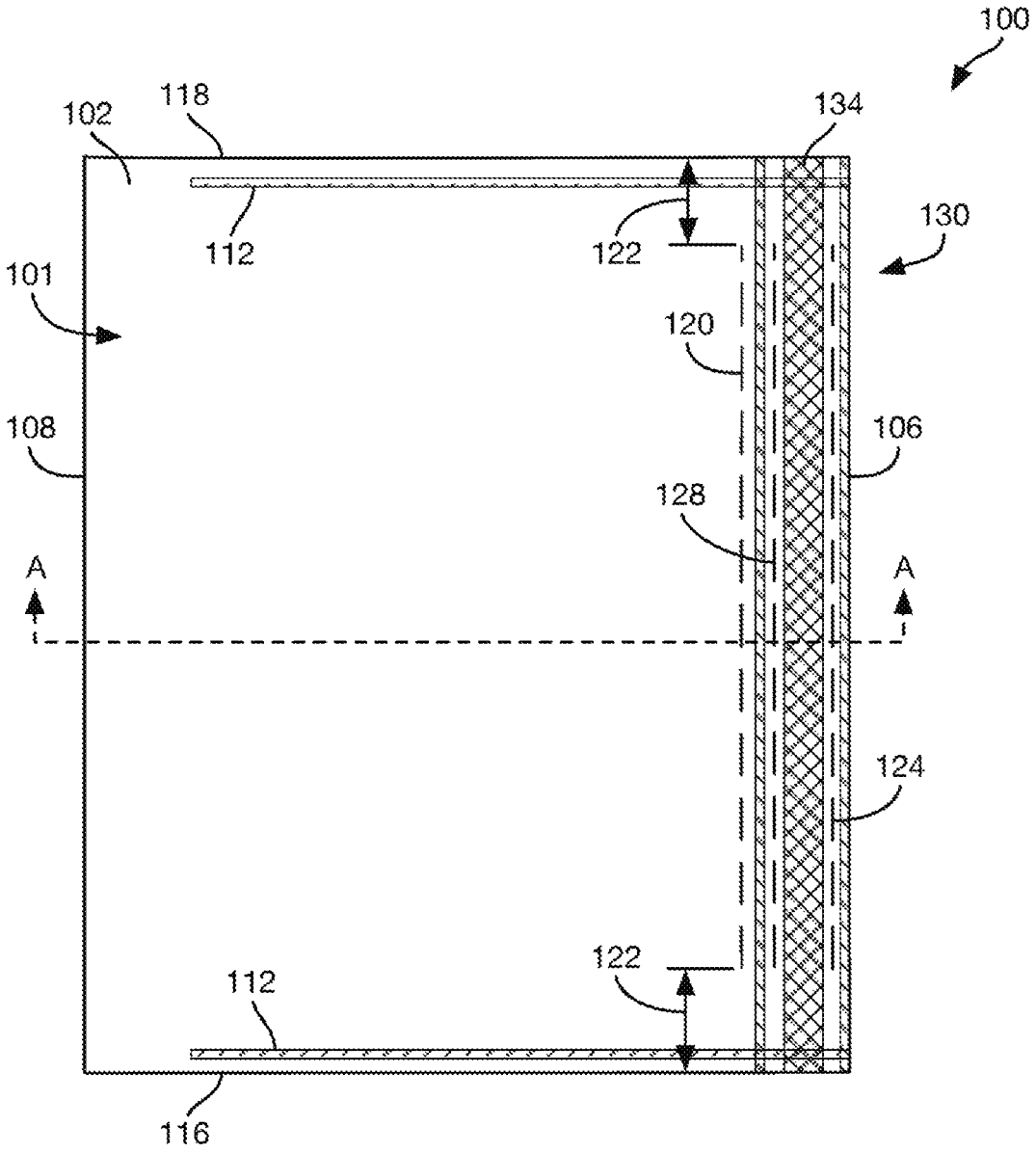
Figure 124:
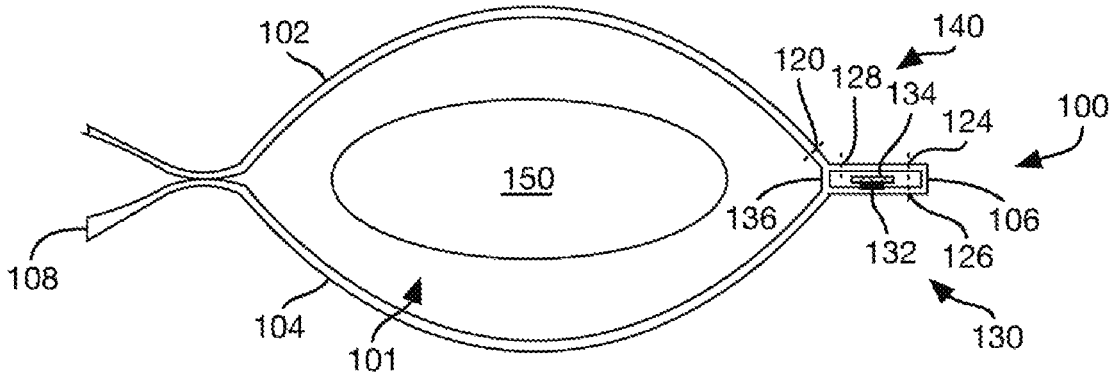
Figure 123:
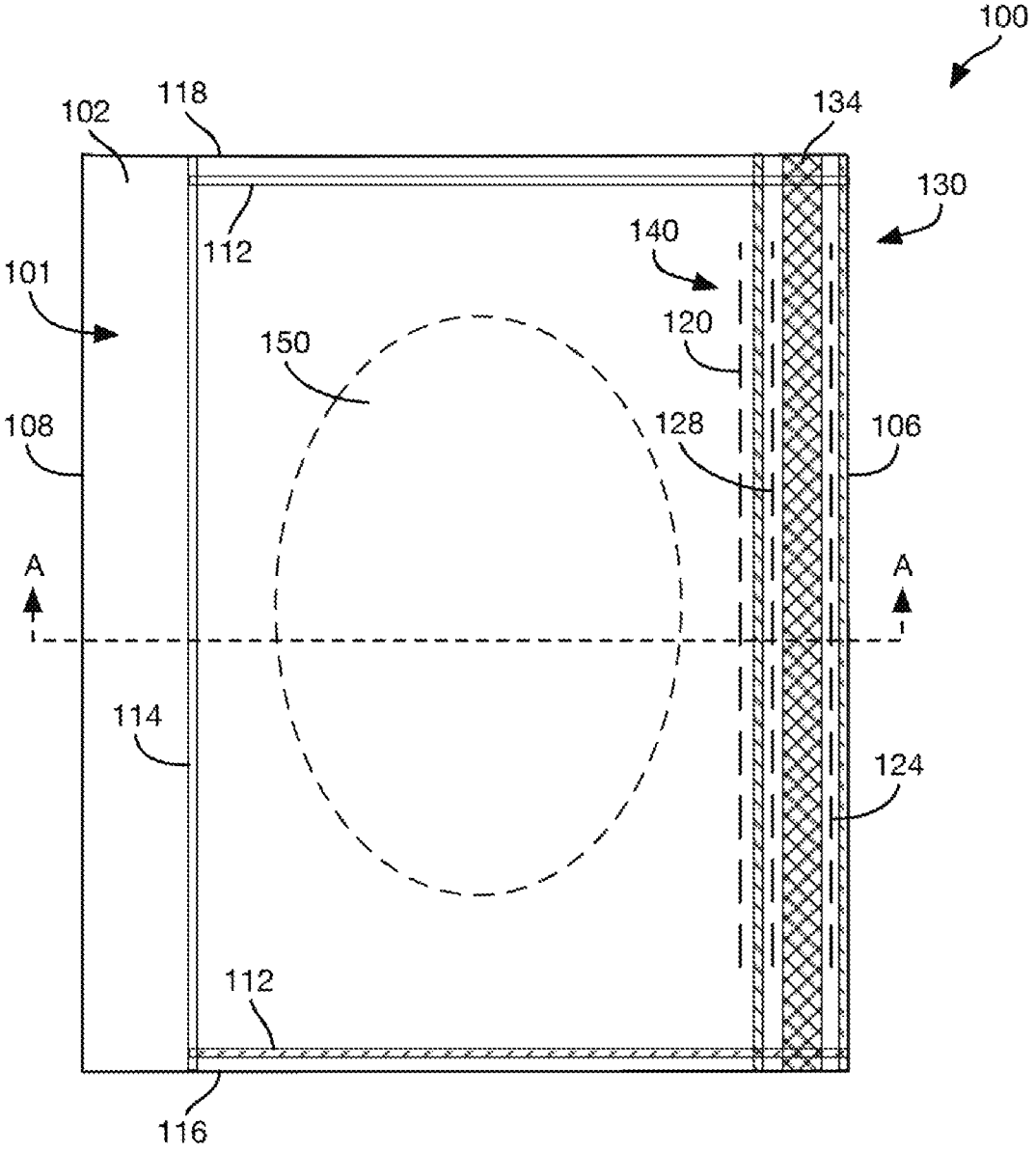
Figure 126:
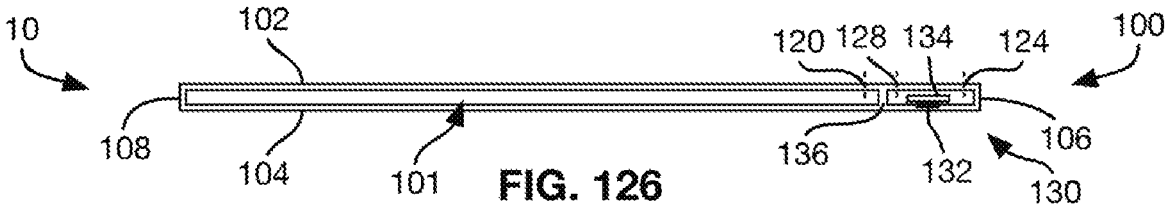
Figure 125:
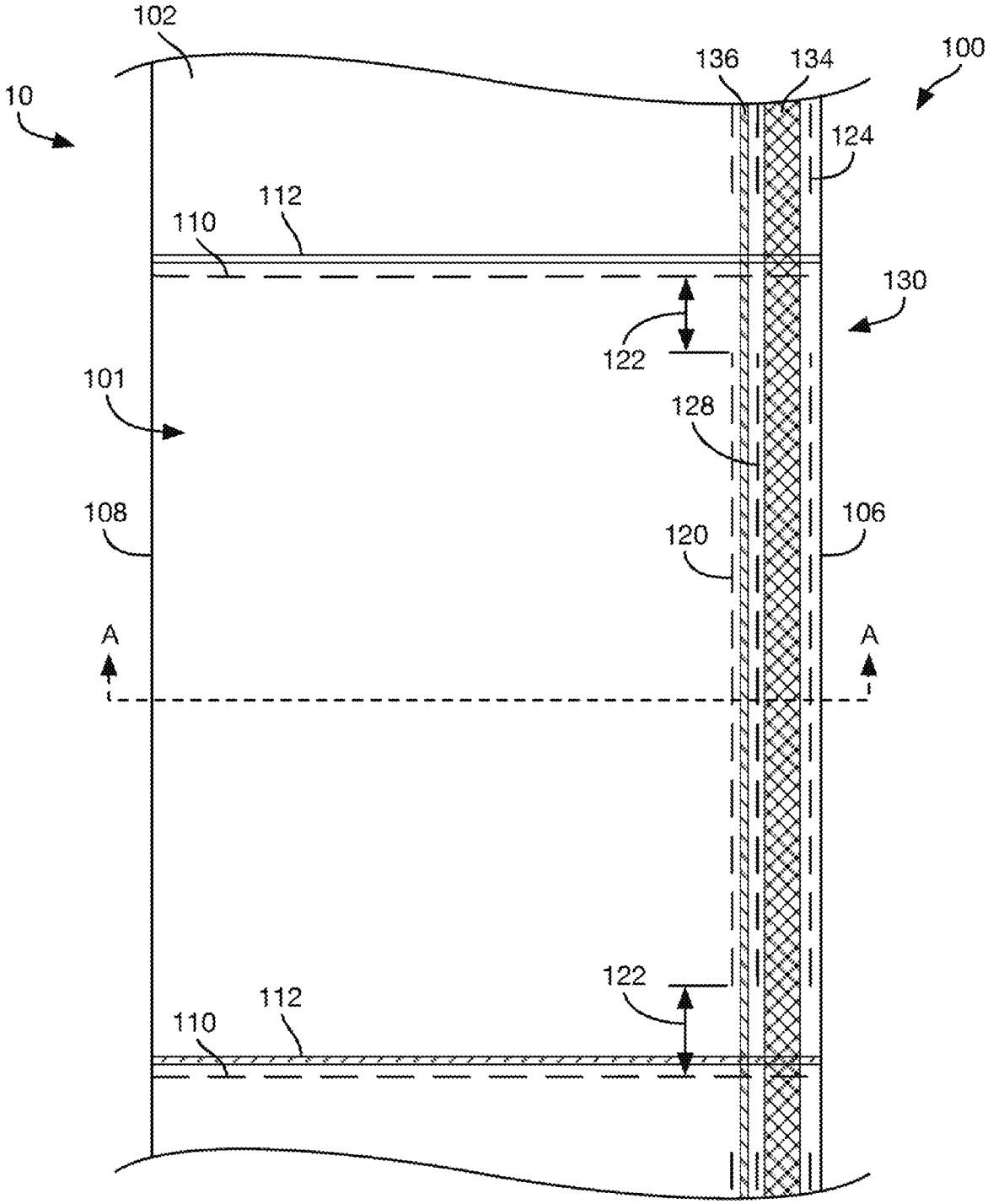
Figure 128:
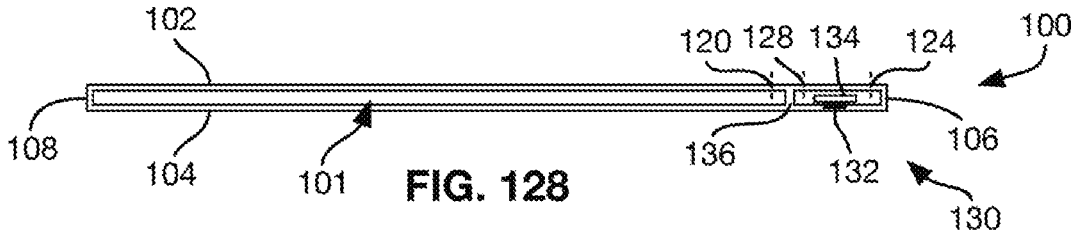
Figure 127:
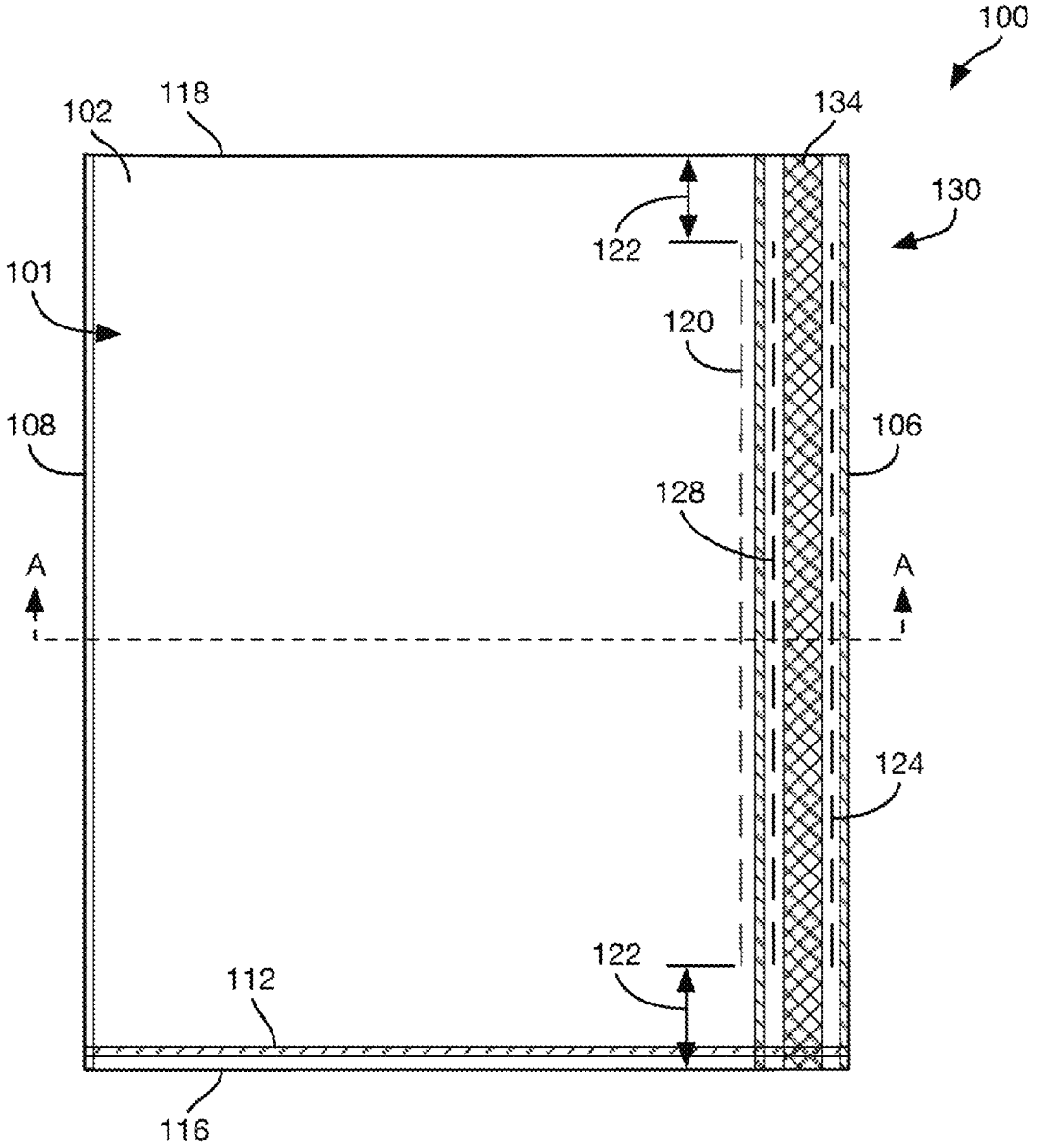

The exemplary reclosable bags 100 illustrated in FIGS. 93-124 are used and function in a manner similar to the previously described exemplary reclosable bags 100. For example, the product 150 can be loaded into the bags 100 after separation from the web 10 (FIGS. 97-102) or while part of the web 10 (FIGS. 117-118). The product 150 is removed from the bags 100 by breaking open the bag opening zone 140 formed by the first opening line of weakness 120 (FIGS. 103-104). The dividing seal 136 also serves to form the reclosing flap 130 between the dividing seal 136 and the first side 106 of the web 10. The reclosing flap compartment 105 is opened by breaking the second and third opening lines of weakness 124, 126 and removing the strip of material 141 (FIGS. 105-106). The fourth opening line of weakness 128 can then be broken to remove the strip of material 144 covering the reclosing and release material 132, 134 (FIGS. 107-108). Alternatively, the strip of material 144 can be removed without first removing the strip of material 141. The product 150 is loaded into the bag 100 through the product retrieval opening 142 (FIGS. 109-110), the release material 134 is removed to expose the reclosing material 132 (FIGS. 111-114), and the product 150 is closed within the bag 100 with the reclosing flap 130 by sealing the reclosing material 132 to the bag 100 (FIGS. 115-116). In some embodiments, the release material is provided on the strip of material 144 so that removing the strip of material 144 simultaneously removes the release material 134 to expose the reclosing material 132 and prepare the reclosing flap 130 for reclosing the bag 100. When the product 150 is within the compartment 101 and the compartment 101 has been reclosed, the consumer may return the product to the seller by mail or courier service.

An additional exemplary web 10 of reclosable bags 100 and bags 100 separated from the web 10 are shown in FIGS. 125-154 that are similar to the webs 10 and bags 100 shown in FIGS. 93-124. The web 10 and reclosable bags 100 of FIGS. 125-154, however, does not include the third opening line of weakness 126. In other words, all of the opening lines of weakness 120, 124, 128 are in the first ply 102 and the second ply 104 does not include any opening lines of weakness. Similar to the web 10 shown in FIGS. 25-26, FIGS. 147-148 show that the product 150 can be loaded into and sealed within the compartment 101 while the bags 100 remain connected in the web 10. Like the webs 10 and reclosable bags 100 described above, the web 10 and reclosable bags 100 shown in FIGS. 125-154 can be configured for loading from the side 106, as shown in FIGS. 149-154. Like the bags 100 previously discussed, the bags 100 illustrated in FIGS. 125-154 are opened in the same manner whether the product 150 is loaded from the side or top.

The exemplary reclosable bags 100 illustrated in FIGS. 125-154 are used and function in a manner similar to the previously described exemplary reclosable bags 100. For example, the product 150 can be loaded into the bags 100 after separation from the web 10 (FIGS. 129-134) or while part of the web 10 (FIGS. 147-148). The product 150 is removed from the bags 100 by breaking open the bag opening zone 140 formed by the first opening line of weakness 120 (FIGS. 135-136). The dividing seal 136 also serves to form the reclosing flap 130 between the dividing seal 136 and the first side 106 of the web 10. The reclosing flap compartment 105 is opened by breaking the second and fourth opening lines of weakness 124, 128 and removing the strip of material 144 (FIGS. 137-138). The product 150 is loaded into the bag 100 through the product retrieval opening 142 (FIGS. 139-140), the release material 134 is removed to expose the reclosing material 132 (FIGS. 141-144), and the product 150 is closed within the bag 100 with the reclosing flap 130 by sealing the reclosing material 132 to the bag 100 (FIGS. 145-146). In some embodiments, the release material is provided on the strip of material 144 so that removing the strip of material 144 simultaneously removes the release material 134 to expose the reclosing material 132 and prepare the reclosing flap 130 for reclosing the bag 100. When the product 150 is within the compartment 101 and the compartment 101 has been reclosed, the consumer may return the product to the seller by mail or courier service.

An additional exemplary web 10 of reclosable bags 100 and bags 100 separated from the web 10 are shown in FIGS. 155-164 that are similar to the webs 10 and bags 100 shown in FIGS. 125-154, except that the first, second, and fourth opening lines of weakness 120, 124, 128 extend fully between separating lines of weakness 110 of the web 10 and, therefore, from the bottom 116 to the top 118 of the bags 100. Any one or more of the lines of weakness 120, 124, 126, 128 can extend continuously or intermittently. For example, in some exemplary embodiments, especially where a dividing seal is included, the lines of weakness 120 can be intermittent and form gaps 122 at the top and/or the bottom, while one or more of the lines of weakness 124, 126, and/or 128 can be continuous. In the example illustrated by FIGS. 155-164, gaps 122 and areas of reinforcement 123 are not formed the web 10 or bags 100.

Similar to the web 10 shown in FIGS. 25-26, FIGS. 157-158 show that the product 150 can be loaded into and sealed within the compartment 101 while the bags 100 remain connected in the web 10. Like the webs 10 and reclosable bags 100 described above, the web 10 and reclosable bags 100 shown in FIGS. 155-164 can be configured for loading from the side 106, as shown in FIGS. 159-164. Like the bags 100 previously discussed, the bags 100 illustrated in FIGS. 155-164 are opened in the same manner whether the product 150 is loaded from the side or top.

The exemplary reclosable bags 100 illustrated in FIGS. 155-164 are used and function in a manner similar to the previously described exemplary reclosable bags 100. For example, the product 150 can be loaded into the bags 100 after separation from the web 10 or while part of the web 10 (FIGS. 157-158). The product 150 is removed from the bags 100 by breaking open the bag opening zone 140 formed by the first opening line of weakness 120. The dividing seal 136 also serves to form the reclosing flap 130 between the dividing seal 136 and the first side 106 of the web 10. The reclosing flap compartment 105 is opened by breaking the second and fourth opening lines of weakness 124, 128 and removing the strip of material 144. The product 150 is loaded into the bag 100 through the product retrieval opening 142, the release material 134 is removed to expose the reclosing material 132, and the product 150 is closed within the bag 100 with the reclosing flap 130 by sealing the reclosing material 132 to the bag 100. In some embodiments, the release material is provided on the strip of material 144 so that removing the strip of material 144 simultaneously removes the release material 134 to expose the reclosing material 132 and prepare the reclosing flap 130 for reclosing the bag 100. When the product 150 is within the compartment 101 and the compartment 101 has been reclosed, the consumer may return the product to the seller by mail or courier service.

In an exemplary embodiment, a method of forming a reclosable bag 100 containing a product 150 includes joining a first ply 102 to a second ply 104. In certain embodiments, the first and second plies 102, 104 may be two separate plies, or a single ply that is folded. The joined first ply 102 and second ply 104 define a bag 100 having a compartment 101 including a first side 106, a second side 108, a bottom 116 that extends between the first side 106 and the second side 108, a top 118 that extends between the first side 106 and the second side 108, and a product receiving opening 103 formed the top 116 or the second side 108. A reclosing flap 130 is connected to or formed from the bag 100. The product receiving opening 103 is arranged on a side of the bag 100 adjacent to the reclosing flap 130 (e.g., the bottom 116 or the top 118) or can be arranged on a side of the bag 100 opposite the reclosing flap 130 (i.e., the second side 108). As previously mentioned, the first ply 102 and the second ply 104 may be joined utilizing various techniques known to those of skill in the art including, but not limited to, heat sealing, ultrasonic welding, gluing with adhesives, etc. In certain embodiments, a flattened tube of material may be utilized instead of a first ply 102 and a second ply 104, wherein one of the open ends of the flattened tube may be sealed prior to loading a product 150 therein. As previously discussed, a reclosing material 132 is applied to the bag 100 and a release material 134 is applied to the bag 100. The reclosing material 132 and the release material 134 are arranged such that the reclosing material 132 releasably adheres to the release material 134. The bag also includes a bag opening zone 140 formed in or on the bag 100 proximate the reclosing flap 130.

In another step of the exemplary method, the bag opening zone 140 is formed in or on the bag 100 proximate the reclosing flap 130 or proximate to the area of the bag 100 that will be formed into the reclosing flap 130. As discussed above, the bag opening zone 140 may be defined by one or more lines or areas of weakness, an indicia that indicates where the bag 100 should be cut to open the bag 100, an adhesive, an openable connection, etc.

In yet another step of the exemplary method, a reclosing material 132 is applied to the bag 100. In certain embodiments, the reclosing material 132 may be printed directly onto a surface of the bag 100, such as a surface of the compartment 101 or a surface of the reclosing flap 130. Yet, in other embodiments, the reclosing material 132 may be configured as a double-sided adhesive that is automatically or manually pressed onto a surface of the bag 100, such as a surface of the compartment 101 or a surface of the reclosing flap 130.

In an additional step of the exemplary method, a release material 134 is applied to the bag 100 or to a removable strip of tape. In certain embodiments, the release material 134 may be printed directly onto a surface of the bag 100, such as a surface of the compartment 101 or a surface of the reclosing flap 130. After the reclosing material 132 is applied onto a surface of the bag 100 and the release material 134 is applied onto a surface of the bag 100 to cover the reclosing material. In certain embodiments where the reclosing and release materials 132, 134 are applied directly to surfaces of the bag 100, the portion of the bag 100 to which the release material 134 is applied is moved to bring the release material 134 into contact with the reclosing material 132 to releasably adhere the reclosing material 132 to the release material 134.

After the reclosable bag 100 has been formed, a product 150 is loaded into the compartment 101 through the product receiving opening 103. When the product 150 has been loaded into the compartment 101, the product receiving opening 103 is sealed to retain the product 150 therein. As previously described, the product receiving opening 103 may be sealed utilizing various techniques known to those of skill in the art including, but not limited to, heat sealing, ultrasonic welding, gluing with an adhesive, etc.

As will be appreciated, the arrangement of the reclosing material 132 and the release material 134 on the bag 100 eliminate the need for the relatively costly release strips utilized in conventional reclosable bags. Moreover, there is no waste material generated when the compartment 101 is accessed to retrieve the product 150 and very little waste material may be generated when the consumer returns the product 150 to the compartment 101 and recloses the compartment 101 to return the product 150 to the seller.

In an exemplary embodiment, a method of reclosing a product 150 in a bag includes providing a bag for reclosing a product 150 therein. In the example, the bag includes a first ply 102 joined to a second ply 104. In certain embodiments, the first and second plies 102, 104 may be two separate plies, or a single ply that is folded. The joined first ply 102 and second ply 104 define a bag 100 having a compartment 101 including a first side 106, a second side 108, a bottom 116 that extends between the first side 106 and the second side 108, a top 118 that extends between the first side 106 and the second side 108, and a product receiving opening 103 formed the top 116 or the second side 108. A reclosing flap 130 is connected to or formed from the bag 100. The product receiving opening 103 is arranged on a side of the bag 100 adjacent to the reclosing flap 130 (e.g., the bottom 116 or the top 118) or can be arranged on a side of the bag 100 opposite the reclosing flap 130 (i.e., the second side 108). As previously discussed, a reclosing material 132 is applied to the bag 100 and a release material 134 is applied to the bag 100. The reclosing material 132 and the release material 134 are arranged such that the reclosing material 132 releasably adheres to the release material 134. The bag also includes a bag opening zone 140 formed in or on the bag 100 proximate the reclosing flap 130.

A next step in the exemplary method includes loading a product 150 into the compartment 101 through the product receiving opening 103. The loading step may be performed manually or via an automated process. After the product 150 is loaded into the compartment 101, the next step in the method includes sealing the first ply 102 to the second ply 104 to close the product receiving opening 103 with a seal 114. As previously mentioned, the sealing step may be performed utilizing various techniques known to those of skill in the art including, but not limited to, heat sealing, ultrasonic welding, gluing, etc.

In a further step of the exemplary method, the bag opening zone 140 is broken or otherwise opened to create a product retrieval opening 142 to permit retrieval of the product 150 from the compartment 101. After the product 150 is removed from the compartment 101, the consumer may inspect the product 150 and may decide to return the product 150 to the seller for a variety of reasons. Thus, in a further step of the method, the product 150 is returned to the compartment 101 through the product retrieval opening 142. The reclosing flap 130 may be formed from the bag 100 before or after the product 150 is returned to the compartment. Before or after the product 150 is returned to the compartment 101 the release material 134 is separated from the reclosing material 132 to expose the reclosing material 132 to prepare the bag 100 for reclosing. Next, the reclosing flap 130 may be moved such that the reclosing material 132 adheres to a portion of the bag 100 and the product retrieval opening 142 is covered to reclose the product 150 within the compartment 101.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, alternatives as to form, fit, and function, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein.

Additionally, even though some features, concepts, or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated.

Moreover, while various aspects, features and concepts may be expressly identified herein as being inventive or forming part of a disclosure, such identification is not intended to be exclusive, but rather there may be inventive aspects, concepts, and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. A web of interconnected reclosable bags, wherein each of the reclosable bags in the web comprises:

first and second plies extending from a first side to a second side and from a bottom to a top;

a seal joining the first and second plies arranged near the bottom of the bag;

a reclosing material disposed on an interior surface of one of the first and second plies;

a release material disposed between the reclosing material and the other of the first and second plies; and a bag opening zone extending between the top and the bottom;

wherein the reclosable bags in the web are separated by lines of weakness;

wherein, in each of the reclosable bags, the bag opening zone comprises a first and second opening lines of weakness in the first ply and a third opening line of weakness in the second ply;

wherein each of the reclosable bags further comprises a fourth opening line of weakness in the first ply and arranged between the first and second lines of weakness; and wherein each of the reclosable bags further comprises a separating seal extending from the top to the bottom to form a reclosing flap between the separating seal and the first side.

2. The web of interconnected reclosable bags of claim 1, wherein, in each of the reclosable bags, the reclosing and release materials are arranged between the bag opening zone and the first side.

3. The web of interconnected reclosable bags of claim 1, wherein, in each of the reclosable bags, the bag opening zone comprises a first and second opening lines of weakness in the first ply.

4. The web of interconnected reclosable bags of claim 1, wherein, in each of the reclosable bags, the third opening line of weakness is aligned with the second opening line of weakness.

5. The web of interconnected reclosable bags of claim 1, wherein, in each of the reclosable bags, the separating seal is arranged between the first opening line of weakness and the first side.

6. The web of interconnected reclosable bags of claim 1, wherein, in each of the reclosable bags, the separating seal is arranged between the first and the fourth opening lines of weakness.

7. The web of interconnected reclosable bags of claim 1, wherein, in each of the reclosable bags, the reclosing and release materials are arranged between the first and second opening lines of weakness.

8. The web of interconnected reclosable bags of claim 1, wherein, in each of the reclosable bags, the reclosing and release materials are arranged between the fourth and second opening lines of weakness.

9. The web of interconnected reclosable bags of claim 1, wherein, in each of the reclosable bags, the reclosing material is formed in a strip extending from the top to the bottom of the bag proximate the first side.

10. The web of interconnected reclosable bags of claim 1, wherein, in each of the reclosable bags, the bag opening zone extends entirely from the top to the bottom of the bag.

* * * * *